US006351620B1

(12) United States Patent
Miyabe et al.

(10) Patent No.: US 6,351,620 B1
(45) Date of Patent: Feb. 26, 2002

(54) PROCESS CARTRIDGE HAVING GUIDE PROJECTIONS AND IMAGE FORMING APPARATUS USING SAME

(75) Inventors: Shigeo Miyabe, Numazu; Kouji Miura, Mishima; Takeshi Arimitsu, Odawara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/428,492

(22) Filed: Oct. 28, 1999

(30) Foreign Application Priority Data

Oct. 23, 1998 (JP) ..... 10-322919

(51) Int. Cl.[7] ..... G03G 21/16
(52) U.S. Cl. ..... 399/111
(58) Field of Search ..... 399/25, 111, 113, 399/114, 125

(56) References Cited

U.S. PATENT DOCUMENTS

| | | | | |
|---|---|---|---|---|
| 5,331,373 A | | 7/1994 | Nomura et al. | |
| 5,452,056 A | | 9/1995 | Nomura et al. | |
| 5,463,446 A | | 10/1995 | Watanabe et al. | |
| 5,500,714 A | | 3/1996 | Yashiro et al. | |
| 5,585,889 A | | 12/1996 | Shishido et al. | |
| 5,617,579 A | | 4/1997 | Yashiro et al. | 399/114 |
| 5,640,650 A | | 6/1997 | Watanabe et al. | 399/117 |
| 5,708,922 A | * | 1/1998 | Azuma et al. | 399/111 |
| 5,729,796 A | | 3/1998 | Miura et al. | 399/114 |
| 5,768,658 A | | 6/1998 | Watanabe et al. | 399/111 |
| 5,825,472 A | | 10/1998 | Araki et al. | |
| 5,839,028 A | | 11/1998 | Nomura et al. | 399/109 |
| 5,870,655 A | | 2/1999 | Nishiuwatoko | 399/111 |
| 5,873,012 A | | 2/1999 | Miyabe et al. | 399/90 |
| 5,878,309 A | | 3/1999 | Nomura et al. | 399/111 |
| 5,878,310 A | | 3/1999 | Noda et al. | 399/117 |
| 5,893,006 A | | 4/1999 | Kanno et al. | 399/13 |
| 5,926,666 A | * | 7/1999 | Miura et al. | 399/25 |
| 5,937,240 A | | 8/1999 | Kanno et al. | 399/111 |
| 5,943,529 A | * | 8/1999 | Miyage et al. | 399/111 |
| 5,946,531 A | | 8/1999 | Miura et al. | 399/111 |
| 5,950,047 A | | 9/1999 | Miyabe et al. | 399/111 |
| 5,966,567 A | | 10/1999 | Matsuzaki et al. | 399/111 |
| 6,002,896 A | | 12/1999 | Miyamoto et al. | 399/114 |

FOREIGN PATENT DOCUMENTS

| | | |
|---|---|---|
| EP | 827 047 | 3/1998 |
| JP | 60-149669 | 8/1975 |
| JP | 10-69199 | 3/1998 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

A process cartridge is mounted to or demounted from a movable member which is retractable in a horizontal direction to mount the process cartridge to the main assembly or to demount the process cartridge from the main assembly, and includes: an electrophotographic photosensitive member; a cleaning member for removing toner from the electrophotographic photosensitive member; a toner feeding portion for feeding by a toner feeding member toner removed from the electrophotographic photosensitive member by the cleaning member; a cartridge frame supporting at least the electrophotographic photosensitive member; a first projection projecting outwardly substantially coaxially with the electrophotographic photosensitive member, provided on one end surface of the cartridge frame; a third projection projecting outwardly at a position upstream of the first projection; a second projection projected outwardly substantially coaxially with the first projection, provided on the other end surface; and a fourth projection projected outwardly substantially coaxially with the third projection.

19 Claims, 56 Drawing Sheets

(a)

(b)

(a)

(b)

PROCESS CARTRIDGE HAVING GUIDE PROJECTIONS AND IMAGE FORMING APPARATUS USING SAME

FIELD OF THE INVENTION AND RELATED ART

The present invention relates to a process cartridge and an electrophotographic image forming apparatus to which the process cartridge is detachably mountable.

Here, the term "electrophotographic image forming apparatus" refers to the an apparatus that forms images on recording materials using an electrophotographic-image-formation-type process.

Examples of the electrophotographic image forming apparatus include an electrophotographic copying machine, an electrophotographic printer (a laser beam printer, an LED printer or the like), a facsimile device and a word processor.

The process cartridge is a unit containing charging means, cleaning means and an electrophotographic photosensitive member as a unit, wherein the cartridge is detachably mountable to the main assembly of the image forming apparatus.

It may contain the cleaning means and electrophotographic photosensitive member as a unit.

Such a process cartridge is advantageous in that maintenance of the apparatus is easy since the exchange of the process cartridge is, in effect, the maintenance.

An image forming apparatus using the electrophotographic image forming process employs such a process cartridge.

The process cartridge type is advantageous in that maintenance of the apparatus can be in effect carried out by the users, and therefore, the operativity is remarkably improved.

For this reason, the process cartridge type is widely used in the field of the image forming apparatus.

With the extension of the lifetime of the electrophotographic photosensitive member (increase of printable number of sheets), it is desired that developing means, which must be supplied with power, is made independent from the other parts including the electrophotographic photosensitive member, the charging means and the cleaning means to permit longer use without losing the easy mounting-and-demounting of the unit to the main assembly of the apparatus.

The residual developer (toner) resulting from the cleaning operation in the process cartridge is stored in the cleaner container having a volume sufficient to accommodate all the residual toner generated during the lifetime of the electrophotographic photosensitive member, and is removed by exchange of the process cartridge.

In the cleaning container, there are provided partition walls for dividing the cleaning container into the electrophotographic photosensitive member side and the rear side of the container, an opening provided in the partition wall, and developer feeding means including rotatable blades for feeding the developer in such a part of the cleaning container closer to the electrophotographic photosensitive member.

With the extension of the service life of the electrophotographic photosensitive member, the residual toner accommodating portion of the process cartridge has to accommodate the residual toner after the development and transfer operation of the plurality of the developing devices, and therefore, the capacity thereof has to be relatively larger.

In view of this, the following two alternatives are considered for the mounting and demounting of the process cartridge in terms of the positional relation relative to the other units.

(1) A hole portion is formed in a side plate portion of the main assembly of the image forming apparatus, and the process cartridge is mounted and demounted in a horizontal direction which is substantially parallel with a direction of the generating line of the electrophotographic photosensitive member.

(2) A movable member, which is drawable or retractable in the horizontal direction and in the perpendicular direction relative to the direction of the generating line of the electrophotographic photosensitive member, is provided, and the process cartridge is mounted to or demounted from the movable member, and the movable member is mounted to or demounted from the main assembly of the image forming apparatus.

By doing so, the process cartridge can be smoothly mounted to or demounted from the main assembly of the apparatus.

SUMMARY OF THE INVENTION

Accordingly, it is a principal object of the present invention to provide a process cartridge and an image forming apparatus having a movable member in which the process cartridge can be smoothly mounted to or demounted from the movable member with a simple structure.

It is another object of the present invention to provide a process cartridge and an electrophotographic image forming apparatus wherein the process cartridge can be assuredly positioned relative to the movable member and the image forming apparatus with a simple structure.

It is a further object of the present invention to provide a process cartridge and an electrophotographic image forming apparatus, wherein the process cartridge can be smoothly mounted to and demounted from the movable member, and can be smoothly and assuredly mounted to and demounted from the main assembly of the image forming apparatus.

According to an aspect of the present invention, there is provided a process cartridge detachably mountable to a main assembly of an image forming apparatus, wherein the process cartridge is mounted to or demounted from a movable member, which is retractable in a horizontal direction, to mount the process cartridge to the main assembly or to demount the process cartridge from the main assembly, comprising: an electrophotographic photosensitive member; a cleaning member for removing toner from the electrophotographic photosensitive member; a toner feeding portion for feeding by a toner feeding member toner removed from the electrophotographic photosensitive member by the cleaning member; a cartridge frame supporting at least the electrophotographic photosensitive member; a first projection projecting outwardly substantially coaxially with the electrophotographic photosensitive member, provided on one end surface of the cartridge frame, as seen in a mounting direction when the process cartridge is mounted to the main assembly of the image forming apparatus; a third projection projecting outwardly at a position upstream of the first projection with respect to the mounting direction; a second projection projected outwardly substantially coaxially with the first projection, provided on the other end surface; a fourth projection projected outwardly substantially coaxially with the third projection; wherein centers of the first and second projections are placed at predetermined positions in the main assembly of the image forming apparatus; wherein the third and fourth projections are placed at predetermined circumferential positions about the center; wherein the first, second, third and fourth projections function as guiding members when the process cartridge is mounted to or demounted from the movable member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, embodiments of the present invention will be described in detail with reference to the appended drawings.

In the following description of the embodiments of the present invention, the direction parallel to the shorter edges of a process cartridge B coincides with the direction in which the process cartridge B is installed into, or removed from, an image forming apparatus A, as well as the direction in which a recording medium S is conveyed. The longitudinal direction of the process cartridge B means the direction perpendicular (substantially perpendicular) to the direction in which the process cartridge B is installed into, or removed from, the image forming apparatus A. The left or right side of the process cartridge B means the left or right side of the recording medium S as seen from above, and upstream in terms of the conveyance direction of the recording medium S. As for the front or rear of the process cartridge B, the downstream side of the process cartridge B in terms of the direction in which the process cartridge B is inserted is the front side, and the upstream side is the rear side. The apparatus main assembly means the main assembly of the image forming apparatus.

Embodiment 1

Next, this embodiment will be described with reference to the drawings.

(General Structure of Electrophotographic Image Forming Apparatus)

Figure 1:
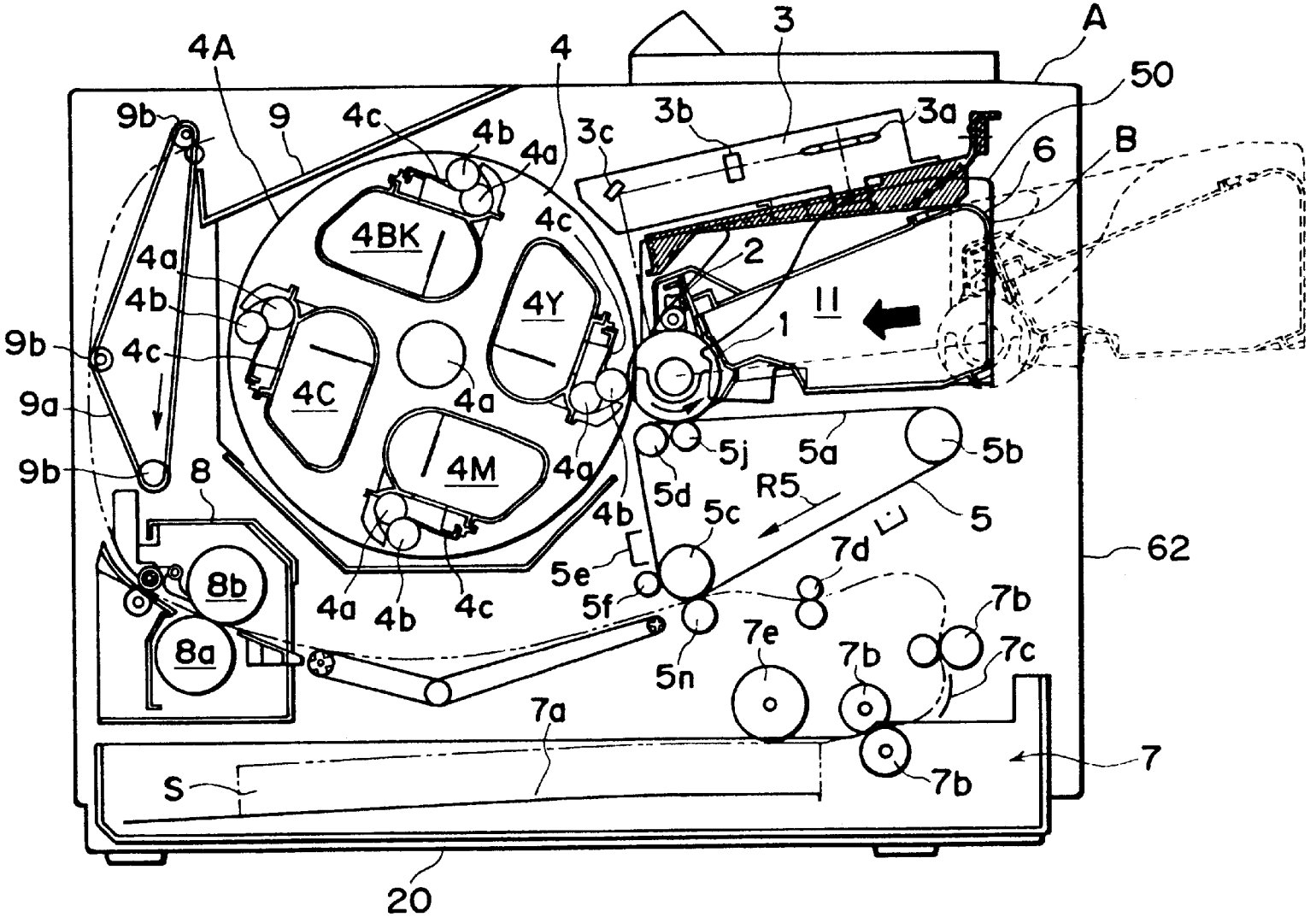
FIG. 1 is a longitudinal sectional view of an electrophotographic image forming apparatus.

FIG. 1 is a vertical sectional view of an electrophotographic image forming apparatus (hereinafter, "image forming apparatus") in accordance with the present invention, and depicts the general structure of the entire apparatus.

First, referring to FIG. 1, the general structure of the entirety of the image forming apparatus A will be described. The image forming apparatus A illustrated in the drawing is a full-color laser beam printer based on four primary colors.

The image forming apparatus A in the drawing is provided with an electrophotographic photosensitive member 1 (hereinafter, "photosensitive drum") in the form of a drum, as a first image bearing member. The photosensitive drum 1 is rotationally driven in the counterclockwise direction in the drawing by a driving means (unillustrated, and, which will be described later). Along the peripheral surface of the photosensitive drum 1, a charging apparatus 2, an exposing means 3, a developing apparatus 4, a transferring unit 5, a cleaning apparatus 6, and the like, are disposed in the listed order in terms of the rotational direction of the photosensitive drum 1. The charging apparatus 2 is an apparatus for uniformly charging the peripheral surface of the photosensitive drum 1. The exposing means 3 is a means for forming an electrostatic latent image on the photosensitive drum 1 by projecting a laser beam modulated with image formation data. The developing apparatus 4 is an apparatus for developing the latent image formed on the photosensitive drum 1 into a toner image by adhering toner to the electrostatic latent image formed on the photosensitive drum 1. The transferring unit 5 is a unit for transferring (primary transfer) the toner image formed on the photosensitive drum 1. The cleaning apparatus 6 is an apparatus for removing the transfer residual toner, i.e., the toner that remains on the peripheral surface of the photosensitive drum 1 after the primary transfer.

The photosensitive drum 1, charging apparatus, and cleaning apparatus 6 for removing the residual toner, are integrated in the form of a process cartridge B, which is removably installable in the main assembly 20 of the image forming apparatus A.

In addition to the above described apparatuses, the electrophotographic image forming apparatus A comprises a conveying means 7 for conveying recording medium S (third image bearing member) to the transferring unit 5. The electrophotographic image forming apparatus A also comprises a fixing apparatus 8 for fixing the toner image to the recording medium S after the secondary transfer.

Next, the structure of each of the above described portions of the laser beam printer will be described starting from the photosensitive drum.

The photosensitive drum 1 comprises an aluminum cylinder 1*c* with a diameter of 47 mm (FIG. 16), and an organic photoconductive layer (OPC) coated on the peripheral surface of the aluminum cylinder 1*c*. The photosensitive drum 1 is rotationally supported at both longitudinal ends by the supporting members. The photosensitive drum 1 is rotationally driven in the direction indicated by an arrow mark as a driving force is transmitted from a driving motor (unillustrated) to one of the longitudinal ends of the photosensitive drum 1.

As for the charging apparatus 2, a so-called contact type charging apparatus such as the one disclosed in Japanese Laid-Open Patent Application No. 149669/1985 can be employed. A charging member is an electrically conductive roller. The peripheral surface of the photosensitive drum 1 is uniformly charged by placing the charge roller in contact with the peripheral surface of the photosensitive drum 1 and applying charge bias voltage to the charging roller from a power source (unillustrated).

The exposing apparatus 3 comprises a polygonal mirror 3*a*, onto which image formation light modulated with image formation signals is projected from a laser diode (unillustrated). The polygonal mirror 3*a* is rotated at a high velocity by a scanner motor (unillustrated), and the light reflected by the polygonal mirror 3*a* is projected onto the charged peripheral surface of the photosensitive drum 1, by way of a focusing lens 3*b*, a deflection mirror 3*c*, and the like, to selectively expose the peripheral surface of photosensitive drum 1, so that an electrostatic latent image is formed on the peripheral surface of the photosensitive drum 1.

The developing apparatus 4 comprises a rotary unit 4A, which is indexically rotatable about the shaft 4*d* with which the apparatus main assembly A1 is provided. It also comprises four developing devices 4Y, 4M, 4C and 4Bk, which are mounted in the rotary unit 4A, and contain yellow, magenta, cyan and black toners, correspondingly. When developing an electrostatic latent image on the photosensitive drum 1, a specific developing device (which) that contains the toner to be adhered to the electrostatic latent image on the photosensitive drum 1 is positioned at the development position. In other words, the rotary unit 4A is indexically rotated so that the specific developing device stops at the development position at which the specific developing device opposes the photosensitive drum 1, with the presence of a microscopic gap (approximately 300 $\mu$m) between the development sleeve 4*b* of the developing device and the photosensitive drum 1. After the positioning of the development sleeve 4*b* relative to the photosensitive drum 1, the electrostatic latent image on the photosensitive drum 1 is developed. This development process is carried out in the following manner. That is, the toner in the toner container of the developing device corresponding to the color into which the latent image is to be developed is sent to a coating roller 4*a* by a toner sending mechanism (unillustrated). The toner sent to the coating roller 4*a* is coated in a thin layer, while being triboelectrically charged, on the peripheral surface of the development sleeve 4*b* by the rotating coating roller 4*a* and a toner regulating blade 4*c*. Then, the development bias is applied between the development sleeve 4*b*, and the photosensitive drum 1 on which an electrostatic latent image has been formed. As a result, the toner on the development sleeve 4*b* is adhered to the electrostatic latent image on the photosensitive drum 1 to develop the latent image into a toner image. The developing apparatus is configured so that as any of the developing devices 4Y, 4M 4C and 4Bk is positioned at the development position, an electrical connection is established between the development sleeve 4*b* of the development device at the development position, and the corresponding color development high voltage power source with which the apparatus main assembly A1 is provided, so that voltage is selectively applied for each of the different color development processes. The developing devices 4Y, 4M, 4C and 4Bk are structured so that they can be individually mounted in the rotary unit 4A, and the rotary unit 4A is structured so that it can be removably installed in the apparatus main assembly A1.

The transferring unit 5 as the second image bearing member is a unit for transferring (secondary transfer) all at once a plurality of toner images which have been sequentially transferred (primary transfer) from the photosensitive drum 1 and placed in layers onto a recording medium S. More specifically, the transferring unit 5 comprises an intermediary transfer belt 5*a*, which runs in the direction indicated by an arrow mark R5. In this embodiment, the intermediary transfer belt 5*a* is an approximately 440 mm long endless belt, and is supported by being stretched around three rollers: a driving roller 5*b*, a secondary transfer counter roller 5*c*, and a follower roller 5*d*. It also comprises a pressing roller 5*j*, which is disposed adjacent to the follower roller 5*d*. The transferring apparatus 5 is configured so that the pressing roller 5*j* is allowed to take two positions: a position at which the pressing roller 5*j* presses the intermediary transfer belt 5*a* against the photosensitive drum 1, and a position to which the pressing roller 5*j* retreats to allow the intermediary transfer belt 5*a* to be held away from the photosensitive drum 1. The intermediary transfer belt 5*a* is caused to run in the direction of the arrow mark R5 by the rotation of the driving roller 5*b*. The transferring apparatus is also provided with a cleaning unit 5*e*, which is disposed outside the loop of the intermediary transfer belt 5*a*, and can be placed in contact with, or moved away from, the surface of the intermediary transfer belt 5*a*. This cleaning unit 5*e* is a unit for removing the transfer residual toner, i.e., the toner which remains on the intermediary transfer belt 5*a* after the plurality of the toner images on the intermediary transfer belt 5*a* are transferred (secondary transfer) all at once onto the recording medium S which will be described later. More specifically, the cleaning unit 5*e* comprises a charge roller 5*f*, which is placed in contact with the intermediary transfer belt 5*a* to give the toner an electrical charge opposite in polarity to the electrical charge given when transferring the toner images. Then, the toner given the opposite electric charge is electrostatically adhered to the photosensitive drum 1, and is recovered by the cleaning apparatus 6 for the photosensitive drum 1, which will be described later. The method for cleaning the intermediary transfer belt 5*a* does not need to be limited to the above described electrostatic cleaning method. For example, mechanical methods which employ a blade, a fur brush, or the like, or a combination of the electrostatic and mechanical methods, may be employed.

The cleaning apparatus 6 is an apparatus that removes, the so-called transfer residual toner, i.e., the toner which fails to be transferred (primary transfer) and remains on the peripheral surface of the photosensitive drum 1 after the primary transfer process in which the toner image developed on the photosensitive drum 1 by the developing apparatus 4 is transferred (primary transfer) onto the intermediary transfer belt 5*a*. The toner removed from the peripheral surface of the photosensitive drum 1 by the cleaning apparatus 6 is stored in the cleaning means housing portion 11 of the process cartridge B. In FIG. 1, the cleaning means housing portion 11 is not illustrated, and will be described later.

The feeding-conveying means 7 is an apparatus that feeds the recording medium S into the apparatus main assembly A1 and conveys it to the image forming portion of the apparatus main assembly A1. It comprises a sheet feeder cassette 7*a* which holds a plurality of recording medium S sheets, and is installed into the bottom portion of the apparatus main assembly A1. During an image forming operation, a pickup member 7*e* and a conveying roller 7*b* are rotationally driven in synchronism with the image forming operation, to feed one by one the sheets of recording medium S in the sheet feeder cassette 7*a*, out of the cassette 7*a*, and sequentially convey them to the intermediary transfer belt 5*a*. During the conveyance of the recording medium S to the intermediary transfer belt 5*a*, the recording medium S is guided by a guide plate 7*c*, and passes by a registration roller 7*d*.

The fixing apparatus 8 is an apparatus that fixes the plurality of the toner images, which have been transferred (secondary transfer) onto the recording medium S, to the recording medium S. Referring to FIG. 1, the fixing apparatus 8 comprises a driving roller 8*a* which rotates to drive the recording medium S, and a fixing roller 8*b*, which is pressed upon the driving roller 8*a* to apply heat and pressure to the recording medium S. In operation, after passing by the transfer roller 5*n* for the secondary transfer for transferring all at once the plurality of the toner images on the intermediary transfer belt 5*a* onto the recording medium S, the recording medium S is conveyed to the fixing apparatus 8, and is conveyed through the fixing apparatus 8 by the driving roller 8*a*. As the recording medium S is conveyed through the fixing apparatus 8, heat and pressure is applied to the recording medium S by the fixing roller 8*b*. As a result, the plurality of the toner images of different color are fixed to the surface of the recording medium S.

Figure 2:
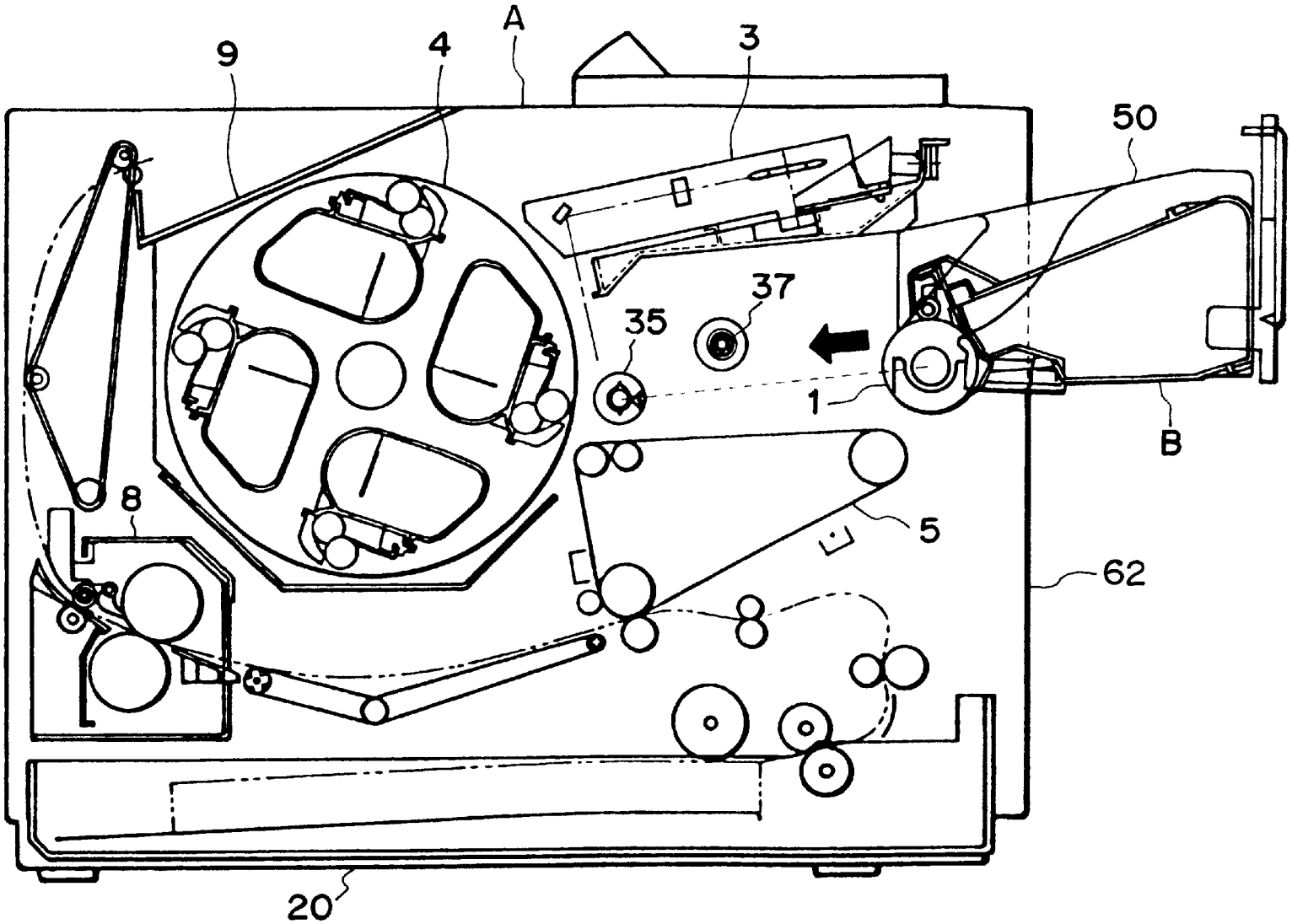
FIG. 2 is a longitudinal sectional view illustrating mounting-and-demounting of the process cartridge in the apparatus shown in FIG. 1.
Figure 14:
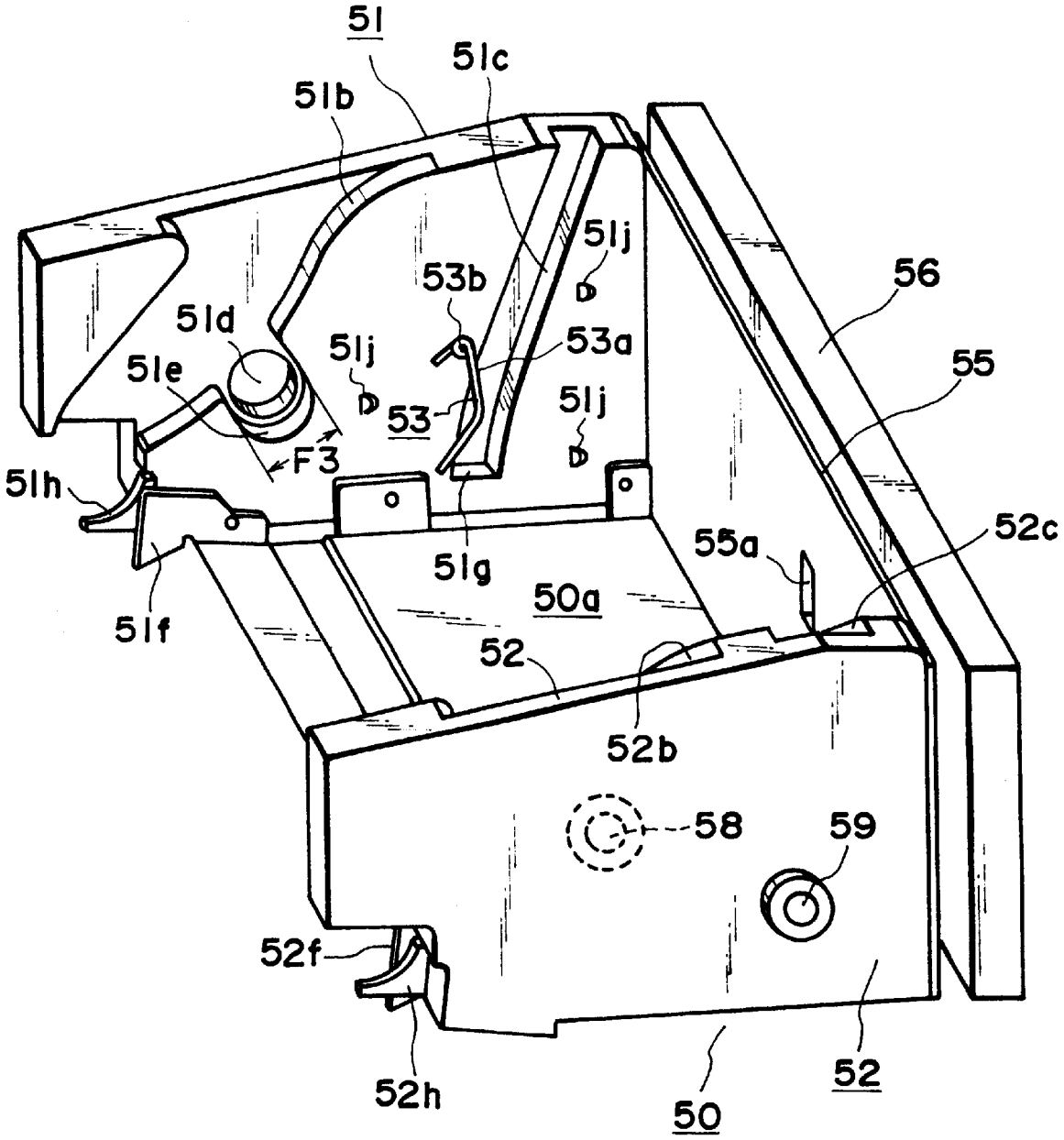
FIG. 14 is a perspective view of a movable member.
Figure 15:
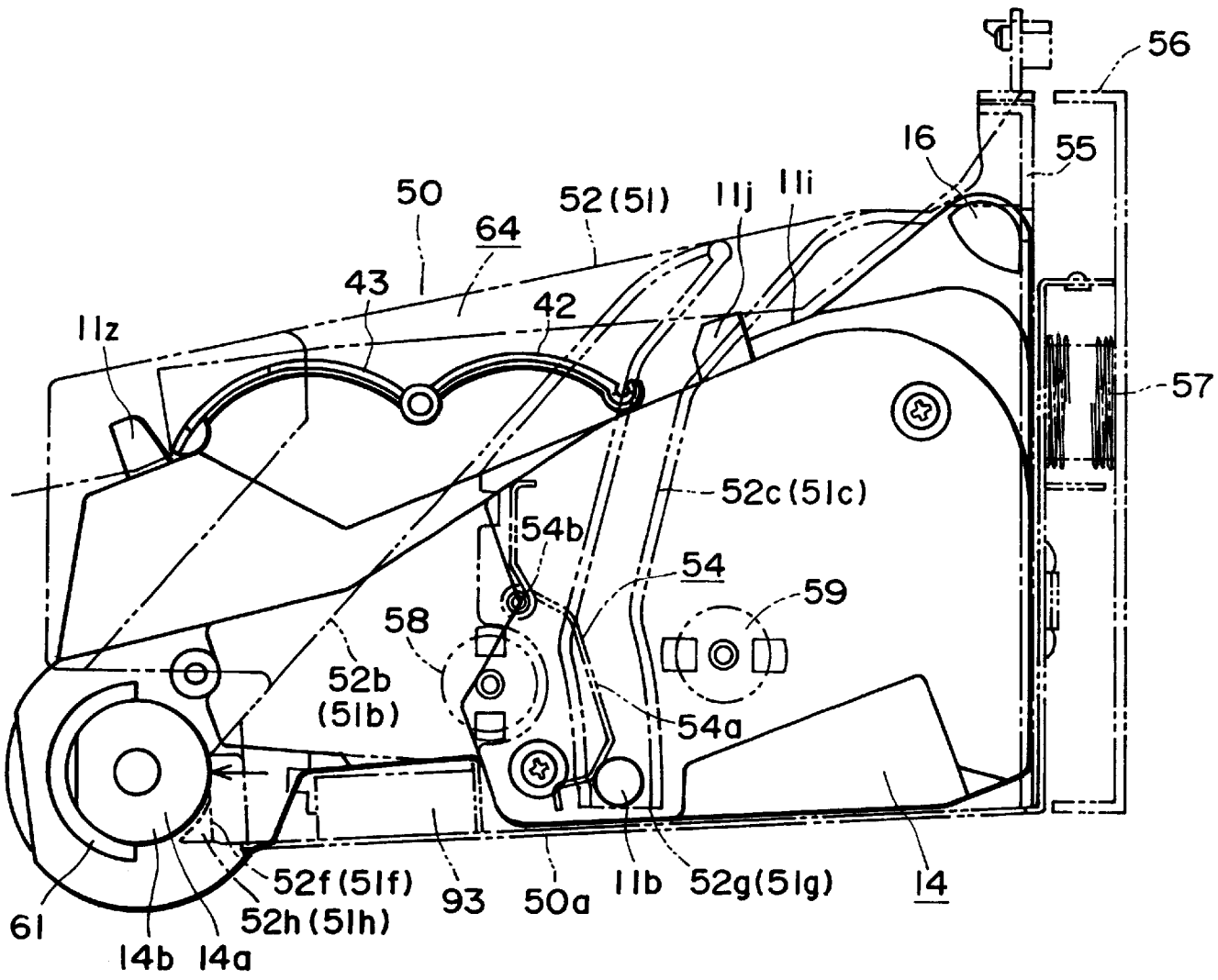
FIG. 15 is a side view illustrating mounting of the process cartridge to a movable member.

Referring to FIG. 2, the image forming apparatus main assembly 20 is provided with a movable member 50, which is structured so that it can be horizontally pulled out or pushed into the image forming apparatus A to guide the process cartridge B into the image forming apparatus A. Referring to FIGS. 14 and 15, the movable member 50 is provided with guiding members 51 and 52. When installing the process cartridge B into the image forming apparatus A, the shaft coupling member 28 and cylindrical guiding portion 14*b* (FIG. 6) of the process cartridge B are guided along the guiding surfaces 51*b* and 52*b* of the guiding members 51 and 52, respectively, so that cylindrical positioning bosses 13*a* and 14*a*, which are disposed immediately next to, and coaxially with, the shaft coupling member 23 (which corresponds with the cylindrical guide 14*b* on the opposite side), enter the catching portions 51*h* and 52*h* located at the deepest ends of the guiding surfaces 51*b* and 52*b*, respectively. As the shaft coupling member 23 and guiding portion 14*b* are inserted into the movable member 50 along the guiding surfaces 51*b* and 52*b* of the guiding members 51 and 52, respectively, rotation control projections 11*a* and 11*b*, which are on the rear end portion of the process cartridge B in terms of the direction in which the process cartridge B is installed into the movable member 50, come into contact with the guiding surfaces 51*c* and 52*c*, respectively, of the movable member 50. Then, the rotation control projections 11*a* and 11*b* move downward, pushing away the CRG pressing spring 53 and 54, along the guiding surfaces 51*c* and 52*c* until they come into contact with the rotation control surfaces 51*g* and 52*g* located at the deepest ends of the guiding surfaces 51*c* and 52*c*, respectively. During the above described installation process, when the rotation control projections 11*a* and 11*b* push their way against the CRG pressing spring 53 and 54, respectively, the process cartridge B pivots clockwise about the cylindrical positioning bosses 13*a* and 14*a*, which already have been caught by the catching portions 51*h* and 52*h*, respectively. As a result, the process cartridge B settles in the movable member 50, as a cartridge guiding means, as illustrated in FIG. 15.

Then, the movable member 50 is pushed into the image forming apparatus A. As a result, the image forming apparatus A is placed in the state illustrated in FIG. 1, in which the image forming apparatus A is ready for image formation.

(Image Forming Operation)

Next, an image forming operation by an image forming apparatus structured as described above will be described.

The photosensitive drum 1 is rotated in the direction (counterclockwise direction) indicated by an arrow mark in FIG. 1, in synchronism with the rotation of the intermediary transfer belt 5*a*, so that the peripheral surface of the photosensitive drum 1 is uniformly charged by the charging apparatus 2. Then, light that corresponds to the yellow component of an image to be formed is projected from the exposing means 3 to expose the charged peripheral surface of the photosensitive drum 1. As a result, an electrostatic latent image corresponding to the yellow component of the image to be formed is formed on the peripheral surface of the photosensitive drum 1. In synchronism with the formation of this electrostatic latent image, the developing apparatus 4 is driven to position the yellow component developing device 4Y at the development position, and voltage that has the same polarity as the polarity to which the peripheral surface of the photosensitive drum 1 has been charged, and has approximately the same potential level as the voltage applied to the charge roller, is applied to develop the electrostatic latent image on the photosensitive drum 1 by adhering yellow toner to the electrostatic latent image on the photosensitive drum 1. Then, as the photosensitive drum 1 is further rotated, the yellow toner image on the photosensitive drum 1 comes into contact with the intermediary transfer belt 5*a*, and is transferred (primary transfer) onto the intermediary transfer belt 5*a* by applying voltage which is opposite in polarity to the toner, to the primary transfer roller 5*d* (follower roller).

After the completion of the primary transfer of the yellow toner image, the rotary unit is rotated to move the next developing device, that is, the developing device corresponding to the color component to be developed next, to the development position where the developing device opposes the photosensitive drum 1, and the toner image formed by this cycle of the development process is transferred (primary transfer) onto the intermediary transfer belt 5*a*, in alignment with the yellow toner image on the intermediary transfer belt 5*a*. Then, the same operation as the one described above, which comprises the electrostatic image formation, development, and primary transfer, is carried out for the cyan and black components of the image to be formed. As a result, four toner images of different color are placed in layers on the intermediary transfer belt 5*a*. These four toner images of different color are transferred (secondary transfer) all at once onto the recording medium S supplied from the sheet feeding-conveying means 7.

After the secondary transfer, the recording medium S is conveyed to the fixing apparatus 8, in which the toner images are fixed to the recording medium S. Then, the recording medium S is discharged into the delivery tray 10, by the belt 9*a* which moves in the direction indicated by the arrow mark in the drawing, and the discharge roller 9*b* around which the belt 9*a* is wrapped to be driven. This concludes the image forming operation.

(Structure of Process Cartridge)

Figure 3:
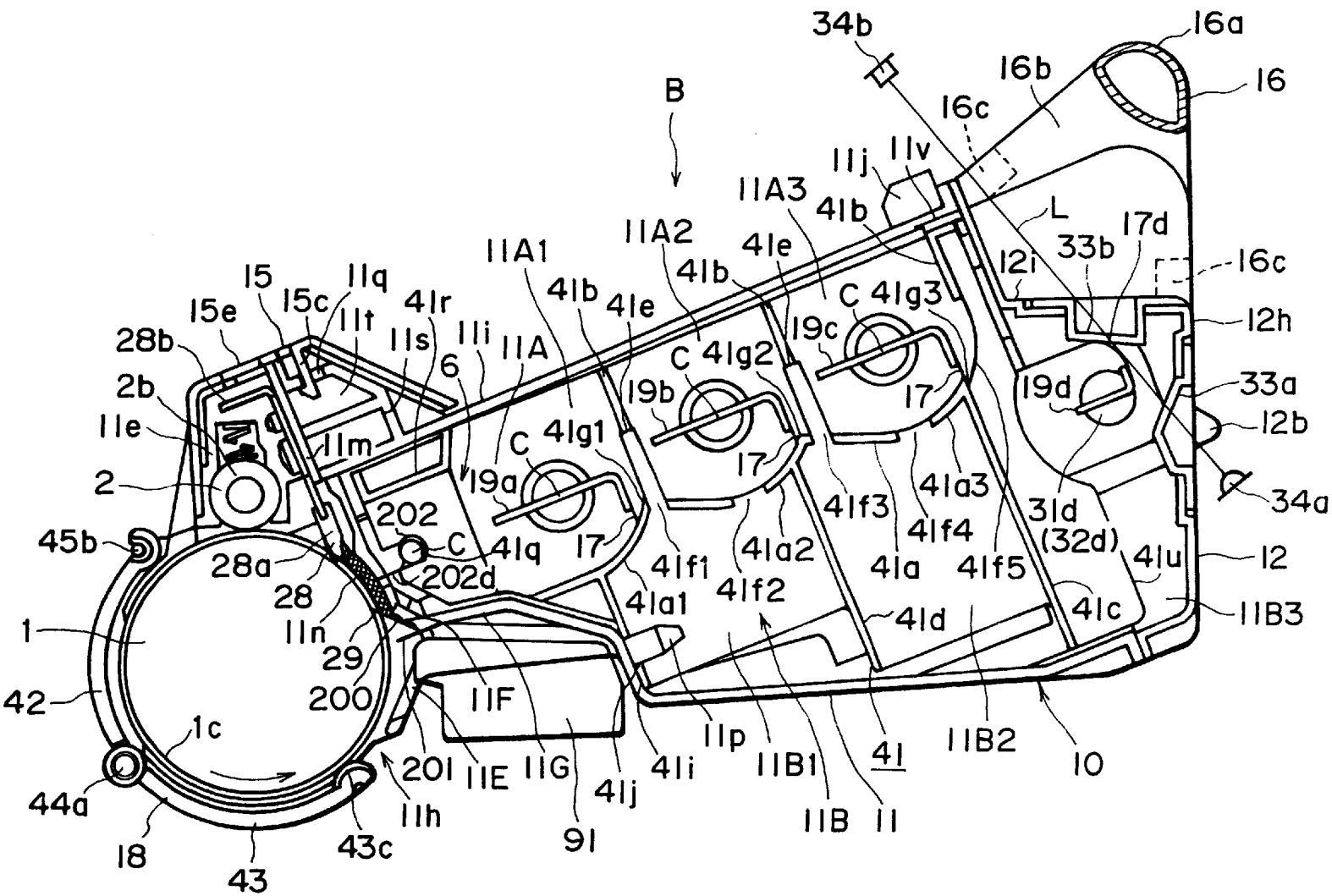
FIG. 3 is a longitudinal sectional view of a process cartridge.
Figure 6:
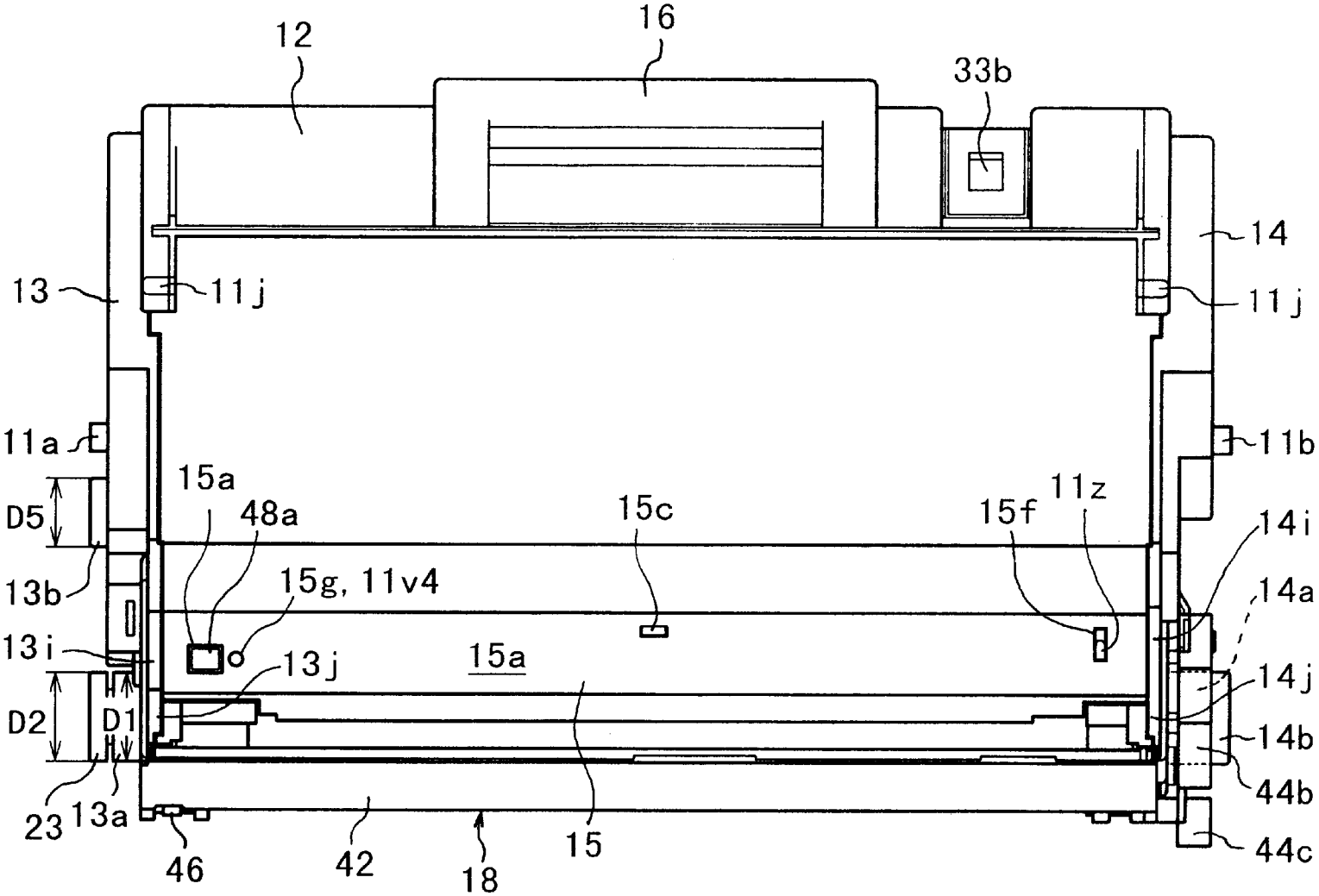
FIG. 6 is a top plan view of a process cartridge shown in FIG. 3.

Referring to FIG. 3, the process cartridge B comprises the charging apparatus 2 and cleaning apparatus 6, which are disposed along the peripheral surface of the photosensitive drum 1. These components are integrally disposed in the housing 10 which is a cartridge guide. The housing 10 of the process cartridge B comprises a cleaning means housing portion 11, and a rear housing portion 12 which is joined with the rear end of the cleaning means housing portion with the use of ultrasonic waves. The cleaning means housing portion 11 comprises: a pair of drum supporting portions 11*d* (FIG. 10) which extend from the portions corresponding to the longitudinal ends, one for one, of the photosensitive drum 1 and charging apparatus 2; a cleaning member attachment portion 11*m*; and a container portion located behind the preceding three portions. Referring to FIG. 6, the process cartridge B comprises a gear cover 13 (side cover for covering one of the longitudinal ends of process cartridge B), which is fixed to the process cartridge B, on the driven side of the longitudinal ends of the process cartridge B, to cover the longitudinal end of the cleaning means housing portion 11 and rear housing portion 12. To the other longitudinal end of the process cartridge B, a side cover 14 is fixed to cover the other longitudinal end of the cleaning means housing portion 11 and rear housing portion 12. Further, the process cartridge B comprises a charging apparatus cover 15, which is fixed to the top portion of the cleaning means housing portion 11, and covers the charging apparatus 2 across the top as well as both longitudinal ends.

The charging apparatus cover 15 is a member for protecting the charging apparatus 2.

The material for the cartridge housing 10 (cleaning means housing portion 11 and rear housing portion 12), and end covers 13 and 14, is plastic, for example, polystyrene, ABS resin (copolymer of acrylonitrile butadiene and styrene), polycarbonate, polyethylene, polypropylene, or the like.

Further, the front end portion of the cleaning means housing portion 11 is provided with the drum shutter 18 as a movable cover, which is movable along the peripheral surface of the photosensitive drum 1, and protects the photosensitive drum 1 by, for example, preventing the photosensitive drum 1 from being exposed to the external light and from coming into contact with the operator while the photosensitive drum 1 is outside the image forming apparatus A, and which exposes or covers, from outside, the opening 11*h* to expose the photosensitive drum 1 to carry out the aforementioned exposing, developing, and transferring processes when the photosensitive drum 1 is within the image forming apparatus A.

Referring to FIG. 6, the gear cover 13 and the end cover 14, which are the portions of the cartridge housing 10, are provided with a guide portion for guiding and positioning the process cartridge B when the process cartridge B is installed into, or removed from, the apparatus main assembly 20, being assisted by the movable member 50.

More specifically, the process cartridge B is provided with a cylindrical positioning boss 13*a*, which is the first projection for positioning the process cartridge B, a cylindrical positioning boss 14*a*, which is the second projection for positioning the process cartridge B, and a rotation control projection 11*a* which is the third projection for controlling the pivoting of the process cartridge B about the cylindrical positioning bosses 13*a* and 13*b*, and a rotation control projection 11*b* which is the fourth projection for controlling the angle by which the process cartridge B pivots about the cylindrical positioning bosses 13*a* and 13*b*. The first and third projections are on the driven side (side where the shaft coupling member 23 is), and the second and fourth projections are on the non-driven side (side where there is no shaft coupling member 23). Further, the first and second projections are coaxial with the shaft coupling member 23 and photosensitive drum 1, and the second and third projections stand in the same line which is substantially parallel to the axial line of the photosensitive drum 1.

The positions of the outward end surface of the cylindrical positioning bosses 13*a* and 14*a*, i.e., the first and second projections, are on the immediately inward sides of the positions of the bases of the rotation control projections 11*a* and 11*b*, i.e., the third and fourth projections, in terms of the longitudinal direction of the process cartridge B, respectively.

The process cartridge B is also provided with the shaft coupling member 23 and cylindrical guide portion 14*b*, as the guiding portion for guiding the process cartridge B when the process cartridge B is installed into, or removed from, the movable member 50, which are on the immediately outward sides of the cylindrical positioning bosses 13*a* and 14*a*, i.e., the first and second projections, in the longitudinal direction of the process cartridge B. In terms of the longitudinal direction of the process cartridge B, the positions of the shaft coupling member 23 and cylindrical guide portion 14*b* are substantially the same as the positions of the rotational positioning bosses 11*a* and 11*b*, i.e., the third and fourth projections, respectively. The shaft coupling member 23 and cylindrical guide portion 14*b* are guided by guiding surfaces 51*b* and 52*b* of the movable member 50, and the rotation control bosses 11*a* and 11*b* are guided by the guiding surfaces 51*c* and 52*c* of the movable member 50, so that the attitude of the process cartridge B is regulated when the process cartridge B is installed into, or removed from, the movable member 50.

In other words, the rotation control bosses 11*a* and 11*b*, i.e., the third and fourth projections, constitute the guiding portions for guiding the process cartridge B when the process cartridge B is installed into, or removed from, the movable member 50, and also constitute the rotation control, portions for controlling the angle by which the process cartridge B pivots. It is feasible to form a cylindrical hollow portion by extending outward the cylindrical positioning boss 13*a* on the driven side in its axial direction, so that the shaft coupling member 23 fits in this cylindrical hollow portion of the cylindrical positioning boss 13*a* in the same manner as the cylindrical positioning boss 14*a* is disposed coaxially with the cylindrical guide portion 14*b*, on the opposite side of the process cartridge B.

(Movable Member (Drawer) for Installation or Removal of Process Cartridge)

Next, referring to FIGS. 14 and 15, the movable member 50 (drawer) provided with a drawer mechanism used for installing or removing the process cartridge B will be described in detail.

The guiding member 51 of the movable member 50, on the driven side of the process cartridge B, is provided with a guiding surfaces 51*b* and 51*c*, which are the surfaces of the grooves cut in the inward surface of the guiding member 51 to insert the process cartridge B into the movable member 50. The guiding member 52 of the movable member 50, on the non-driven side of the process cartridge B, is provided with the guiding surfaces 52*b* and 52*c*, which are the surfaces of the grooves cut in the inward surface of the guiding member 52 for inserting the process cartridge B into the movable member 50. The guiding surfaces 51*b* and 51*c* are symmetrical with the guiding surfaces 52*b* and 52*c*, respectively, with regard to the plane which divides the movable member 50 into the left and right halves. The guiding surface 51*b* on the driven side dips downward across a portion 51*e* (hereinafter, "dip portion") which corresponds to a through hole 51*d* made in the guiding member 52 to input the driving force from the image forming apparatus A to the driving force inputting member 49 for the removed toner conveying member (FIG. 4) of the process cartridge B. The movable member 50 is provided with a catching portion 51*h*, on the driven side, and a catching portion 52*h*, on the non-driven side, which temporarily fix the positions of the cylindrical bosses 13*a* (FIG. 6), on the driven side, and 14*a* (FIG. 12), on the non-driven side, by catching them. In terms of the direction in which the shaft coupling member 23 and guide portion 14*b* of the process cartridge B are inserted into the movable member 50 along the guiding surfaces 51*b* and 52, the catching portions 51*h* and 52*h* are positioned at the downstream ends of the guiding surfaces 51*b* and 52*b*, respectively. In terms of the longitudinal direction of the process cartridge B, the catching portions 51*h* and 52*h* are positioned on the immediately inward side of the guiding surfaces 51 and 52*b*. The catching portions 51*h* and 52*h* are configured to cover the approximately ¼ of the peripheral surface of the cylindrical positioning bosses 13*a* and 14*a*, respectively, from underneath, so that they can play a role mainly in preventing the bosses 13*a* and 14*a* from falling downward. Further, the movable member 50 is provided with bumping portions 51*f*, on the driven side, and 52, on the non-driven side, which are substantially vertically disposed. As the movable member 50 is pushed into the image forming apparatus A, the bumping portions 51*f* and 52*f* come into contact with, and therefore, are positioned by, the cylindrical bosses 13*a* and 14*a*, respectively. As a result, the movable member 50 is accurately positioned relative to the photosensitive drum 1.

The movable member 50 is also provided with rotation control surfaces 51*g* and 52*g*, which are substantially horizontal surfaces, and are located at the deepest ends of the guiding surfaces 51*c* and 52*c*, respectively. While the process cartridge B is inserted into the movable member 50, the rotation control projections 11*a* and 11*b* (FIG. 6) of the process cartridge B come into contact with these rotation control surfaces 51*g* and 52*g*, respectively, and control the attitude of the process cartridge B which rotates about the cylindrical bosses 13*a* and 14*a*. Further, the movable member 50 is provided with a pair of CRG pressing springs 53 and 54, which are located immediately above the rotation control surface 51*g* and 52*g*, at the downstream ends of the guiding surfaces 51*c* and 52*c*, being bent so that their bend portions protrude toward the guiding surfaces 51*c* and 52*c*, respectively. The pressing springs 53 and 54 are torsional springs with a wire diameter of approximately 1.0 mm, and comprise a torsional coil spring portion 53*b*, by which the pressing springs 53 and 54, are attached to the inward surfaces of the guiding member 51 and 52, and a bent arm portion, which applies approximately down- and rearward pressure to the rotation control projections 11*a* and 11*b* after the rotation control projections 11*a* and 11*b* seat on the rotation control surfaces 51*g* and 52*g*, respectively. In other words, the pressing springs 53 and 54 are configured so that they apply pressure as the rotation control projections 11*a* and 11*b* arrive at predetermined positions.

The main assembly 20 of the image forming Apparatus A is provided with a rear plate 55, which is attached to the upstream end of the movable member 50 in terms of the direction in which the movable member 50 is inserted into the image forming apparatus A, and a pressing unit 56, which is attached to the rear plate 55, in parallel to the rear plate 55, with the insertion of the movable member pressing spring 57 between the rear plate 55 and pressing unit 56. As the movable member 50 is pushed into the image forming apparatus A, the cylindrical positioning bosses 13*a* and 14*a* of the process cartridge B come into contact with the catching members 61 one for one on the main assembly side, which is semicircular in cross section, and the open side of which faces the direction from which the movable member 50 is pushed into the image forming apparatus A. At this moment, the bumping portions 51*f* and 52*f* of the movable member 50, which are located very close to the front end of the movable member 50, have already come into contact with the cylindrical positioning bosses 13*a* and 14*a*, respectively. Therefore, as the pressing unit 56 is pushed inward of the image forming apparatus A, the movable member pressing spring 57, which is an elastic member, is compressed, causing the bumping members 51*f* and 52*f* of the movable member 50 to press the cylindrical positioning bosses 13*a* and 14*a* against the catching members 61 on the main assembly side, one for one. Since the catching members 61 on the main assembly side are fixed to the apparatus main assembly 20, a pair of hooking portions (unillustrated) of the pressing unit 56, which are located at the left and right sides of the pressing unit 56, catch the image forming apparatus A. As a result, the movable member 50 is kept in contact with the image forming apparatus A by the pressure which applies to the movable member 50 in the direction in which the movable member 50 is pushed into the apparatus main assembly 20. In other words, the movable member 50 is accurately positioned relative to the process cartridge B.

Figure 5:
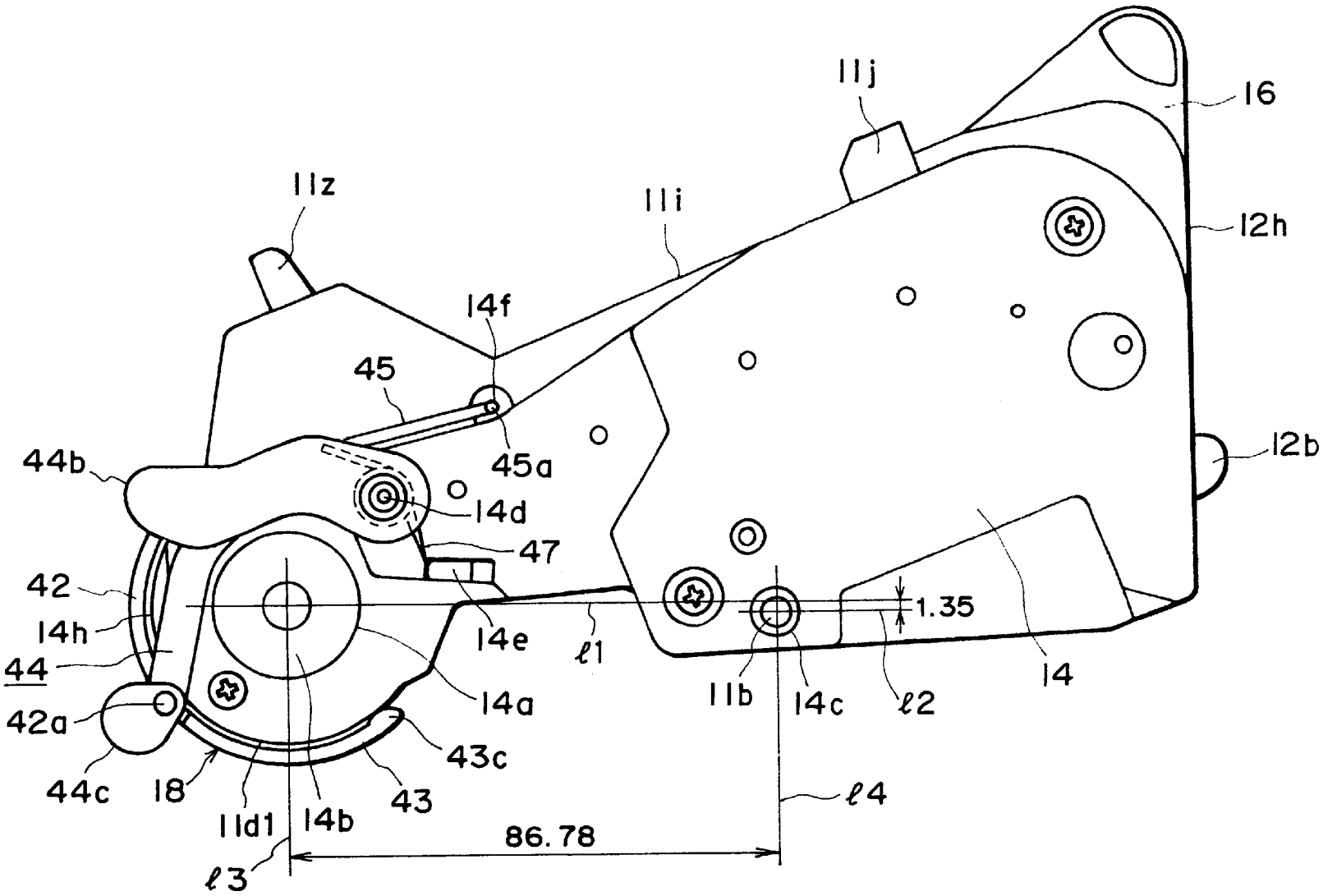
FIG. 5 is a left side view of a process cartridge shown in FIG. 3.

The rear plate 55 is provided with a hole 55*a*, which is located at the approximate center of the rear plate 55, and is approximately 5 mm wide and 10 mm long. This is a hole for accepting a projection which protrudes from the most upstream surface 12*h* of the rear housing portion 12, which will be described later, in terms of the process cartridge B insertion direction (FIG. 5).

The guiding member 52 on the non-driven side is provided with springs 58 and 59, which are located on the inward and outward surfaces, respectively, of the guiding member 52, and generate pressure in the inward and outward directions, respectively, in terms of the longitudinal direction of the process cartridge B. The spring 58 is structured to press the process cartridge B in the longitudinal direction of the process cartridge B by coming into contact with the lateral wall (end cover 14) of the process cartridge B. The guiding member 51 on the driven side is provided with a bumping rib 51, which corresponds in position to the spring 58. As the spring 58 presses the process cartridge B, the bumping rib 51*j* comes into contact with the lateral wall of the process cartridge B, and takes the pressure generated by the spring 58. With the provision of the above structure, the process cartridge B is accurately and reliably positioned relative to the movable member 50 in terms of the longitudinal direction of the process cartridge B. The spring 59 is structured so that as the movable member 50 is pushed into the image forming apparatus A, the spring 59 is compressed against the housing of the apparatus main assembly 20, and generates the pressure in the longitudinal direction of the process cartridge B. As a result, the movable member 50 is accurately positioned relative to the apparatus main assembly 20 in terms of the longitudinal direction of the process cartridge B.

The movable member 50 is provided with a pattern reading apparatus 93 (FIG. 37) for reading the image density on the photosensitive drum 1 to adjust the image density, which is disposed in the bottom portion of the movable member 50, and will be described later in detail. The sensing light emitted from the pattern reading apparatus 93 is caused to hit the photosensitive drum 1, and in order to accurately focus this sensing light upon the photosensitive drum 1, the horizontal distance between the photosensitive drum 1 and pattern reading apparatus must be perfectly adjusted .

(Positioning of Process Cartridge)

In order to precisely position the process cartridge B relative to the image forming apparatus A when installing the process cartridge B into the image forming apparatus A, the side cover 13 (gear cover) and end cover 14 of the cartridge housing 10 (cartridge frame) are provided with cylindrical positioning bosses 13*a*, on the driven side, and 14*a*, on the non-driven side (FIGS. 3–13, except for FIG. 9), which are integral with the side cover 13 and end cover 14, respectively. The side cover 13 and end cover 14 are provided with an insertion error prevention projection 11*j*, which is integral with the respective cover (FIGS. 3–6, 9–11 and 13), and is positioned so as to be at the side edge of the top wall of the cleaning means housing portion 11 after the attachment of the respective cover to the cleaning means housing portion 11. Further, the housing 10 itself is also provided with projections 11*j*, which are integral with the housing 10.

Figure 16:
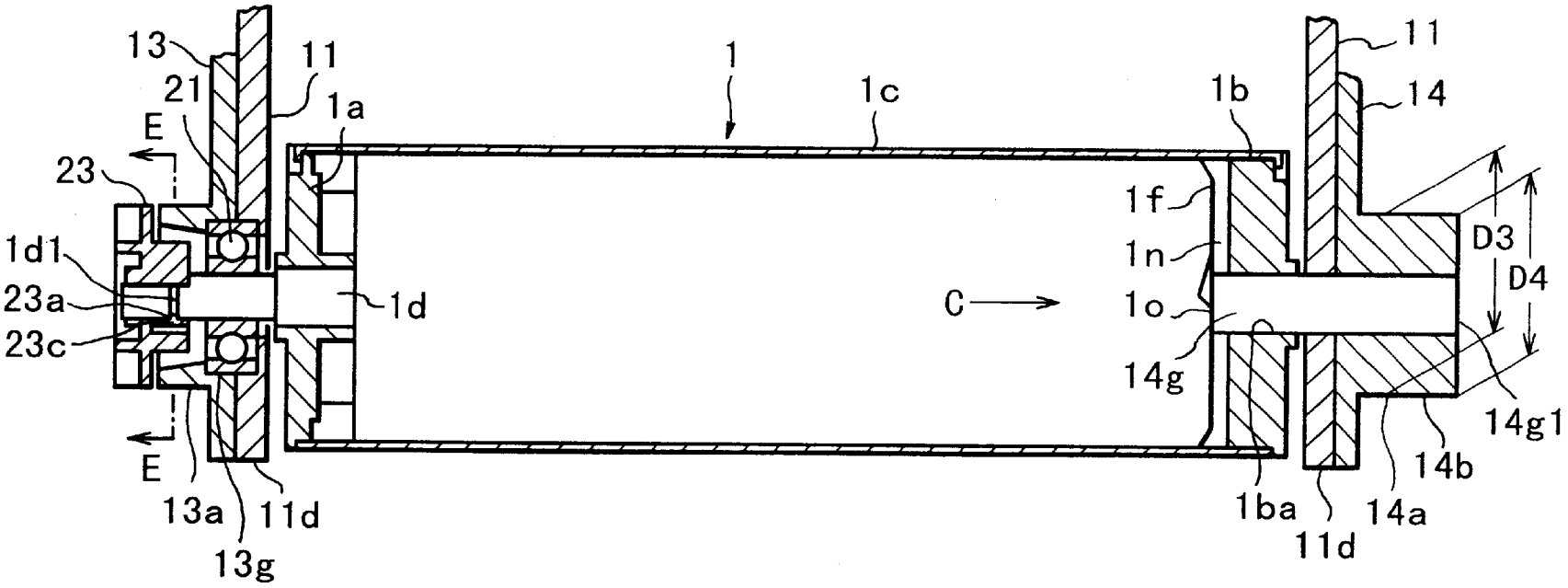
FIG. 16 is a longitudinal sectional view of a photosensitive drum.

Referring to FIG. 6, the side cover 13 is formed so that the attachment of the side cover 13 to the housing 10 positions the cylindrical positioning boss 13*a* immediately next to the shaft coupling member 23, in terms of the longitudinal direction of the shaft coupling member 23, which is attached to the drum shaft 1*d* (FIG. 16). The diameter of the cylindrical positioning boss 13*a* is slightly larger than that of the shaft coupling member 23. In terms of the longitudinal direction after the attachment of the gear cover 13 to the housing 10, the position of the outward end surface of the cylindrical positioning boss 13*a* is approximately the same as, or slightly on the inward side of, the position of the outward surface of the outward plate of the gear cover 13, as shown in FIG. 6. On the other hand, the position of the shaft coupling member 23 is on the outward side relative to the position of the outward plate of the gear cover 13 in terms of the longitudinal direction. There is the following relationship between the external diameter D1 of the cylindrical positioning boss 13*a* and the external diameter D2 of the shaft coupling member 23: D1>D2. More specifically, D1 and D2 are approximately 28 mm and 27.6 mm, respectively.

Figure 7:
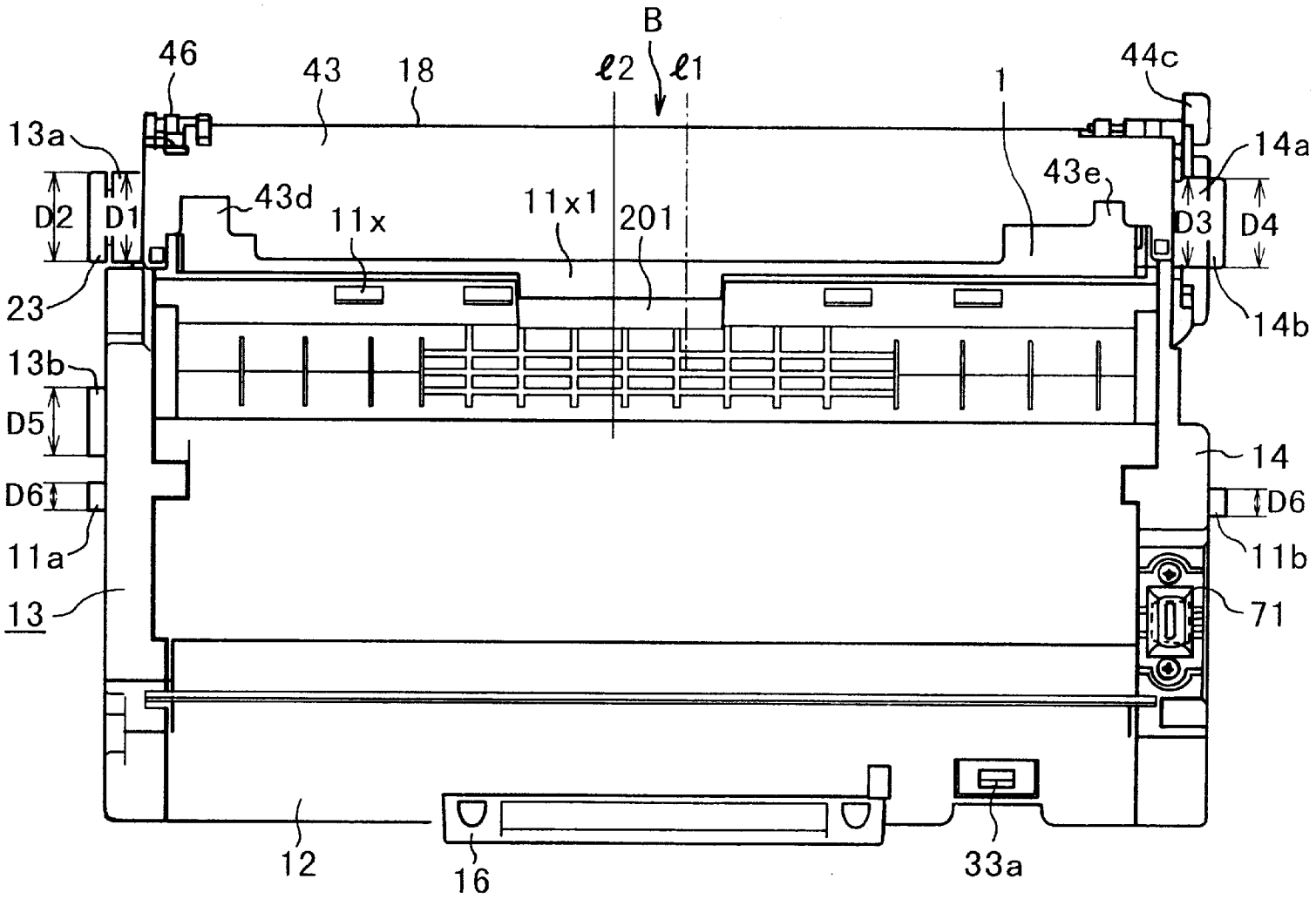
FIG. 7 is a bottom view of a process cartridge shown in FIG. 3.
Figure 8:
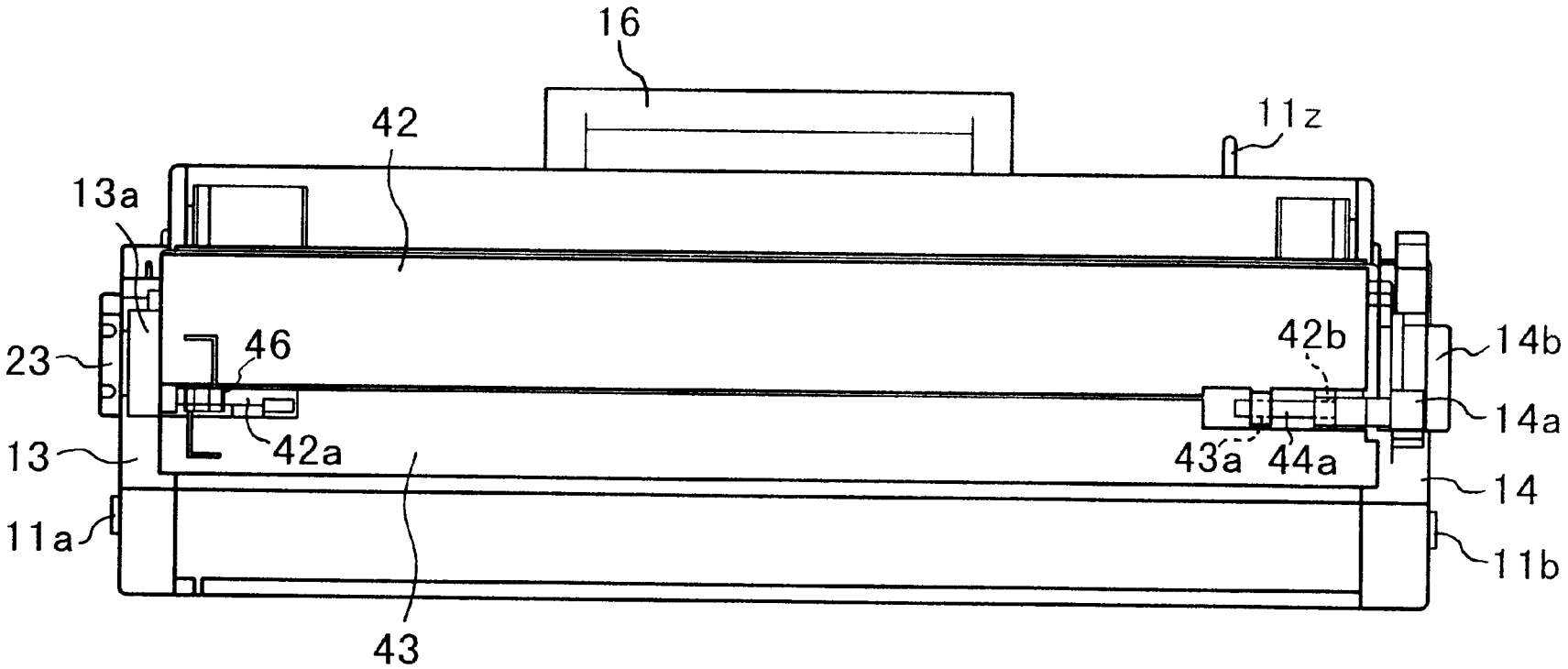
FIG. 8 is a front view of the process cartridge front view shown in FIG. 3.

Referring to FIG. 7, the cylindrical positioning boss 14*a* on the non-driven side is provided with a cylindrical portion 14*b* which is coaxial with the cylindrical positioning boss 14*a*, but is slightly smaller in external diameter than the cylindrical positioning boss 14*a*. In terms of the longitudinal direction of photosensitive drum 1, the position of the outward facing surface of the cylindrical positioning boss 14*a* is the same as, or slight on the inward side of, the position of the outward surface of the end cover 14. Also in terms of the longitudinal direction, the cylindrical portion 14*b* is entirely, or almost entirely, on the outward side of the outward surface of the end cover 14. The external diameter D3 of the cylindrical positioning boss 14*a* and the external diameter D4 of the cylindrical portion 14*b* have the following relationships relative to D1 and D2: D1=D3 and D2=D4.

Figure 4:
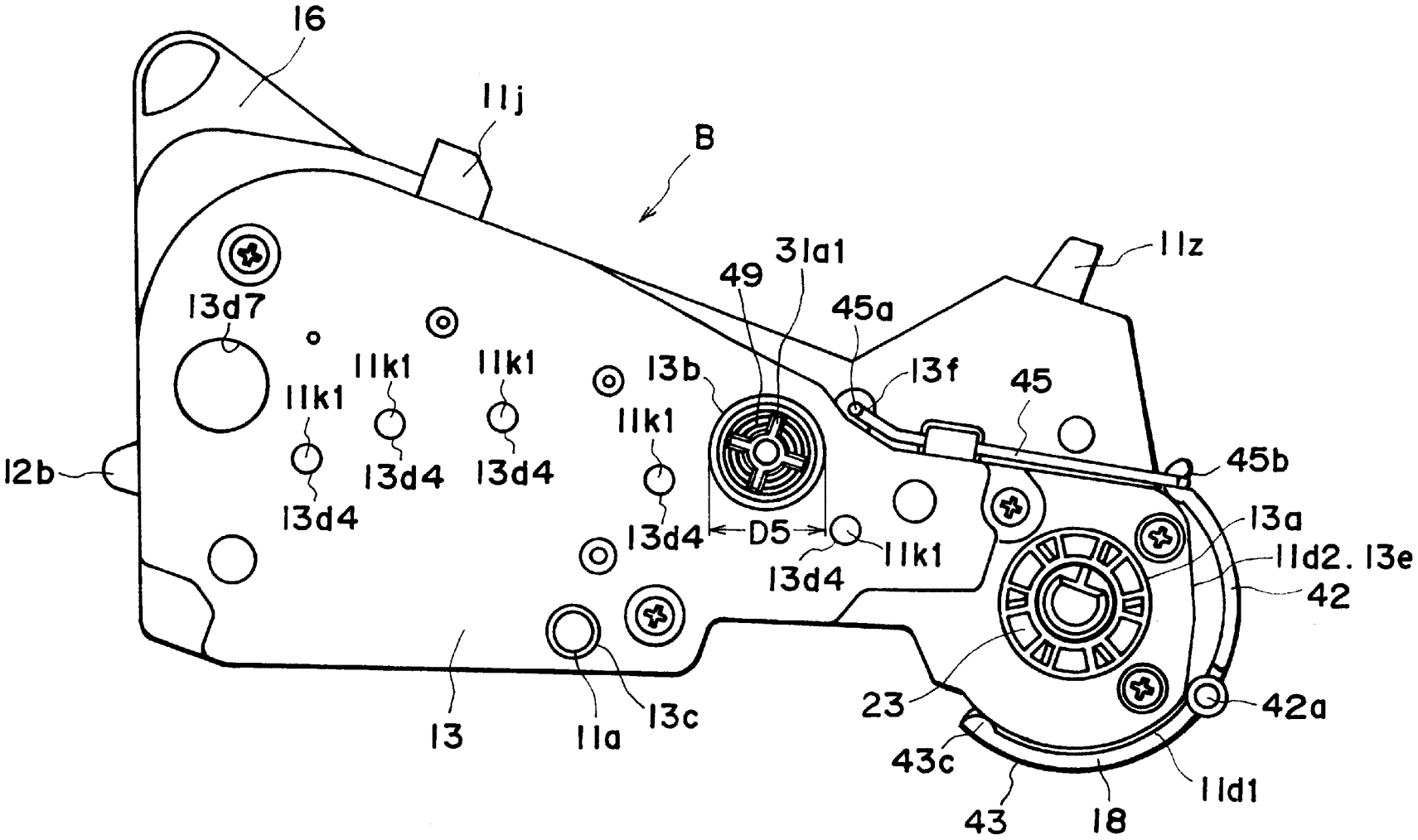
FIG. 4 is a right side view of a process cartridge shown FIG. 3.
Figure 10:
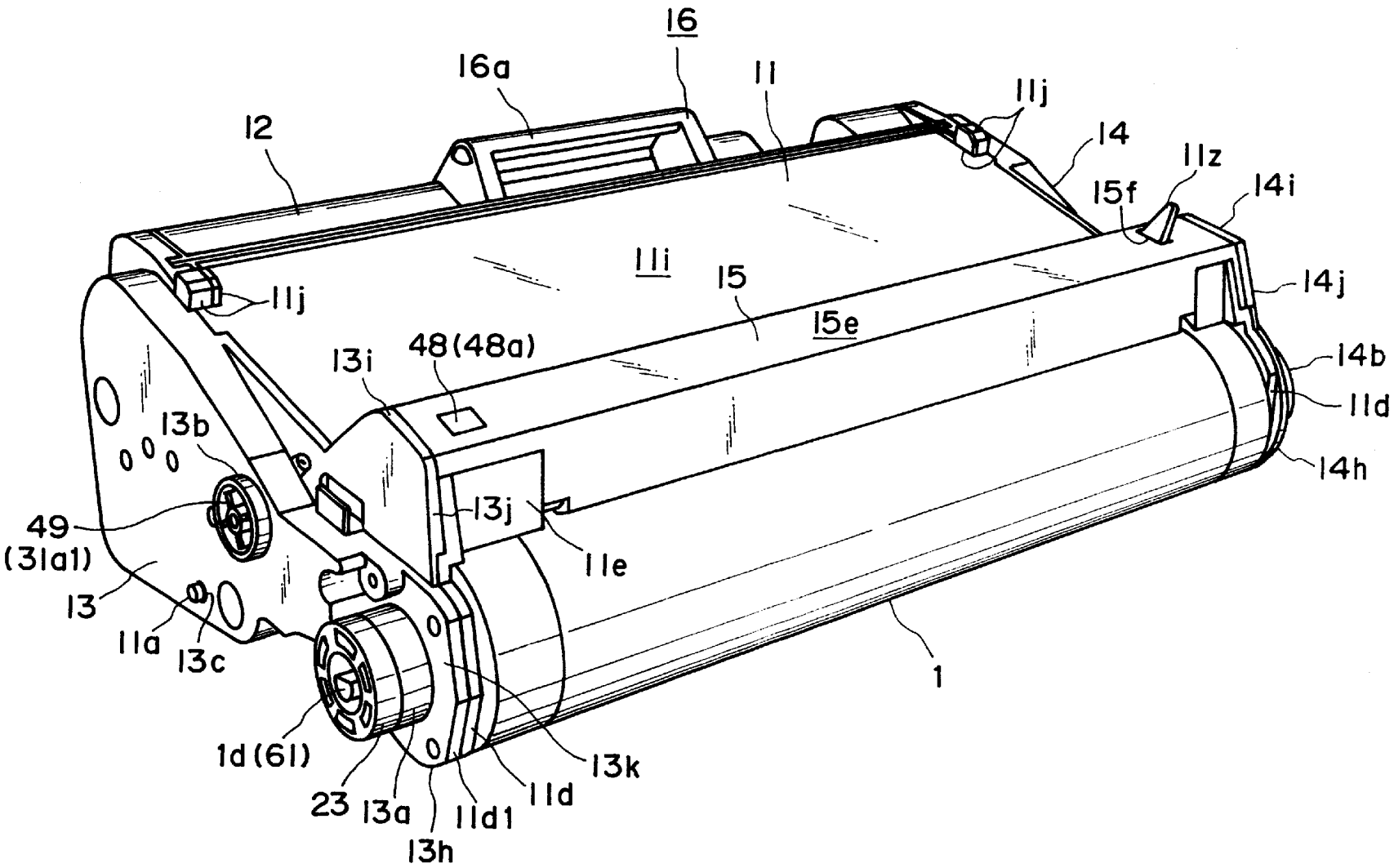
FIG. 10 is a perspective view of an outer appearance as seen from a front, right and upper part of the process cartridge shown in FIG. 3.

Referring to FIGS. 4 and 10, the process cartridge B is provided with a removed toner conveying member driving force input portion 49, which is on the upstream side of shaft coupling member 23 in terms of the process cartridge B insertion direction, and is protected with a second cylindrical boss 13*b* integral with the gear cover 13 fixed to the cleaning means housing portion 11. Referring to FIG. 6, in terms of the longitudinal direction, the position of the second cylindrical boss 13*b* is outward of the outward wall of the gear cover 13, and is inward of, or exactly the same as, the most outward portion of the shaft coupling member 23. The relationship between the external diameter D5 of the second cylindrical boss 13*b* and the external diameter D2 of the shaft coupling member 23 is: D5<D2.

The process cartridge B is provided with a rotation control projection 11*a* (11*b* on the non-driven side), which projects from the side surface of the cleaning mean housing 11. In terms of the direction in which the process cartridge B is inserted into the movable member 50, the position of the rotation control projection 11*a* is on the upstream side of both the shaft coupling member 23 and second cylindrical boss 13*b*. Referring to FIGS. 4, 5, 11 and 12, the side cover 13 and end cover 14 are provided with holes 13*c* and 14*c*, the positions of which correspond to the positions of rotation control projections 11*a* and 11*b*, respectively, and through which the projections 11*a* and 11*b* project beyond the outward walls of the side cover 13 and end cover 14, respectively. These rotation control projections 11*a* and 11*b* are positioned 80 mm and 90 mm, respectively, away from the axial line of the photosensitive drum 1 These distances are the maximum distances affordable in consideration of the dimensions of the side walls of the process cartridge B. In other words, the distances between the projections 11*a* and 11*b* and the axial line of the photosensitive drum 1 are made as long as possible to improve the positional accuracy in terms of the pivotal direction of the process cartridge B about the axial line of the photosensitive drum 1. In terms of the longitudinal direction, the position of the most outward point of the rotation control projection 11*a* is approximately the same as the position of the most outward point of the shaft coupling member 23, and the position of the most outward point of the rotation control projection 11*b* is approximately the same as the position of the most outward point of the guiding portion 14*b*.

(Installation of Removal of Process Cartridge into or out of Movable Member)

Here, referring to FIGS. 44–48, the operation for installing or removing the process cartridge B into or out of the movable member 50 will be described in detail. FIGS. 44–48 are perspective side views of the guiding member 52 on the non-driven side as seen from the outward side of the guiding member 52. In this section of the specification, the description of the invention is made with reference to the non-driven side of the process cartridge B. The driven side of the process cartridge B is substantially the same as that of the non-driven side, except for the portion corresponding to the guide portion 14*b* of the side cover on the non-driven side. However, where the portions different in shape and operation from the portions on the driven side are described, the differences between the two sides are mentioned.

Figure 44:
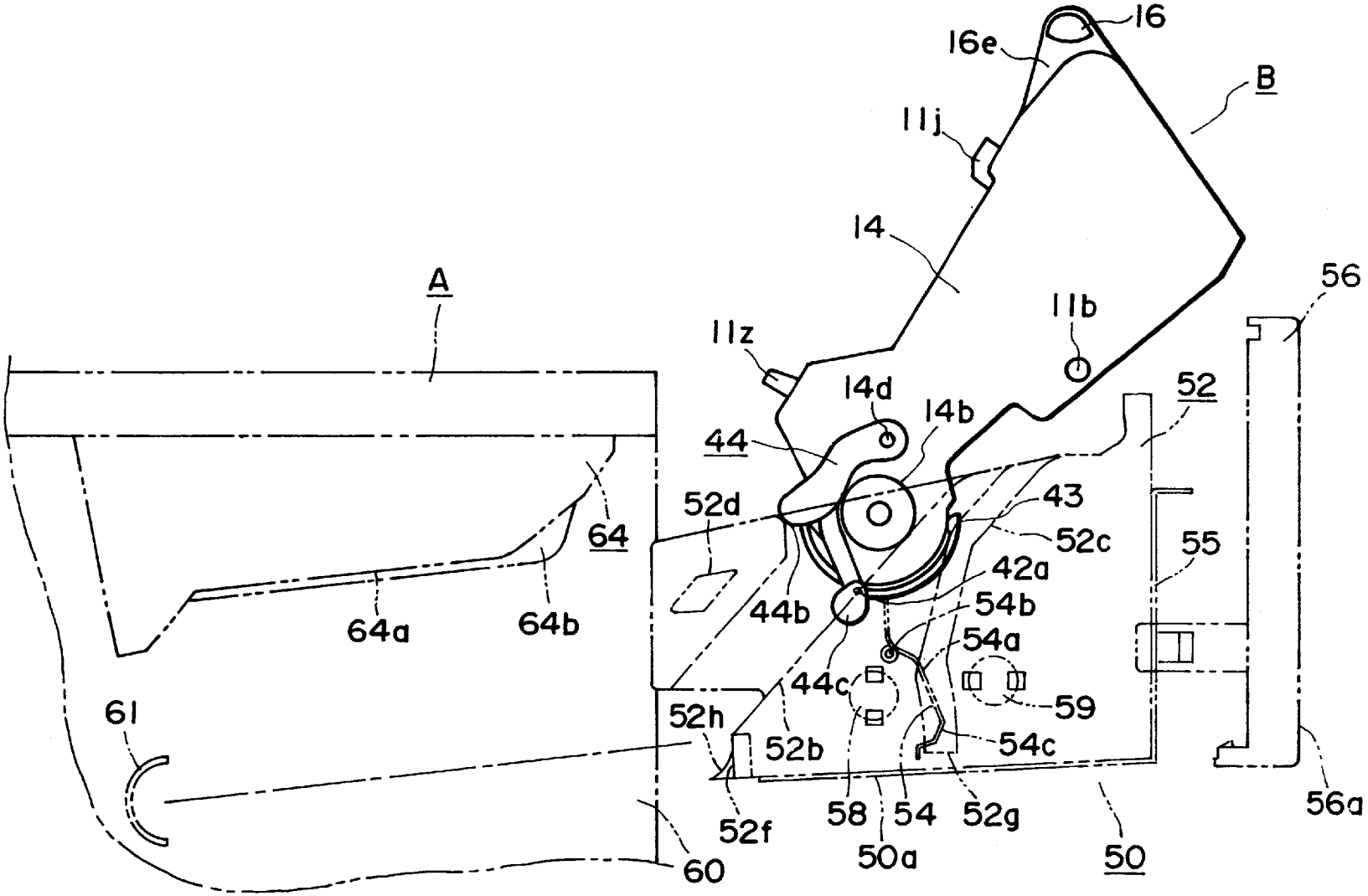
FIG. 44 is a side view illustrating mounting-and-demounting of a process cartridge relative to the movable member and illustrating opening and closing operations of a drum shutter.
Figure 45:
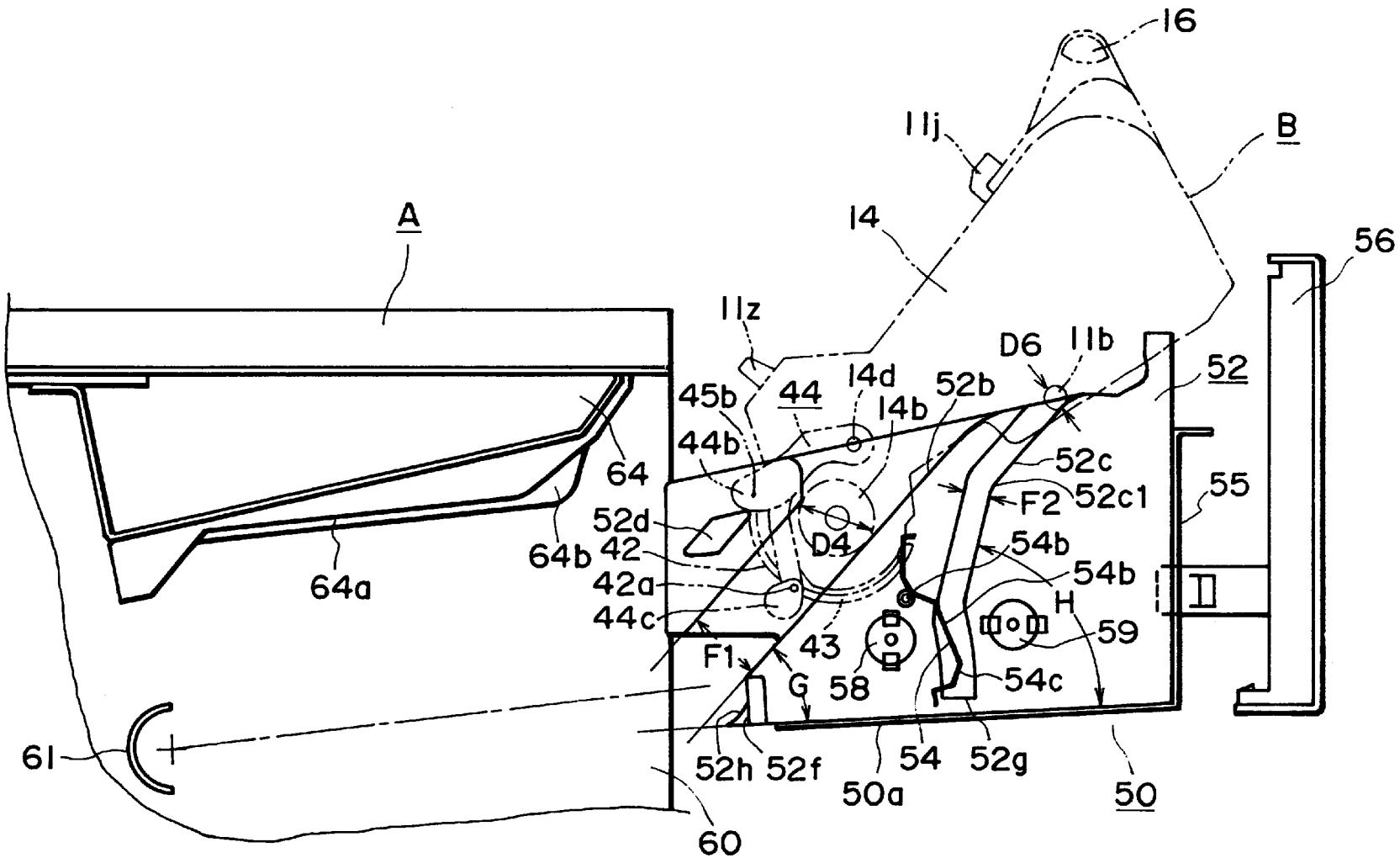
FIG. 45 is a side view illustrating mounting-and-demounting of a process cartridge relative to the movable member and illustrating opening and closing operations of a drum shutter.
Figure 46:
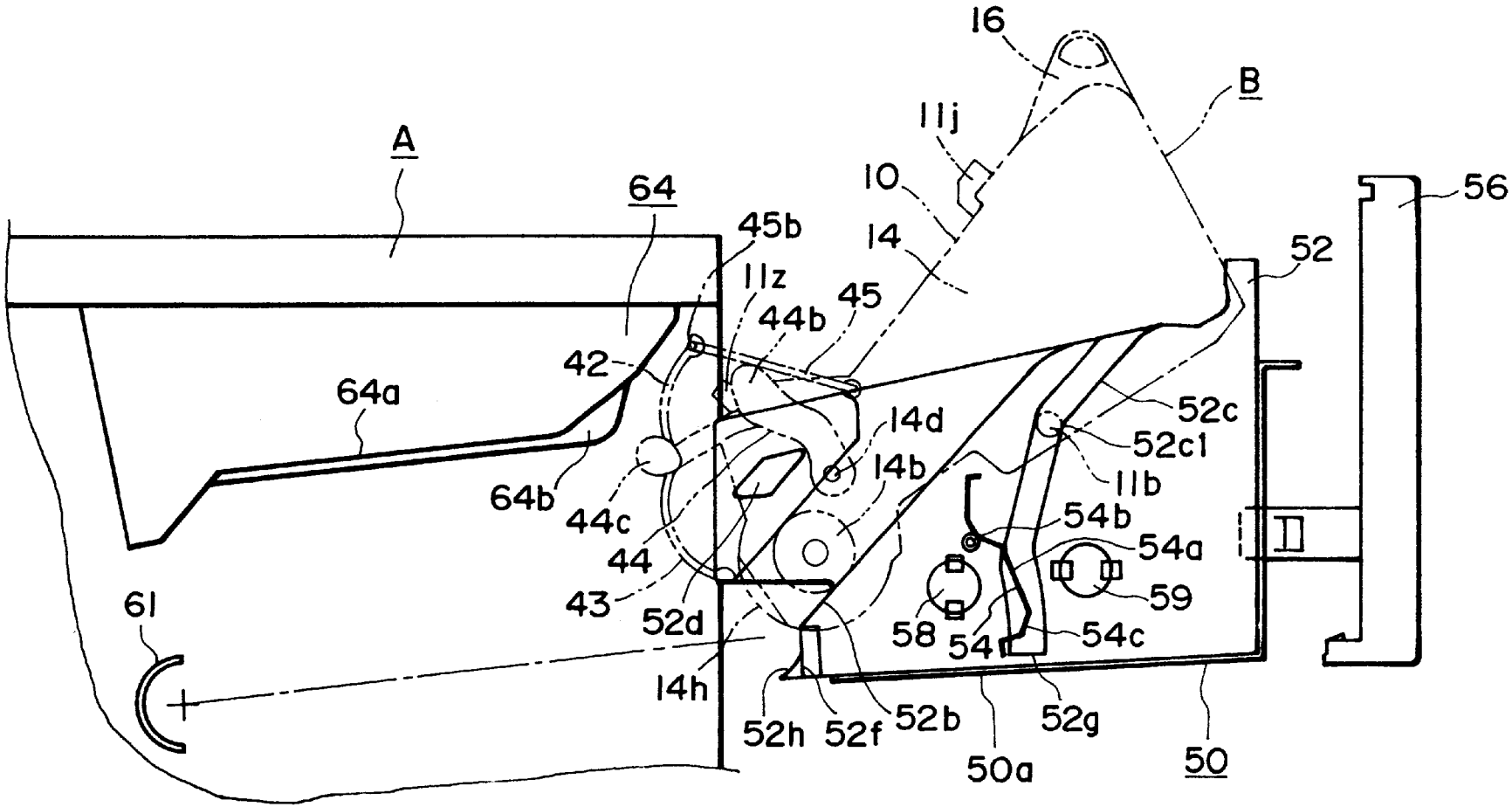
FIG. 46 is a side view illustrating mounting-and-demounting of a process cartridge relative to the movable member and illustrating opening and closing operations of a drum shutter

Referring to FIG. 44, as a user grasps the handle 16 of the process cartridge B, which is fixed to an upstream portion of the process cartridge B in terms of the process cartridge B insertion direction, by putting the fingers through the hole 16*e* of the handle 16, the process cartridge B tilts so that the portion of the process cartridge B corresponding to the location of the photosensitive drum 1 naturally moves downward, since the center of gravity of the process cartridge B is located at a point on the front side of the mid point between the front and rear ends of the process cartridge B, that is, since the center of gravity of the process cartridge B is at a point far away from the handle 16. Then, this attitude of the process cartridge B is used to place the guide portion 14*b* of the end cover 14, the axial line of which coincides with that of the photosensitive drum 1, in contact with the top end portion of the guiding surface 52*b* of the guiding member 52 of the movable member 50 (FIG. 44). Then, the process cartridge B is lowered into the movable member 50 while maintaining the same attitude of the processor cartridge B, and sliding the guiding portion 14*b* along the guiding surface 52*b*. As the process cartridge B is lowered, the rotation control projection 11*b* on the outward surface of the side wall of the process cartridge B arrives at the top end portion of the guiding surface 52*c* (FIG. 45). In this state, the process cartridge B is guided by the two points on its side wall, and therefore, the attitude of the process cartridge B is somewhat restricted. However, the guiding member 52 is configured so that the widths F1 and F2 of the grooves to which the guiding surfaces 52*b* and 52*c* belong, respectively, become slightly greater than the external diameter D4 of the guiding portion 14*b* and the external diameter D6 of the rotation control projection 11*b*, respectively. More specifically, for instance, if D4 is 27.6 mm, F1 is approximately 30 mm, and if D6 is 8 mm, F2 is approximately 11 mm. In other words, an appropriate amount of play is provided between the guiding portion 14*b* and the walls of the corresponding groove, and between the rotation control projection 11*b* and the walls of the corresponding groove, so that the attitude of the process cartridge B stabilizes without the need for additional force from the user, also without causing the user to feel that the process cartridge B is fitting too tightly. In this state, the process cartridge B is further lowered into the movable member 50. As the process cartridge B is lowered, the rotation control projection 11*b* passes the top portion of the guiding surface 52*c*, which is substantially parallel to the guiding surface 52*b*, passes the bend portion 52*cl* of the guiding surface 52*c*, and arrives at the top end of the portion of the guiding surface 52*e* with a steep angle H (FIG. 46). In this state, the user is to apply a small amount of downward force to the process cartridge B. As the force is applied, the process cartridge B is guided into the movable member 50 while being gradually changed in its attitude, that is, from slanted to horizontal. This change in the process cartridge B attitude occurs for the following reasons. That is, referring to FIG. 45, there is the following relationship between the angle G of the guiding surface 52*b* relative to the horizontal surface, and the angle H of the guiding surface 52*c* relative to the horizontal surface: H>G. Therefore, the velocity at which the rotation control projection 11*b* slides down is greater than that of the guiding portion 14*b*, causing the process cartridge B to pivot clockwise about the axial line of the photosensitive drum 1 while gliding downward.

Figure 47:
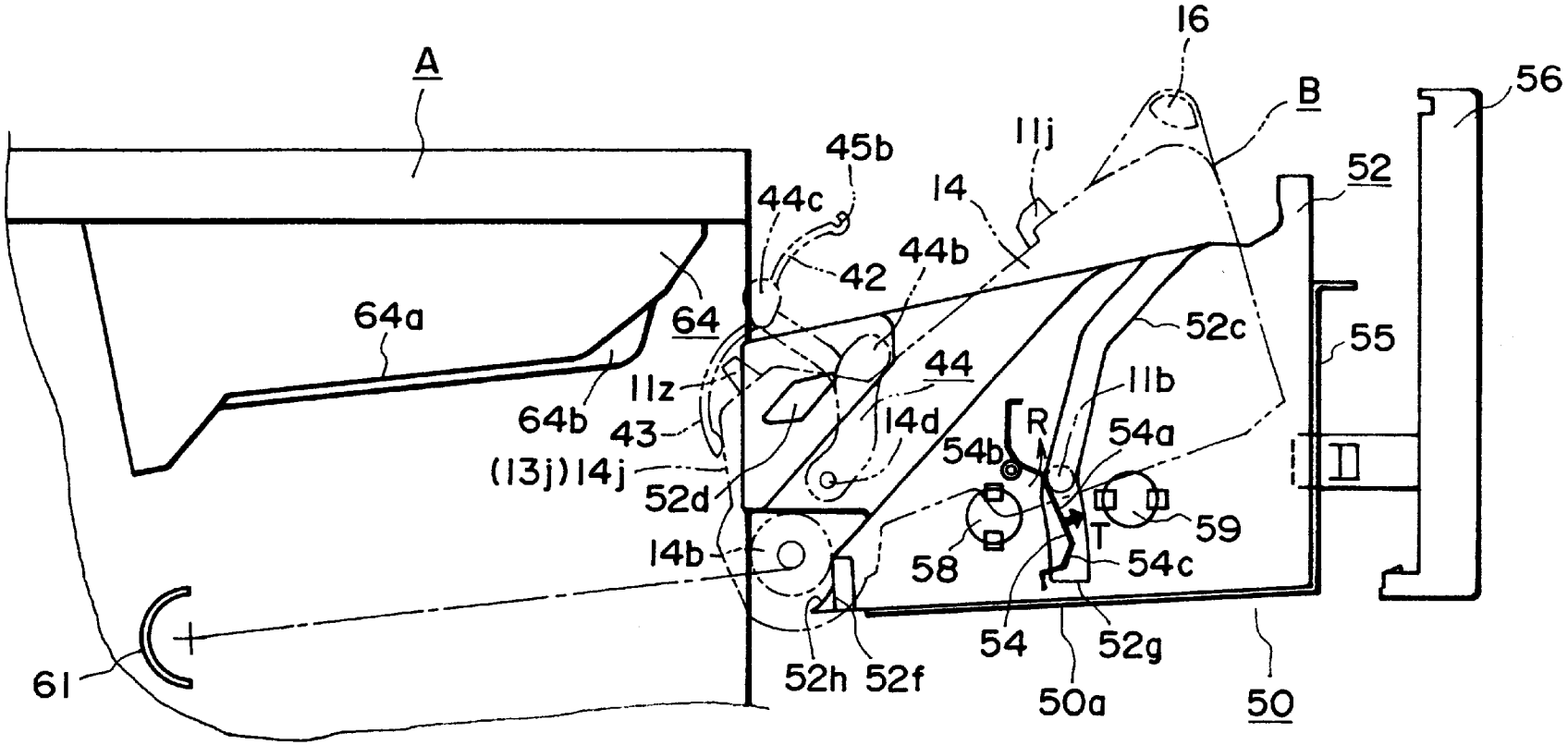
FIG. 47 is a side view illustrating mounting-and-demounting of a process cartridge relative to the movable member and illustrating opening and closing operations of a drum shutter

As the process cartridge B is inserted to the position illustrated in FIG. 47, past the position illustrated in FIG. 46, the rotation control projection 11*b* stops at the top end of the straight portion 54*a* of the CRG pressing spring 54, i.e., an elastic member, on the non-driven side. This is for the following reason. That is, the CRG pressing spring generates such force that causes the straight portion 54*a* to pivot about the support portion 54*b* in the direction indicated by an arrow mark R. Therefore, when left alone, the process cartridge B does not descend further, remaining in the same place.

At this point, the user is to apply a small amount of force to the process cartridge B. With the application of the force, the CRG pressing spring bends in the direction opposite to the direction indicated by the arrow mark R, as if it were pivoting about the support portion 54*b*, allowing the rotation control projection 11*b* of the process cartridge B to descend along the straight portion 54*a* to the position illustrated in FIG. 48, at which the rotation control projection 11*b* is in contact with the rotation control surface 52*g*, i.e., the lowest portion of the guiding surface 52*c*. As the rotation control projection 11*b* passes past the CRG pressing spring 54, the user notices a feeling of clicking (feels that the installation of the process cartridge B has not been completed). In the state illustrated in FIG. 48, the rotation control projection 11*b* of the process cartridge B is in contact with the contact portion 54*c* of the CRG pressing spring 54, which extends downward from the straight portion 54*a* at approximately 45 deg. relative to the straight portion 54*a*. Thus, a component of the force generated by the deformation of the CRG pressing spring 54 applies to the rotation control projection 11*b* of the process cartridge B, preventing the process cartridge B from being lifted by the force generated by the rotation of the photosensitive drum 1. As a result, the attitude of the process cartridge B in the movable member 50, that is, in the image forming apparatus A, in terms of its pivotal direction, becomes fixed.

While the rotation control projection 11*b* is making the above described movement, the guiding portion 14*b* comes into contact with the guiding surface 52*b*, and slides along the guiding surface 52*b* until the cylindrical positioning boss 14*a* is caught by the catching portion 52*h*, which is located immediately on the inward side of the guiding portion 14 in terms of the axial direction of the guiding portion 14*b*. As a result, the movement of the process cartridge B is somewhat controlled in terms of the downward movement of the axial line of the photosensitive drum 1 in the process cartridge B. In this state, the horizontal movement of the rotation control projection 11*b* along the rotation control surface 52*g* is limited to approximately 1 mm to 2 mm, and therefore, the process cartridge B is somewhat controlled in terms of its horizontal movement. In addition, the external diameter of the cylindrical positioning boss 14*a* is greater than that of the guiding portion 14*b*. Therefore, even if the width of the catching portion 52*h* in terms of the longitudinal direction of the cylindrical positioning boss 14*a* is increased, that is, even if the catching portion 52*h* is extended outward in its longitudinal direction beyond the cylindrical positioning boss 14*a*, into the territory of the guiding portion 14*b*, by increasing the thickness of the catching portion 52*h* to strengthen the catching portion 52*h*, it does not occur that the positioning of the process cartridge B is affected by the interference between the catching portion 52*h* and the guiding portion 14*b* in their longitudinal direction. Further, the catching portion 52*h* can be simplified on the side which makes contact with the cylindrical positioning boss 14*a*, in terms of the curvature. Therefore, the shape of the metallic mold for the movable member 50 can be simplified.

Further, the end cover 14, on the non-driven side, fixed to the cleaning means housing portion 11 is pressed in the longitudinal direction of the photosensitive drum 1 by a pressure generating member 58 with which the guiding member 52 is provided. Therefore, the process cartridge B is pressed toward the driven side, causing the gear cover 13 on the driven side to come into contact with the three bumping ribs 51*j* (FIG. 14) which are approximately 2 mm wide and are distributed on the inward surface of the guiding member 51. As a result, the position of the process cartridge B relative to the movable member 50 in terms of the longitudinal direction becomes fixed.

During the above described movement of the process cartridge B, the rotation control projection 11*a* on the driven side is guided by the guiding surface 51*c* while the process cartridge B is inserted into the movable member 50. Therefore, the attitude of the process cartridge B is stabilized by the two points which correspond to the guiding portion 14*b* and rotation control projection 11*b*. In other words, no other guiding portions are required, making it possible to simplify the shape of the process cartridge B and the corresponding structure on the apparatus main assembly 20 side. Therefore, it is possible to reduce the cost of the mold production. Further, the rotation control projection 11*a* carries out two functions: a function to guide the process cartridge B into the movable member 50, and a function to fix the attitude of the process cartridge B in the movable member 50. Therefore, the process that must be carried out in the case of conventional art to fix the attitude of the process cartridge B in terms of the pivotal direction of the process cartridge B is unnecessary, adding to the improvement in operational efficiency. Further, the function of providing the user with the feel of the completion of the installation of the process cartridge B, and the function of controlling the pivotal movement of the process cartridge B, are both carried out by the CRG pressing springs 53 and 54 as elastic members. In other words, a plurality of functions are carried out by a single component. Therefore, the cost is reduced. Further, the process cartridge B and movable member 50 are configured so that the catching portion 52*h* of the movable member 50 catches the cylindrical positioning boss 14*a*, the position of which in terms of the longitudinal direction is on the inward side of the guiding portion 14*b*. Therefore, the movable member 50 is smaller in terms of the longitudinal direction.

In the preceding paragraphs, mainly, the nondriven side is described. However, the description of the non-driven side substantially applies to the driven. In other words, the guiding surface 51*b* which makes contact with the shaft coupling member 23 is symmetrical to the guiding surface 52*b* on the non-driven side with regard to the plane which divides the movable member 50 into the left and right halves, except that on the driven side, the guiding surface 51*b* dips across the portion 51*e* (dip portion), i.e., the portion corresponding to the front portion of the gear cover 13. The shaft coupling member 23 is the same in diameter as the guiding portion 14*b* on the non-driven side, and is coaxial with the photosensitive drum 1. The width F3 of the portion 51*c* is smaller than the external diameter D2 of the shaft coupling member 23, and therefore, it does not occur that the shaft coupling member 23 falls through the dip portion 51*e* during the insertion of the process cartridge B. The external diameter D5 of the second cylindrical boss 13*b* corresponding to the removed toner conveying member driving force input portion 49 is smaller than the width F3 of the dip portion 51*e*.

Therefore, the shaft coupling member 23 on the driven side slides along the guiding surface 51*b* without falling into the dip portion 51*e* in spite of the presence of the dip portion 51*e*, and at the same time as the cylindrical positioning boss 14*a* on the non-driven side is caught by the catching portion 52*h*, the cylindrical positioning boss 13*a* which corresponds to the guiding portion 14*b* on the non-driven side, and is on the immediately inward side of the shaft coupling member 23 in terms of the axial direction of the shaft coupling member 23, is caught by the catching portion 51*h*, that is, a member for positioning the cylindrical positioning boss 13*a*, the cross section of which is in the form of a ¼ of a circle. Also, at the same time, the second cylindrical boss 13*b* illustrated in FIG. 4 fits into the dip portion 51*e*, i.e., a portion of the guide surface 51*b* on the driven side, making it possible for a mechanical connection to be established between the process cartridge B side and the apparatus main assembly 20 so that the driving force can be transmitted to the removed toner conveying system. Further, the guiding surface 51*c*, and the CRG pressing spring 53 as an elastic member, on the driven side, are symmetrical to the guiding surface 52*c*, and the CRG pressing spring 54, on the non-driven side, respectively, with regard to the plane which divides the movable member 50 into the left and right halves. Therefore, the rotation control projection 11*a* on the driven side, which is coaxial with the rotation control projection 11*b* on the non-driven side, slides on the guiding surface 51*c*, bending the CRG pressing spring 53, and reaches the rotation control surface 51*g*.

As is evident from the above description, in the case of this embodiment of the present invention, the shaft coupling member 23 is the most outward component of the process cartridge B, and therefore, the stroke of the driving force inputting member supported within the apparatus main assembly 20 of the image forming apparatus A is short.

The provision of the CRG pressing springs 53 and 54, or at least one of them, as described above, allows the user to feel the progress of the insertion of the process cartridge B into the movable member 50. Therefore, it is easier for the user to insert or remove the process cartridge B into or from the movable member 50.

The positional arrangement for the projection 11*b* (11*a*) and positioning boss 14*a* (13*a*) is as follows. Referring to FIG. 5, the vertical distance between a horizontal line 11 perpendicular to the axial line of the boss 14*a*, and a horizontal line 12 perpendicular to the axial line of the projection 11*b*, is approximately 1.35 mm. The distance between a vertical line 13 perpendicular to the axial line of the boss 14*a*, and a vertical line 14 perpendicular to the axial line of the projection 11*b*, is approximately 86.7 mn. FIG. 5 shows the state of the process cartridge B after its installation into the apparatus main assembly 20. The choice of an image forming apparatus does not need to be limited to the one described in this embodiment; it may be optionally selected.

(Portions of Image Forming Apparatus Related to Installation or Removal of Process Cartridge)

Next, referring to FIG. 5, the portions of the main assembly of the image forming apparatus related to the installation or removal of the process cartridge B will be described in detail.

The image forming apparatus main assembly 20 is provided with an opening 60 through which the movable member 50 is pushed into the image forming apparatus main assembly 20 after the installation of the process cartridge B into the movable member 50. This opening 60 is made through one of the side panels of the image forming apparatus main assembly 20, more specifically, the rear panel, that is, the panel which is on the rear side, i.e., the side opposite to the developing apparatus 4 with regard to the photosensitive drum 1, and is parallel to the longitudinal direction of the photosensitive drum 1. The image forming apparatus main assembly 20 is also provided with a pair of substantially horizontal rails(unillustrated), which are located, one for one, on the side panels of the image forming apparatus main assembly 20, perpendicular to the panel with the opening 60, and extend in the direction in which the movable member 50 is pushed into the image forming apparatus main assembly 20. These rails guide the unillustrated guiding members located, one for one, on the lateral panels of the movable member 50. Further, the image forming apparatus main assembly 20 is provided with a pair of catching portions 61, which are positioned so as to catch the cylindrical positioning bosses 13*a* and 14*a* of the process cartridge B as the movable member 50 is pushed into the image forming apparatus main assembly 20 to reach a predetermined position. The cross section of the catching member 61 is semicircular, and its open side faces the direction from which the movable member 50 is pushed into the image forming apparatus main assembly 20.

(Pull-out or Push-in of Movable Member out of or into Image Forming Apparatus Main Assembly, and Installation of Removal of Process Cartridge into or from Image Forming Apparatus Main Assembly)

Referring to FIGS. 48–51, the process in which the movable member 50 which contains the process cartridge B is pulled out of, or pushed back into, the image forming apparatus main assembly 20 will be described.

For the installation of the process cartridge B into the image forming apparatus main assembly, first, the movable member 50 is pulled out of the image forming apparatus A following the aforementioned unillustrated pair of rails, to a predetermined position. Then, the process cartridge B is inserted into the movable member 50 as described previously with reference to FIGS. 44–48. Then, the movable member 50 is pushed back into the image forming apparatus A by being pushed on the rear surface 56*a* of the pressing unit 56 located on the upstream side of the movable member 50 in terms of the direction in which the movable member 50 is pushed into the image forming apparatus A. Then, as the movable member 50 reaches a given point, the movable member pressing spring 57 (FIG. 15) is bent by the resistance generated by the returning of the movable member 50 into the image forming apparatus A. As a result, the velocity at which the pressing unit 56 moves inward of the image forming apparatus A becomes greater than the velocity at which the main assembly of the movable member 50 moves into the image forming apparatus A. Then, the hooking portions 56*b* of the pressing unit 56 located at the side edges, one for one, catch the image forming apparatus A. As a result, the main assembly of the movable member 50 settles at the predetermined position in the image forming apparatus A, remaining under the pressure generated in the direction to press the entirety of the movable member 50 against the image forming apparatus A in the direction in which the movable member 50 is pushed back into the image forming apparatus A. Then, as additional force is applied to the pressing unit 56 in the inward direction of the image forming apparatus A, the rear surface 56*a* of the pressing unit 56 becomes level with the rear panel 62 (FIG. 1) of the image forming apparatus A, it virtually becomes a part of the rear panel 62 (state illustrated in FIG. 51).

At the same time as the above described process occurs, the cylindrical positioning bosses 13*a* and 14*a* of the process cartridge B are caught, one for one, by the catching members 61 which look like an axially divided half of a cylindrical pipe, and the open sides of which face the direction from which the movable member 50 is pushed back into the image forming apparatus A. Also, the vertical bumping portions 51*f* and 52*f* of the movable member 50 come into contact with the cylindrical positioning bosses 13*a* and 14*a* of the process cartridge B. At this moment, the entirety of the movable member 50 comes under the pressure which is generated by the resiliency of the aforementioned movable member pressing spring 57, with which the pressing unit 56 is provided, in the direction to press the entirety of the movable member 50 against the cylindrical positioning bosses 13*a* and 14*a* in the downstream direction in terms of the direction in which the movable member 50 is pushed into the image forming apparatus A. Also at this moment, the cylindrical positioning bosses 13*a* and 14*a* move slightly upward away from the catching portions 51*h* and 52*h*, respectively.

In this state, the bumping portions 51*f* and 52*f* of the movable member 50 are located immediately next to the catching members 61, one for one, in terms of the longitudinal direction, and also are in contact with the peripheral surfaces of the cylindrical positioning bosses 13*a* and 14*a*, respectively. Also in this state the catching members 61 of the image forming apparatus A, and the catching portions 51*h* and 52*h* of the movable member 50, are aligned in the longitudinal direction of the photosensitive drum 1; their theoretical axial lines align with the axial line of the photosensitive drum 1. In other words, the position of the process cartridge B relative to the image forming apparatus A is fixed by a single point; the process cartridge B is prevented from horizontally moving relative to the movable member 50. Also in this state, there is an approximately 1 mm to 2 mm gap between the catching portions 51*h* and 52*h* of the movable member 50 and the cylindrical positioning bosses 13*a* and 14*a*. Further, in this state, the position of the movable member 50 in the image forming apparatus A has become fixed, and therefore, the attitude of the process cartridge B in terms of its pivotal direction about the axial line of the photosensitive drum 1 becomes fixed. The position of the pivotal center is fixed in terms of the vertical direction of the movable member 50 after the positioning of the movable member 50 relative to the image forming apparatus A. This is due to the fact that the above described structure is provided because the position of the pattern reading apparatus 93 located in the bottom portion of the movable member 50 relative to the photosensitive drum 1 must be far more strictly controlled in terms of the horizontal direction than in terms of the vertical direction As the movable member 50 reaches the predetermined point, the pressure generating member 59 of the movable member 50 located on the lateral wall of the movable member 50, on the non-driven side, comes into contact with the corresponding panel (unillustrated) of the image forming apparatus A. Therefore, the movable member 50 is pressed toward the driven side in the image forming apparatus A. As a result, the movable member 50 comes in contact with the inward surface of the lateral panel of the image forming apparatus A, on the driven side, becoming fixed in terms of the longitudinal direction. In this state, the position of the process cartridge B relative to the movable member 50 in terms of the longitudinal direction of the process cartridge B has already become fixed, and therefore, the position of the process cartridge B relative to the image forming apparatus A in terms of the longitudinal direction of the process cartridge B also became fixed as the movable member 50 came in contact with the inward surface of the lateral panel of the image forming apparatus A, on the driven side.

In the cases of the above described processes, the cylindrical positioning bosses 13*a* and 14*a* of the process cartridge B are pinched by the catching members 61 for positioning the main assembly of the movable member 50, and the bumping portion 51*f* and 52*f* of the movable member 50, which are under the pressure applied by the aforementioned pressure generating member. Therefore, the positions of the apparatus main assembly 20, the process cartridge B, and the movable member 50 in terms of the horizontal direction are fixed at a single point, not requiring additional positioning members for accurately positioning the axial line of the photosensitive drum 1 relative to the image forming apparatus A and movable member 50. Therefore, the size of the image forming apparatus is reduced. Further, the theoretical axial lines of the catching members 61 of the main assembly of the image forming apparatus A, and the catching members 51*h* and 52*h* of the movable member 50, are aligned with the axial line of the photosensitive drum 1, reducing the image-forming-apparatus size. Further, the single pressure generating spring 59 with which the movable member 50 is provided carries out two functions: a function to keep the process cartridge B accurately positioned by causing the process cartridge B to come in contact with the lateral wall of the movable member 50, on the driven side, during the insertion of the process cartridge B into the movable member 50, and a function to keep the movable member 50 accurately positioned by causing the movable member 50 to come into contact with the lateral panel of the apparatus main assembly 20, on the driven side, during the pushing of the movable member 50 into the apparatus main assembly 20. As a result, it is assured that the driving force receiving means, that is, the driving force transmitting means on the photosensitive drum 1 side, is kept on the driven side, minimizing the driving force input stroke, simplifying the structure of the means for transmitting the driving force to the process cartridge B. Therefore, it is assured that the driving force is reliably transmitted to the photosensitive drum 1.

(Prevention of Erroneous Process Cartridge Insertion)

Figure 51:
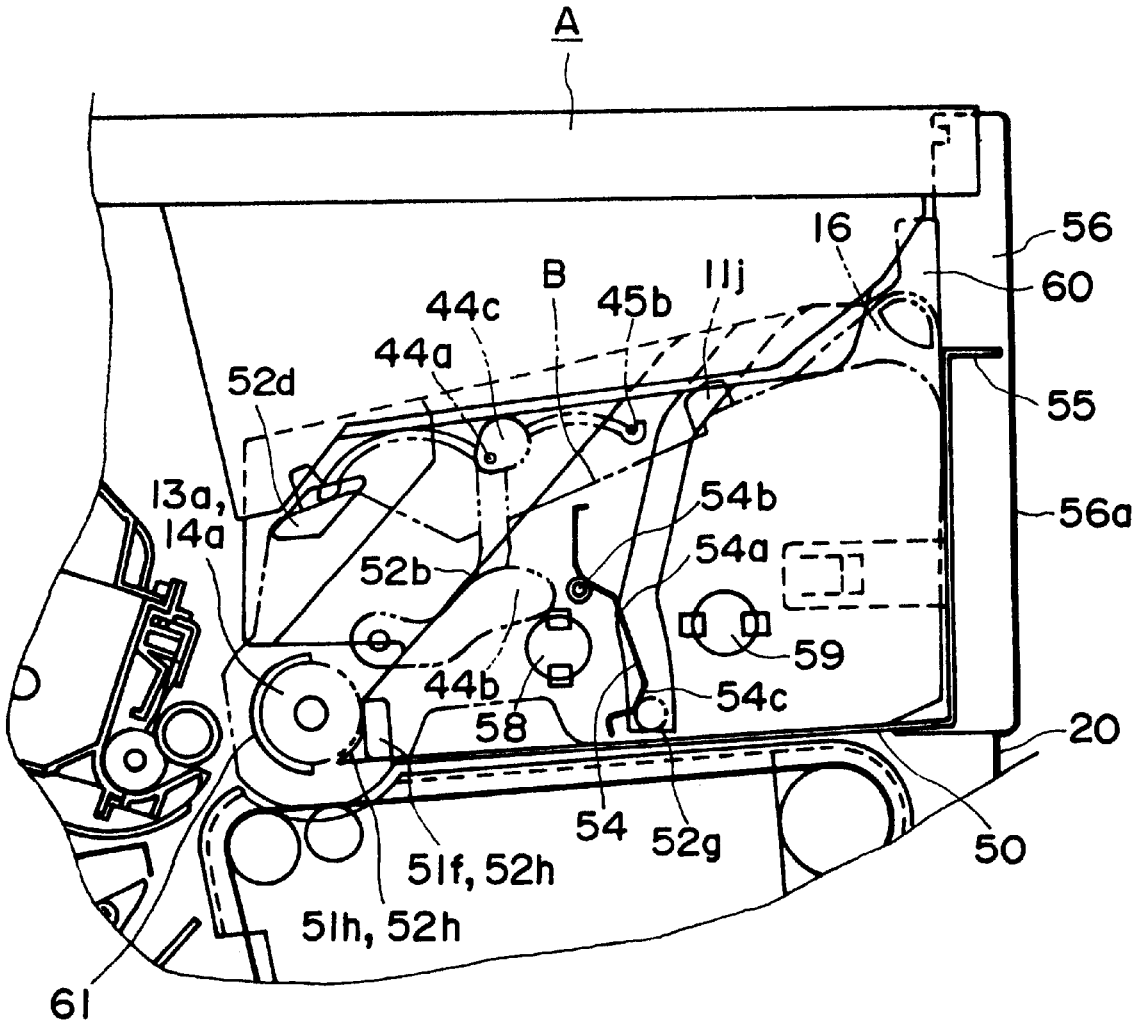
FIG. 51 is a side view showing mounting-and-demounting of the process cartridge and the movable member relative to the image forming apparatus and opening and closing of the drum shutter.
Figure 52:
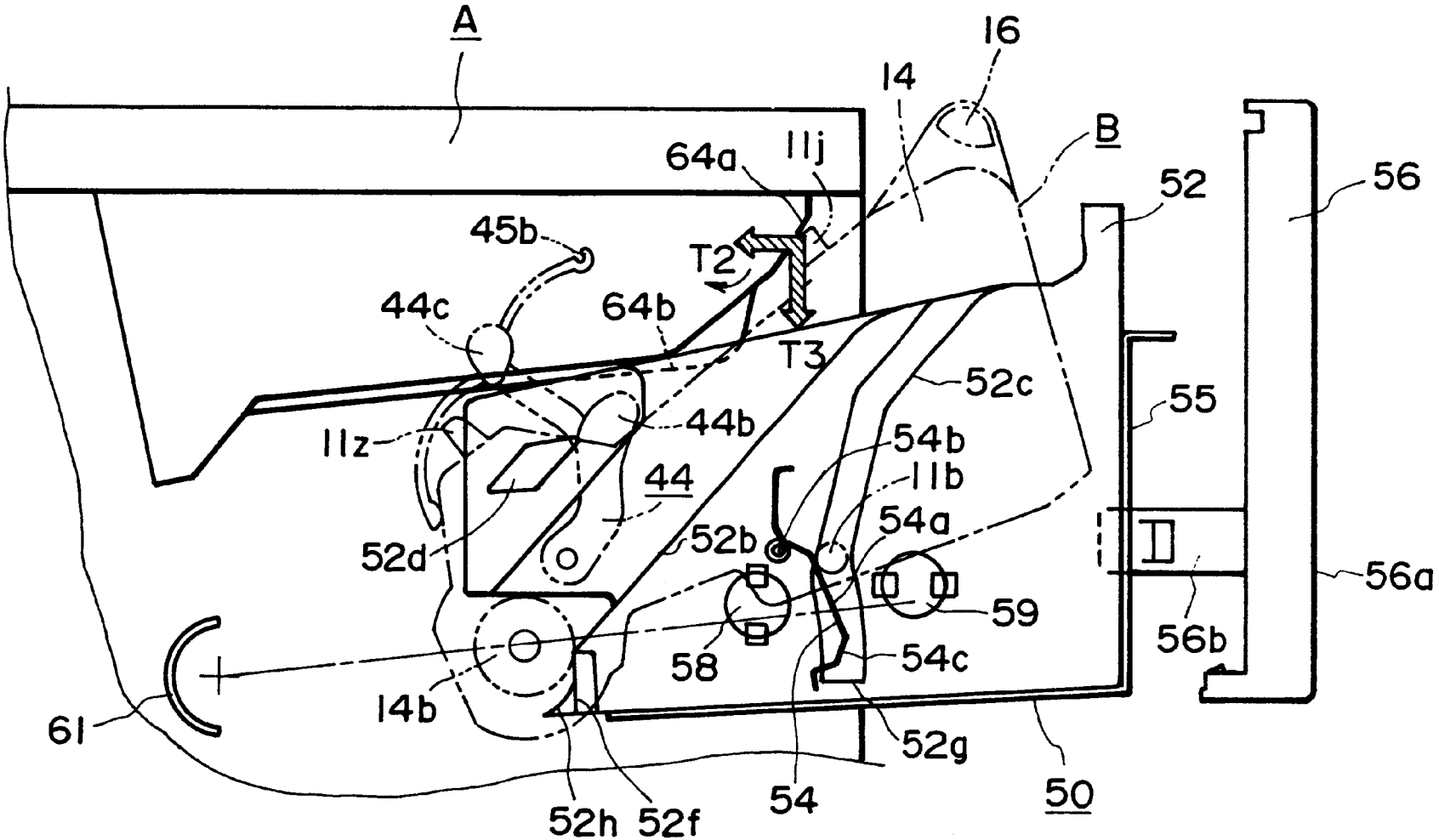
FIG. 52 is a side view illustrating the erroneous insertion state of a process cartridge into the image forming apparatus.

Referring to FIGS. 47, 51 and 52, prevention of erroneous process cartridge insertion will be described.

The process cartridge B is provided with a plurality of erroneous insertion prevention projections 11*j* with a height of approximately 5 mm, one of which is located on the top surface of the process cartridge B, on the downstream side in terms of the direction in which the movable member 50 is pushed into the apparatus main assembly 20. With the provision of this projection 11*j* on top of the process cartridge B, a gap of approximately 1 mm in kept between the highest point of the erroneous insertion prevention projection 11*j* and the inward surface of the scanner cover 64 of the apparatus main assembly 20 as shown in FIG. 15. The erroneous insertion prevention projections 11*j* are as on upward facing surfaces of the side cover 13, on the driven side, cleaning means housing 11, and end cover 14, on the non-driven side, one for one, and project upward.

When the process cartridge B in the movable member 50 is in the state illustrated in FIG. 47, that is, when the rotation control projection 11*b* of the process cartridge B has temporarily stopped adjacent to the top portion of the CRG pressing spring 54 in the movable member 50, as soon as a slight downward load is applied by the user, the rotation control projection 11*b* of the process cartridge B normally slips past the CRG pressing spring 54, and glides downward until the process cartridge B finally settles at the predetermined position in the movable member 50. However, if the user fails to perform this expected action, the movable member 50 is pushed into the image forming apparatus A while the process cartridge B remains in the state illustrated in FIG. 47. Then, first, the erroneous insertion prevention projection 11*j* of the process cartridge B bumps into the bottom surface 64*a* of the bottom cover of the scanner within the image forming apparatus A (FIG. 52). The bottom surface 64*a* of the bottom cover 64 is slanted downward from the upstream side to the downstream side, in terms of the direction in which the movable member 50 is pushed into the apparatus main assembly 20, so that the inclination is gradually reduced in the downstream direction. Therefore, as the movable member 50 is pushed, the downward component T3 of the force T2 generated by the pushing of movable member 50 applies to the process cartridge B. Thus, the rotation control projection 11*b* (also, 11*a* on the driven side) is caused to slip past the CRG pressing spring 54 (53 on the driven side), by this downward force T3, and the process cartridge B settles at the predetermined position in the movable member 50 as shown in FIG. 51.

In other words, the simple structural provision, i.e., the provision of a simple projection on the top surface of the process cartridge B, causes the process cartridge B to settle at the predetermined position even when the user pushes the movable member 50 into the apparatus main assembly 20 with the process cartridge B incorrectly positioned.

The above description was made with reference to the non-driven side. The actions which occur on the driven side are substantially the same as those described above.

The cleaning means housing portion 11 may be the only one on which the erroneous insertion prevention projection 11*j* is integrally formed, or the side cover and end cover 14 may be the only ones on which the erroneous insertion prevention projection 11*j* is integrally formed. Further, there is no numerical restriction regarding the erroneous insertion prevention projection 11*j*. In other words, the number of the erroneous insertion projection 11*j* may be only one, and the cleaning means housing portion 11 may be the only one on which a single erroneous insertion prevention projection 11*j* is strategically located in terms of the longitudinal direction of the process cartridge B.

The structures described above may be summarized as follows.

Regarding the electrophotographic image forming apparatus, and the process cartridge B removably installable in the main assembly of the image forming apparatus, the main assembly of the image forming apparatus is provided with a drawer(movable member 50), which is movable relative to the apparatus main assembly, and can take two positions: an outward position, i.e., a position at which it is projecting from the main assembly, being readied for insertion or removal of the process cartridge B, and an inward position, i.e., a position at which it is in the apparatus main assembly. The process cartridge B comprises: the housing 10; an electrophotographic photosensitive drum (photosensitive drum 1); one or more processing means (for example, charging apparatus 2 or cleaning apparatus 6) that work on the electrophotographic photosensitive member; and contact portions (projections 11) that make contact with the contact portion (bottom surface 64*a* of bottom cover 64 of scanner), with which the apparatus main assembly is provided, during the process in which the drawer is moved to the image formation point, with the process cartridge B in the drawer. The contact portions of the process cartridge B are located on one of the external surfaces of the housing 10 of the process cartridge B, that faces upward when the process cartridge B is installed into the apparatus main assembly. More specifically, the contact portions are on the left and right edges of the process cartridge B in terms of the longitudinal direction of the process cartridge B, adjacent to the longitudinal ends of the electrophotographic photosensitive drum.

Further, the contact portions of the process cartridge B are located on the upstream side of the electrophotographic photosensitive member in terms of the inserting direction of the process cartridge B.

The process cartridge B is also provided with a first projection (positioning boss 13*a*) which projects outward from the outward surface of one of the lateral walls of the housing 11 of the process cartridge B, in alignment with the electrophotographic photosensitive drum in the form of a drum, and a second projection (projection 11*a*), which also projects from the same surface as the first projection, and is positioned on the upstream side of the first projection in terms of the direction in which the process cartridge B is installed into the apparatus main assembly. Further, the process cartridge B is provided with a third projection (positioning projection 14*a*), which projects outward from the outward surface of the other of the lateral walls of the housing 11 of the process cartridge B, in alignment with the first projection, and a fourth projection (projection 11*b*) which projects outward from the same surface as the third projection, in alignment with the second projection. The positions of the first and third projections are fixed relative to the apparatus main assembly or drawer, whereas the positions of the second and fourth projections are fixed relative to the drawer.

The contact portion of the process cartridge B is positioned so that it will be above the second and fourth projections after the installation of the process cartridge B into the apparatus main assembly.

The contact portion of the apparatus main assembly is a part of the bottom cover of the scanner with which the apparatus main assembly is provided.

(Structural of Drum Shutter)

Referring to FIGS. 4–8, 11, 12, 44–50 and 53, the structure of the drum shutter will be described.

The process cartridge B is provided with the drum shutter 18, i.e., a member which is opened or closed to expose or cover the photosensitive drum 1. When the process cartridge B is out of the apparatus main assembly 20 of the image forming apparatus A, the drum shutter 18 is closed to cover the peripheral surface of the photosensitive drum 1 to prevent the photosensitive drum 1, in particular, the peripheral surface of the photosensitive drum 1, from being damaged, or prevent the photosensitive layer from being deteriorated due to its exposure to the external light, while the process cartridge B is handled outside the apparatus main assembly 20, whereas as the process cartridge B is installed into the apparatus main assembly 20 of the image forming apparatus A, it is opened to expose the photosensitive drum 1, across the portion where the image forming light is focused, and which faces the developing apparatus 4 and transferring unit 5.

Figure 53:
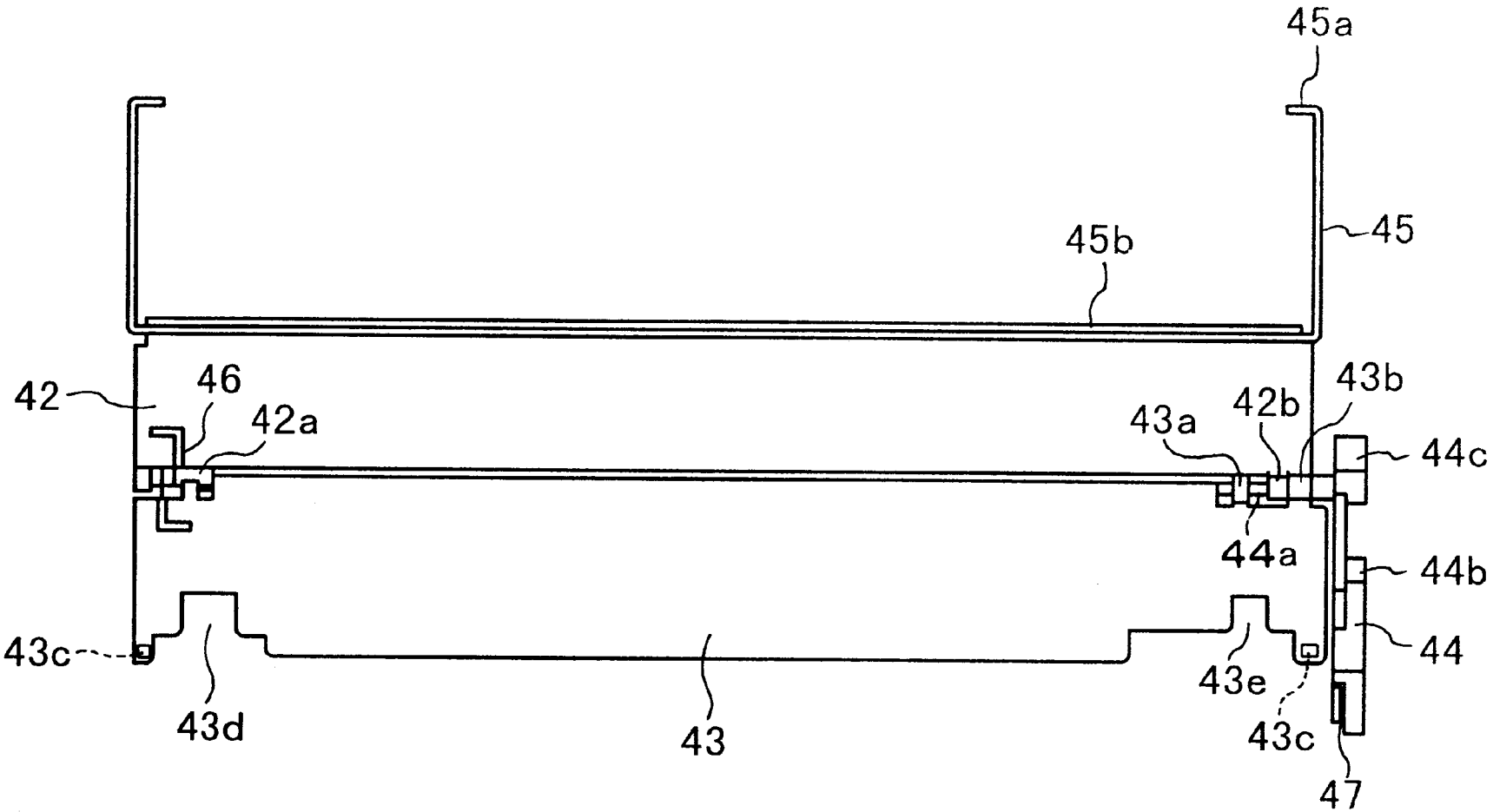
FIG. 53 is a top plan view of a drum shutter.

Referring to FIGS. 4 and 5, the gear cover 13 and end cover 14 are provided with holes 13*f* and 14*f*, respectively, in which pivot axes 45*a*, which are parts of the arm 45, are fitted. In fact, a single component integrally comprises the left and right pivot axes 45*a*, left and right arms 45, and a shaft 45*b*. The shaft 45*b* extends in the longitudinal direction of the process cartridge B and connects the left and right arms 45. The shaft 45*b* rotationally supports the drum shutter 18. More specifically, the drum shutter 18 comprises a first shutter cover 42, i.e., the first piece of the drum shutter as counted from the top side of the process cartridge B, and a second shutter cover 43, i.e., the second piece of the drum shutter as counted from the top side of the process cartridge B, and the shaft 45*b* is rotationally fitted in the grooves made in the outward surface of the first shutter cover 42 along the edge on the top side. The other edge of the first shutter cover 42 is joined with the second shutter cover 43. At one of the longitudinal ends of the bottom edge of the first shutter cover, the first and second shutter covers 42 and 43 are joined, with the use of the pin shaft 42*a*, and this pin shaft 42*a* is fitted with a torsional coil spring 46, that is, a resilient member as a pressure generating member, as shown in FIGS. 3 and 53. At the other longitudinal end of the bottom edge of the first shutter cover 42, the first and second shutter covers 42 and 43 are joined, with the use of a shaft 44*a*, which is integrally formed with an operational arm 44, that is, an arm-shaped shutter supporting member, and is put through the hole 42*b* of the first shutter cover 42, and the hole 43*c* of the second shutter cover 43. After the joining of the two shutter covers 42 and 43, the axial lines of the pin shaft 42*a* and shaft portion 44*a* coincide with each other.

When the process cartridge B is seen from the direction perpendicular to the inserting direction of the process cartridge B, with the drum shutter 18 closed, the first and second shutter covers 42 and 43 form an arc, the center of which is concentric with the center of the photosensitive drum 1, and the radius of which is greater than the radius of the photosensitive drum 1. The drum shutter 18 also covers both the drum supporting portions 11*d* (FIG. 10) across the surfaces perpendicular to the inserting direction of the process cartridge B. Also, as seen from the side, the bottom edge 11*d*1 of the drum supporting portion 11*d* is in the form of an arc, the center of which is concentric with the center of the photosensitive drum 1. The front edge 11*d*2 of the drum supporting portion 11*d* forms an almost straight line which intersects with the arc which the bottom edge 11*d*1 forms. In fact, it slightly projects frontward, forming a peak at the center. The second shutter cover 43 is provided with a shoe 43*c*, which is located at the longitudinal end to snugly fit with the bottom and front edges 11*d*1 and 11*d*2. Also, as seen from the side, the shoe 43*c* forms an arc. Referring to FIG. 53, the shoes 43*c* are provided one for one at both longitudinal ends of the second shutter cover 43. The shoe 43*c* which fits with the front edge 11*d*2 on the driven side projects more in the direction parallel to the radial direction of the photosensitive drum 1 than the shoe 43*c* which fits with the front edge 11*d*2 on the non-driven side. The bottom and front edges 11*d*1 and 11*d*2 function as guide portions which define the locus of the second shutter cover 43. The front and bottom edges 11*d*2 and 11*d*1 of the drum supporting portion 11*d* on the driven side perfectly align with the edge of the front portion of the side cover 13. The front portion 14*h* of the drum supporting portion 11*d* on the non-driven side is in the form of an arc, as seen from the side. The front shoe 43*c* of the second shutter cover 43 is guided by the front portion 14*h*, by sliding on the front portion 14*h*. With the provision of the above-described structure, even if the process cartridge B is directly placed on a flat surface, the inward surface of the second shutter cover 43 is prevented from touching the photosensitive drum 1, except for the longitudinal ends of the photosensitive drum 1. The operational arm 44 comprises a first cam portion 44*b* as the first contact portion, and a second cam portion 44*c* as the second contact portion, which are necessary for opening or closing the drum shutter 18, and are integrally formed parts of the arm portion 44. The pivotal center portion of the operational arm 44 is fitted around the pivotal shaft 14*d* provided on the end cover 14 on the non-driven side by being integrally molded with the end cover 14.

Figure 11:
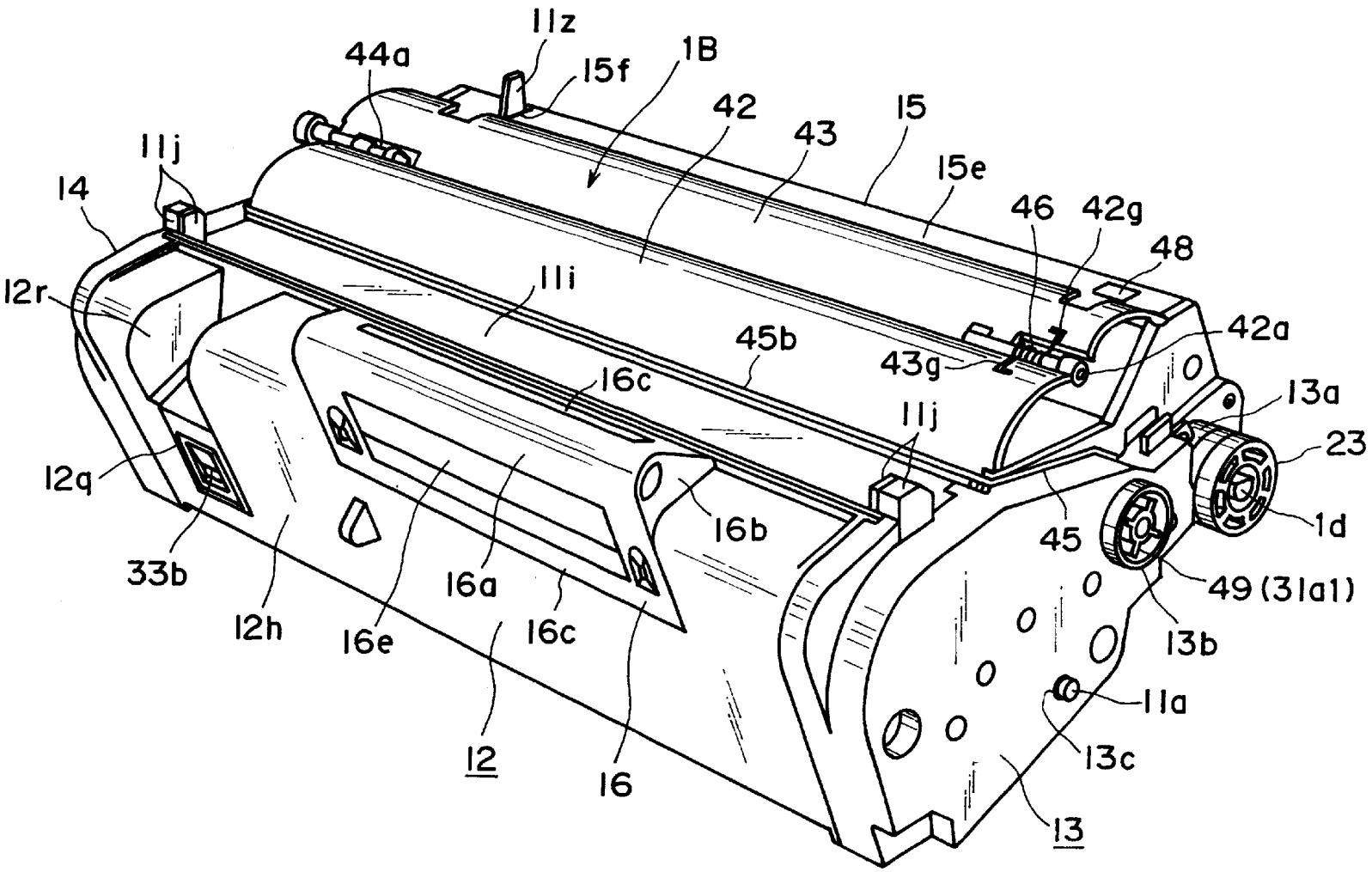
FIG. 11 is a perspective view of an outer appearance as seen from rear, right and upper part of the process cartridge shown in FIG. 3.

Referring to FIG. 11, both ends of the torsional coil spring 46 are bent in the shape of a key. The torsional coil spring 46 is fitted around the pin shaft 42*a*, the key-shaped ends of the spring 46 fitting in the spring seating grooves 42*g* and 43*g* cut in the same shape as the key-shape end of the spring 46, in the outward surfaces of the first and second shutter covers 42 and 43, respectively, so that the torsional coil spring 46 generates pressure in the direction to cause the inward surfaces of the first and second shutter covers 42 and 43 to approach each other. Since both end portions of the torsional coil spring 46 are seated in the corresponding spring seating grooves 42*g* and 43*g*, they do not entangle with each other during the movement of the drum shutter 18.

Referring to FIG. 5, the pivot center portion of the operational arm 44 is fitted around the pivotal shaft 14*d*. The pivotal shaft 14*d* is also fitted with a torsional coil spring 47. One end of the torsional coil spring 47 is fixed to a spring seat portion 14*e* provided on the end cover 14 by being integrally formed with the end cover 14, and the other end is fixed to the operational arm 44, to a portion of the operational arm 44 which is invisible from outside, so that the torsional coil spring 47 generates pressure which applies to the operational arm 44 in a manner to press the operational arm 44 about the pivotal center shaft 14*d*, in the counterclockwise direction.

The second shutter cover 43 is provided with a mechanism (unillustrated) for supplying the charging apparatus with high voltage current after the drum shutter 18 is retracted (completely opened), and recessed portions 43*d* and 43*e* (FIGS. 7 and 53) for providing clearance for the ribs for opening or closing a laser shutter which blocks the laser beam emitted from the scanning apparatus. The aforementioned front portion 14*h* with an arc-like curvature is an integrally molded part of the end cover 14. This "arc" is concentric with the circumference of the photosensitive drum 1, and is slightly larger in radius than the photosensitive drum 1.

With the provision of the above described structural configuration, three components, that is, the operational arm and the first and second shutter covers, can be joined all at once simply by connecting the first and second shutter covers by the shaft portion of the operational arm, which contributes to the improvement in assembly efficiency. In the preceding description, the point of the drum shutter to which the operational arm is attached coincides with the joint between the first and second shutter covers. However, the operational arm may be connected to a point of the first shutter cover different from the joint between the first and second shutter covers.

(Mechanism for Opening or Closing Drum Shutter)

Referring to FIGS. 44–54, the mechanism for opening or closing the drum shutter will be described.

The mechanism for opening or closing the drum shutter, which is disclosed in this embodiment, is a so-called quadri-joint mechanical linkage. The second shutter cover 42 connected to the quadri-joint mechanical linkage is caused to always open or close along the housing 10 of the process cartridge B, by the torsional coil spring 46. The pivotal center shaft 14*d*, which functions as the supporting axis for the quadri-joint mechanical linkage, and the pivotal axis 45*a*, are positioned so that the radii of the arcs which the first and second shutter covers 42 and 43 describe when they are opened or closed become as small as possible, and the line which connects the pivot shaft 14*d* for supporting the operational arm 44, and the pin shaft 42*a* (shaft portion 44*a*), that is, the first rotation point, at which the first and second shutter covers 42 and 43 are joined, does not intersect with the line which connects the pivot axis portion 45*a* and the longitudinal shaft portion 45*b*, that is, the second rotation point, of the arm 45.

As the process cartridge B is moved into the movable member 50, the cylindrical guiding portion 14*b* on the front side of the side wall of the process cartridge B, and the rotation control projection 11*b*, slide along the guiding surfaces 52*b* and 52*c*, respectively, and then, the advancement of the first cam portion 44*b* of the operational arm 44 is blocked by a cam catching surface 52*d*, which is integrally formed with the guiding member 52 of the movable member 50, and projects inward of the movable member 50 (state depicted in FIG. 45). Then, as the process cartridge B is pushed inward in this state, the first cam portion 44*b* slides forward along the surface of the cam catching surface 52*d* in the movable member 50. During this movement of the process cartridge B, the operational arm 44 is pivoted upward about the axial line of the Pivot shaft 14*d*, against the resiliency of the torsional coil spring 47, while lifting the pin shaft 42*a* at the first rotation point and the shaft 45*b* of the second rotation point. As a result, the first and second shutter covers 42 and 43 move upward, and the pair of sheets 43*c* located, as guiding portions, at both the longitudinal ends of the second shutter cover 43, are moved upward along the bottom edge 11*d*1 and front edge 11*d*2 of the drum supporting portion 11*d*, and the edge 14*h* of the end cover 14 aligned in rows, and in contact, with the drum supporting portion 11*d*, respectively, by the resiliency of the torsional coil spring 46 which works in the direction to inwardly fold the first and second shutter covers 42 and 43 toward each other (FIGS. 44–45–46).

Figure 48:
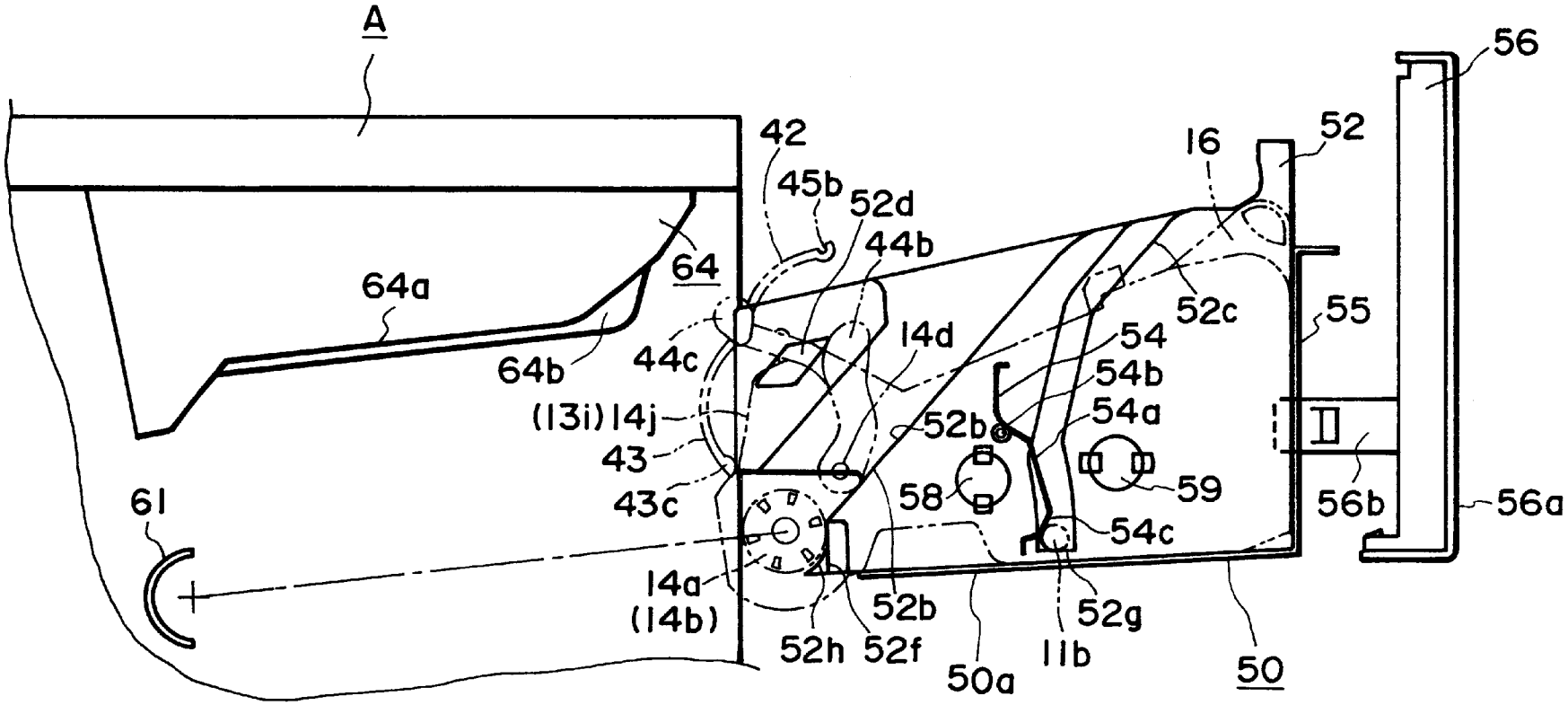
FIG. 48 is a side view showing a relation between the drum shutter and the mounting-and-demounting of the process cartridge relative to the movable member.
Figure 49:
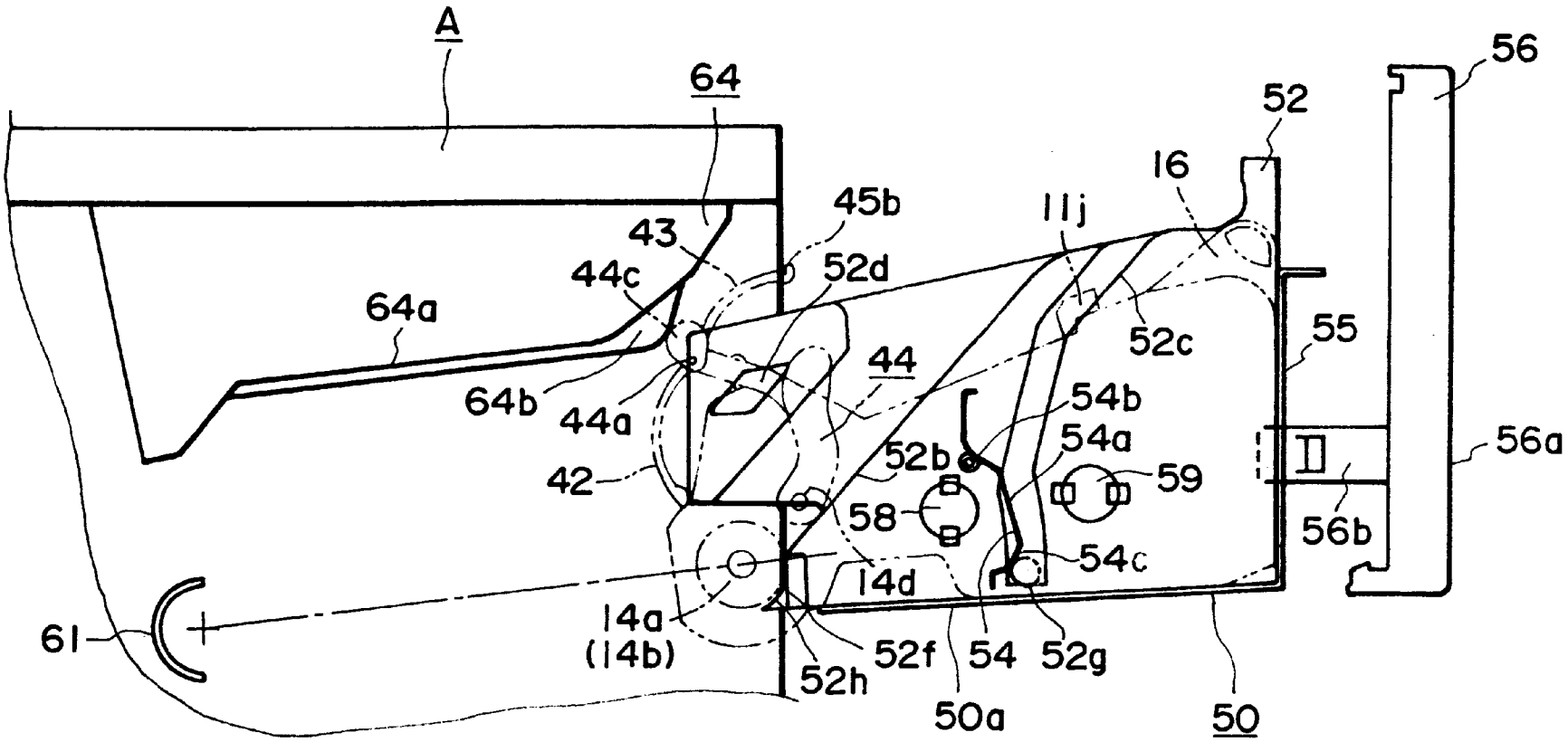
FIG. 49 is a side view showing mounting-and-demounting of the process cartridge and the movable member relative to the image forming apparatus and opening and closing of the drum shutter.

As described above, on the driven side, the drum supporting portion 11*d*, and the front end of the side cover 13, are placed in parallel in contact with each other, and the edge 13*h* of the side cover 13 and the front edge 11*d*2 of the drum supporting portion 11*d*, which align with each other, are virtually vertical, that is, protruding frontward like a very dull wedge. Therefore, the position of this virtually vertical front edge 11*d*2 is on the inward side of the peripheral surface of the photosensitive drum 1 in terms of the radial direction of the photosensitive drum 1. On the driven side, the shoe 43*c* sticks out beyond the corresponding shoe 43*c* on the non-driven side, in terms of the radial direction of the photosensitive drum 1. Therefore, the free end portion of the second shutter cover 43 does not come into contact with the peripheral surface of the photosensitive drum 1, on the driven side, even though the process cartridge B is structured so that the contact surface of the shoe 43*c* on the driven side comes into contact with the front edge 11*d*2, at a location which is on the outward side of the photosensitive drum 1 in terms of the longitudinal direction of the photosensitive drum 1, and on the inward side of the peripheral surface of the photosensitive drum 1 in terms of the radial direction of the photosensitive drum 1. On the non-driven side, the shoe 43*c* slides up along the edge of the drum supporting portion 11*d*, which is on the outward side of the peripheral surface of the photosensitive drum 1 in terms of the radial direction of the photosensitive drum 1, and the arc-like edge 14*h* of this end cover 14. Then, the first and second shutter covers 42 and 43 move upward along the front edges 13*j* and 14*j* (FIG. 47) of the side walls 13*i* and 14*i* (FIGS. 6 and 10) of the trapezoidal charging apparatus cover 15. Next, the process cartridge B rotates about the cylindrical bosses 13*a* and 14*a* caught by the catching portions 51*h* and 52*h*, in such a manner that the rear portion of the process cartridge B lowers. As a result, the rotation control projections 11*a* and 11*b* move downward and contact the rotation control surfaces 51*g* and 52*g*, and at the same time, the part of the first cam portion 44*b*, which has come around the cam catching surface 52*d*, and down to the position on the right side and diagonally below the cam catching surface 52*d*, descends. Therefore, the first and second shutter members 42 and 43 move back slightly in their closing direction, and the shoes 43*c* slide down along the corresponding front edges 13*j* and 14*j* of the side walls of the trapezoidal charging apparatus cover 15, to their bottom ends (FIGS. 47 and 48). In other words, as the process cartridge B settles down at the predetermined position in the movable member 50, the first and second shutter covers 42 and 43 close slightly, yet leaving the photosensitive drum 1 fully exposed (state depicted in FIG. 48).

Figure 50:
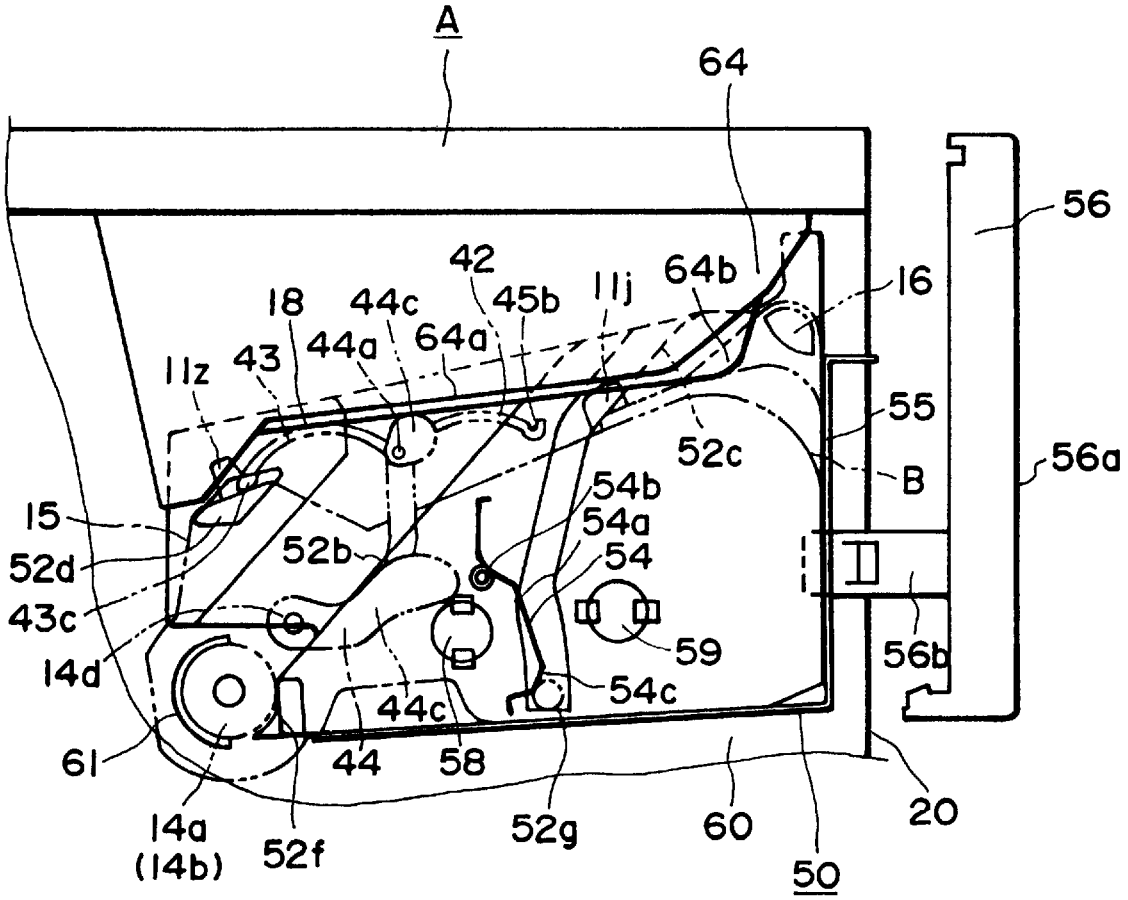
FIG. 50 is a side view showing mounting-and-demounting of the process cartridge and the movable member relative to the image forming apparatus and opening and closing of the drum shutter.

Next, the movable member 50 is pushed into the image forming apparatus A. As the movable member 50 is pushed into the image forming apparatus A, the second cam portion 44*c* comes into contact with the cam catching rib 64*b* formed on the bottom surface of the bottom cover of the scanner (state depicted in FIG. 49). As the movable member 50 is pushed in further, the second cam portion 44*c* slides on the cam catching rib 64*b*, while pivoting upward about the pivot shaft 14*d* against the resiliency of the torsional coil spring 47, and the first rotation point corresponding to the shaft portion 44*a* (42*a*, on the driven side) which rotationally connects the first and second shutter covers 42 and 43, and the second rotation point corresponding to the shaft 45*b* which is rotationally connected to the edge of the first shutter cover 42, are moved upward. As a result, the first and second shutter covers 42 and 43 are moved upward into a space which is on the rear side of the charging apparatus cover 15, and under the bottom cover 64 of the scanner. In other words, the drum shutter 18 is stored in the space behind the charging apparatus cover 15 and under the bottom cover 64 of the scanner after exposing the photosensitive drum 1, as depicted in FIGS. 11 and 50.

During the above described drum shutter opening-closing sequence, the shoes 43*c* which function as the guide portions for the second shutter cover 43 are caused to slide on the bottom and front edges 11*d*1 and 11*d*2 of the drum supporting portions 11*d*, i.e., the front portion of the left wall of the housing 10 of the process cartridge B and the front portion of the right wall of the housing 10 of the process cartridge B, in terms of the inserting direction of the process cartridge B, and the arc-like edge 14*h* on the non-driven side. Therefore, the drum shutter 1 will not be damaged by the shutter covers during the opening or closing of the drum shutter.

Further, the arm 45, the operational arm 44, the first shutter cover 42, and the cleaning means housing portion 11 to which the side and end covers 13 and 14 are attached, form the quadri-join mechanical linkage, and the first and second shutter covers 42 and 43 are connected by the pin shaft 42*a* and shaft portion 44*a* corresponding to the first rotation point of this quadri-joint mechanical linkage, and are kept under the pressure applied by the torsional coil spring so that the pivot about the pin shaft 42*a* and shaft portion 44*a* in the direction to approach each other on their inward sides. Therefore, even though the first and second shutter covers 42 and 43 are enabled to expose the peripheral surface of the photosensitive drum 1 by no less than 180 degrees in terms of the center angle of the photosensitive drum 1, their loci remain close to the peripheral surface of the photosensitive drum 1, and also they can be parked in a narrow space above the top surface 11*i* of the cleaning means housing 11, with out affecting the positional arrangement of the developing apparatus 4, the transferring unit 5, and the like, on the image forming apparatus A side.

Further, the drum shutter 18 is opened or closed in two steps with the provision of the first and second cam portions 44*b* and 44*c* which function within the movable member 50 and within the image forming apparatus A, respectively, enabling the elimination of the need for a short stroke mechanism which tends to tax the apparatus with a substantial amount of load, or a costly mechanism, for example, a mechanism which employs a gear train or the like to provide the drum shutter with a faster pivotal velocity.

Further, the drum shutter 18 is automatically opened by the inward movement of the process cartridge B into the movable member 50 which occurs when the process cartridge B is inserted into the movable member 50. Therefore, a specific step for opening the drum shutter 18 is unnecessary.

Further, the second shutter cover 43 is provided with the shoes 43*c* as a guiding portion, which is integrally formed with the second shutter cover 43, and is located at the edge thereof, and the shoes 43*c* slide on the edge of the supporting member for the photosensitive rum 1. Therefore, there is no possibility that the photosensitive drum 1 will be damaged by the drum shutter itself during the opening or closing of the drum shutter. It should be noted here that in order to eliminate such a possibility, the housing of a process cartridge may be provided with drum shutter guides, the positions of which are on the outward side of the position of the peripheral surface of the photosensitive drum 1 in terms of the radial direction of the photosensitive drum 1, or both the shutter cover and housing of the process cartridge B may be provided with guide portions, instead of providing the drum shutter with the shoes 43*c*.

(Mechanism for Opening or Closing Laser Shutter)

Figure 54:
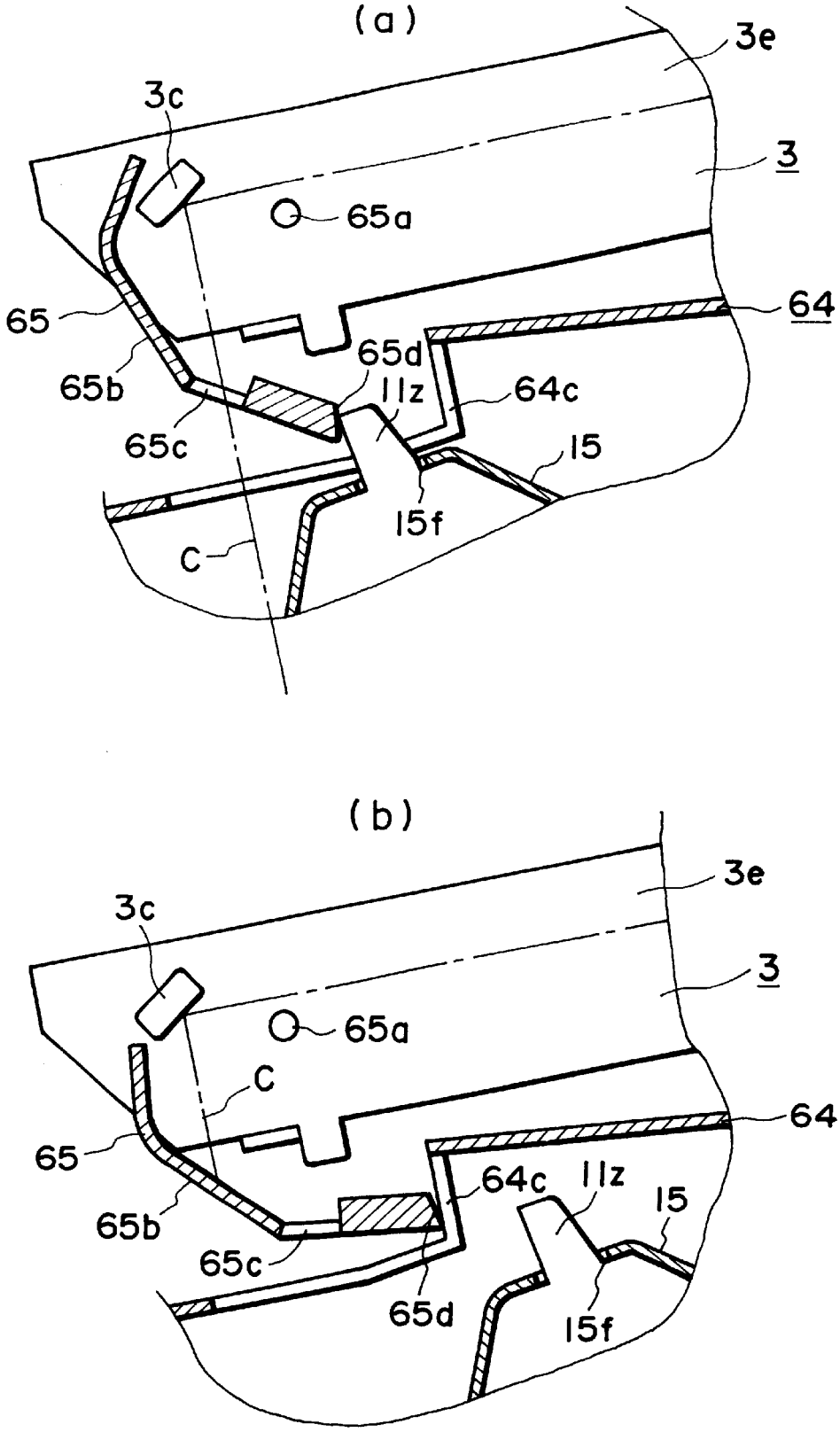
FIG. 54 is a longitudinal sectional view illustrating an opening and closing of a laser beam shutter.

Referring to FIG. 54, the structure of the mechanism for opening or closing the laser shutter will be described.

During image formation, a beam of laser light C is projected from the laser beam emitting means as the exposing means 3 to expose the photosensitive drum 1 to form a latent image, whereas when not forming an image, a laser shutter 65 is closed to block the path of the laser beam C so that the laser beam C does not leak from the apparatus. Referring to FIG. 54, the laser shutter 65 is supported by a case 3*e* which houses the exposing means 3, being enabled to pivot about a supporting point 65*a*. The laser shutter 65 comprises a shielding panel 65*b*, which extends in the longitudinal direction of the photosensitive drum 1 across the entire width of the laser beam C path to block the laser beam C. As the laser shutter 65 is opened, an opening 65*c* is formed to allow the laser beam C to pass. The laser shutter 65 also comprises a cam portion 65*d* which is necessary for opening or closing the laser shutter 65. The cam portion 65*d* extends from one of the longitudinal ends of the shielding panel 65*b*, that is, the one on the driven side, in terms of the longitudinal direction of the photosensitive drum 1. Further, the laser shutter 65 is provided with a torsional coil spring (unillustrated), which is fitted around the supporting shaft 65*a* to apply clockwise pressure upon the laser shutter 65.

The exposing means 3 and the bottom portion of the laser shutter 65 are covered with the bottom cover 64 of the scanner, which is provided with a slit 64*c*, the location of which corresponds to the cam portion 65*d* for opening or closing the laser shutter 65. Because the width of the slit 64*c* in terms of the direction in which the movable member 50 is pushed into the apparatus main assembly 20 is only 5 mm or so, it is impossible for the use to intentionally open the laser shutter 65 when the process cartridge B is out of the image forming apparatus A.

The process cartridge B is provided with a rib 11*z* for opening or closing the laser shutter 65, which is integrally formed as a part of the cleaning means housing portion 11, and the location of which is on the top surface and corresponds to the aforementioned slit 64*c* of the bottom cover 64 of the scanner. The width of the rib 11*z* in terms of the direction in which the movable member 50 is pushed into the apparatus main assembly 20 is approximately 3 mm. The rib 11*z* protrudes above the charging apparatus cover 15 through the opening 15*f* with which the charging cover 15 is provided.

Next, the sequence for opening or closing the laser shutter 65 will be described. When the movable member 50 (unillustrated in FIG. 54) into which the process cartridge B has been inserted has not been pushed into the opening of the apparatus main assembly 20, the laser shutter 65 for the exposing means 3 is closed, and therefore, even if the power source for the image forming apparatus A is turned on, the laser beam C emitted from the exposing means 3 is blocked by the shielding panel 65*b* of the laser shutter 65, being prevented from leaking out of the apparatus (state deposited in FIG. 54, (*b*)). Then, as the movable member 50 (unillustrated) which contains the process cartridge B is pushed into the apparatus main assembly 20, the laser shutter opening rib 11*z* of the process cartridge B for opening or closing the laser shutter 65 comes into contact with the laser shutter opening cam portion through the slit 64*c* of the bottom cover 64 of the scanner. Then, as the movable member 50 is pushed in further, the laser shutter 65 is pivoted clockwise about the supporting shaft 65*a* against the torsional coil spring (unillustrated). Then, as the movable member 50 finally settles as the predetermined location (state in FIG. 54, (*a*)), the laser shutter 65 is completely opened. In this state, as the power source for the image forming apparatus A is turned on, the laser beam C emitted from the exposing means 3 is allowed to reach as far as the photosensitive drum 1 (unillustrated in FIG. 54) through the opening 65*c* of the laser shutter 65.

As described above, the laser shutter opening rib 11*z* is integrally formed with the cleaning means housing portion 11. Therefore, the combined amount of the tolerances afforded for the cam surface portion 65*d* of the laser shutter 65 of the apparatus main assembly 20 and the laser shutter opening rib 11*z* of the process cartridge B is small, eliminating the possibility that the laser shutter 65 fails to be opened due to the failure of the laser shutter opening rib 11*z* to come into the shutter opening cam surface 65*d* of the laser shutter 65.

The above described sequence may be summarized as follows.

The above described sequence relates to the image forming apparatus A and the process cartridge B removably installable into the main assembly of the image forming apparatus A. The apparatus main assembly comprises the means (exposing means) for emitting the laser beam C, and the laser shutter 65 for blocking the laser beam C emitted from the laser beam emitting means. The shutter is supported in a way that allows it to take the operational position for blocking the laser beam C and the position to which it retracts from the operation position to pass the laser beam C. The process cartridge B comprises: the housing 10, electrophotographic photosensitive member (photosensitive drum 1), charging means (charging apparatus 2) for charging the electrophotographic photosensitive member, charging bias contact point 48 for receiving the charge bias to be applied to the charging means from the apparatus main assembly. The charging bias contact point 48 is attached to the apparatus main assembly, and is exposed from one of the walls of the housing 11, which faces upward after the installation of the process cartridge B into the apparatus main assembly. The process cartridge B also comprises the contact portion (rib 11*z*), which comes into contact with the laser shutter of the main assembly, to move the laser shutter, which is at the aforementioned operational position, to the retread position, during the installation of the process cartridge B into the apparatus main assembly. The contact portion (rib 11*z*) projects from a portion of the housing 10 of the process cartridge B.

The position of the charge bias contact corresponds to the position of one of the longitudinal ends of the charging roller, and the position of the laser shutter retracting contact portion corresponds to the other. The process cartridge B can be installed into, or removed from the apparatus main assembly, in the direction perpendicular to the longitudinal direction of the charge roller.

The aforementioned portion of the housing 10 is the cover portion (charging apparatus cover 15) of the housing 10, which covers the charging roller 2.

The contact portion (rib 11*z*) projects outward from the top surface of the cover portion (cover 15) of the housing 10.

The outermost portion of the charge bias contact point 48 is even with the top surface of the cover portion (cover 15).

The charge bias contact point 48 and the contact portion (rib 11*z*) are aligned in parallel to the generatrix of the charge roller 2C as the charging means.

The contact portion (rib 11*z*) projects 5 mm–10 mm from the top surface of the cover portion (cover 15).

The charge roller 2C is supported by its shaft, by a portion of the housing 10 of the process cartridge B. The position of the charge bias contact point 48 is 5 mm–14 mm outward of one of the longitudinal ends of the charge roller 2C.

The position of the contact portion (rib 11*z*) is 0.5 mm–3.5 mm outward of the other longitudinal end of the charging roller 2C.

In terms of the longitudinal direction of the charge roller C, a distance of 263.5–275.5 mm is provided between the charge bias contact point 48 and the contact portion (rib 11*z*).

With the provision of the above numerical restrictions, it is assured that as the process cartridge B is installed into the apparatus main assembly, an electrical connection is established between the process cartridge B and the apparatus main assembly to enable the process cartridge B to receive the charge bias from the apparatus main assembly, and also that as the process cartridge B is installed into the apparatus main assembly, the laser shutter is reliably opened.

In addition, the process cartridge B is provided with the drum shutter 18 for covering the portion of the electrophotographic photosensitive member, which is exposed from the housing 10 of the process cartridge B. The drum shutter 18 moves through the space above the charge bias contact point 48 and contact portion (rib 11*z*) when it retreats from the protective position at which it covers the electrophotographic photosensitive member, to the retreat position.

Next, the additional description regarding the structure of the process cartridge B will be given.

(Structure of Photosensitive Drum)

Referring to FIG. 16, the photosensitive drum 1 is rotationally supported by the cleaning means housing portion 11 of the process cartridge B. The photosensitive drum 1 comprises the aluminum cylinder 1*c*, and a drum flanges 1*a* and 1*b* which are inserted into the longitudinal end portions of the aluminum cylinder 1*c*, one for one, and are fixed thereto by such a method as bonding or crimping. The drum flange 1*a* is provided with the drum supporting shaft 1*d*, which extends from the center of the outward surface of the drum flange 1*a*. The drum supporting shaft 1*d* is formed separately from the drum flange 1*a* and is attached to the drum flange 1*a* by its largest diameter portion by pressing, or insert molding. The drum supporting shaft 1*d* is fitted in the drum supporting portion 11*d* of the cleaning means housing portion 11, and the cylindrical positioning boss 13*a* of the gear cover 13. More specifically, the drum supporting shaft 1*d* is put through the ball bearing 21, which is embedded in the bearing hole 13*g* of the drum supporting portion 11*d* and gear cover 13 so that it does not displace in the axial direction of the photosensitive drum 1. In other words, the drum supporting shaft 1*d* is rotationally supported by the ball bearing 11*l*. Since the bearing hole 13*g* and cylindrical positioning boss 13*a* are made coaxial, the axial line of the cylindrical positioning boss 13*a* coincides with the axial line of the photosensitive drum 1.

On the other hand, the drum flange 1*b* is provided with a hole 1*ba*, which is put through the center of the drum flange 1*b*. Fitted rotationally in this hole 1*ba* is a drum supporting shaft 14*g*, which is integrally formed with the end cover 14 by insert molding so as to be coaxial with the cylindrical positioning boss 14*a*.

Figure 17:
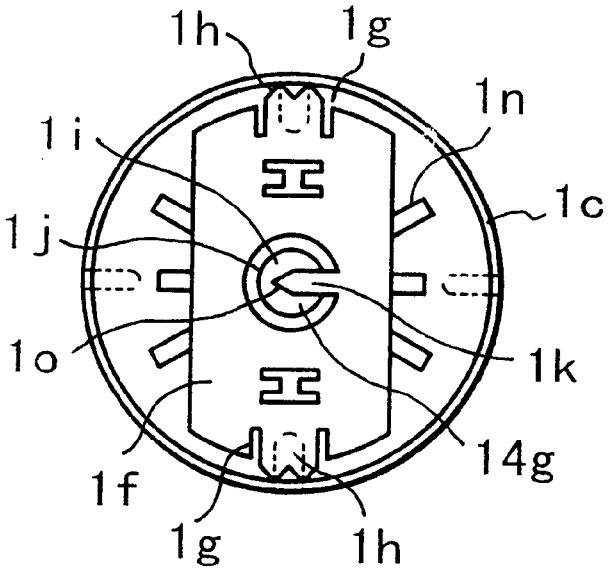
FIG. 17, (*a*) is a sectional view taken along a line E—E in FIG. 16, and (*b*) is a view in the direction C.
Figure 17:
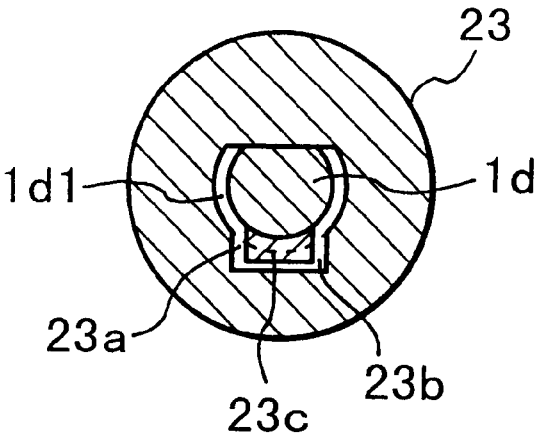

The outward end of the drum supporting shaft 1*d* is fixedly fitted with the shaft coupling member 23, which is a member for receiving the rotational force from the apparatus main assembly 20 side. Referring to FIG. 17, (b), the cross sections of the drum supporting shaft 1*d*, that is, the main supporting shaft, and shaft coupling member 23 are both D-shaped in cross section. The drum supporting shaft 1*d* is provided with a groove 1*d*1 which extends in the surface of the curved portion of the shaft 1*d*, in the circumferential direction. The shaft coupling member 23 is provided with a nib, which is integrally formed with the shaft coupling member 23, in the D-cut hole 1*ba* of the shaft coupling member 23. More specifically, the nib 23*a* is located at the tip of a diagonal projection 23*c* in the form of a cantilever formed by cutting into the surface of the hole 1*ba* to create a groove 23*b* in the axial direction of the hole.

(Structure of Charging Roller)

Figure 18:
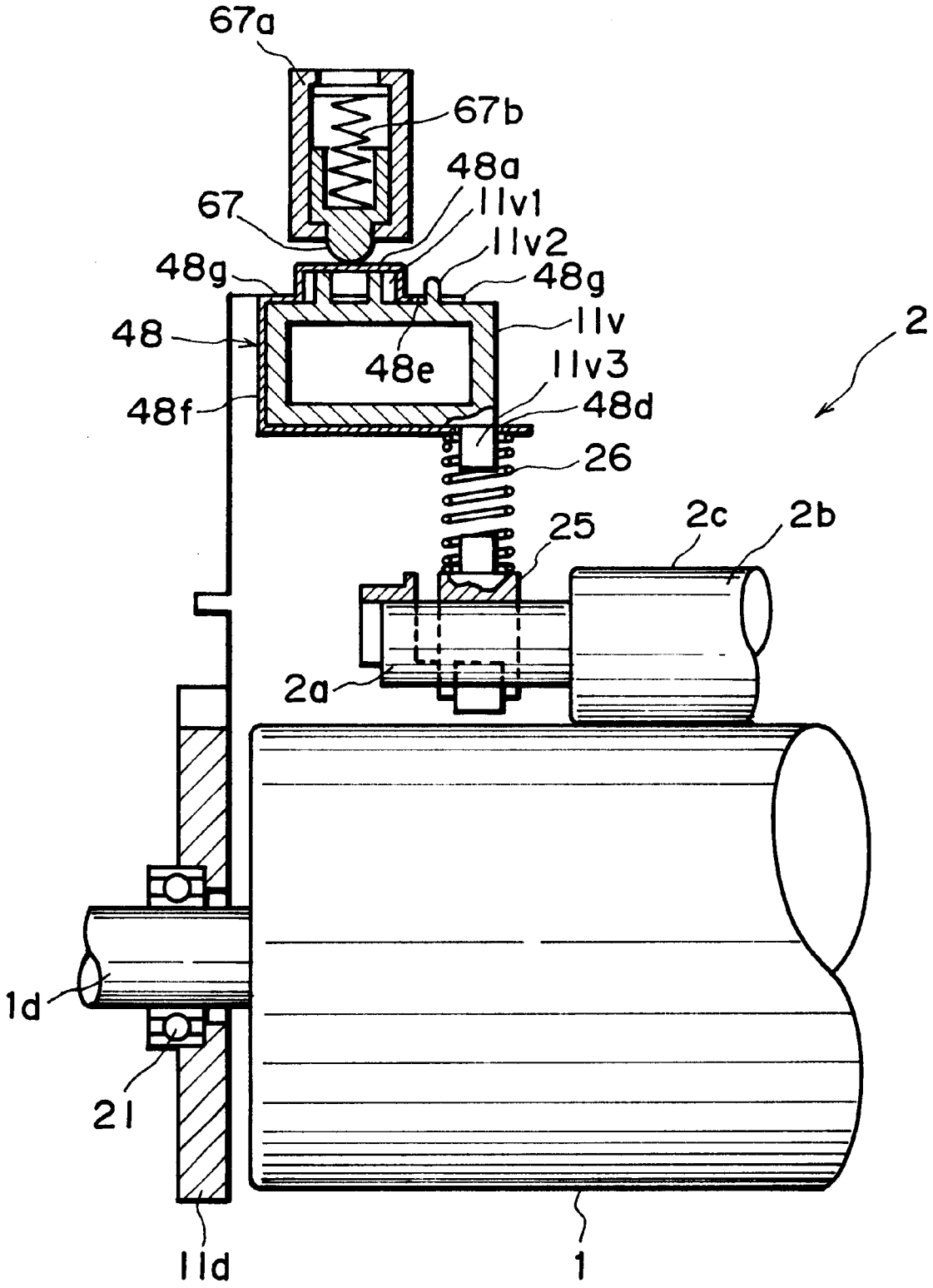
FIG. 18 is a longitudinal sectional view showing a charging roller and a photosensitive drum.
Figure 19:
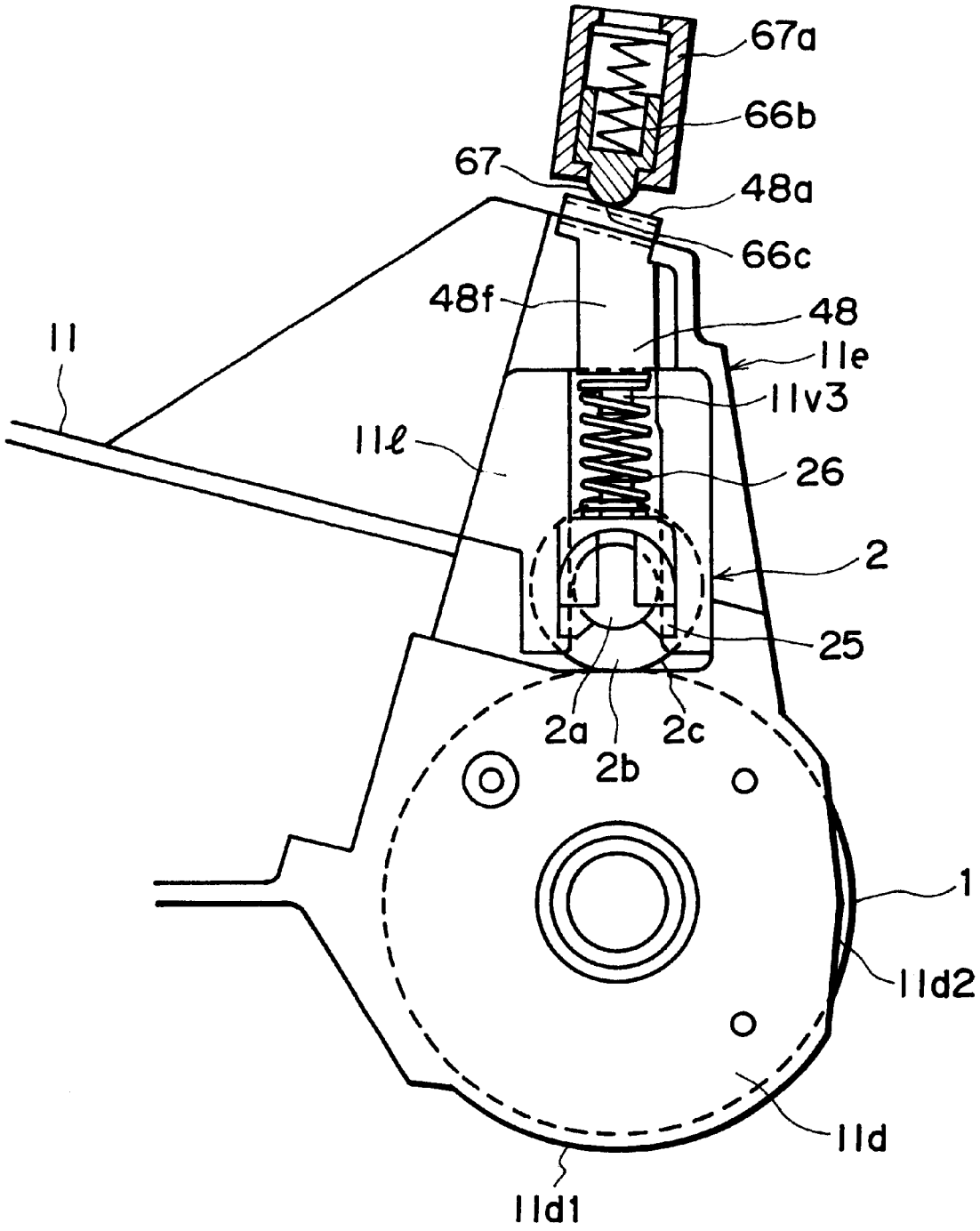
FIG. 19 is a partly broken side view of a supporting device of a charging roller portion shown in FIG. 18.

Referring to FIGS. 18 and 19 the charging apparatus 2 in such a charging apparatus employs a contact-type charging method. It is provided with a charging roller 2*c*, which comprises a metallic shaft 2*a* and a layer of electrically conductive rubber 2*b* coated on the peripheral surface of the metallic shaft 2*a*. The charge roller 2*c* is supported at both of its longitudinal ends, in parallel to the photosensitive drum 1, by the longitudinal ends of the metallic shaft 2*a*.

More specifically, each longitudinal end portion of the metallic shaft 2*a* is rotationally fitted in a charge roller bearing 25, which is slidably fitted in a bearing guides 11*l*, which projects in the radial direction of the photosensitive drum 1. The charge roller 2*c* is under pressure from a compound spring 26 compressed between the charge roller bearing 25 and the blind end of the bearing guide 11*l*, in a way that the charge roller 2*c* is placed in contact with the photosensitive drum 1 across their generatrics, and is rotated by the rotation of the photosensitive drum 1.

(Structure of Cleaning Blade)

Figure 57:
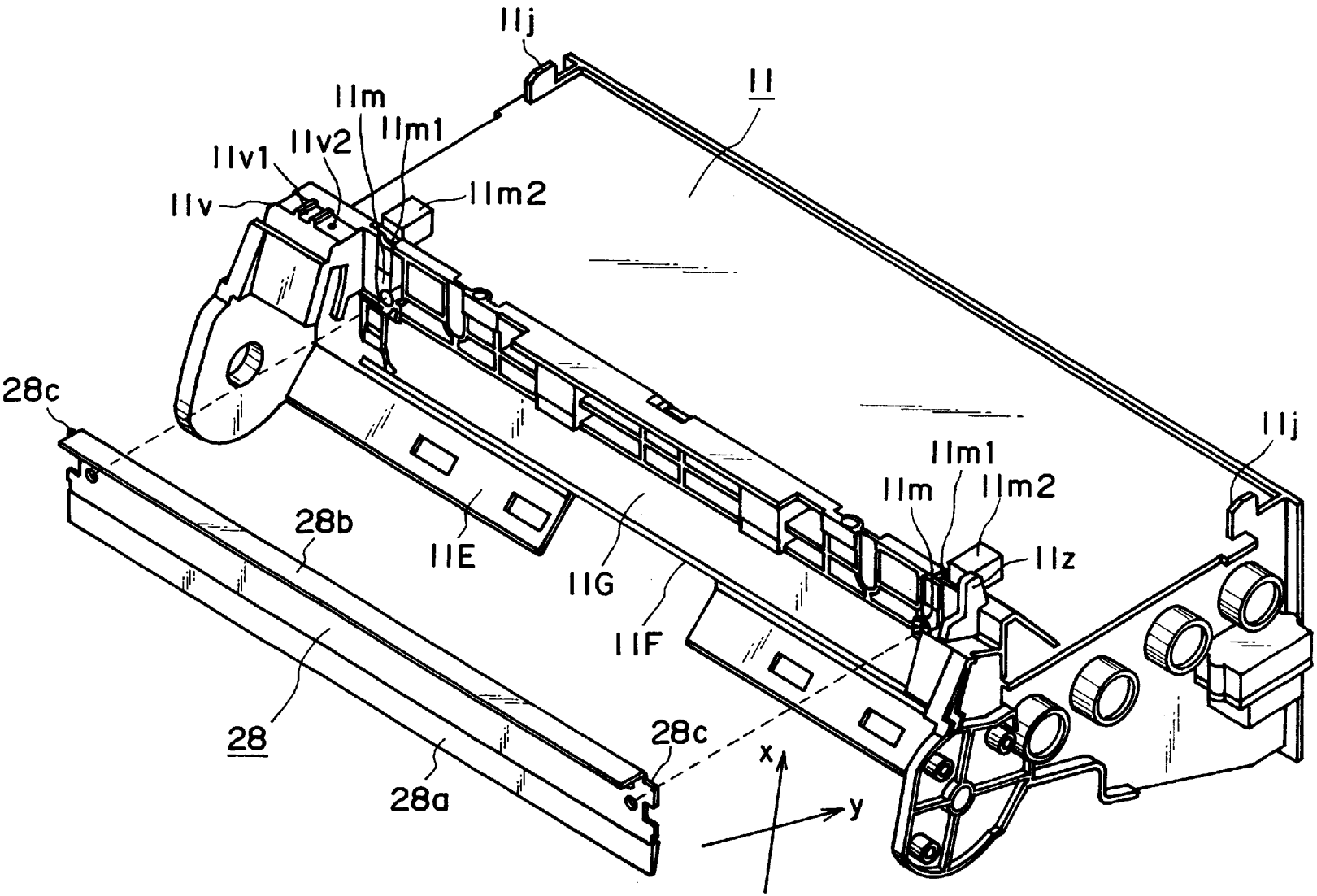
FIG. 57 is a perspective view showing mounting of the cleaning blade to the cleaner container.

Referring to FIGS. 3 and 57, the cleaning blade 28 is what removes the toner which remains on the photosensitive drum 1 after an image visualized as a toner image on the photosensitive drum 1 by the developing apparatus 4 is transferred onto the intermediary transfer belt 5*a*. The removed toner is accumulated in the cleaning means housing 11.

Referring to FIG. 3, the cleaning blade 28 is generally in the form of a flat plate and is disposed in parallel to the photosensitive drum 1. It comprises a rubber blade 28*a*, the edge of which is pressed against the peripheral surface of the photosensitive drum 1, being angled so that it faces in the direction to counter the moving direction of the peripheral surface of the photosensitive drum 1, and a supporting metallic plate 28*a* to which the rubber blade 28*a* is bonded by gluing, welding, or the like. The dimension of the cleaning blade 28 in terms of its longitudinal direction is slightly greater than the dimension of the electrically conductive rubber layer 2*b* of the charge roller 2*c* in terms of its longitudinal direction. The supporting metallic plate 28*b* has an L-shaped cross section, and is fixed to the cleaning member attachment portion 11*m* of the cleaning means housing portion 11 with the use of unillustrated small screws. In attaching the cleaning blade 28 to the cleaning means housing 11, the position of the cleaning blade 28 is automatically adjusted by an automatic assembly line so that it is accurately positioned. More specifically, referring to FIG. 57, the supporting metallic plate 28*b* is provided with a pair of notches 28*c* which are located one for one at the longitudinal ends of the supporting metallic plate 28*b*, corresponding to the bend portion of the L-shaped cross section of the metallic supporting plate 28*b*. During assembly, the position of the cleaning blade 28 in terms of the direction indicated by an arrow mark x is adjusted by applying pressure to the notch portion 28*c* while keeping pressure upon the metallic supporting plate 28*b* in the direction indicated by an arrow mark y. Then, as the edge of the rubber blade 28*a* of the cleaning blade 28 aligns with its predetermined position, the metallic supporting plate is fixed with the use of the unillustrated small screws. During this process, the cleaning member attachment portion 11*m* of the cleaning means housing portion 11 is backed up from behind by a backing member 11*m*2, that is, an assembly jig, which is placed in contact with the back surface 11*m*1 of the cleaning member attachment portion 11*m*. Next, the pressure applied in direction y is removed, and the position of the edge of the rubber blade 28*a* of the cleaning blade 28 is measured for the second time to check if the removal of the pressure applied in direction y has affected the position of the edge. If it has, the position of the edge is adjusted by loosening the screws, and then, the loosened screws are tightened again. This concludes the attachment of the cleaning blade 28 to the cleaning means housing portion 11.

(Structure of Raking Sheet)

Referring to FIG. 3, the structure of a raking sheet 29 will be described. The raking sheet 29 is an elastic sheet. It is positioned on the upstream side of the cleaning blade 28 in terms of the moving direction of the peripheral surface of the photosensitive drum 1, across the opening of the cleaning means housing portion 11, on the photosensitive drum side. It is placed in contact with the photosensitive drum 1 with the application of only slight pressure, so that the toner which remains on the photosensitive drum 1 after the image transfer from the photosensitive drum 1 is allowed to pass. The scat 11F, that is, the surface area to which the raking sheet is adhered, is the surface of a thin metallic plate 200 adhered to the cleaning means housing portion 11, with the use of a double-sided adhesive tape (unillustrated) immediately below the photosensitive drum side opening 11*n* of the cleaning means housing portion.

The above described structure may be summarized as follows.

The cleaning apparatus 6 for removing the developer which remains adhered to the electrophotographic photosensitive drum 1 comprises: a cleaning means frame (cleaning means housing portion 11); a cleaning member (for example, cleaning blade 28) for removing the developer which remains adhered to the electrophotographic photosensitive drum 1; and a flexible sheet (for example, raking sheet 29) for guiding the developer removed from the electrophotographic photosensitive drum 1 by the cleaning member, to the developer catching portion which is attached to the cleaning means frame, on the upstream side of the cleaning member in terms of the rotational direction of the electrophotographic photosensitive drum 1, with the placement of a piece of metallic plate between the flexible sheet and the cleaning means frame.

The metallic plate (for example, thin metallic plate 200) is pasted to the cleaning means frame, with the use of a piece of double-side adhesive tape (unillustrated).

The flexible sheet (for example, raking sheet 29) is pasted to the metallic plate (thin metallic plate 200) with the use of double-side adhesive tape (unillustrated).

The metallic plate (for example, thin metallic plate 200) is formed of stainless steel.

The flexible sheet (for example, raking sheet 29) is formed of polyethylene terephthalate.

(Structure of Pattern Reading Apparatus Protection Sheet)

Figure 12:
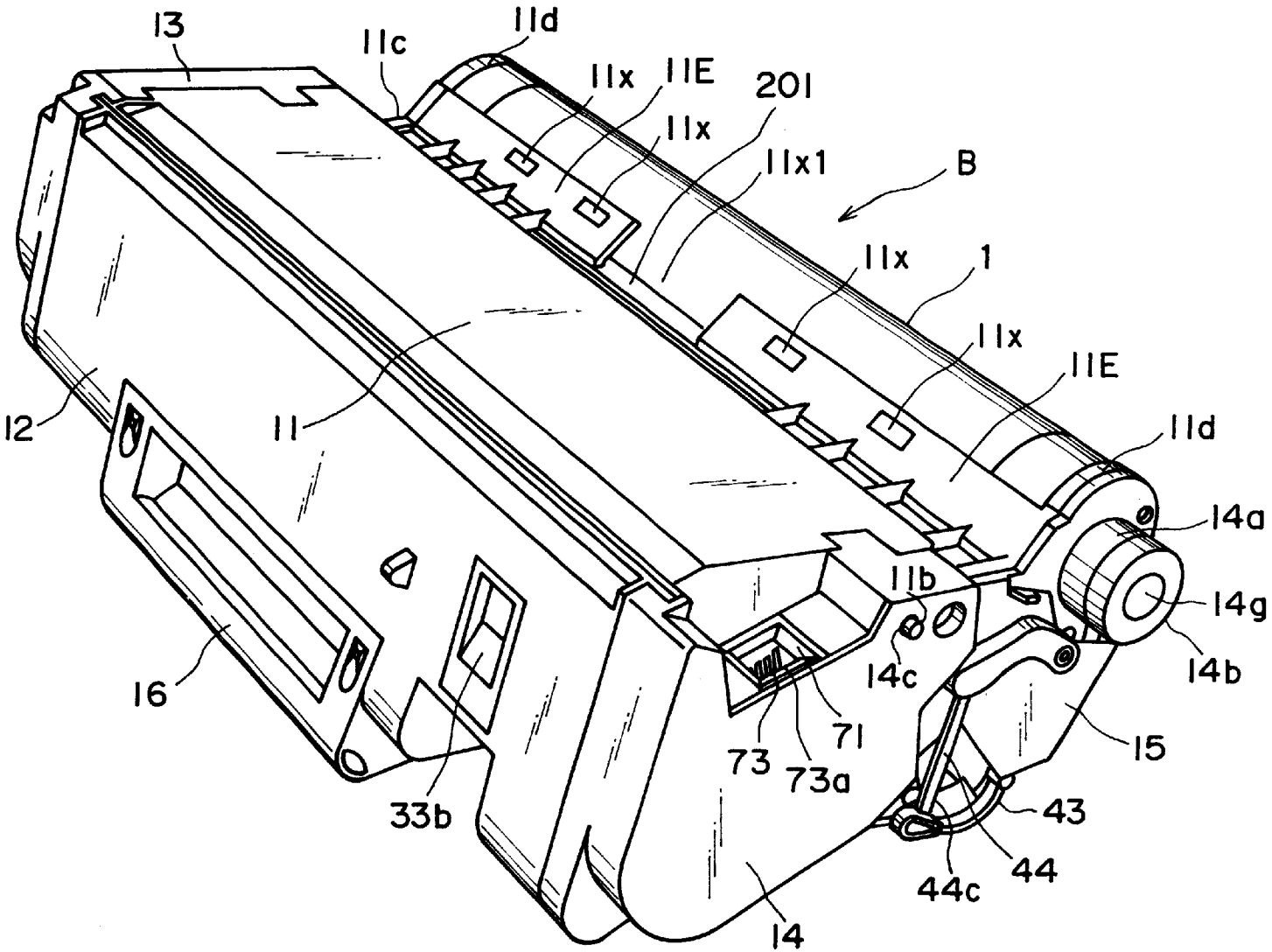
FIG. 12 is a perspective view as seen from right, rear part of a process cartridge in a reversed state (upsidedown) shown in FIG. 3.
Figure 13:
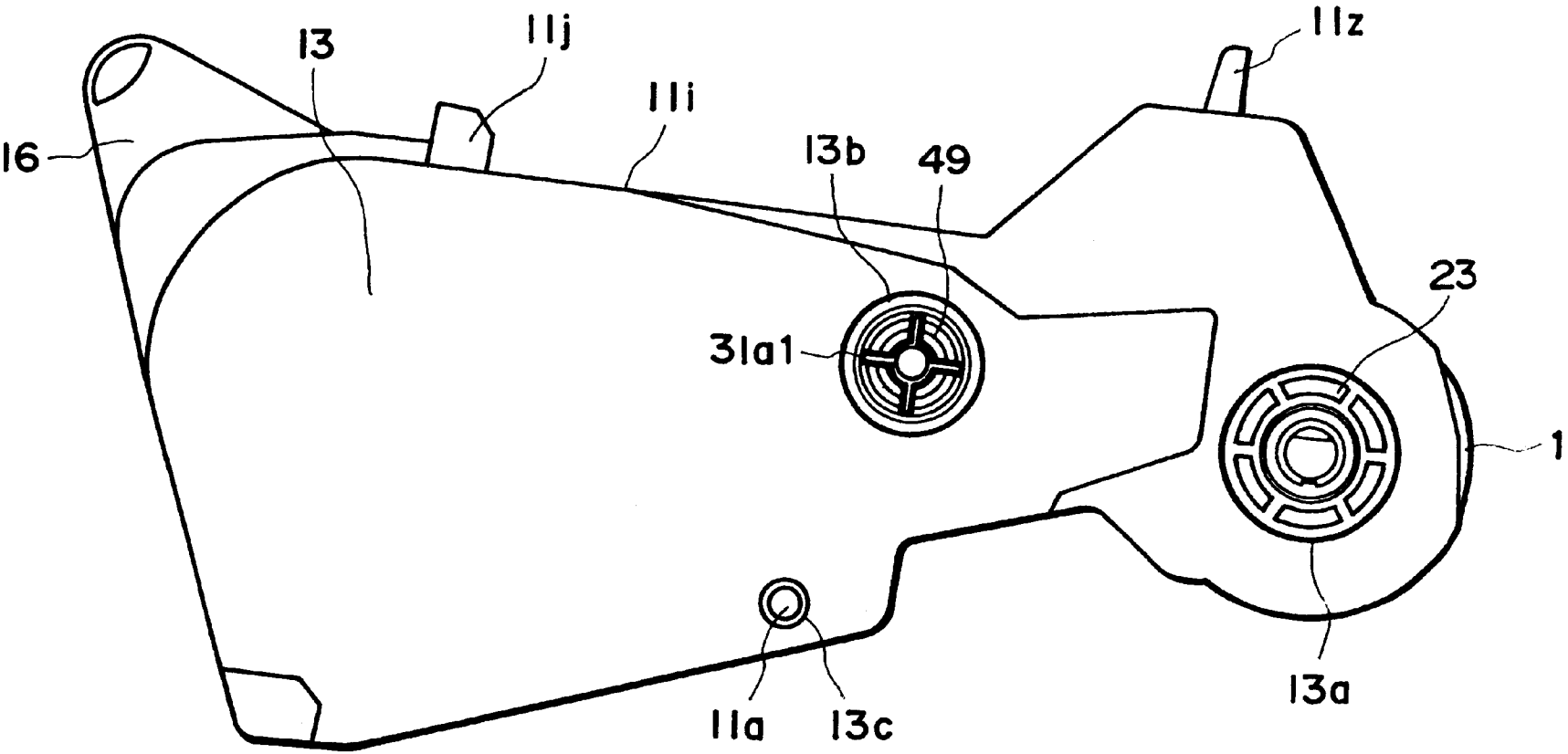
FIG. 13 is a side view illustrating a mounting guide portion of a process cartridge.

Referring to FIGS. 3 and 12, the cleaning means housing portion 11 is provided with a mandible-like portion 11E, which is located below the photosensitive drum side opening 11*n* of the cleaning means housing portion 11. The mandible-like portion 11E lacks its center portion in terms of its longitudinal direction, and a sheet-like member 201 is located corresponding to this missing portion of the mandible-like portion 11E, projecting toward the photosensitive drum 1, from the bottom surface 11G of the cleaning means housing portion 11, which is contiguous to the raking sheet seat 11F, in parallel to the bottom surface 11G of the cleaning means housing portion 11. The dimension of the sheet-like member 201 in terms of its longitudinal direction is greater than the dimension of an image density reading apparatus 93 (FIG. 37) in terms of the longitudinal direction of the sheet-like member 201. The apparatus 93 is for adjusting image density, and will be described later. This sheet-like member 201 is approximately 0.1 mm thick, and its surface is matted to reduce its reflectance to approximately 10% or below.

(Structure for Toner Conveyance and Toner Storage)

Figure 41:
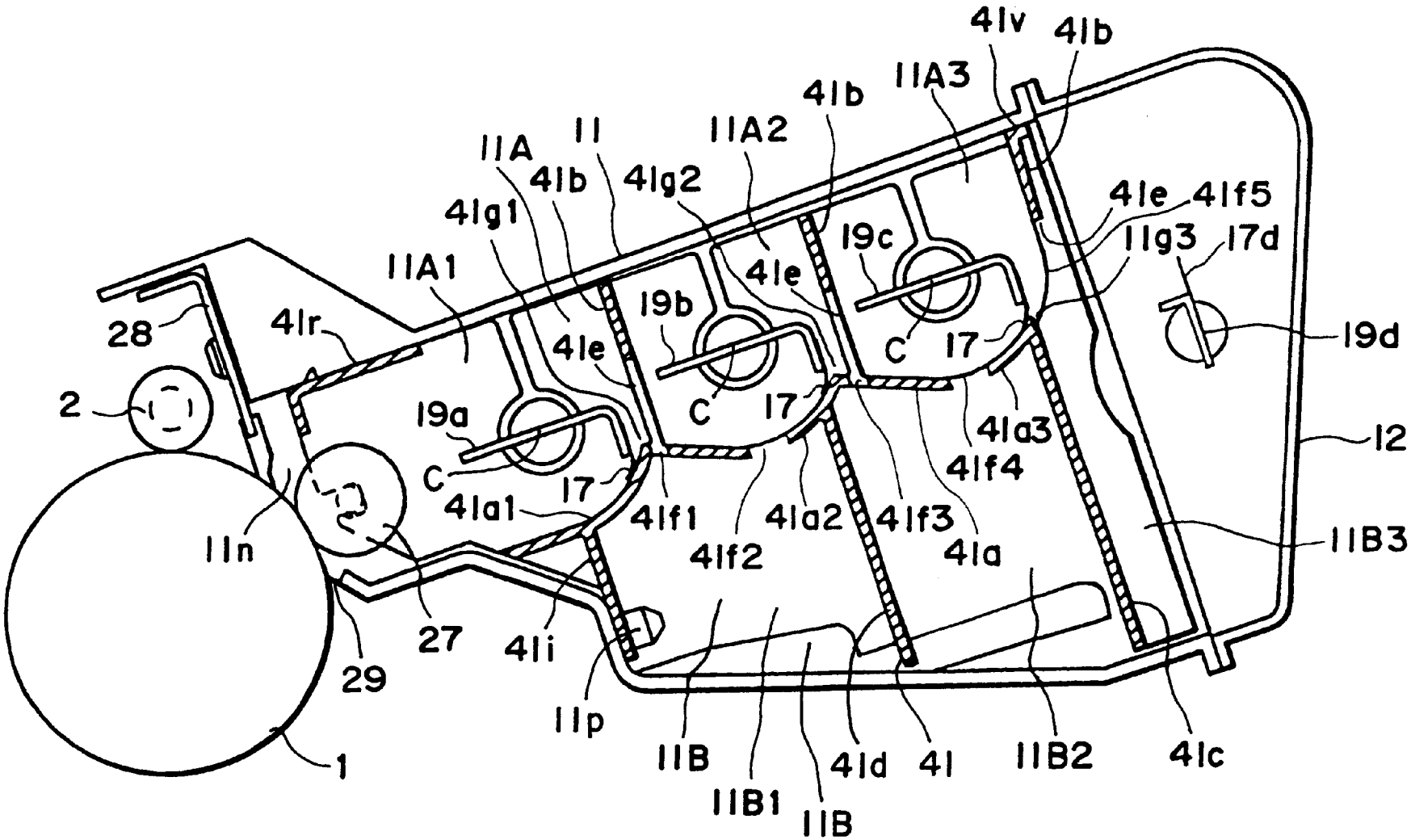
FIG. 41 is a longitudinal sectional view of a cleaner container portion according to a modified example.

FIGS. 3 and 41 are substantially the same, except for the presence of a toner conveying blade 202 in FIG. 3, and the presence of a cleaning roller 27, in place of the toner conveying blade 202, in FIG. 41.

Referring to FIGS. 3 and 41, as described above, the cleaning means housing portion 11 is provided with the rear housing portion 12, which is located at the rear in terms of the direction in which the process cartridge B is inserted into the apparatus main assembly 20. Having only one small opening 11*n* which faces the photosensitive drum 1, the cleaning means housing portion 11 is a virtually sealed container. Its internal space is divided by a partitioning member 41. More specifically, the space is divided by a sub-partitioning member 41*a*, into a toner conveying portion 11A and a toner storing portion 11B, which take top and bottom positions, respectively, when the process cartridge B is in the apparatus main assembly 20. Regarding the sub-partitioning member 41*a*, the cleaning means housing portion 11 is structured so that, when the process cartridge B is in the apparatus main assembly 20, the sub-partitioning member 41*a* gently slants upward, in broad terms, as seen from the direction of the photosensitive drum 1 (FIGS. 3 and 41).

The toner conveying portion 11A is divided by the sub-partitioning members 41*b* into three sub-chambers: first, second and third toner conveying sub-portions 11A1, 11A2 and 11A3. There is another space between the rear plate 4*c* of the cleaning means housing portion partitioning member 41 in the cleaning means housing portion 11, and the rear housing portion 12. This space is the toner storing third sub-portion 11B3

The toner storing portion 11B is divided by the toner storing portion sub-partitioning member 41*d*. The aforementioned rear plate 41*c* of the cleaning means housing portion partitioning member 41 is virtually one of the sub-partitioning members which sub-divide the toner storing portion 11B. That is, the toner storing portion 11B is divided by the toner storing portion sub-partitioning member 41*d* and this rear plate 41*c*, into these sub-chambers: toner storing first, second, and third sub-portions 11B, 11B2 and 11B3.

The toner conveying sub-portions 11A1, 11A2 and 11A3 are provided with rotational plates 19*a*, 19*b* and 19*c*, correspondingly, which are supported so that they rotate counterclockwise about their own axes C. The rear housing portion 12 is provided with a rotational plate 19*d* which rotates clockwise.

Figure 28:
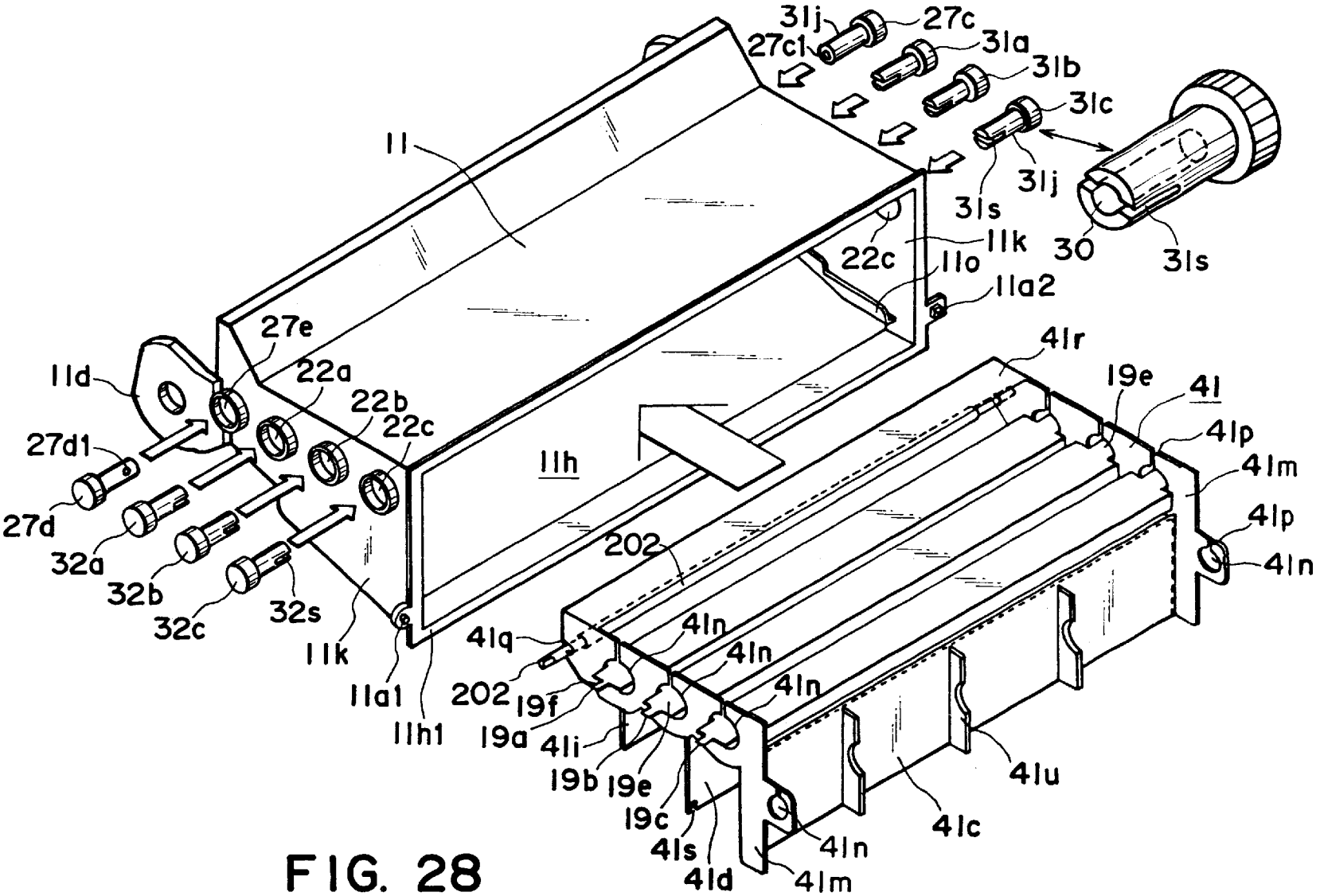
FIG. 28 is a exploded perspective view showing a frame of a cleaner container.

Referring to FIG. 28 which depicts these rotational plates 19 (19*a*, 19*b*, 19*c* and 19*c*), along with the cleaning means housing portion partitioning member 41, with the omission of the sub-partitioning member 41*b* (FIGS. 3 and 41) for the toner conveying portion 11A, and the cleaning means housing portion 11, the longitudinal end portions of the rotational plate 19 are loosely fitted, being thereby allowed to rotate, in round holes 41*n* made in the side plates 41*m* located one for one at the longitudinal ends of the cleaning means housing portion partitioning member 41 (FIG. 28 does not show rotational plate 19*d*). Both longitudinal end portions of the rotational plate 19 are provided with an extension 19*e* narrower than the main portion of the rotational plate 19, which fits in the hole 41*m* of the side plate. The extension 19*e* is provided with a centering portion 19*f*. At one of the longitudinal ends of the rotational plate 19, the centering portion 19*f* tightly fits into the hole 30 of a driving gear 31 (31*a*, 31*b*, 31*c* and 31*d* (unillustrated)) as the extension 19*e* is fitted into the slit 31*s* of the driving gear 30, whereas at the other longitudinal end, the centering portion 19*f* fits into the center hole 30 of a journal 32 (32*a*, 32*b*, 32*c* and 32*d* (unillustrated)) as the extension 19*e* is fitted into the slit 32*s* of the journal 32. These holes 30 are deeper than the slits 31*s* or 32*s*, in terms of the axial directions of the driving gear 31 or journal 32. Each of the side plates 11*k* of the cleaning means housing portion 11 is provided with bearing holes 22 (22*a*, 22*b* and 22*c*), which, when assembling the process cartridge B, align one for one with the front three holes 41*n*, out of the four holes 41*n*, made in the corresponding side plate 41*m* of the cleaning means housing portion partitioning member 41. The line which connects the center of the corresponding left and right bearing holes 22 is parallel to the axial line of the photosensitive drum 1. The rearmost hole 41*n* of the side plate 41 is positioned so as to align with the bearing hole 22*d* (FIGS. 24 and 39) of the rear housing portion 12 during the assembly of the process cartridge B.

During the assembly process of the process cartridge B, as the driving gear 31 (31*a*, 31*b* and 31*c*) and journal 32 (32*a*, 32*b* and 32*c*) are fitted into the bearing hole 22 (22*a*, 22*b* an 22*c*), on the corresponding sides, while aligning the axial lines of the driving gear 31 and journal 32 with the axial line of the rotational plate 19, the extensions 19*e* of the rotational plate 19 fit one for one into the slit 31*s* and 32*s* of the driving gear 31 and journal 32, respectively, and the centering portions 19*f* of the extensions 19*e* fit into the holes 30 and 30 of the driving gear 31 and journal 32, respectively. With the provision of the above described structural arrangement, the edge of the round hole 41*n* made in the side plate 41*m* of the partitioning member 41 for the cleaning means housing portion 11 and the extension 19*e* of the rational plate 19 do not touch each other after the assembly.

The rotational plates 19*a*, 19*b* and 19*c* are provided with a toner impelling blade 17, which is approximately 50 $\mu$m thick and is attached to the edges of the rotational plates 19. In order to allow the rotational plate 19 (19*a*, 19*b* and 19*c*) to rotate while causing the toner impelling blade 17 to rub the toner conveying portion partitioning member 41*a* while being evenly and resiliently bent, the bottom walls of the first, second and third toner conveying portions 11A1 are given a certain curvature. More specifically, referring to FIG. 41, in terms of a cross section in the inserting direction of the process cartridge B, the right portion 41*a*1 of the bottom wall of the first toner conveying sub-portion 11*a*1 is shaped like ¼ the cylinder, the rotational axis of which coincides with the rotational axis of the rational plate 19*a*, and the rear portions 41*a*2 and 41*a*3 of the bottom walls of the second and third toner conveying subportions 11A2 and 11A3 relative to the vertical lines from the rotational axes of the rotational plates 19*b* and 19*c*, are shaped like slightly smaller than ¼ a cylinder, the axial line of which coincides with the rotational axis of the rotational plate 19*b* or 19*c*, respectively.

The rotational plates 19*a*, 19*b* and 19*c* are arranged so that when the process cartridge B is in the apparatus main assembly 20, the greater their distance from the photosensitive drum 1, the higher the positions of their rotational axes.

The adjacent two toner conveying sub-portions are connected through a toner conveyance opening 41*e*, which is located below each toner conveying portion partitioning member 41*b*.

Figure 42:
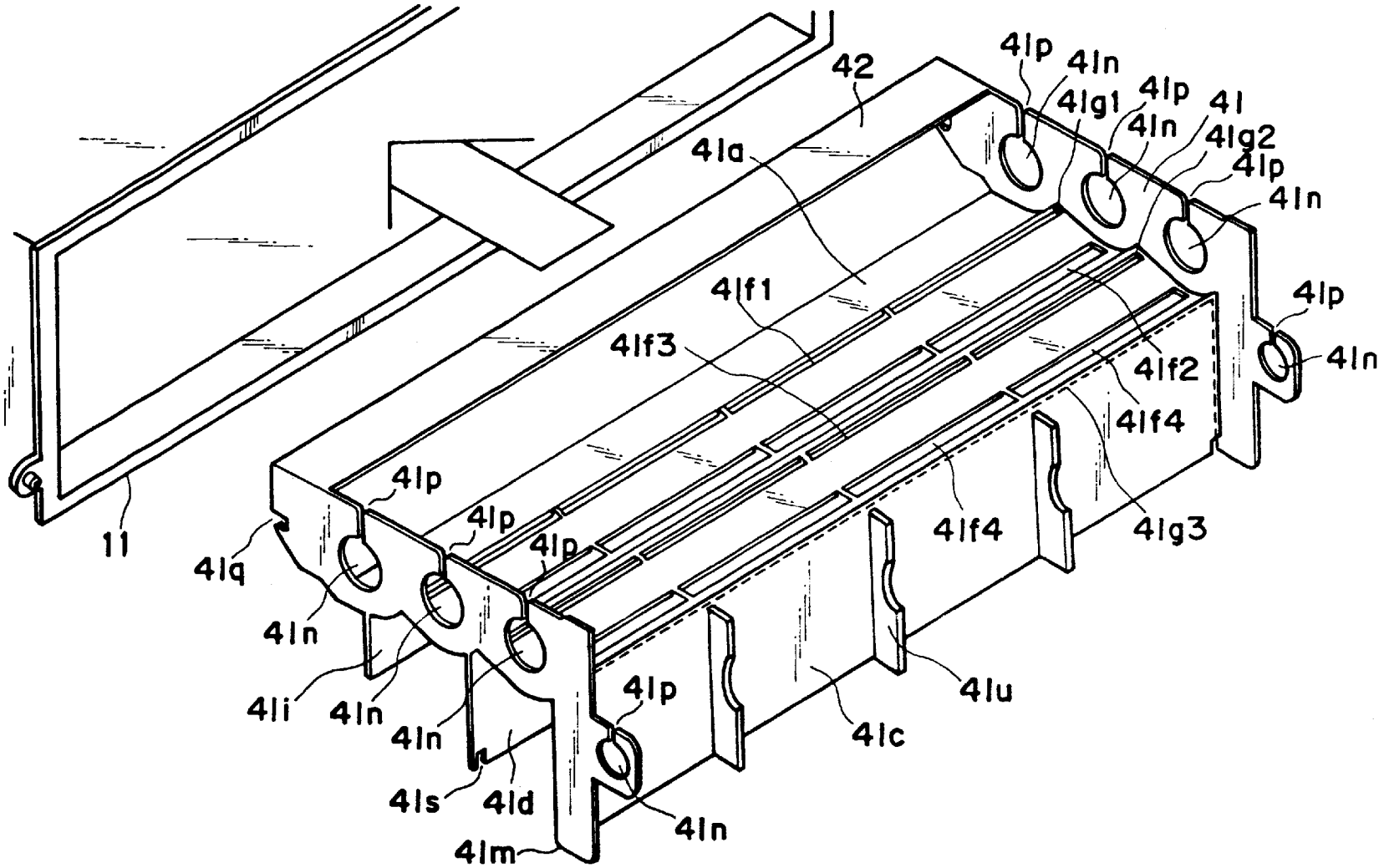
FIG. 42 is a perspective view of a partitions in the cleaner container.
Figure 43:
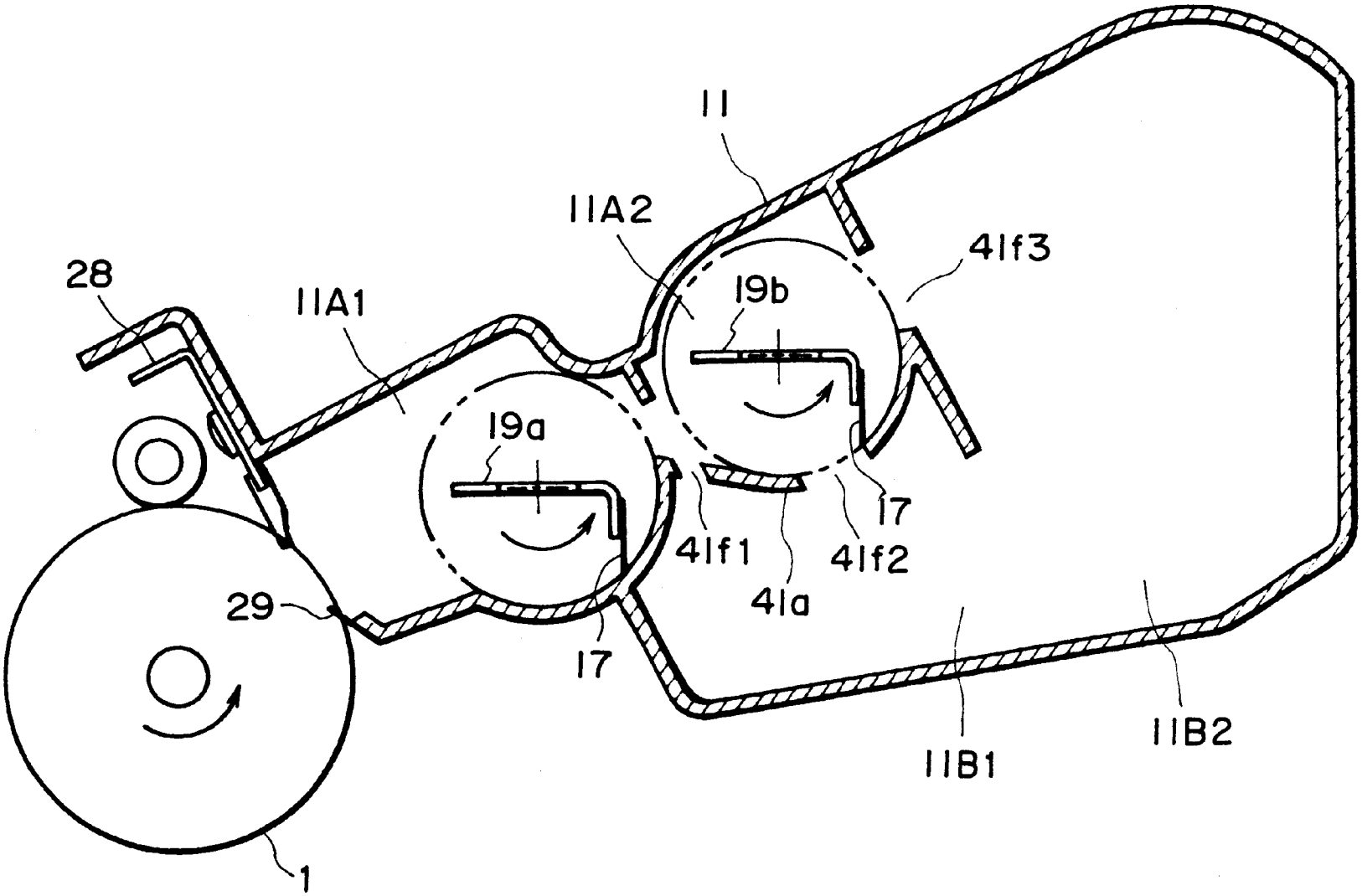
FIG. 43 is a longitudinal sectional view of a modified example of the device shown in FIG. 27.

The toner conveying portion partitioning member 41*a* is provided with storage openings 41*f*1, 41*f*2, 41*f*3, 41*f*4 and 41*f*5, providing toner passages between the toner conveying portion 11A and toner storing portion 11B (FIGS. 3, 41 and 42).

The position of the storage opening 41*f*1 is on the immediately rear side (as seen from the upstream side in terms of the toner conveying direction) of the ridge 41*g*1 corresponding to the rear end of the arc 41*a*1, and almost directly below the toner conveyance opening 41 e), i.e., the highest portion of the bottom wall of the first toner conveying sub-portion 11A1. As the rotational plate 19*a* rotates counterclockwise, the toner removed from the photosensitive drum 1 and discharged into the first toner conveying sub-portion 11A1 is first sent into the toner storing sub-portion 11B1 through this toner storage opening 41*f*1 of this first toner conveying sub-portion 11A1.

The toner storage opening 41*f*5, with which the third toner conveying sub-portion 11A3 is provided, is positioned so that as the rotational plate 19*c* rotates in the counterclockwise direction, and the toner removed from the photosensitive drum 1 is lifted by the toner impelling blade 17 of the rotational plate 19*c*, along the cylindrically curved portion 41*a*3, to the ridge 41*g*3, the lifted toner naturally falls into the toner storing third sub-portion 11B3. The toner conveying portion partitioning member 41*a*, toner conveying portion partitioning member 41*b*, rear plate 41*c*, and toner storing portion partitioning member 41*d*, which were previously described with reference to FIGS. 3 and 41, and the top front portion 41*r*, which will be described later, are attached together, by their longitudinal ends, to the corresponding side plates 41*m*, forming the cleaning means housing portion partitioning member 41, as shown in FIG. 28 (toner conveying portion partitioning member 41*b* is not illustrated).

Referring to FIG. 28 which is an exploded perspective view, the rear end of the cleaning means housing portion 11, to which the rear housing portion 12 is to be attached, has a wide opening 11*h*, through which the cleaning means housing portion partitioning member 41 is inserted into the cleaning means housing portion 11 when assembling the process cartridge B.

Each of both side plates 11*k* of the cleaning means housing portion 11 is provided with an inner guide 11*o*, which is located on the inward surface of the side plate 11*k*. The two inner guides 11*o* are parallel to each other. During the insertion of the cleaning means housing portion partitioning member 41 into the cleaning means housing portion 11, a guide groove 41*s*, with which each side plate 11*k* of the cleaning means housing portion partitioning member 41 is provided, and which is located near the bottom edge of the side plate 11*k*, comes into contact with the inner guide 11*o*, and thereafter, the cleaning means housing portion partitioning member 41 is guided by the inner guide 11*o*, with the bottom of the guide groove 41*s* riding on the top edge of the inner guide 11*o*.

Referring to FIGS. 3 and 41, the cleaning means housing portion partitioning member 41 is provided with an anchoring plate 41*i*, which is located at the bottom front portion, in parallel to the toner storing portion partitioning member 41*d*. The anchoring plate 41*i* is provided with a positioning hole 41*j*, into which a positioning projection 11*p* of the cleaning means housing portion 11 is fitted all the way to its base. The positioning projection 11*p* is integrally formed with the cleaning means housing potion 11, and is pointed at the tip. In this state, that is, after the complete insertion of the positioning projection 11*p* into the positioning hole 41*j*, the top surface 41*v* of the rearmost toner conveying portion partitioning member 41*b* is in contact with the inward surface of the top wall of the cleaning means housing portion 11, as shown in FIGS. 3 and 41.

Figure 39:
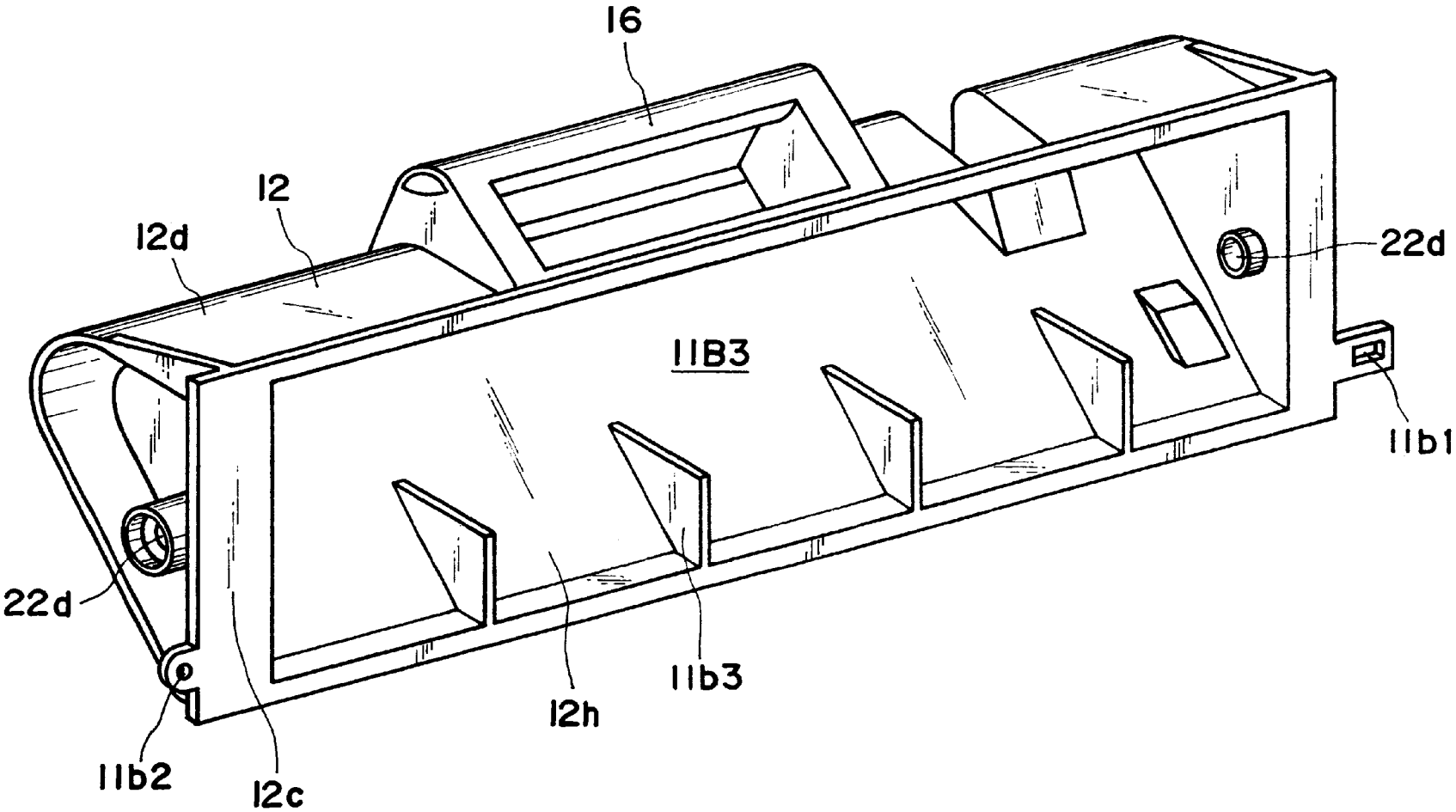
FIG. 39 is a perspective view of a rear container.

Referring to FIG. 28, each side plate 11*k* of the cleaning means housing portion 11 is provided with the bearing holes 27*e*, 22*a*, 22*b* and 22*c*, which are aligned in a substantially straight line. Further, each side plate of the rear housing portion 12 is provided with a bearing hole 22*d* (FIG. 39). On the driving side, the rotational square shaft driving gear 27*c*, which will be described later, and the driving gear 31*a*, 31*b*, 31*c* and 31*d* (31*d* is unillustrated) are rotationally fitted into these bearing holes 27*c*, 22*a*, 22*b*, 22*c* and 22*d*, correspondingly, by their journal portions 31*j*, with the actual gear portions remaining outside the cleaning means housing portion 11. On the non-driven side, the journals 27*d*, 32*a*, 32*b*, 32*c* and 32*d* (32*d* is unillustrated) are rotationally fitted into these bearing holes 27*e*, 22*a*, 22*b*, 22*c* and 22*d*, correspondingly. As described before, the driving gears 31*a*, 31*b*, 31*c* and 31*d*, and journals 32*a*, 32*b*, 32*c* and 32*d* are provided with the slits 31*s* and 32*s*, respectively, which are located at the inward side end in terms of their axial lines, and extend in their axial directions. The rotational square shaft driving gear 27*c* and journal 27*d* are provided with square holes 27*c*1 and 27*d*1, respectively, which are located at the inward ends of the gear 27*c* and journal 27*d*, and extend in their axial directions.

Both sides plates 41*m* of the cleaning means housing portion partitioning member 41 are provided with rotational plate holes 41*n*, which are aligned in a substantially straight line, and which are positioned so that after assembly, they align one for one with the gearing holes 22*a*, 22*b* and 22*c*, with which the side plate 11*k* of the cleaning means housing portion 11 is provided, and the bearing hole 22*d*, with which the side plate of the rear housing portion 12 is provided. The longitudinal end portions of the rotational plates 19*a*, 19*b*, 19*c* and 19*d* project outward from the side plates 41*m*, through the corresponding rotational plate holes 41*n*, being rotationally supported by the driving gear 31*a*, 31*b*, 31*c* and 31*d*, with which the rotational plates 19 engage one for one on the driven side, and the journals 32*a*, 32*b*, 32*c* and 32*d*, with which the rotational plates 19 engage one for one on the non-driven side. Each side plate 41*m* is provided with slits 41*p*, which are slightly wider than the thickness of each rotational plate 19, and extend upward from the rotational plate holes 41*n*, one for one. The slits 41*p* are open at the top edge of each side plate 41*m*. In other words, the rotational plate holes 41*n* have an open contour, and are provided for facilitating the assembly of the rotational plates 19 into the cleaning means housing portion 11.

The cleaning means housing portion partitioning member 41 is inserted into the cleaning means housing portion 11 in the direction indicated by an arrow mark in FIG. 28, after the assembly of the rotational plates 19*a*, 19*b* and 19*c*, and the rotational square shaft 202 with the toner conveying blade 202*d* (FIG. 3), or cleaning roller 27 (FIG. 41), into the cleaning means housing portion partitioning member 41. This makes the assembly process easier. Even if the cleaning roller 27 is employed, it is also the rotational square shaft driving gear 27*c* that is employed for driving the cleaning roller 27.

(Structure of Rotational Square Shaft)

Figures 58, 59:
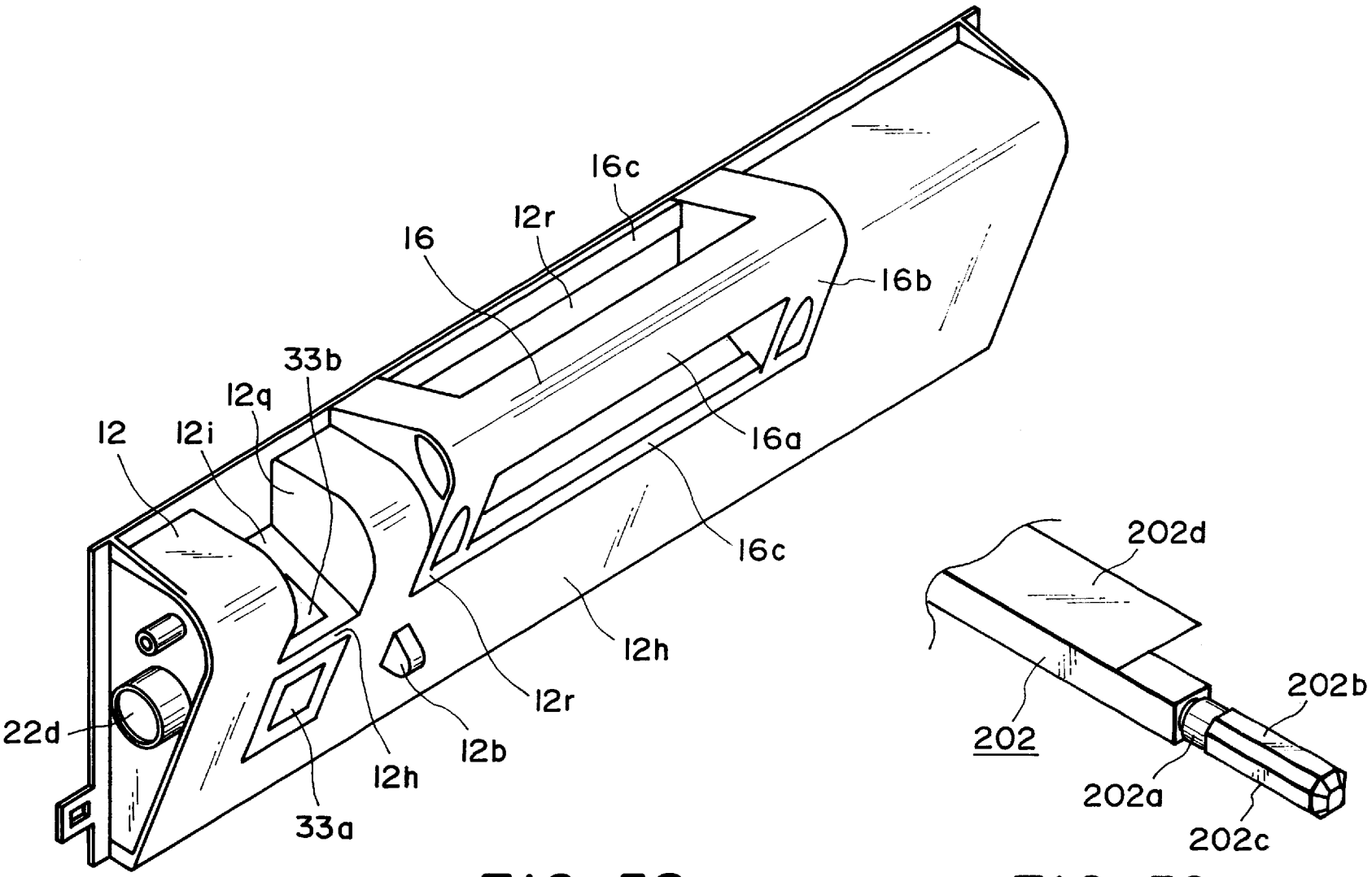
FIG. 58 is a perspective view of a rear container as seen from a grip member.
FIG. 59 is a perspective view rotatable polygonal shaft.

Referring to FIGS. 3 and 59, the structure of the rotational square shaft 202 will be described. The first toner conveying sub-portion 11A1 is provided with the rotational square shaft 202 as a member for conveying the toner removed and collected by the cleaning blade 28, to the adjacencies of the rotational plate 19*a*. The rotational square shaft 202 is also enabled to be rotated counterclockwise about its rotational axis C.

Each longitudinal end of the rotational square shaft 202 is provided with a shaft member 202*c*, which is formed of resin, and integrally comprises a round shaft portion 202*s* and a polygonal shaft portion 202*b*. The shaft member 202*c* is fixed to the longitudinal end of the square shaft 202 by press fitting or the like so that the round shaft portion 202*a* is positioned next to the rotational square shaft 202 and the polygonal shaft portion 202*b* is positioned on the outward side of the round shaft portion 202*a* in terms of the longitudinal direction of the rotational square shaft 202. Referring to FIG. 28, each side plate 41*m* of the cleaning means housing portion partitioning member 41 is provided with a rotational square shaft 202 positioning-guiding slot 41*q*, in which the round shaft portion 202*a* of the resin shaft member 202*c* loosely fits. More specifically, the positioning-guiding slot 41*q* is narrower at its entrance than the diameter of the round portion 202*a*, and is wide enough at its deeper end to allow the round shaft portion 202*a* to loosely fit therein, but not wide enough to allow the rotational square shaft 202, and the polygonal shaft portion 202*b* of the resin shaft member 202*c*, to loosely fit therein.

The polygonal shaft portions 202*b* on the driven and non-driven sides fit in the polygonal hole 27*c*1 located in the end portion of the rotational square shaft driving gear 27*c*, and polygonal hole 27*d*1 located in the longitudinal end of the journal 27*d*, respectively, so that the rotational square shaft 202 is rotationally supported.

One of the peripheral surfaces of the rotational square shaft 202 is provided with a toner sending blade 202*d*, which is formed of some kind of approximately 50 μm thick flexible sheet, and is substantially as long as the entire length of the rotational square shaft 202.

The structure of the rotational square shaft 202 may summarized as follows.

The cleaning apparatus 6 for removing the developer which remains adhered to electrophotographic photosensitive drum 1 is provided with a cleaning member (for example, cleaning blade 28) for removing the developer which remains adhered to the photosensitive drum 1, and a flexible developer conveying member which comprises a rotational shaft (for example, rotational square shaft 202) and a flexible member (for example, toner sending blade 202*d*) attached to a rotational shaft for conveying the developer removed from the photosensitive drum 1 by the cleaning member.

In terms of the direction in which the developer is conveyed, the flexible developer conveying member is positioned on the downstream side of the cleaning member.

The rotational shaft is formed of metallic material (for example, aluminum, steel, or brass), and a piece of polyethylene terephthalate sheet as the flexible member is pasted to this metallic rotational shaft.

As described above, the rotational shaft is a square shaft.

The rotational shaft does not need to be a square shaft. Instead, it may be a round shaft with a double D profile.

(Structure of Rear Housing Portion)

Referring to FIGS. 3, 39 and 58, the structure of the rear housing portion 12 will be described. It is the rear housing portion 12 in which the rotational plate 19*d* is disposed. As described before, the rotational plate 19*d* is rotationally supported, and is rotationally driven in the clockwise direction of the drawing. The rotational blade 19*d* is provided with a thin flexible toner leveling blade 17*d*. As the rotational blade 19*d* is rotationally driven, the thin flexible toner leveling blade 17*d* comes into contact with transparent windows 33*a* and 33*b*, and wipes their inward surfaces, while resiliently bending, to assure that a light path L through the transparent windows 33*a* and 33*b* is secured for detecting whether or not the toner storing sub-portion 11B3 is full of the removed toner. The toner leveling blade 17*d* and toner impelling blade 17 extend from the side plate 41*m*, on the driven side, of the cleaning means housing portion partitioning member 41, to the side plate 41*m*, on the non-driven side, of the cleaning means housing portion partitioning member 41.

The apparatus main assembly 20 is provided with a lamp 34*a*, and a light detecting element 34*b* for detecting the light emitting from the lamp 34*a*. The lamp 34*a* and light detecting element 34*b* are fixed to the apparatus main assembly 20. The transparent windows 33*a* and 33*b* are integrally formed with the rear housing portion 12, so that they align with the path L of this light emitted from the lamp 34*a*.

Figure 9:
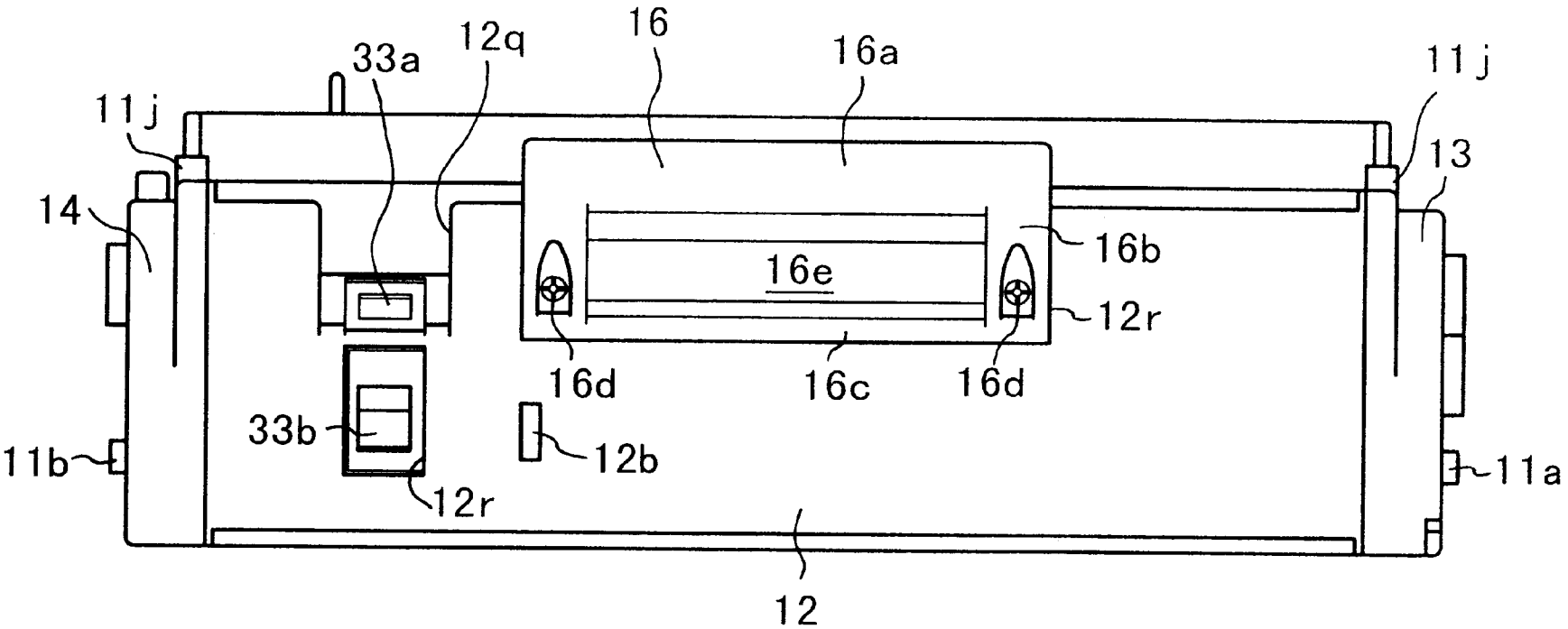
FIG. 9 is a rear view of a process cartridge shown in FIG. 3.

Referring to FIGS. 9 and 58, the transparent window 33*a* is fitted in the left portions of the slanted top portion 12*d* of rear wall of the rear housing portion 12, and the transparent window 33*b* is fitted in the left side of the slanted bottom portion 12*h* of the rear wall of the rear housing portion 12. They are vertically aligned in terms of the inserting direction of the process cartridge B. More specifically, the rear wall of the rear housing portion 12 is provided with two recesses 12*q* and 12*r*, which are located in the left sides of the slanted top and bottom portions of the rear wall, respectively, being vertically aligned in terms of the inserting direction of the process cartridge B. The recess 12*a* and 12*r* are different in dimension in terms of the longitudinal direction of the process cartridge B. The recess 12*q* is provided with a smaller recess, which is in the bottom surface 12*i* of the recess 12*q*. The transparent windows 33*a* and 33*b*, which are formed of transparent synthetic resin, and comprises an actual window portion and a flange, are fitted in the small bottom recess of the recess 12*q*, and the recess 12*r*, respectively, and bonded thereto, with the use of ultrasonic welding or the like. The transparent windows 33*a* and 33*b* project inward of the rear housing portion 12. Thus, as seen from the rear side of the process cartridge B, the actual window portions of the windows 33*a* and 33*b* are recessed from the corresponding wall portions of the rear housing portion 12, and the light path L is established through the deepest end portions of the windows 33*a* and 33*b*.

The rear housing portion 12 is provided with a handle 16, which is attached to the rear wall of the rear housing portion 12, being approximately centered in terms of the longitudinal direction of the process cartridge B. The handle 16 is used for the installation, removal, or the like of the process cartridge B.

The outward surface of the bottom portion of the rear wall of the rear housing portion 12 is provided with a projection 12*b* with a height of approximately 8 mm and a thickness of approximately 5 mm, to prevent the process cartridge B from being caused to stand on this surface. In other words, the rear surface of the cleaning means housing portion 11, which is farthest surface from the photosensitive drum 1 as seen from the direction perpendicular to the axial line of the photosensitive drum 1, that is, the surface of the bottom portion 12*h* of the rear wall of the rear housing portion 12, is provided with the projection 12*b*.

Referring to FIG. 39, the rear housing portion 12 is provided with a rectangular flange 12*c*, which surrounds the wide front opening of the rear housing portion 12. The flange 12*c* is a welding flange which is welded to the flange 11*h*1 (FIG. 28) which is a part of the cleaning means housing portion 11, and surrounds the wide rear opening 11*h* of the cleaning means housing portion 11. The internal space of the rear housing portion 12 is located on the rearward side of this flange 12*c*, and this internal space is the toner storing third sub-portion 11B3. The slanted bottom wall of this toner storing third sub-portion 11B3 is provided with a plurality of ribs 11*b*3, which are integrally formed with the slanted bottom in such a way that they extend in the inserting direction of the process cartridge B, in parallel to each other, and at the same time, become aligned in the longitudinal direction of the process cartridge B. The handle 16 is attached to the main assembly of the rear housing portion 12, which is structured as described above, and then, the transparent windows 33*a* and 33*b*, as the windows through which the toner amount is detected, are welded to the rear housing portion 12 to be integrated with the rear housing portion 12.

The cross section of the main assembly of the rear housing portion 12 in terms of the direction perpendicular to the axial line of the photosensitive drum 1 is substantially triangular. Therefore, the flange 12, i.e., the welding flange, which surrounds the wide front opening of the rear housing portion 12, is contiguous to the front edges of the top and bottom portions 12*d* and 12*h* of the rear wall of the rear housing portion 12.

(Handle of Process Cartridge)

Referring to FIGS. 3, 9, 11 and 39, the handle 16 attached to the rear housing portion 12 is a member separate from the rear housing portion 12. It comprises a grip portion 16*a*, a pair of cross beams 16*c*, and a pair of connecting portions 16*d*. The grip portion 16*a* is a portion parallel to the photosensitive drum 1, and is located corresponding to the top vertex of the cross section of the handle 16. The pair of cross beams 16*c* also are parallel to the photosensitive drum 1, and are located at the base of the handle 16, corresponding one for one to the two other vertices of the triangular cross section of the handle 16. The pair of connecting portions 16*d* are the portions which connect the grip portion 16*a* and the pair of cross beams 16 by their longitudinal ends. The handle 16 is formed of synthetic resin. There is an opening 16*c* between the grip portion 16*a* and each of the cross beams 16*c*.

The outward surface 12*h* of the rear wall of the rear housing portion 12 is a flat surface which is parallel to the photosensitive drum 1 and is substantially vertical. After the joining of the cleaning means housing portion 11 with the rear housing portion 12 and the like, the upward facing surface of the housing 10 of the process cartridge B is substantially flat. The handle 16 is fitted into the recess 12*r* formed in the rear housing portion 12, in the rounded ridge portion where the upward facing surface and the substantially vertical surface 12*h* meet, and is fixed thereto by the screwing of a pair of small screws 16*d* into the rear housing portion 12 through the pair of connecting portions 16*b*, one for one. Referring to FIG. 9, there is an engagement portion between the rear side of each connecting portion 16*b* and the rear housing portion 12, which prevents the base side of the handle 16 from moving upward, although these engagement portions are not visible.

One of the cross beams 16*c* is disposed on the substantially vertical outward surface 12*h* of the rear wall of the rear housing portion 12, and the other is disposed on the top surface of the rear housing portion 12, which forms a part of the substantially flat upward facing surface of the housing 10 of the process cartridge B. With the positioning of the pair of cross beams 16*c* in the above described manner, as the grip portion 16*a* is grasped from above with the right or left hand, the thumb is allowed to smoothly move along the surface 12*h* to come into contact with the cross beam 16*c* on the surface 12*h*, making it very easy to control the attitude of the process cartridge B, and therefore, making it easy to operate the apparatus.

As described above, the handle 16 is disposed at the top rear comer of the process cartridge B. Therefore, as the grip portion 16*a* is grasped with the hand as described above, the process cartridge B rotates so that its front end lowers. As a result, the shaft coupling member 23, i.e., the projection corresponding to the front guiding surface 51*b* of the movable member 50, and the guiding portion 14*b*, i.e., the projection corresponding to the front guiding surface 52*b* of the movable member 50, can be easily inserted into the movable member 50 without any contact between the process cartridge B and the movable member 50 except for the contacts between the shaft coupling member 23 and the movable member 50, and between the guiding portion 14*b* and the movable member 50, and further, it is easier to tilt the process cartridge B so that the rotation control projections 11*a* and 11*b* of the process cartridge B come into contact with and slide down on the rear guiding surfaces 51*c* and 52*c*, respectively, of the movable member 50 after the insertion of the shaft coupling member 23 and guiding portion 14*b* of the process cartridge B into the movable member 50 along the front guiding surfaces 51*b* and 51*c* of the movable member 50. In other words, it is easier to handle the process cartridge B when installing the process cartridge B into the movable member 50. In addition, the rotation control projections 11*a* and 11*b* can be easily pushed down to the rotation control surface 51*g* and 52*g*, respectively, without requiring any intentional control, against the CRG pressing springs 53 and 54, after the rotation control projections 11*a* and 11*b* are temporarily stopped by these springs 53 and 54 from descending.

Further, the handle 16 is attached to the above described position. Therefore, as the process cartridge B is pulled up by grasping the handle 16 to remove the process cartridge B from the movable member 50, the rear portion of the process cartridge B ascends first, with the cylindrical positioning bosses 13*a* and 14 remaining supported by the catching portion 51*h* and 52*h* of the movable member 50. Thereafter, the process cartridge B can be easily pulled out of the movable member 50 in the diagonally backward direction. In other words, the operational efficiency in the removal of the process cartridge B from the movable member 50 is improved.

(Structure of Toner Amount Detecting Portion)

As is evident from the above description of the process cartridge B, the transparent windows 33*a* and 33*b* are in the downstream side of the cleaning means housing portion 11 in terms of the conveying direction of the removed toner.

As the level of the removed toner accumulated in the toner storing sub-portion 11B3 approaches the full level, the transparent windows 33*a* and 33*b* remain covered with the removed toner, even if the rotational plate 19*d* keeps on rotating. As a result, the light path L is completely blocked by the accumulated removed toner, and therefore, the level of an active signal which remains at a level H due to photoelectric conduction while the light detecting element 34*b* is receiving the light from the lamp 34*a* drops to a level L as the light reception is interrupted. Upon detection of the drop of the active signal level, the engine controller 131 (which will be described later with reference to FIG. 36) of the apparatus main assembly 20 informs the user that the toner storing portion 11B of the cleaning means housing portion 11 of the process cartridge B has become full of the removed toner. Referring to FIGS. 3 and 28, the rearmost plate 41*c* of the cleaning means housing portion partitioning member 41 is provided with a plurality of ribs 41*u*, which project rearward. Referring to FIG. 39, the rear wall of the rear housing portion 12 is provided with the plurality of ribs 11*b*3, which are on the bottom side of the inward surface of the rear wall of the rear housing portion 12. These ribs 11*b*3 and 11*b*3 are alternately positioned in terms of the longitudinal direction of the process cartridge B, functioning together to prevent the movement of the removed toner in the longitudinal direction of the toner storing sub-portion 11B3. Therefore, the following problem is prevented: when the process cartridge B is removed from the apparatus main assembly 20, the removed toner is somehow caused to shift to the adjacencies of the transparent windows 33*a* and 33*b* due to a certain way the process cartridge B is handled, and then, when the process cartridge B in this condition is reinserted into the apparatus main assembly 20 the shifted removed toner causes the toner amount detecting portion to malfunction, that is, causes the toner amount detection portion to signal that the toner storing third sub-portion 11B3 is full of the removed toner, when actually, it is not full.

Next, a method for signaling that the removed toner has filled up the toner storing portion 11B of the cleaning means housing portion 11 will be described. As described above, as soon as the toner storing third portion 11B3 in the cleaning means housing portion 11 is filled up with the removed toner, the engine controller 131 (which will be described later) outputs a warning that the toner storing portion B in the cleaning means housing portion 11 will soon be entirely filled up with the removed toner (removed toner full-up pre-warning). At this point, there is little removed toner in the toner conveying portion 11A. Therefore, the printing operation can be continued for a certain number of copies after the removed toner fill-up pre-warning. In other words, as the printing operation is continued after the pre-warning, the removed toner is stored into the toner conveying portion 11A, starting from the deepest end (toner conveying third sub-portion 11A3), until the toner conveying portion 11A is completely filled up with the removed toner. However, before the toner conveying portion 11A becomes literally full of the removed toner, the engine controller 131 of the apparatus main assembly 20 warns that the cleaning means housing portion 11 is virtually filled up with the removed toner (removed toner fill-up warning). The pre-warning and warning are outputted in the form of flickering of a lamp, or a message on a display screen.

A warning "Removed toner fill-up pre-warning" may be replaced with a warning "cartridge exchange".

The apparatus main assembly 20 may be designed so that it stops operating after operating for a certain length of time equivalent to a certain amount of the removed toner after the "removed toner fill-up" or "cartridge exchange" warnings.

Figure 61:
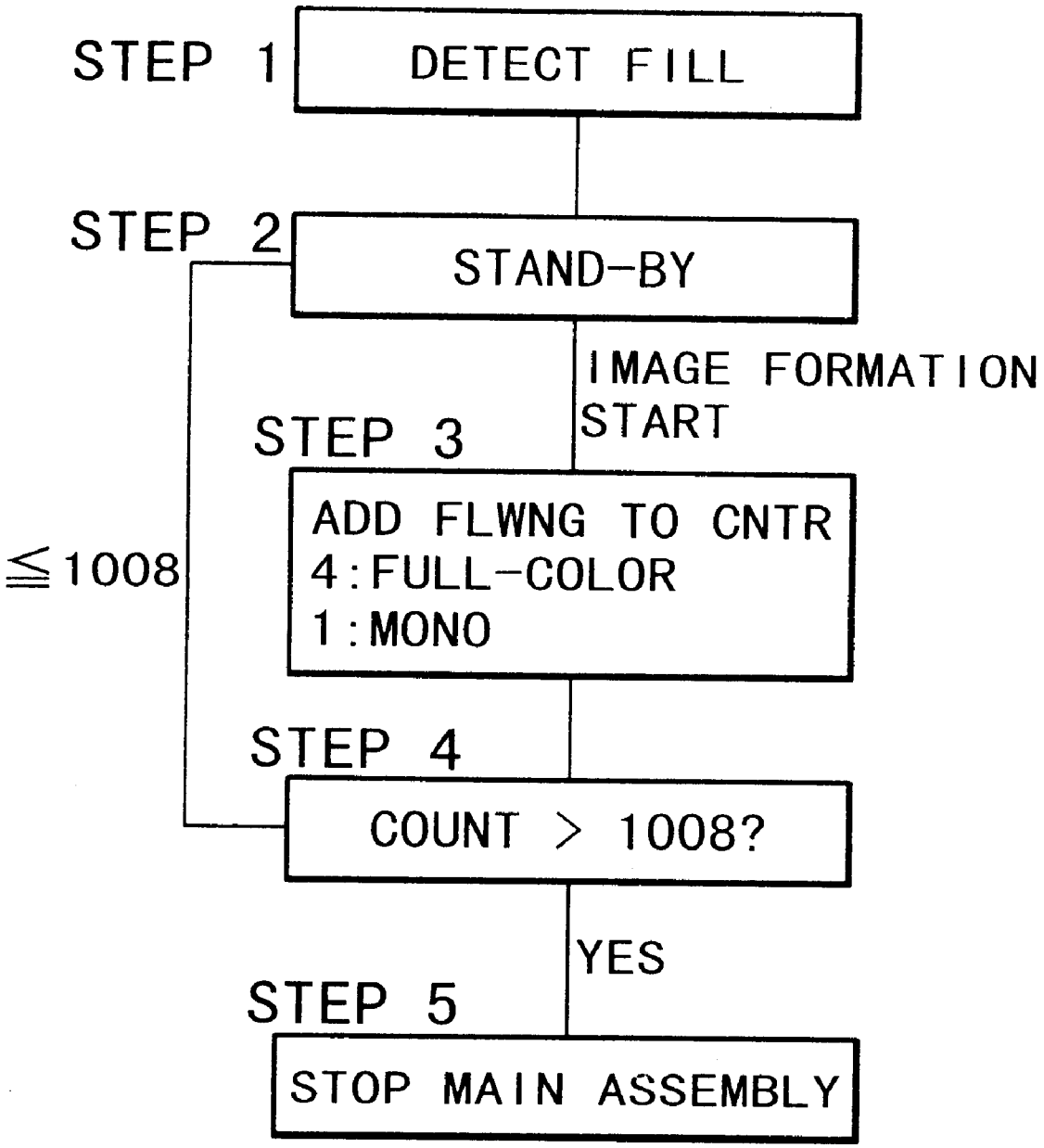
FIG. 61 is a flow chart of a detection system for detecting a full state of used toner.

Next, referring to FIG. 61, the method for detecting that the cleaning means housing portion 11 is completely full of the removed toner will be described with regard to a full-color image formation mode, and a mono-color image formation mode. FIG. 61 is a flowchart for the removed toner fill-up detecting method.

First, the engine controller (MPV) on the printer main assembly side detects that the light detecting element 34*b* has stopped receiving the light from the lamp 34*a* (Step 1). Then, the engine controller (MPV) puts the printer on standby while allowing the continuation of the printing operation (Step 2). At this point, the value in the image formation number counter is increased by a certain number (actual number is different depending on whether the apparatus is in the full-color mode (for example, "4") or mono-color mode (for example, "1")) (Step 3). Thereafter, the counter value is compared to the threshold value (1008) (Step 4). As the counter value matches the threshold value, the engine control prevents the continuation of the printing operation, and outputs a warning "cleaner full" (Step 5). In Step 5, the warning "cleaner full" may be outputted without preventing the continuation of the printing operation.

(Structure of Charging Apparatus Cover)

Referring to FIGS. 3, 10, 11 and 60, the charging apparatus cover 15 will be described. The charging apparatus cover 15 is a protective member for the charging apparatus 2. As described previously, not only does the charging apparatus cover 15 cover the charging apparatus 2 across the top and side, inclusive of both longitudinal ends, but also fixes to the housing, a high voltage charge voltage contact plate 48, which will be described later, by pressing it down on the top. The charging apparatus cover 15 is provided with snap detents 15*c*, which are located at about the center of the charging apparatus cover 15 in terms of the front to back direction, positioning holes 15*g* made in the top wall 15*e*, and holes 15*d* made in both side walls 15*b* (one on the non-driven side is not illustrated). The charging apparatus cover 15 is fixed to the main assembly of the process cartridge B, in parallel to the photosensitive drum 1, in the following manner. First, the snap detents 15*c* are snapped into the corresponding holes 11*q* of the cleaning means housing portion 11, so that the hook portions of the snap detents 15 are locked by the edges of the holes, and that the positioning projections 11*v*2 located on the top surface of the charge bias contact holding portion 11*v* fit one for one into the positioning holes 15*g* of the charging apparatus cover 15, to temporarily position the charging apparatus cover 15 relative to the cleaning means housing portion 11. Then, the holes 15*d* of the side plates are engaged with the bosses 13*z* (FIG. 60) provided on the side cover 13 and end cover 14 (two bosses per cover).

The top wall 15*e* of the charging apparatus cover 15 is provided with a square hole 15*a* in which the external contact point 48*a* of the high voltage charge contact plate 48 is perfectly fitted to be exposed from the top wall 15*e*. The charging apparatus cover 15 is trapezoidal in its cross section perpendicular to the longitudinal direction of the process cartridge B. The outermost point (or surface) of the external contact point 48*a* is in approximately the same plane as the outward surface of the top wall 15*e* of the charging apparatus cover 15.

The top wall 15*e* of the charging apparatus cover 15 is also provided with an opening 15*f*, through which the laser shutter opening rib 11*z* integral with cleaning means housing portion 11 is exposed.

(Operation of cleaning Apparatus)

The photosensitive drum 1, rotational square shaft 202, and rotational plate 19 simultaneously rotate as they receive the driving force. The structures of the apparatuses which drive them will be described later. At this time, the operation of the cleaning apparatus 6 will be described. The toner which remains on the photosensitive drum 1 after image transfer is removed from the photosensitive drum 1 by the cleaning apparatus 6, in particular, the cleaning blade 28 of the cleaning apparatus 6, and is stored as the removed toner in the cleaning means housing portion 11.

The toner which has accumulated adjacent to the aforementioned opening 11*n* is prevented by the function of the raking sheet 29 from leaking out of the cleaning means housing portion 11 through the gap between the raking sheet 29 and the photosensitive drum 1. The toner which has accumulated on the bottom wall, i.e., the cleaning means housing portion interior sub-partitioning member 41*a*, of the toner conveying first portion 1A1, is impelled toward the toner conveying second sub-portion 11A2 by the impelling blade 17 of the first rotational plate 19*a*. As the toner is impelled, it is lifted toward the ridge 41*g*1 following the portion 41*a*1 like a ¼ cylinder, rides over the ridge 41*g*1, reaches the toner storage opening 41*f*1, falls through the toner storage opening 41*f*1, and accumulates in the toner storing first sub-portion 11B1, on the upstream side in terms of the toner conveyance direction. During the above process, a small amount of the toner is thrown into the toner conveying second sub-portion 11A2 due to the inertial given to the toner by the rotational plate 19*a*, and the resiliency of the impelling blade 17 which is released as soon as the impelling blade 17 passes the ridge 41*f*1. After being thrown into the toner conveying second sub-portion 11A2, the toner slides toward the toner storage opening 41*f*2, because the partitioning member 41*a* corresponding to the toner conveying second sub-portion 11A2 slants downward from the ridge 41*g*1 toward the toner storage opening 41*f*2. Even if the toner happens to stick to the sub-partitioning member 41*a* on its way down to the toner storage opening 41*f*2, it is forced to move to the toner storage opening 41*f*2, and fall into the toner storage opening 41*f*2, by the impelling blade 17 of the second rotational plate 19*b* which repeatedly comes rotating around.

Thus, the removed toner accumulates in the toner storing first sub-portion 11B1, mostly through the toner storage opening 41*f*1, forming a peak substantially directly below the toner storage opening 41*f*1. After the peak of the pile of the accumulated toner reaches the toner storage opening 41*f*1, that is, after the toner storing first sub-portion 11B1 is mostly filled up with the removed toner, the toner removed through the cleaning of the photosensitive drum 1 and discharged into the toner conveying fist sub-portion 11A1 is sent into the toner conveying second sub-portion 11A2, and then sent into the remaining space in the toner storing first sub-portion 11B1, through the toner conveyance opening 41*e*, by the impelling blade 17 of the first rotational plate 19*a*, until there is no remaining space. As the toner storing first sub-portion 11B1 is completely filled up with the removed toner, the toner storage opening 41*f*2 is plugged up. Therefore, the toner removed by the cleaning is sent straight to the toner conveying second sub-portion 11A2 through the toner conveying first sub-portion 11A1. Then, the removed toner is lifted toward the ridge 41*g*2, which is located between the toner conveying second and third sub-portions 11A2 and 11A3, and immediately before the toner conveyance opening 41*e*, along the cylindrically curved portion 41*a*2, and is caused to fall through the toner storage opening 41*f*3 into the toner storing second sub-portion 11B2, on the side closer to the photosensitive drum 1, by the impelling blade 17 of the second rotational plate 19*b*. During this process, a small amount of the toner is thrown into the toner conveying third sub-portion 11A3 due to the inertia given to the toner by the rotation of the rotational plate 19*b*, and the resiliency of the impelling blade 17 of the rotational plate 19*b*, which is released as soon as the impelling blade 17 passes the ridge 41*g*2.

After falling into the toner storing second sub-portion 11B2, the removed toner does not form a peak directly below the toner storage opening 41*f*3, because the toner storage opening 41*f*3 is located adjacent to the toner storing portion sub-partitioning member 41*d*, which separates the toner storing sub-portion 11B1 from the toner storing second sub-portion 11B2, and is slanted so that the position of its bottom portion becomes positioned rearward of the position of its top portion as seen from the direction of the photosensitive drum 1. Thus, the removed toner accumulates in the toner storing second sub-portion 11B2, in such a manner that the highest point of the pile of the removed toner remains directly below the toner storage opening 41*f*3 that is, the surface of the pile of the toner slants downward from its highest portion to its base, the position of which is farther to the rear than its highest point, as seen from the direction of the photosensitive drum 1. As the printing operation continues, the slanted surface of the pile of the removed toner in the toner storing second sub-portion 11B2 gradually rises, and eventually, its highest portion reaches the toner storage opening 41*f*3 causing the opening 41*f*3 to be plugged with the removed toner. Thereafter, the removed toner is conveyed through the toner conveying first and second sub-portion 11A1 and 11A2, pushed over the ridge 41*g*2 between the toner conveying second and third sub-portion 11A2 and 11A3, and sent into the toner conveying third sub-portion 11A3 through the toner conveyance opening 41*e*. In the toner conveying third sub-portion 11A3, the removed toner moves on the cleaning means housing portion partitioning member 41*a* corresponding to the toner conveying third sub-portion 11A3, to the toner storage opening 41*f*4, due to the downward inclination of the portion of the member 41*a* from the ridge 41*g*2 to the toner storage opening 41*f*4, and the movement of the impelling blade 17 of the third rotational plate 19*c*. Then, the removed toner falls into the toner storing second sub-portion 11B2 through the toner storage opening 41*f*3 located at the lowest end of the cleaning means housing portion partitioning member 41*a* corresponding to the toner conveying third sub-portion 11A3. Then, as the toner storing second sub-portion 11B2 is completely filled up with the removed toner, and the toner storage opening 41*f*4 is plugged with the removed toner, the removed toner is moved on the cleaning means housing portion partitioning member 41*a* corresponding to the toner conveying third sub-portion 11A3, from the ridge 41*g*2, which is on the photosensitive drive 1 side, to the toner storage opening 41*f*4, and is lifted to the ridge 41*g*3, along the cylindrical curved portion 41*f*5, i.e., a portion of the cleaning means housing portion partitioning member 41*a* corresponding to the toner conveying third sub-portion 11A3, by the impelling blade 17 of the rotational plate 19*c*. The ridge 41*g*3 coincides with the bottom edge of the toner storage opening 41*f*5, and therefore, the removed toner falls into the toner storing third sub-portion 11B3 after being lifted to the ridge 41*g*3. The toner storage opening 41*f*5 is the same opening as the toner conveyance opening 41*e*. In other words, the removed toner is caused to fall, while being sent, into the toner storing third sub-portion 11B3.

After falling into the toner storage third sub-portion 11B3, the removed toner accumulates therein, in such a manner that the surface of the pile of the toner becomes slanted, with its highest point being at the rearmost plate 41*c* which is slanted, in parallel to the toner storing portion partitioning member 41*d*, so that the bottom side is farther away from the photosensitive drum 1 than the top side. The surface of the pile of the accumulated removed toner is flat and is slanted at the angle of repose of the toner relative to the horizontal plane. This surface of the pile of the accumulated toner gradually raises, and eventually, it is raked by the leveling blade 17*d* of the rotational plate 19*d*. As a result, the removed toner in the top portion of the pile is thrown toward the rearmost member 41*c* of the cleaning means housing portion partitioning member 41. The dimension of the leveling blade 17*d* in terms of the radial direction of the circular locus which its edge describes is made large enough for the transparent windows 33*a* and 33*b* to be continuously wiped clean across their actual window portions through which the light path L is established. As the toner storing third sub-portion 11B3 is nearly filled up with the removed toner thrown toward the rearmost member 41*c* of the cleaning means housing portion partitioning member 41, it becomes no longer possible for the transparent windows 33*a* and 33*b* to be cleaned even with the leveling blade 17*d* of the rotational plate 19*d*. Consequently, the transparent windows 33*a*, and 33*b* remain covered with the removed toner, resulting in the blockage of the light path L. Then, it is displayed by the apparatus main assembly 20 that the toner storing third sub-portion 11B3 of the process cartridge B has been filled up with the removed toner. This display literally means two things: that the removed toner has filled up the toner storing portion 11B, and that the toner conveying portion 11A is yet to be filled up with the removed toner. In other words, this display means that the removed toner can still be stored in the toner conveying portion 11A of the process cartridge B, which makes this display a pre-warning. At this point, it is possible to predict the number of image formations in terms of the number of prints it takes for the toner conveying portion 11A to be filled up with the removed toner. Thus, a warning that indicates the filling up of the cleaning housing means portion 11 with the removed toner is displayed as the number of image formations reaches the predicted number.

(Apparatus for Driving Removed Toner Conveying Member, in Process Cartridge)

Figure 20:
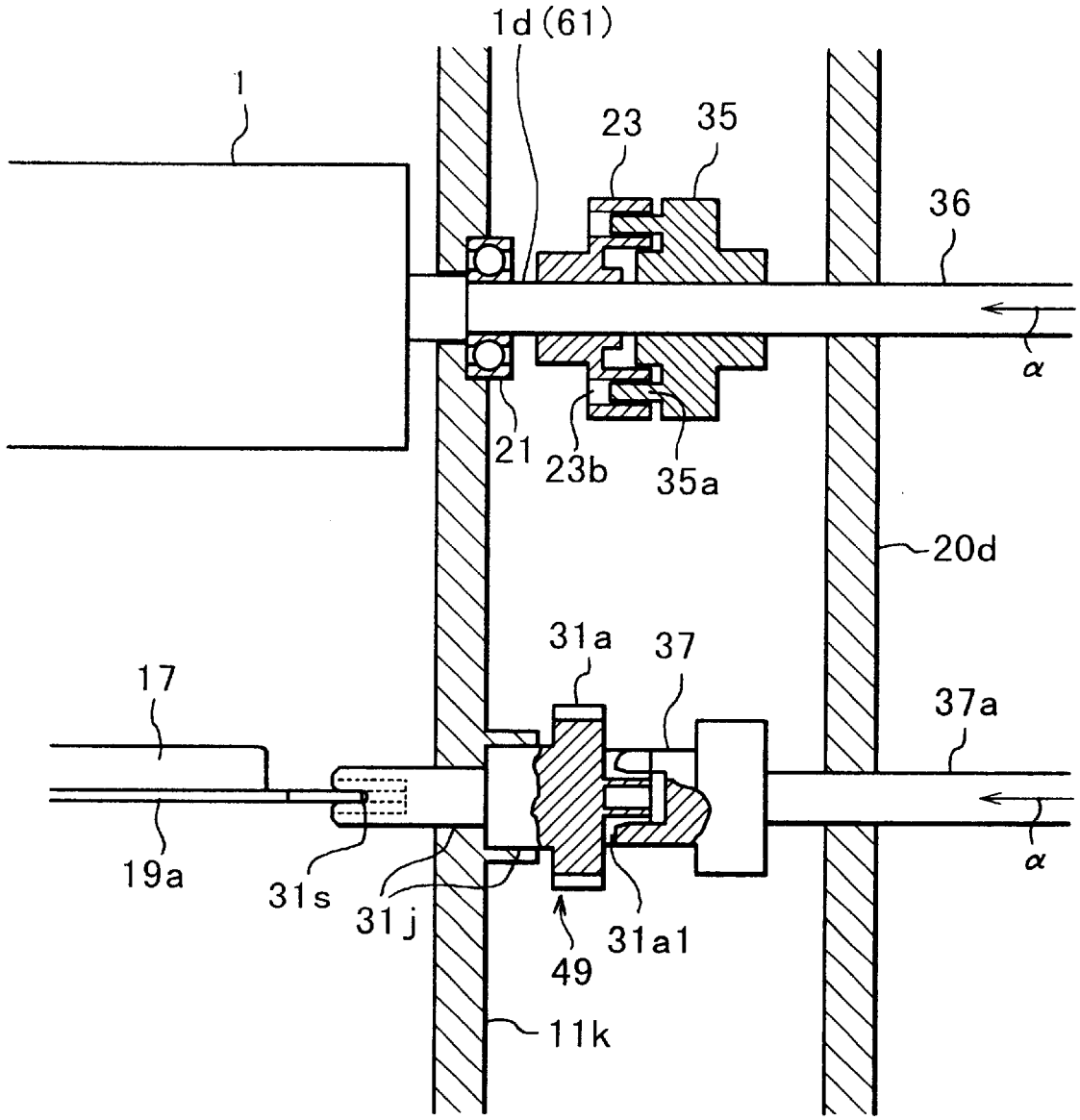
FIG. 20 is a developed sectional view of a driving system for the process cartridge from the main assembly of an electrophotographic image forming apparatus.
Figure 24:
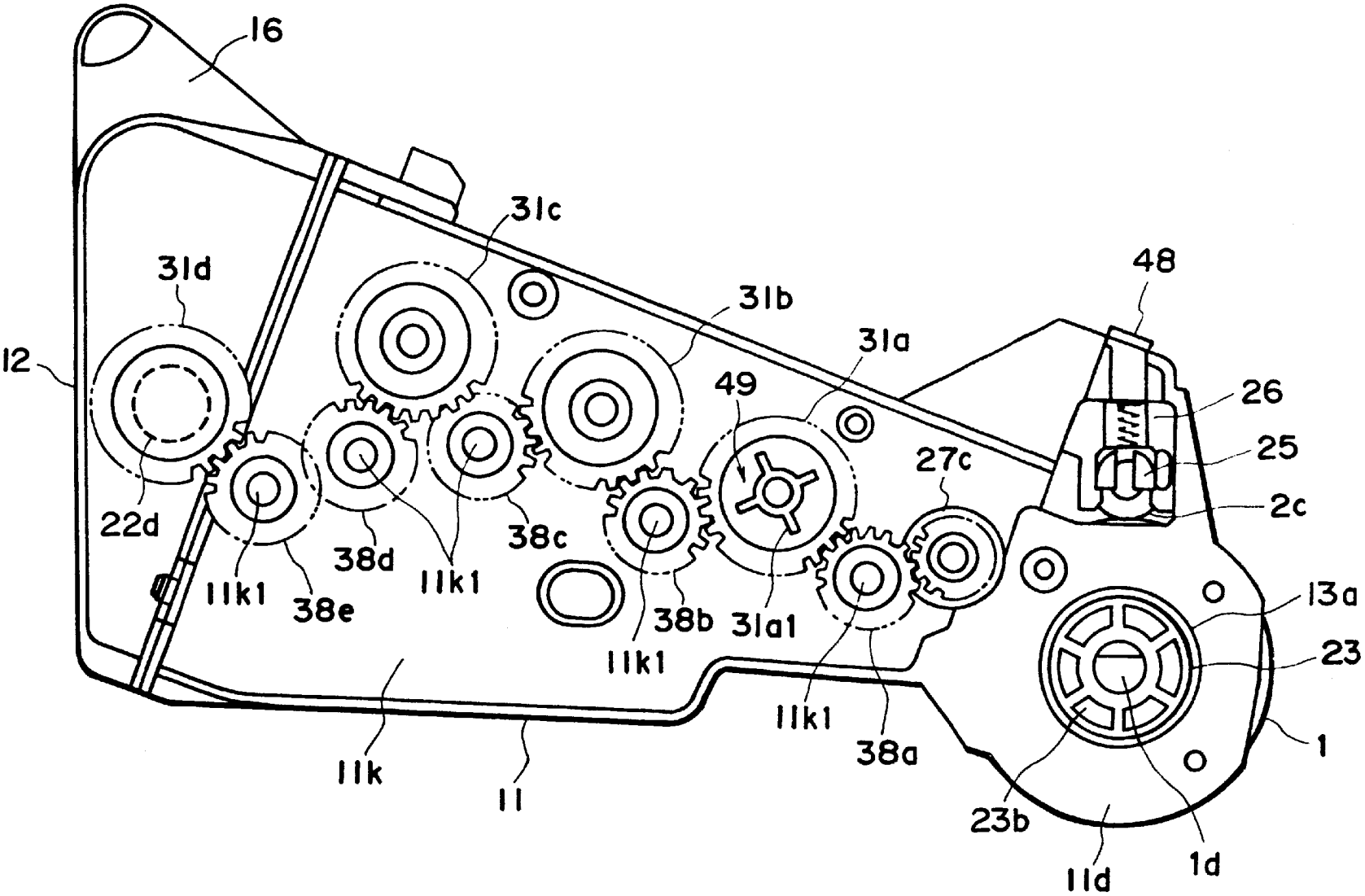
FIG. 24 is a side view of a drive transmission apparatus provided in the process cartridge.

FIG. 24 is a side view of the process cartridge B, the gear cover 13 (side cover on driven side) of which has been removed. FIG. 20 is a schematic cross sectional view of the longitudinal end of the photosensitive drum 1, and the longitudinal end of the first rotational plate 19*a*, an the driven side, in the cleaning means housing portion 11.

Figure 21:
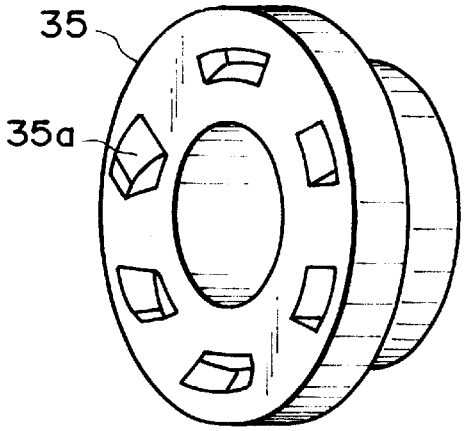
FIG. 21 is a perspective view of a shaft coupling member provided in the main assembly of the apparatus.
Figure 22:
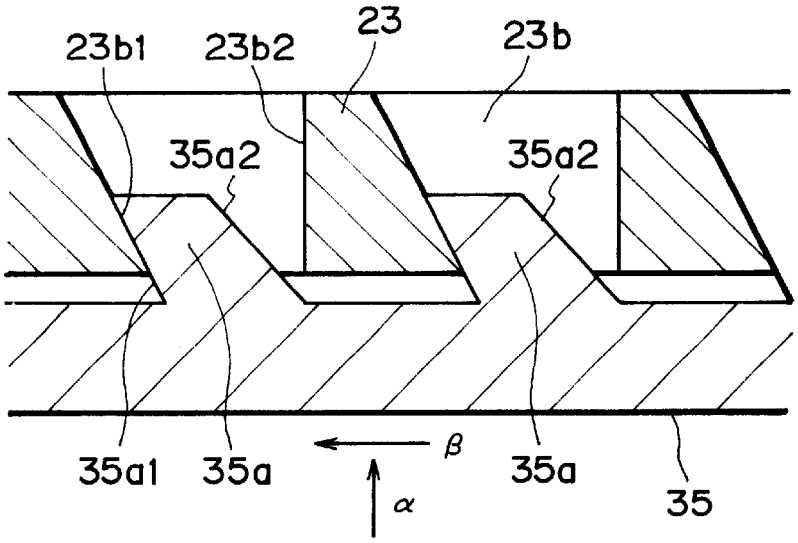
FIG. 22 is a development of a pin portion of the device shown in FIG. 21.

The drum supporting shaft 1*d* of the photosensitive drum 1 is provided with the shaft coupling member 23 which has six holes 23*b* into which the same number of projections 35*a* on the apparatus main assembly 20 side fit one for one. The six holes 23*b* are evenly distributed in a circular pattern about the rotational axis of the drum shaft 1*d*. Referring to FIGS. 21 and 22, the apparatus main assembly 20 is provided with a driving side shaft coupling member 35, which is enabled to move in its axial direction so that it can take two positions: a position at which the projections 35*a* will be in the aforementioned holes 23*b* one for one, and a position at which the projections 35*a* will be completely out of the corresponding holes 23*b*. This shaft coupling member 35 is fixed to the drive shaft 36 which is coaxial with the drum supporting shaft 1*d*, and moves inward or outward in its axial direction. The drive shaft 26 is rotationally supported by the housing 20*d* of the apparatus main assembly 20, being allowed to freely move in its axial direction. The aforementioned holes 23*b* are shaped so that the projections 35*a* are allowed to smoothly fit into, and come out of, the holes 23*b*, one for one, in their axial directions. For example, they are holes, the widths of which in the radial direction of the shaft coupling member 23 are even in terms of the circumferential direction of the shaft coupling member 23.

FIG. 22 is a developed view of the shaft coupling members 23 and 35, which is obtained by cutting the shaft coupling members 23 and 35 by a cylindrical plane, which is coaxial with the shaft coupling members 23 and 35, and runs through the middles of the holes 23*b* and projections 35*a* in terms of the radial directions of the shaft coupling members 23 an 35. As illustrated in FIG. 22, the holes 23*b* and projections 35*a* are provided with a clutching surface 23*b*1 and a clutching surface 35*a*1, respectively, which are flat, and slanted so that as the shaft coupling member 35 on the apparatus main assembly 20 side rotates in the direction indicated by an arrow mark "RO", the clutching surfaces 35*a*1 come into contact with the clutching surfaces 23*b*1 one for one, and the shaft coupling member 35 pulls the shaft coupling member 23 toward the shaft coupling member 35. Each hole 23*b* is formed by two cylindrical or conic surfaces, which oppose each other in the radial direction of the shaft coupling member 23 and are coaxial with the shaft coupling member 23, the aforementioned clutching surface 32*b*1, and a surface 23*b*2 which oppose the clutching surface 23*b*2. Each projection has two cylindrical or conic surfaces which opposes each other in the radial direction of the shaft coupling member 35, the clutching surface 35*b*1, and a surface 35*b*2 which opposes the clutching surface 35*b*1. The clutching surfaces 23*b*1 and 35*a*1, and the surface 23*b*2 and 35*b*2 which oppose the clutching surfaces 23*b*2 and 35*b*2, correspondingly, are flat surfaces which extend in the radial directions of the shaft coupling members 23 and 35. The end surface of the shaft coupling member 23 is a flat surface perpendicular to the axial direction of the shaft coupling member 23. The end surface of each projection 35*a* of the shaft coupling member 35, and the bottom surface of each interval between the adjacent two projections 35*a*, are flat surfaces perpendicular to the axial direction of the shaft coupling member 35. The plane of the clutching surface 23*b*1 of each hole 23*b* of the shaft coupling member 23 is angled relative to the axial line of the shaft coupling member 23, whereas the plane of the surface 23*b*2 which opposes the clutching surface 23*b*1 includes the axial line of the shaft coupling member 23. The plane of the clutching surface 35*a*1 of each projection 35*a* of the shaft coupling member 35 is angled relative to the axial line of the shaft coupling member 35, and the plane of the surface 35*a*2 which opposes the clutching surface 35*a*1 is more angled relative to the axial line of the shaft coupling member 35 than the plane of the surface 35*a*1, so that the projection 35*a* tapers.

Immediately after the process cartridge B configured s described above is installed in the apparatus main assembly 20, the shaft coupling members 23 and 35 are separated from each other in terms of their axial direction, although coaxial. Then, the shaft coupling member 35 moves in the direction indicated by an arrow mark "I" in the drawing, and the projections 35*a* enter the holes 23*b*, one for one. As a result, the shaft coupling member 35 is accurately positioned in terms of its axial direction by an unillustrated stopper on the apparatus main assembly 20 side. Next, as the shaft coupling member 35 rotates, the projections 35*a* move in the direction indicated by the arrow mark "RO", and the clutching surfaces 35*a*1 come into contact with the clutching surfaces 23*b*1 one for one, causing the shaft coupling member 23 to rotate. As described above, the clutching surfaces 23*b*1 and 35*b*1 are angled so that they pull each other. Thus, as the shaft coupling member 35 rotates, the shaft coupling member 23 is pulled toward the shaft coupling member 35, in terms of their axial directions, by the force which applies in the circumferential direction to the clutching surfaces 23*b*1 and 35*a*1 due to rotational resistance.

Figure 23:
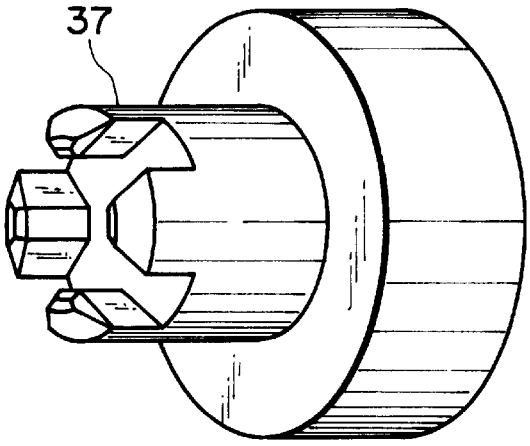
FIG. 23 is a perspective view of a clutch provided in the main assembly of the apparatus.

Also as described above, one of the longitudinal ends of the first rotational plate 19*a* is fitted in the slit 31*s* of the driving gear 31*a*, and the journal portion 31*j* of the driving gear 31*a* is rotationally fitted in the bearing hole 22*a* made in the side plate 11*k*, on the driven side, of the cleaning means housing portion 11. Referring to FIGS. 4, 10, 11 and 20, the outward end surface of the driving gear 31*a* is provided with four ribs, which extend in the radial and axial directions of the driving gear 31*a*, forming a cross as seen from the axial direction. In other words, the driving gear 31 is provided with a projection portion 31*a*1 which functions as one side of clutching means. Referring to FIGS. 20 and 23, the apparatus main assembly 20 is provided with a drive shaft 37*a*, which is rotationally supported, being also allowed to freely move in its axial direction, by the housing 20*d* of the apparatus main assembly 20. The drive shaft 37*a* is provided with a clutch portion 37 with a pair of grooves which perpendicularly intersect with each other, also forming a cross. This clutch portion 37 functions as the other side of the clutching means. In other words, the projecting side

31*a*1 of the clutching means, on the driving gear 31*a* side on the process cartridge B side engages with the clutch portion 37 with the grooves of the drive shaft 37*a* on the apparatus main assembly 20 side. Referring to FIG. 14, the clutch portion 37 with the grooves engages with, or disengages from, the projecting clutch portion 31*a*1, through the through hole 51*d*, which is made in the guiding member 51 of the movable member 50 so as to correspond to the dip portion 51*e* of the guiding surface 51*b*. The drive shafts 36 and 37*a* on the apparatus main assembly 20 side, which correspond to the drive portion of the photosensitive drum 1, and the removed toner conveying member driving force input portion 49, respectively, move in the direction indicated by the arrow mark "I" or the opposite direction, as they receive driving force from the apparatus main assembly 20. The shaft coupling member 35 on the apparatus main assembly 20 side and the clutch portion 37 with the grooves on the apparatus main assembly 20 side, are provided with spring (unillustrated) which generates pressure for pressing the shaft coupling member 35 or clutch portion 37 with the grooves, against the shaft coupling member 23 and projecting side 31*a*1 of the clutch, on the process cartridge B side, after the movement of the shaft coupling member 35 and clutch portion 37 in the direction of the arrow mark "I". Thus, even if the shaft coupling member 35, and clutch portion 37 with the grooves, on the apparatus main assembly 20 side, fail to engage with the shaft coupling member 23 and projecting side 31*a*1 of the clutch, respectively, on the process cartridge B side, in spite of the movement of the shaft coupling member 35 and clutch portion 37 in the direction of the arrow mark "I", the shaft coupling member 35, and the clutch portion 37 with the grooves, immediately engage with the shaft coupling member 23, and projecting side 31*a*1 of the clutch, due to the presence of the pressure from the spring, as soon as the shaft coupling member 35 and clutch portion 37 begin to rotate. The retraction of the shaft coupling member 35 and clutch portion 37 in the direction indicated by the arrow mark "RO" is caused by a disengaging means, the description of which will be omitted.

Referring to FIG. 24, the driving gear 31*a* with the projecting side 31*a*1 of the clutch is in engagement with the rotational square shaft driving gear 27*c* through an idler gear 38*a*, and is in engagement with the driving gear 31*b* through an idler gear 38*b*. The driving gear 31*b* is in engagement with the driving gear 31*c* through the idler gear 38*c*.

Figure 40:
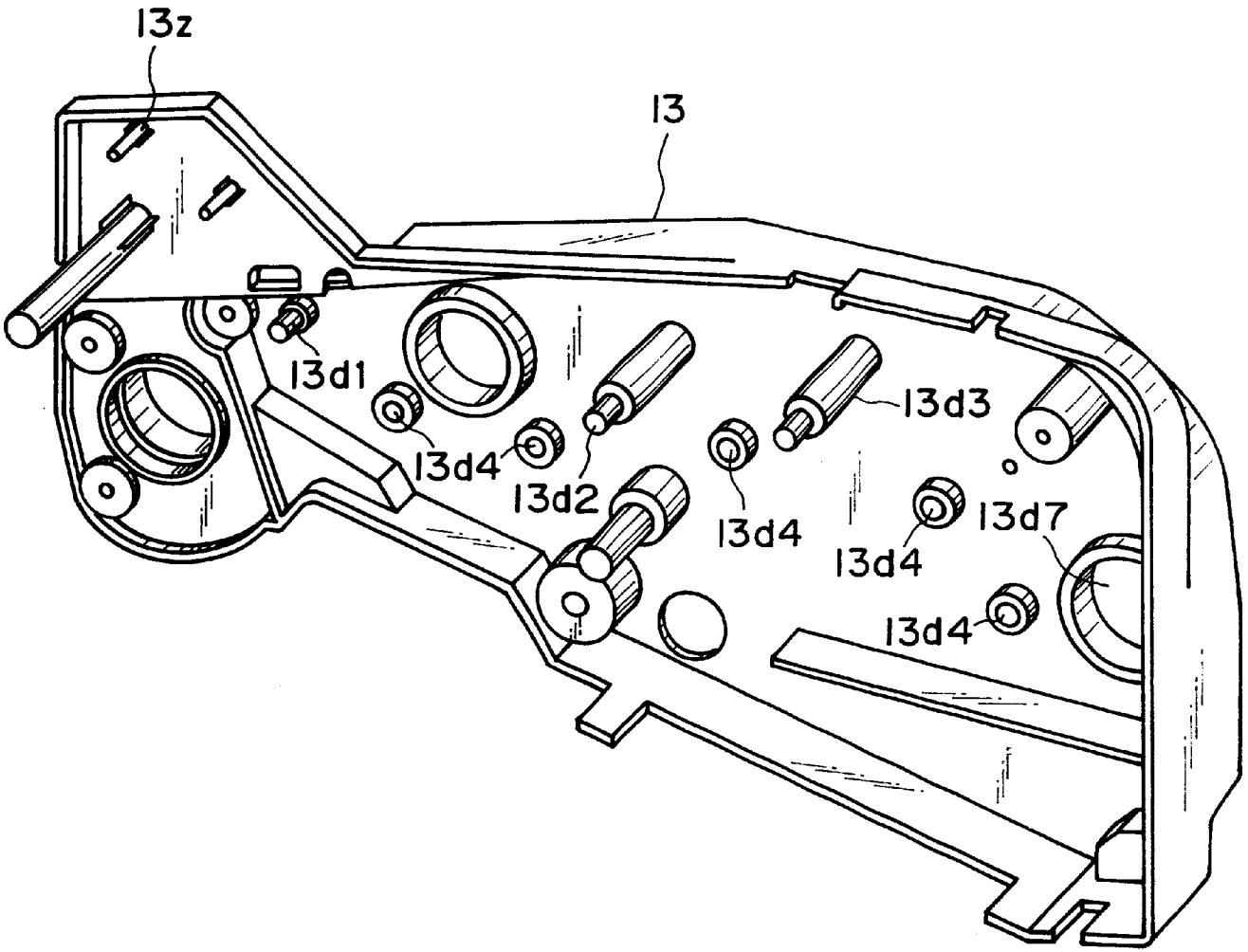
FIG. 40 is a perspective view of a gear cover as seen from inside thereof.

Referring to FIG. 40, the inward surface of the side cover 13 is provided with projections 13*d*1–13*d*3, which are perpendicular to the inward surface of the side cover 13 The projections 13*d*1–13*d*3 fit in the center holes of the rotational square shaft driving gear 27*c*, and the center holes of the driving gears 31*b* and 31*c*, rotationally supporting the rotational square shaft driving gear 27, and the driving gears 31*b* and 31*c*. The projections 13*d*1, 13*d*2, and 13*d*3 each comprises two cylindrical portions different in diameter, having a stepped portion which prevents the outward movements of the rotational square shaft driving gear 27*c* and the driving gears 31*b* and 31*c* in their axial directions. The idler gears 38*a*–38*e* are rotationally supported one for one by the perpendicular projections 11*k*1 on the outward surface of the side plate 11*k* of the cleaning means housing portion 11 (FIG. 4). These projections 11*k*1 fit one for one into the holes 13*d*4 made in the side cover 13. The driving gear 31*d* engaged with the rotational plate 19*d* with the leveling blade 17*d* is rotationally fitted in the cylindrical hole 13*d*7, the wall of which projects inward of the side cover 13.

Referring to FIG. 20, after the installation of the process cartridge B into the apparatus main assembly 20 with the use of the movable member 50, the photosensitive drum 1 and driving gear 31*a* on the process cartridge B side individually receive a driving force from the apparatus main assembly 20 side, through the engagements between the shaft coupling member 35 on the driven side attached to the end of the drive shaft 36, and the shaft coupling member 23, and between the clutch portion 37 with the grooves, attached to the end of the drive shaft 37*a*, and the projecting side 31*a*1 of the clutch.

Regarding the above described cleaning apparatus 6, the toner removed from the photosensitive drum 1 by the cleaning blade 28 after the image transfer from the photosensitive drum 1 is conveyed as the removed toner into the cleaning means housing portion 11. The driving force for rotationally driving the mechanism for filling, in steps, the toner storing first to third sub-portions 11B1–11B3 is transmitted from an mechanical power source (unillustrated) on the apparatus main assembly 20 side to the clutch portion 37 with the grooves, which drives the driving gear 31*a*.

With the provision of the above structure, the driving force is transmitted from the driving gear 31*a* to the rotational square shaft driving gear 27*c* through the idler gear 38*a*, as illustrated in FIG. 24. As a result, the impelling blade 202*d* keeps on rotating in the same direction as the photosensitive drum 1 during the rotation of the photosensitive drum 1. Meanwhile, driving gear 31*a*, idler gear 38*b*, driving gear 31*b*, idler gear 38*c*, driving gear 31*c*, idler gear 38*d*, idler gear 38*e*, and driving gear 31*d*, which sequentially engage with the adjacent gears, rotate at the same time, the rotational square shaft driving gear 27*c* and driving gears 31*a*–31*c* rotating in one direction, and the driving gear 31*d* rotating in the other direction.

(Assembly Method for Cleaning Apparatus)

Next, a method for assembling the cleaning apparatus with the above described structure will be described.

Referring to FIG. 28, when assembling the cleaning apparatus 6, first, the rotational square shaft 202 is fitted by the longitudinal end portions into the corresponding positioning-guiding slots 41*q* of the side plates 41*m* of the cleaning means housing portion partitioning member 41, in such a way that the round portions 202*a* of the rotational square shaft 202 loosely fit in the slots 41*q* and 41*r*. As described above, the positioning-guiding slot 41*q* is narrower at its entrance than the diameter of the round portion 202*a* and is wide enough at its deeper end to allow the round shaft portion 202*a* to loosely fit therein.

Next, the rotational plates 19*a*, 19*b*, 19*c* and 19*d* are inserted into the corresponding holes 41*n* though the slits 41*p*, and then, the cleaning means housing portion partitioning member 41 is inserted into the cleaning means housing portion 11. During this insertion, the guiding grove 41*s* of the cleaning means housing portion partitioning member 41 engages with the internal guide 11*o* of the cleaning means housing portion 11, regulating the position of the partitioning member 41 in terms of the longitudinal direction of the process cartridge B.

Next, the journal 27*d* for supporting one of the longitudinal ends of the rotational square shaft 202, and the rotational square shaft driving gears 27*c* for supporting the other longitudinal end of the rotational square shaft 202, and driving it, are inserted one for one from both lateral sides of the cleaning means housing portion 11.

Since the rotational square shaft 202 is temporarily positioned relative to the cleaning means housing portion partitioning member 41 with substantial accuracy, the shaft 202 is substantially coaxial with the journal 27*d* and gear 27*c* which are to be attached to the shaft 202. Therefore, the journal 27*d* and gear 27 can be easily engaged with the corresponding polygonal portion of the shaft 202. The attachment of the journal 27*d* and gear 72*c* to the shaft 202 accurately positions the shaft 202.

Next, referring to FIG. 28, the cylindrical projection 11*a*1 and square projection 11*a*2 located one for one at the vertical edges of the flange 11*h*1 which surround the wide rear opening of the cleaning means housing portion 11, are fitted into the round and square positioning holes 11*b*1 and 11*b*2 illustrated in FIG. 39. Then, the rear housing portion 12 and cleaning means housing portion 11 are joined by their flanges, which surround the wide openings of the rear housing portion 12 and cleaning means housing portion 11, by supersonic welding.

Thereafter, before the lateral surfaces of the cleaning means housing portion 11 integrated with the rear housing portion 12 by welding, are almost entirely covered with the side cover 13 and end cover 14, respectively, the photosensitive drum 1, charging apparatus 2, and cleaning blade 28 are assembled into the cleaning means housing portion 11, and the charging apparatus cover 15 is attached to the cleaning means housing portion 11.

Figure 25:
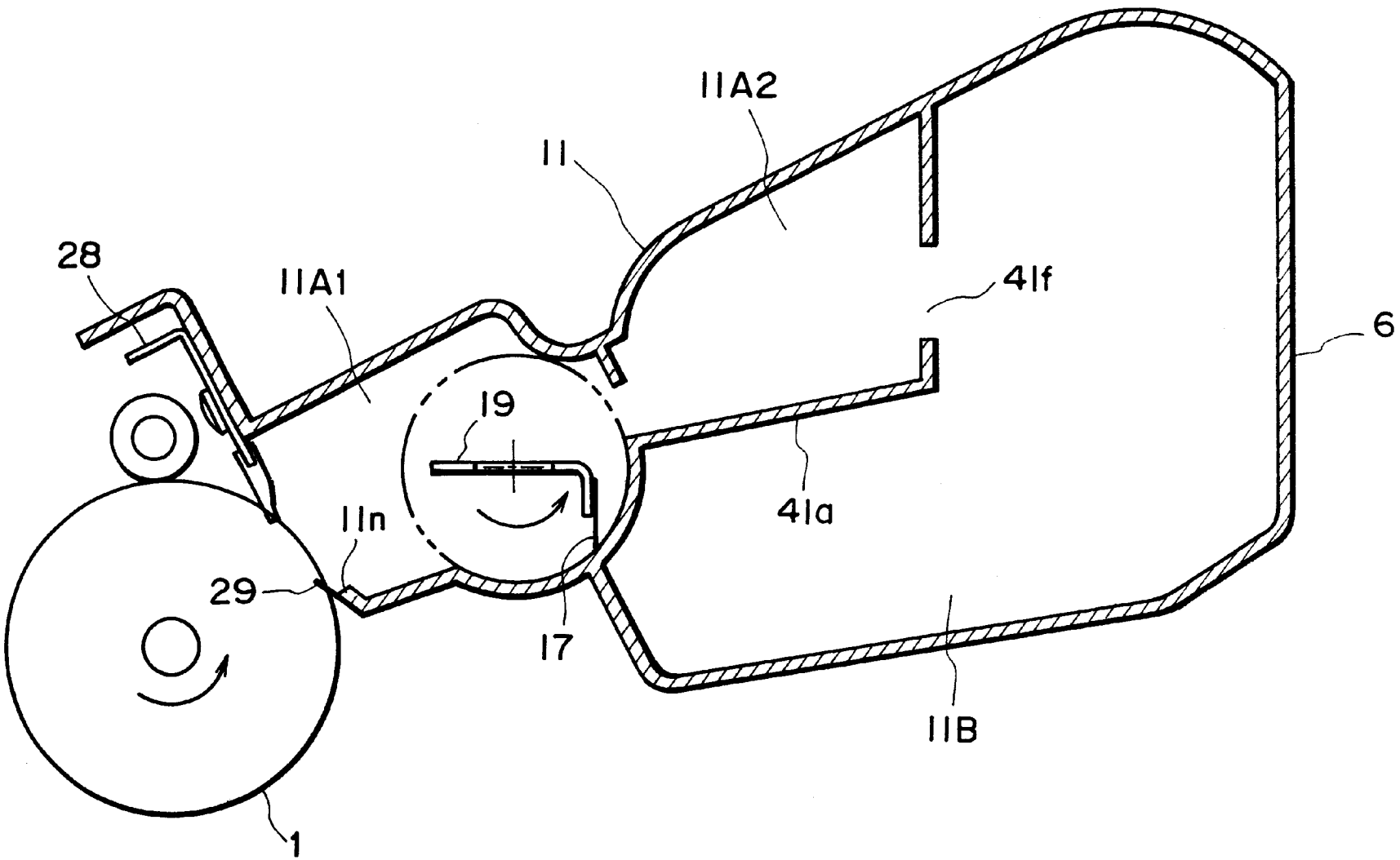
FIG. 25 is a schematic longitudinal sectional view of a cleaning device according to another embodiment of the present invention.

Next, referring to FIG. 25, another embodiment, i.e., the second embodiment, of the cleaning apparatus 6, will be described in detail. The cleaning apparatus 6 stores the toner which remained on the photosensitive drum 1 after the image transfer from the photosensitive drum 1, stores as the removed toner in the cleaning means housing portion 11, with the use of the cleaning blade 28. The removed toner, i.e., the toner removed from the peripheral surface of the photosensitive drum 1, first falls to the adjacency of the opening 11*n* of the toner conveying first sub-portion 11A1, on the photosensitive drum 1 side, and accumulates there. Below the opening 11*n*, there is a raking sheet 29, which is placed in contact with the photosensitive drum 1 at a certain angle, with the application of a certain amount of pressure. The toner which remained on the photosensitive drum 1 after the image transfer passes the raking sheet 29 which is in contact with the photosensitive drum 1, and enters the toner conveying first sub-portion 11A1. However, the toner which was scraped off from the photosensitive drum 1 by the cleaning blade 28 does not pass through the gap between the raking sheet 29 and the photosensitive drum 1, and accumulates there. In the toner conveying first sub-portion 11A1, the toner impelling blade rotates with the rotational plate 19 in the counterclockwise direction of the drawing. The toner impelling blade 17 is structured so that it rotates by directly receiving driving force from a drive shaft on the apparatus main assembly 20 side. This drive shaft is behind the illustrated portion of the cleaning apparatus 6, and is unillustrated. The toner impelling blade 17 impels backward and lifts upward of the housing portion, the toner which has accumulated in the toner conveying first sub-portion 11A1. The cleaning means housing portion 11 is provided with a partitioning member 41*a* which divides the internal space of the cleaning means housing portion 11 into the toner conveying first and second sub-portions 11A1 and 11A2, and a toner storing portion 11B. This cleaning means housing portion partitioning member 41*a* is located at the approximate center of the cleaning means housing portion 11. On the rear side of the partitioning member 41*a*, there is a toner storage opening 41*f* through which the removed toner is sent into the toner storing portion 11B after being conveyed by the impelling blade 17. The partitioning member 41*a* doubles as the bottom wall for the toner conveying second sub-portion 11A2, and is slanted so that the rear side is higher than the photosensitive drum 1 side. The above structural arrangement makes it possible to position the toner storage opening 41*f* slightly above the center portion of the toner storing portion 11B, so that after being sent in through the toner storage opening 41*f*, the removed toner is evenly accumulated to minimize the volume of the dead space which might be created as the removed toner accumulates. Since the toner storage opening 41*f* is positioned at a location in the upper portion of the cleaning means housing portion 11, it is easier for the user to handle the process cartridge B during the installation or removal of the process cartridge B into or out of the apparatus main assembly 20. In other words, even if the photosensitive drum 1 is held upside down by the user, the removed toner in the storing portion 11B does not move back into the toner conveying second sub-portion 11A2, and therefore, the adjacencies of the opening 11*n* of the toner conveying first sub-portion 11A1, on the photosensitive drum 1 side, always remains virtually free of the removed toner, assuring that the cleaning performance of the cleaning apparatus 6 is maintained at a proper level throughout the service life of the photosensitive drum 1.

Next, another embodiment, i.e., the third embodiment, of the cleaning apparatus 6 will be described. In the following, the cleaning apparatus 6 in this embodiment will be described with regard to only the aspects different from those in the second embodiment.

Figure 26:
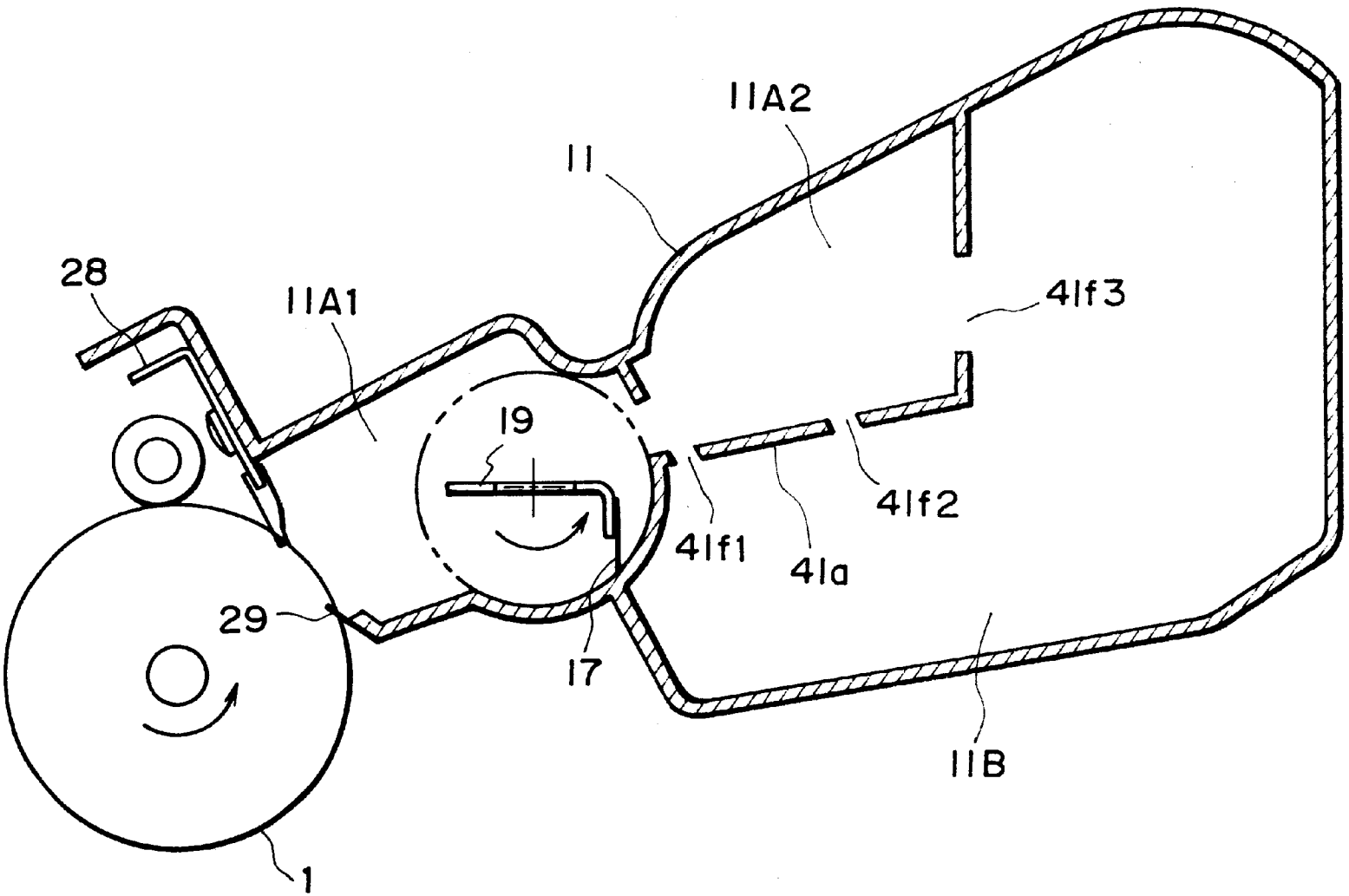
FIG. 26 is a schematic longitudinal sectional view of a cleaning device according to a further embodiment of the present invention.

Referring to FIG. 26, the cleaning means housing portion partitioning member 41*a* of the cleaning means housing portion 11 is provided with a plurality of toner storage openings 41*f*1, 41*f*2 and 41*f*3. The dimensions of these openings in terms of the longitudinal direction of the process cartridge B are substantially the same as the dimension of the impelling blade 17 in the longitudinal direction of the process cartridge B. After being conveyed by the impelling blade 17, the removed toner first falls into the toner storing portion 11B through the toner storage first opening 41*f*1, and accumulates there, until the removed toner accumulates high enough to reach and fill the toner storage opening 41*f*1. Thereafter, the removed toner is conveyed rearward past the toner storage first opening 41*f*1, and reaches the toner storage opening 41*f*2, through which the removed toner falls into the toner storing portion 11B, and accumulates therein, until it accumulates high enough to reach and fill the toner storage opening 41*f*2 as it did the toner storage first opening 41*f*1. Thereafter, the removed toner is conveyed further rearward of the cleaning means housing portion 11, to the toner storage third opening 41*f*3, and falls into the toner storing portion 11B through the opening 41*f*3. With this structural arrangement, the removed toner is accumulated in the toner storing portion 11B in three sequential stages, that is, conveying and accumulating the removed toner, first on the photosensitive drum 1 side, second on the middle, and third on the rear side. Therefore, the removed toner can be evenly accumulated in the toner storing portion 11B, minimizing the volume of the dead space which might be created as the removed toner accumulates. Thus, the amount of the removed toner in the toner conveying first sub-portion 11A1 can be always kept extremely small, making it possible to maintain a proper level of cleaning performance throughout the much increased service life of the photosensitive drum 1, and therefore, making it easier for the user to maintain the apparatus.

Next, referring to FIG. 27, another embodiment, i.e., the fourth embodiment, of the cleaning apparatus 6, will be described. In the following, the cleaning apparatus 6 will be described regarding only its aspects different from those in the third embodiment.

Figure 27:
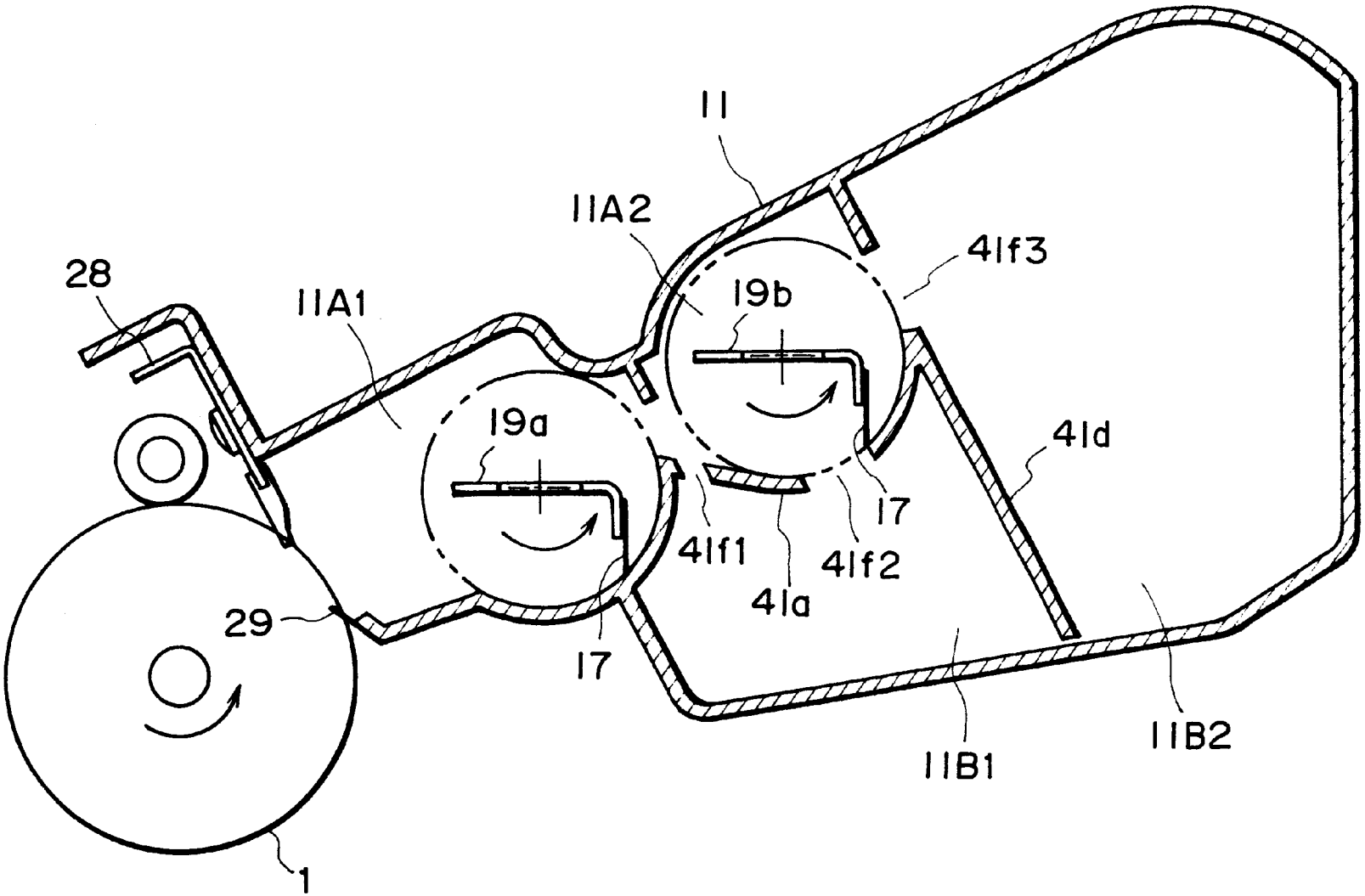
FIG. 27 is a schematic longitudinal sectional view of a cleaning device according to a further embodiment of the present invention.

Referring to FIG. 27, the toner conveying sub-portions 11A1 and 11A2 are provided with a pair of rotational plates

19*a* and 19*b* with an impelling blade 17 as a toner conveying means. The rotational plate 19*a* is structured so that it rotates by directly receiving a driving force from a drive shaft on the apparatus main assembly 20. This drive shaft is located behind the illustrated portion of the cleaning apparatus 6, and is unillustrated. The rotational plate 19*b* receives a driving force from the rotational plate 19*a* through the gear train which connects the rotational plate 19*b* to the rotational plate 19*a*. Both rotational plates 19*a* and 19*b* rotate counterclockwise. They are positioned so that the rotational plate 19*a* is on the photosensitive drum 1 side, and the position of the rotational axis of the rotational plate 19*b*, which is on the rear side of the rotational plate 19*a*, becomes higher than that of the rotational plate 19*a*. In other words, the cleaning apparatus 6 in this embodiment is structured so that after being conveyed to the adjacencies of the second rotational plate 19*b* by the first rotational plate 19*a*, the removed toner is lifted upward of the toner storing sub-portion 11B2 as the removed toner is conveyed further rearward. This structural arrangement improves the toner conveying first and second sub-portions 11A1 and 11A2 in terms of their capacities to convey the removed toner rearward, making it hard for the removed toner to accumulate on the immediate rear side of the photosensitive drum 1. Therefore it is possible to maintain the cleaning performance at a proper level throughput the service life of the photosensitive drum 1. The effects of the division of the toner storing portion 11B into the toner storing first and second sub-portions 11B1 and 11B2 with the use of the toner storing portion partitioning member are the same as the effects provided by the structural arrangement of the cleaning apparatus 6 in the first embodiment. The structural arrangement in this embodiment illustrated in FIG. 27 may be modified so that unlike in this embodiment, the toner storing portion 11B is not completely partitioned with the use of the toner storing portion partitioning member 41*d*.

As described above, unlike a conventional process cartridge, the cleaning means housing portion which allows the cleaning performance to be maintained at a proper level up to the reasonably high print counts in terms of the conventional standard, according to the prevent invention, a process cartridge is equipped with a photosensitive drum with an extremely long service life in terms of print count, and comprises: a toner storing portion partitioning member which partitions the interior of the cleaning means housing portion of the process cartridge B into two portions, that is, a top portion for conveying the removed toner, and a bottom portion for storing the removed toner, a toner storing portion partitioning member for partitioning the removed toner storing portions into two or more sub-portions which align in the toner conveyance direction; a toner conveying portion partitioning member for partitioning the toner conveying portion into two or more sub-portions, and one or more rotational plates as toner conveying means. Therefore, even if the process cartridge is removed from, or installed into, the main assembly of an image forming apparatus to carry out a maintenance operation during image formation, or is simply moved outside the apparatus main assembly, the removed toner does not pile up adjacent to the opening which faces the photosensitive drum 1, making it possible to keep the opening free of the removed toner, and therefore, making it possible to maintain the cleaning performance of the cleaning apparatus at a proper level. Also, it is possible to prevent the removed toner from leaking from the opening while the process cartridge B is handled. Thus, the process cartridge B can be comfortably used for a long period of time.

Further, the toner conveying portion partitioning member which horizontally partitions the cleaning means housing portion into two sub-portions, that is, top and bottom sub-portions, is provided with a plurality of toner storage openings, the dimensions of which in terms of their longitudinal directions are substantially the same as the dimension of the cleaning means housing portion in terms of its longitudinal direction. In other words, a plurality of passages through which the removed toner can be sent from the toner conveying portion into the toner storing portion. Therefore, it becomes possible to eliminate the phenomenon that the removed toner unevenly accumulates by being dropped through only a single toner storage opening. As a result, it becomes less likely for dead space to be formed in the removed toner storing portion. In other words, the removed toner can be efficiently stored in a limited amount of space.

Further, a pair of transparent windows for a light transmission type system for detecting whether or not the toner storing portion has been filled up with the removed toner are provided in the rearmost portion of the toner storing portion of the cleaning means housing portion, which is divided into two sub-portions, that is, the top and bottom sub-portions, by the cleaning means housing portion partitioning member, and further, one or more leveling blades as means for leveling the removed toner as the removed toner accumulates, are provided in the toner storing portion. Therefore, the possibility that the removed toner accumulates only adjacent to the transparent windows, and causes the toner fill-up detecting means to erroneously operate in spite of the presence of a sufficient amount of space for toner accumulation, is eliminated, improving the accuracy with which the full state of the toner storing portion is detected.

Regarding the rotational direction of the leveling blade, the leveling blade is structured to rotate in a direction to move the removed toner away from the transparent windows for detecting the full condition of the toner storing portion, so that the removed toner does not fill the adjacencies of the transparent windows. Therefore, the possibility that the removed toner accumulates only adjacent to the transparent detection windows, and causes the toner fill-up detecting means to erroneously operate in spite of the presence of a sufficient amount of space for toner accumulation, is eliminated, improving the accuracy with which the full state of the toner storing portion is detected.

The present invention is also characterized in that the cleaning means housing portion partitioning member for horizontally partitioning the interior of the cleaning means housing portion into two portions, that is, the toner conveying portion on the top side and the toner storing portion at the bottom, is formed as a member independent from the cleaning means housing portion, and also, this partitioning member is provided with an insertion guide, i.e., a hole, which is made in the anchoring plate 41*i* to facilitate the insertion of the partitioning member into the cleaning means housing portion. With this arrangement, the shape of the cleaning means housing portion does not become complicated, affording more latitude in terms of the apparatus design. Further, the insertion guide with which the cleaning means housing interior space partitioning member is provided makes it easy to fix the partitioning member to a predetermined position, improving the assembly efficiency, and also reducing the number and severity of assembly errors.

Further, this cleaning means housing portion partitioning member independent from the cleaning means housing portion is provided with one or more rotational plate supporting holes 41*n* with a slit 41*p*, which function as the means for temporarily fixing the positions of the rotational axes of the removed toner conveying rotational plates, with reasonable accuracy. Therefore, when assembling the cleaning means housing portion partitioning member into the cleaning means housing portion, the rotational plates fitted in the cleaning means housing portion partitioning member, and temporarily positioned relative to the cleaning means housing portion partitioning member, can be assembled all at once into the cleaning means housing portion along with the partitioning member, so that as the cleaning means housing portion partitioning member is disposed at a predetermined position in the cleaning means housing portion, the rotational plates are temporarily disposed substantially at their predetermined positions. Therefore, it becomes easy to assemble the rotational plates into the cleaning means housing portion, improving the assembly efficiency.

Further, the cleaning means housing portion partitioning member independent from the cleaning means housing portion is provided with a means for temporarily positioning the rotational axis of the removed toner conveying first member for conveying the removed toner immediately after the removal of the toner from the photosensitive drum 1. Therefore, when assembling the cleaning means housing portion partitioning member into the cleaning means housing portion, the removed toner conveying first member fitted in the cleaning means housing portion partitioning member, and temporarily positioned relative to the cleaning means housing portion partitioning member, can be assembled into the cleaning means housing portion along with the partitioning member so that as the cleaning means housing portion partitioning member is disposed at a predetermined position in the cleaning means housing portion, and the removed toner conveying first member is temporarily disposed substantially at their predetermined positions, Therefore, it becomes easy to assemble the removed toner conveying first member into the cleaning means housing portion, improving the assembly efficiency.

Further, the cleaning means housing portion partitioning member independent from the cleaning means housing portion is provided with a pair of positioning guides for guiding and positioning the removed toner conveying first member during the assembly of the first member. Therefore, it is assured that the position of the removed toner conveying first member relative to the photosensitive drum remains stable. In addition, this arrangement does not require separate components for guiding and positioning the removed toner conveying first member, making it possible to reduce the component count, which leads to structural simplification.

(Structure of electrical contacts)

A description will be provided as to the connection and the arrangement of the electrical contacts for electric connection between the process cartridge B and the image forming apparatus A.

As shown in FIGS. 10–12, the process cartridge B is provided with a plurality of electric contacts.

More particularly, 1) driving side or non-driving side supporting shaft 14*g* or 1*d*, which functions as an electroconductive grounding contact electrically connected with the photosensitive drum 1 to electrically ground the photosensitive drum 1 to the image forming apparatus A;

a high voltage charging contact plate 48 electrically connected with a metal shaft 2*a* of the charging roller 2*c* to apply a charging bias voltage to the charging roller 2*c* from the image forming apparatus A; and (3) a connector 71 provided in the process cartridge B to supply the information from the apparatus A to a storing member provided in the process cartridge so as to store the information relating to the process cartridge B.

(structure of the drum grounding contact)

Figure 55:
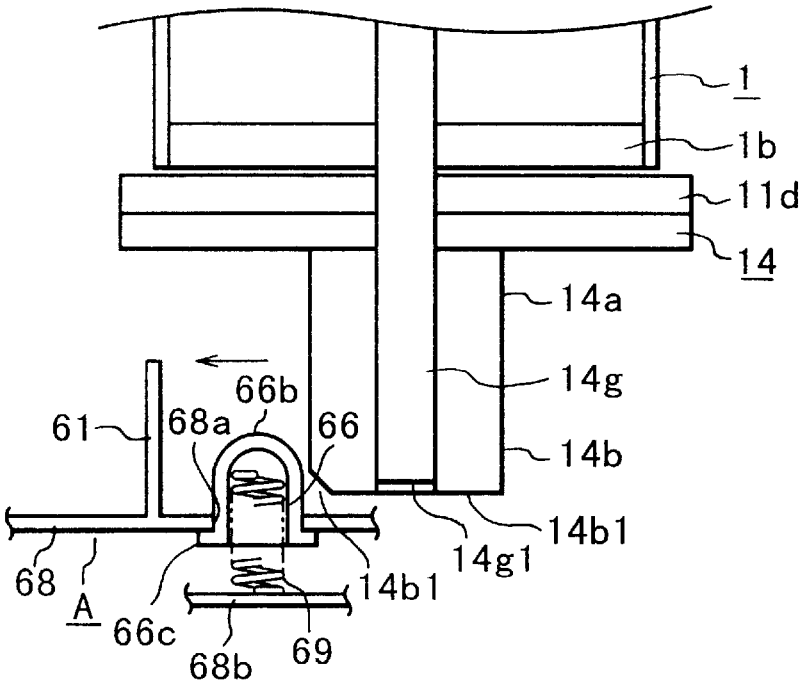
FIG. 55 is a horizontal sectional view illustrating access to a drum grounding contact.
Figure 55:
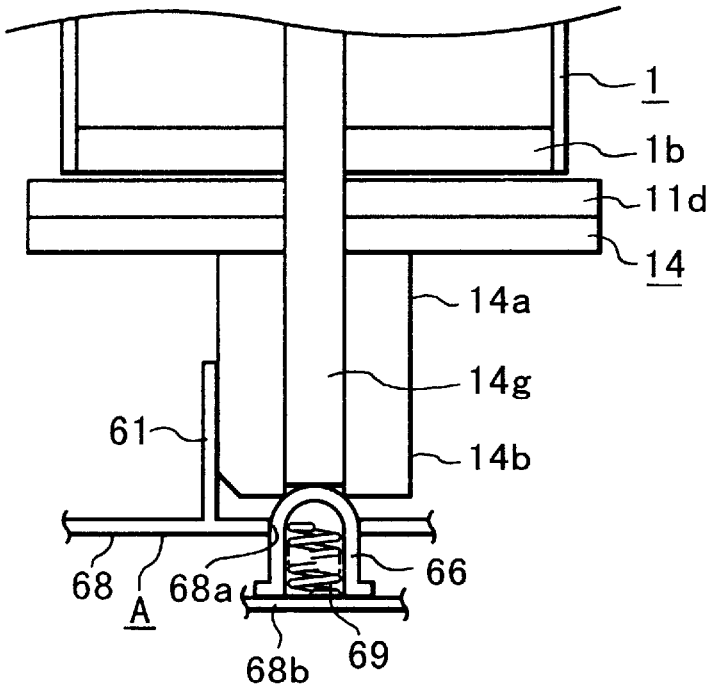

The drum supporting shaft 14*g* which has been provided by insertion molding integrally with the end cover 14 described in the foregoing, is contacted to the main assembly side grounding contact 66 on the axis of the photosensitive drum 1, as shown in FIG. 55.

As shown in FIG. 55, the main assembly side grounding contact 66 is a hollow metal cylinder having a diameter of approximately 5 mm, and has a semispherical free end, and is supported, for sliding motion in the longitudinal direction of the photosensitive drum, in a hole 68*a* of a plate 68 in the main assembly coaxial with the main assembly side engageable member 61 at the non-driving side.

The main assembly side engageable member 61 at each side has a center on a longitudinal line, and as seen from the righthand side in FIG. 55, it is in the form of a half-pipe of which the righthand side is open.

In the main assembly side grounding contact 66, there is provided a compression coil spring 69 compressed to provide an urging force toward the inside in the longitudinal direction of the photosensitive drum, and the compression coil spring 69 is contacted to a spring seat 68*b* fixedly provided.

The material of the guide portion 14*b* is a plastic resin material, so that drum supporting shaft 14*g* is not damaged even by mounting or demounting of the process cartridge B relative to the moveable member 50 or by handling after it is demounted.

As shown in FIG. 16 which is a sectional view taken along a plane including the axis of the photosensitive drum 1, the grounding plate 1*f* is engaged in the aluminum cylinder 1*c* so as to be elastically urged to the drum supporting shaft and to the aluminum cylinder 1*c*.

As shown in FIG. 17, the grounding plate 1*f* is provided at the side for engagement with the aluminum cylinder 1*c* with a projection 1*h* provided by the provision of groove 1*g*, and when it is outside the aluminum cylinder 1*c*, the distance between the free ends of the projections 1*h* across the center of the aluminum cylinder 1*c* is slightly larger than the inner diameter of the aluminum cylinder 1*c*.

The grounding plate 1*f* is provided with a hole 1*j* through which the drum supporting shaft 14*g* is penetrated, and a groove 1*i* is formed expanded from the hole 1*j*, in which a leaf spring portion 1*k* in the form of a cantilever is provided to expand toward the center of the photosensitive drum.

The free end portion of the leaf spring portion 1*k* is bent adjacent the enter of the drum supporting shaft 14*g* so as to be opposed and press-contacted to the end surface of the drum supporting shaft 14*g*, into a triangular shape to form a contact portion 1*o*.

The leaf spring portion 1*k* is provided perpendicularly relative to a diameter connecting the projections 1*h* contacted to the aluminum cylinder 1*c*.

The non-driving side drum flange 1*b* to which a grounding plate 1*f* is fixed by welding or the like to rib 1*n* of the non-driving side drum flange 1*b*, is fixed by bonding, clamping or the like to the end of the aluminum cylinder 1*c*.

When the non-driving side drum flange 1*b* to which the grounding plate 1*f* is fixed, is engaged in the axial direction into the aluminum cylinder 1*c*, the projection 1*h* is inclined relative to the line perpendicular to the aluminum cylinder 1*c*, and the free end of the projection 1*h* bites into the aluminum cylinder 1*c*, by which it is fixed to the aluminum cylinder 1*c*.

Additionally, the driving side drum flange is fixed to the other end portion of the aluminum cylinder 1*c*.

As described in the foregoing, the drum supporting shaft 14*g* fixed to the end cover 14 is engaged with the hole portion 1*ba* of the drum flange 1*b* to rotatably support the photosensitive drum 1 on the cleaner container 11, the leaf spring portion 1*k* of the grounding plate 1*f* deforms by approximately 3–5 mm.

At this time a contact pressure of approximately 50–100 g is produced in the axial direction of the drum supporting shaft 14*g*, by which the electrical contact is stabilized.

When the leaf spring portion 1*k* is in the deformed state, the contact portion 1*o* is contacted to the center of the drum supporting shaft 14*g*, and even during the rotation of the photosensitive drum 1, the contact portion 1*o* is substantially free of friction force.

The grounding plate 1*f* of stainless steel plate, phosphor bronze plate, beryllium bronze plate or another electroconductive spring material, so that aluminum cylinder 1*c* and the drum supporting shaft 14*g* are electrically connected through the grounding plate 1*f*.

A description will be provided as to access to the grounding contact in the process of insertion of the movable member.

When the drum supporting shaft 14*g* of the process cartridge B does not reach the main assembly side grounding contact 66, the flange 66*c* thereof is abutted to the edge of the hole 68*a* of the main assembly side plate 68 by the urging force of the spring 69 flange 66*c*, and the free end portion 66*b* is extended out from the side plate 68 of the main assembly of the apparatus by approximately 3–5 mm, as shown in FIG. 55, (*a*).

When the movable member 50 is inserted further, a C surface portion 14*b*1 of the guide portion 14*b* of the non-driving side end cover is adapted to he free end portion 66*b* of the main assembly side rounding contact 66 (FIG. 55, (*a*)).

When it is further inserted, the main assembly side grounding contact 66 is urged by the C surface of the guide portion so that compression coil spring 69*a* is compressed.

Here, the fact that the C surface 14*b*1 of the end cover 14 is subjected to the impact is attributable to the insertion of the movable member 50, but no metal powder is produced because the guide portion 14*b* is made of plastic resin material.

In the final stage, the cylindrical positioning boss 14*a* of the end cover 14 is engaged with the main assembly side engageable member 61 of the main assembly 20 of the apparatus, so that the axis of the drum supporting shaft 14*g* of the end cover 14 is aligned with the axis of the main assembly side grounding contact 66.

At this time, the urging spring 66*a* is in the deformed state, so that contact pressure of approximately 200 g is produced in the direction of the axis of the drum supporting shaft 14*g*, so that electrical contact is stabilized.

As described in the foregoing, by coating the drum supporting shaft 14*g* of metal with the plastic resin material, the impact caused by the metal-to-metal abutment can be avoided so that access to the grounding contact is stabilized without the production of metal powder.

(structure of the high voltage charging contact)

An outer contact 48*a* of the high voltage charging contact plate 48 is exposed at the upper surface 15*e* of the charging device cover 15 which has been described in the foregoing.

The charging device cover 15 has the trapezoidal cross-section taken along a plane perpendicular to the longitudinal direction, and the outer contact 48*a* is substantially flush with the flat upper surface 15*e* of the charging device cover 15.

Figure 60:
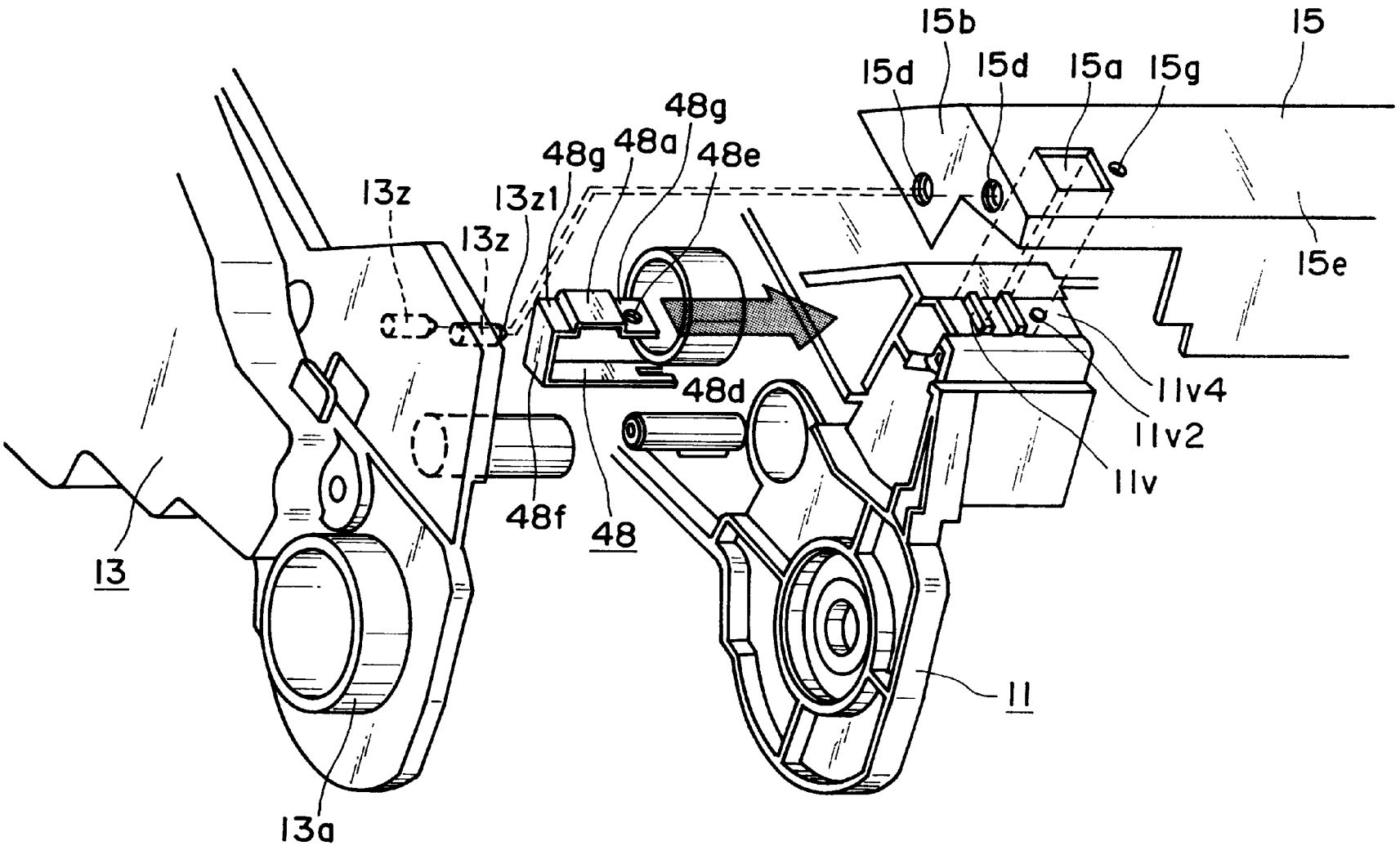
FIG. 60 is a perspective view wherein a charging high voltage contact, a charging device cover and a gear cover are assembled into a cleaner container.

The high voltage charging contact plate 48 is shown in detail in FIGS. 18, 19, 60 which show a bearing portion for supporting the charging roller 2*c*.

The cleaner container 11 is a provided with a bearing guide 11*l* in the supporting portion for the charging device at each of the opposite longitudinal end portions of the vertical wall 11*s* FIG. 3) above the photosensitive drum 1, and the bearing guide 11*l* is integrally molded with the drum supporting portion.

The upper portion of the bearing guide 11*l* has a trapezoidal configuration as seen in the axial direction of the photosensitive drum 1 and is in conformity with the charging device cover 15.

The cross-section taken along a plane perpendicular thereto is angular, and constitutes a holding portion 11*v* for the charging bias contact.

However, the proportion of the bearing guide 11*l* at the non-driving side is retracted from the trapezoidal configuration (not shown).

Then, the bottom edge of the charging device cover 15 cover 15 in the longitudinal direction is contacted to the cleaner container 11.

The high voltage contact plate 48 for the charging is provided at one longitudinal end of the cleaner container 11.

The high voltage contact plate 48 is made of stainless steel plate, phosphor bronze plate, beryllium bronze plate or another metal plate, which is bent substantially perpendicularly at a plurality of positions.

The upper portion of the holding portion 11*v* for the charging bias contact is provided with a dowel 11*v*2 to engage with a positioning hole 48*e* formerly in an end reception surface 48*g* which is one of the reception surfaces 48*g* provided stepped down at each side of the outer contact 48*a* of the high voltage charging contact plate 48 of the cover 15 for the charging device.

The dowel 11*v*2 is extended upwardly to the level sufficient to engage in the positioning hole 15*g* formed in the upper surface 15*e* of the charging device cover 15.

That is, the dowel 11*v*2 functions to correctly position the high voltage charging contact plate 48 and the charging device cover 15 relative to each other.

The dowel is a provided with a recessed seat 11*v*4 which is slightly deeper than the plate thickness of the reception surface 48*g* with which the positioning hole 48*e* is engaged.

Additionally, an upper projection 11*v*1 is expanded upwardly so that it is contacted to the backside of the outer contact while the reception surface 48*g* is contacted to the recessed seat 11*v*4.

The upper projection 11*v*1 is extended in the direction perpendicular to the longitudinal direction, and is away from the stepped portion of the outer contact 48*a* in the longitudinal direction.

An upper spring seat of the charging roller urging spring 26 is provided with a dowel 11*v*3.

The high voltage charging contact plate 48 includes a reception surface 48*f* extending along and in contact with the outer top and bottom edges from a reception surface 48*g* which is opposite from the end contacted to the upper surface of the holding portion 11*v* for the charging bias contact, bending toward longitudinally outwardly below an outer recessed seat 11*v*4, and further includes a forked portion 48*d* engaged with a dowel 11*v*3, which is further extended toward the bottom from the outer surface of the contact holding portion 11*v* for the charging bias.

The charging roller urging spring 26 is in the form of a compression coil spring, and has an end contacted to a fork portion 48*d* and the other end engaged with the charging roller bearing 25 of electroconductive material.

With such a structure of the high voltage charging contact plate 48, when the high voltage charging contact plate 48 is urged in the direction indicated by the arrow into the holding portion 11*v* for the charging bias contact while expanding the end portions against the elastic force, the reception surface 48*g* is abutted to the recessed seat 11*v*4 at the outer contact 48*a* side, and the positioning hole 48*e* is engaged with the positioning dowel 11*v*2, and the outer contact 48*a* is contacted to the upper projection 11*v*1, and the fork portion 48*d* is engaged with the dowel 11*v*3. Thus, the mounting of the high voltage charging contact plate 48 to the cleaner container 11 is very simple.

In order to retain the high voltage charging contact plate 48 on the cleaner container 11, as shown in FIG. 60, one free end 13*z*1 of the boss portion 13*z* penetrating the hole 15*d* of the end plate 15*b* of the charging device cover 15 is provided adjacent the reception surface 48*f* for the high voltage charging contact plate 48.

As described in the foregoing, the high voltage charging contact plate 48 is urged to the holding portion 11*v* for the charging bias contact while expanding the open side provided by bending the metal strand material into a channel shape, by which the positioning hole 48*e* is engaged with the positioning projection 11*v*2, and the fork portion 48*d* is engaged with the dowel 11*v*3, so that it is easily assemble without using tools.

In the assembled state, the position of the high voltage charging contact plate 48 is correctly determined relative to the cleaner container 11.

A description will be provided as to access to the high voltage charging contact during insertion of the movable member 50.

The main assembly side Charging high voltage contact 67 is engaged for movement substantially in the article direction with a hole 67*a*1 of a charging contact support block 67*a* supported on the lower cover 64 of the scanner.

In the charging high voltage contact 67, an urging spring 67*b* is seated on an unshown spring seat of the main assembly 20 of the apparatus at its one end, the urging spring 67*b* being compressed to produce a downward urging force.

Figure 56:
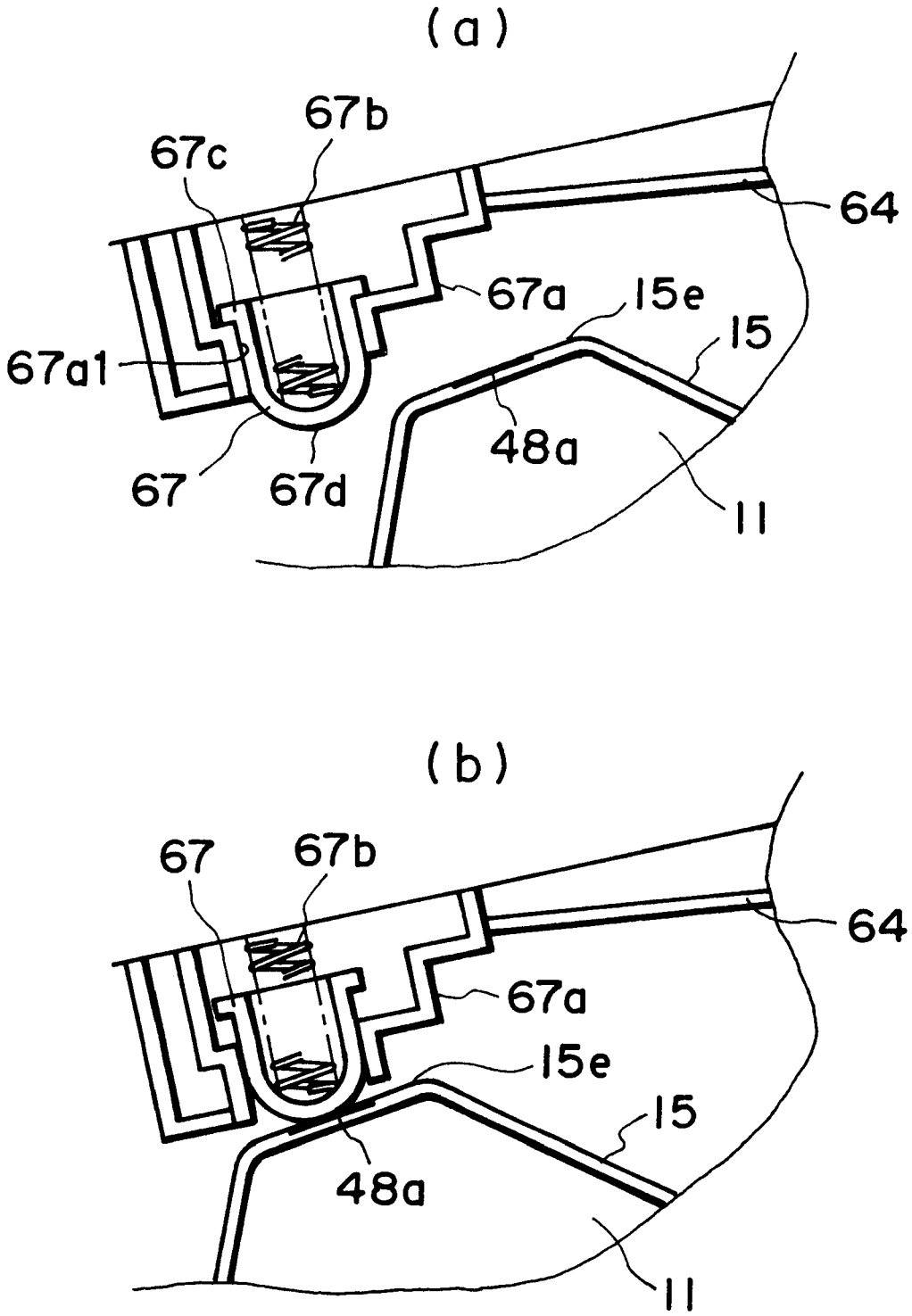
FIG. 56 is a longitudinal sectional view illustrating access of a charging high voltage contact.

Before mounting of the movable member 50 (FIG. 56, (a)), the urging spring is in a free state, and the flange 67*c* of the main assembly side charging high voltage contact urged by the spring force of the urging spring 67 is contacted to the edge of the hole 67*a*1, and the free end portion 67*c* of the main assembly side charging high voltage contact 67 is extended beyond the charging contact support block 67*a* by approximately 3 to 5 mm.

The outer contact 48*a* extends downward toward the front, as seen in the horizontal inserting direction of the movable member 50 into the main assembly 20 of the apparatus. When the movable member 50 is inserted into the main assembly 20 of the apparatus (FIG. 56, (b)), the outer contact 48*a* urges the main assembly side charging high voltage contact 67 in the form of a plunger having a spring against the spring force of the spring 67*b* to establish the contact.

At this time, the main assembly side charging high voltage contact 67 produces a contact pressure of approximately 200 to 300 g to the outer contact 48*a* so that electrical contact is stabilized.

The main assembly side charging high voltage contact 67 is the supplied with an alternating voltage and a DC voltage from the voltage source controlled by a control device of the main assembly 20 of the apparatus to uniformly charge the photosensitive layer of the surface of the photosensitive drum 1 through the high voltage charging contact plate 48, the charging roller urging spring 26, the charging roller bearing 25, and the charging roller 2*c*.

The outer contact 48*a* is provided at the driving side in the upper surface of the charging device cover 15. As shown in FIG. 10, the upper surface 15*e* of the charging device cover 15 is provided at the non-driving side with a laser shutter opening and closing rib 11*z* which is integrally molded with the cleaner container 11 and which is projected through the opening 15*f* formed in the upper surface 15*e*.

The outer contact portion 48*a* and the rib 11*z* are disposed on a line parallel with the photosensitive drum 1.

Therefore, when employees insert a cartridge, the outer contact portion 48*a* and the laser shutter opening and closing rib 11*z* can be substantially simultaneously accessed, so that insertion resistances at the right and left sides are substantially equivalent to make the insertion easier.

(electronic memory such as storing means of the process cartridge)

In the image forming apparatus according to this embodiment, when a function of a constituent element in the process cartridge is deteriorated by, for example, long-term use, the entire process cartridge is exchanged.

The exchanging operation is a one-touch operation wherein the main assembly of the image forming apparatus is opened, and the used process cartridge is taken out from the main assembly, and then a fresh process cartridge is mounted into the main assembly. The operation is so easy that it can be performed by a user, thus accomplishing a maintenance-free image forming apparatus.

According to this embodiment, the following function or functions can be added to improve the usability.

(1) The process cartridge may be provided with an electronic device, such as memory, which stores data such as the manufacturing condition before shipment from a plant, so that when the process cartridge is mounted to the main assembly of the image forming apparatus, the image forming apparatus refers to the data to optimize the image forming operation.

(2) The number of image formations or time duration of the image formations may be stored in the memory to obtain the integrated time period of use of the process cartridge.

Diagnostic data of the main assembly of the image forming apparatus are stored in the memory of the process cartridge, by which upon the occurrence of an abnormality or a maintenance operation, the servicing person can refer to the data to accomplish quick service (self-diagnosis function).

When the above described function or functions are added to the image forming apparatus, the unit such as a process cartridge which is a detachably mountable to the main assembly, is a provided with an electronic bias such as EEPROM.

Figure 36:
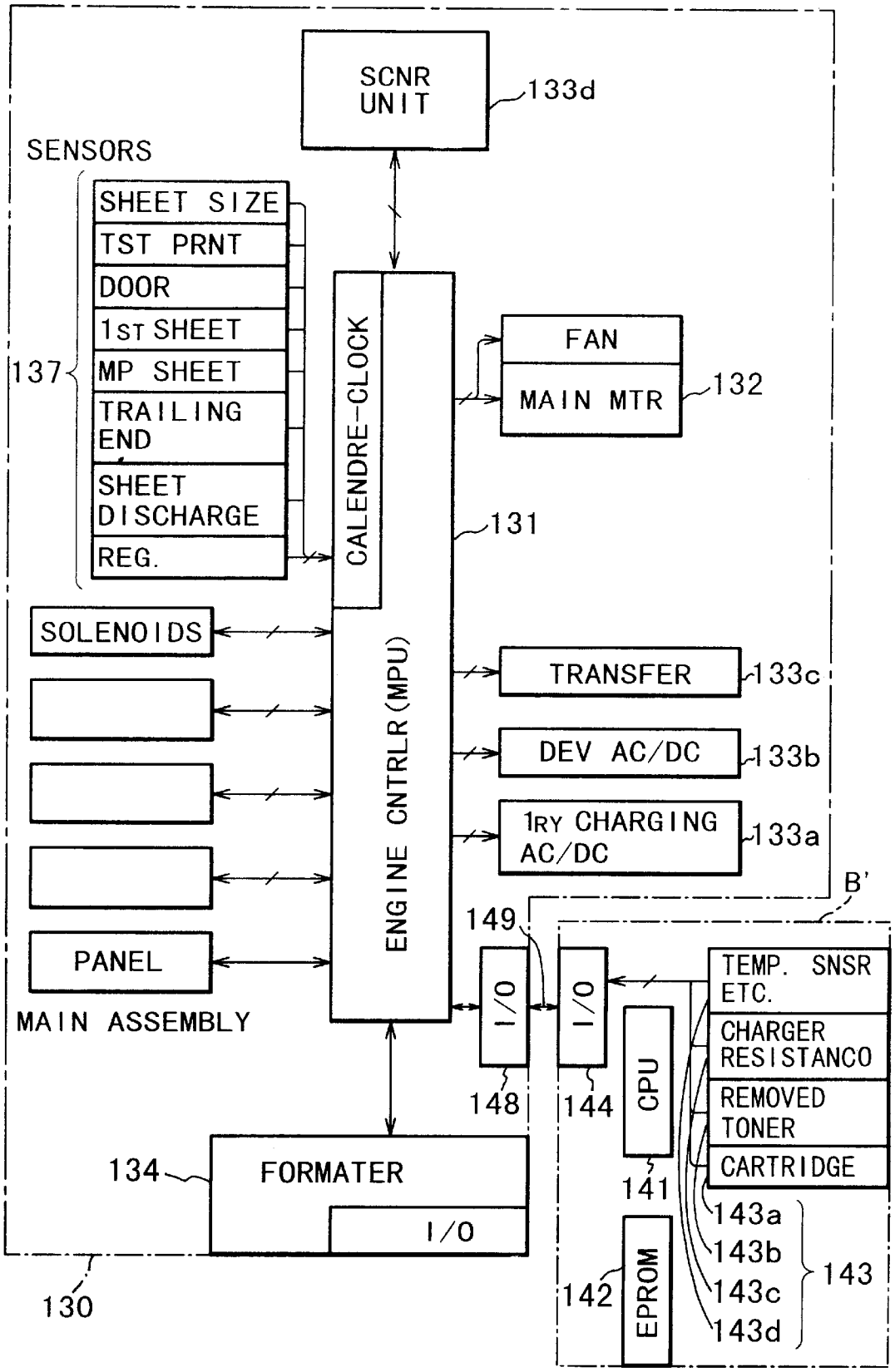
FIG. 36 is a control block diagram of an image forming apparatus.

FIG. 36 is a control block diagram of a process cartridge and a main assembly of an image forming apparatus according to another embodiment of the present invention.

In this Figure, there is shown only a control system omitting the voltage source line or the like.

A description will be provided as to the basic control of the image forming apparatus, first.

In FIG. 36, a portion of the electronic device is enclosed with a chain line 130.

An engine controller (MPU) 131 is provided with control processing, a memory, an inside block and input/output function, which may be in the form of an ordinary ASiC of the like.

Connected to the engine controller 131 are a main motor control block 132, a primary charging potential current control block 133*a*, a developing bias voltage control block 133*b*, primary and secondary transfer voltage control block 133*c* and a scanner unit control block 133*d*, and the blocks are controlled under the program in the engine controller 131.

The image forming apparatus A is provided with various sensor switches 137, and the outputs of the sensor switch group 137 are supplied to the engine controller 131, so that operation situations in the print operational sequence are monitored by the engine controller 131.

The engine controller 131 is connected with a formater 134.

The formater 134 has I/O functions relative to external devices, a storing function of printing formats and a courting function of image data so that is has a pre-process for the engine controller 131.

In FIG. 36, the portion enclosed by the chain line indicated by B' is the portion in the process cartridge B. Simultaneously with the mounting of the process cartridge to the major forming apparatus, the engine controller 131 and the circuit in the portion B' of the process cartridge B are connected with each other at the I/O connector portion 149 (connectors 71, 72 FIGS. 29–35)). The I/O device (I/O port) 148 and the I/O device (I/O port) 144 of the process cartridge B are connected with each other through the I/O connector portion 149, so that data in the process cartridge processing device (CPU) 141, and the data from the process cartridge side sensor group 143 can be referred to.

A description will be provided as to the functions of the devices in the process cartridge.

Of the sensor group 143 in the process cartridge, a sensor 143*a* for detecting the presence or absence of the cartridge using a limit switch, a detecting sensor 143*b* for detecting an amount of removed toner when a electrostatic capacity is used in place of the detection of a light quantity, a charger resistance sensor 143*c* for detecting dew condensation and or a short circuit on the basis of the depiction of the electric resistance of the charging roller 2*c*, and a temperature sensor 143*d* for detecting a temperature rise of the process cartridge B, are connected to the I/O device of the process cartridge B.

A memory device 142 is provided in the process cartridge B, and in this embodiment, the memory device 142 is an EP-ROM which is rewritable.

In addition, in this employment, the I/O device 144 for connection with the processing device 141 of the process cartridge B with the engine controller 131 of the image forming apparatus A uses a serial port to avoid improper contact and to avoid an increase in the number of the contacts.

The control circuit in the portion B' in the process cartridge is built in the process cartridge side connector 71 as an IC circuit.

According to this embodiment, there is provided an electronic device such as memory IC in the process cartridge B, so that it stores the data of the process cartridge B, by which when the process cartridge B is mounted to the main assembly 20 of the apparatus, the state of the process cartridge can be recognized.

The process cartridge B and the main assembly 20 of the apparatus are provided with the connectors 71,72 to permit the information to be supplied to or to be taken out of the memory IC.

According to this embodiment, the process cartridge is swingable about the center of the photosensitive drum, and the electrical connection between the connector of the process cartridge and the main assembly side connector of the image forming apparatus are stabilized by the swinging action when the process cartridge is mounted to the main assembly of the image forming apparatus.

Additionally, according to this embodiment, the process cartridge side connector is mounted to the side plate of the cleaner container, by which the detection of the amount of the removed toner is not influenced.

Furthermore, according to this embodiment, the ground connecting contact is disposed adjacent the center of the swinging action, by which the connectors are connected by the ground connecting contacts so that a memory IC can be assuredly protected.

Moreover, according to this embodiment, the connector having the memory IC mounted to the side plate of the cleaner container is covered with a side cover, by which the memory IC can be protected from contact during the assembling operation or handling by the users.

Furthermore according to this embodiment, the erroneous assembling of the connectors having the memory IC mounted to the side plate of the cleaner container can be avoided.

FIG. 12 is the perspective view as seen in the direction from the rear toward the non-driving side of the process cartridge B which is reversed in the vertical direction.

Figure 29:
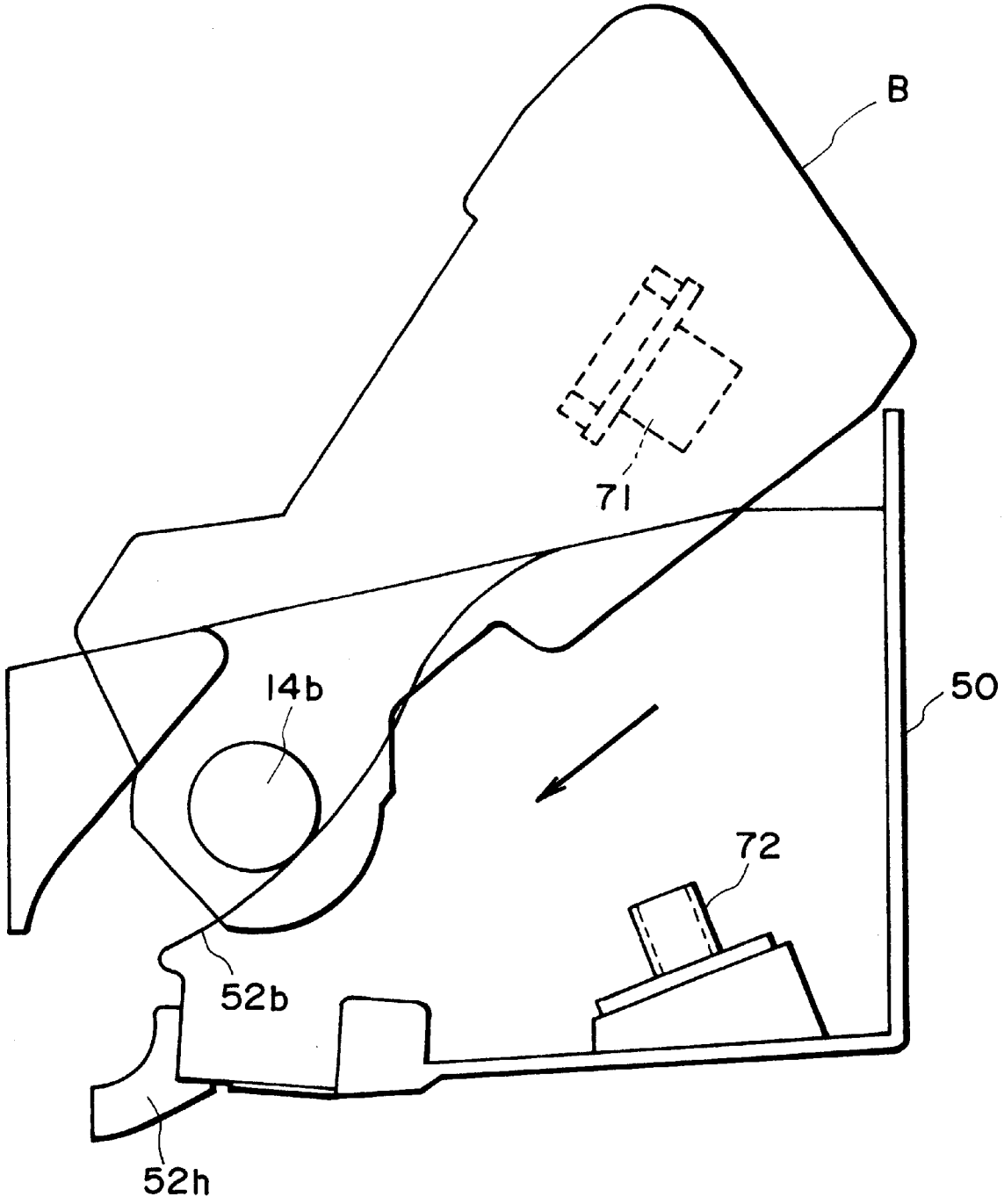
FIG. 29 is a side view illustrating a connecting operation between a connector of a process cartridge and a connector provided in the main assembly of the apparatus.
Figure 30:
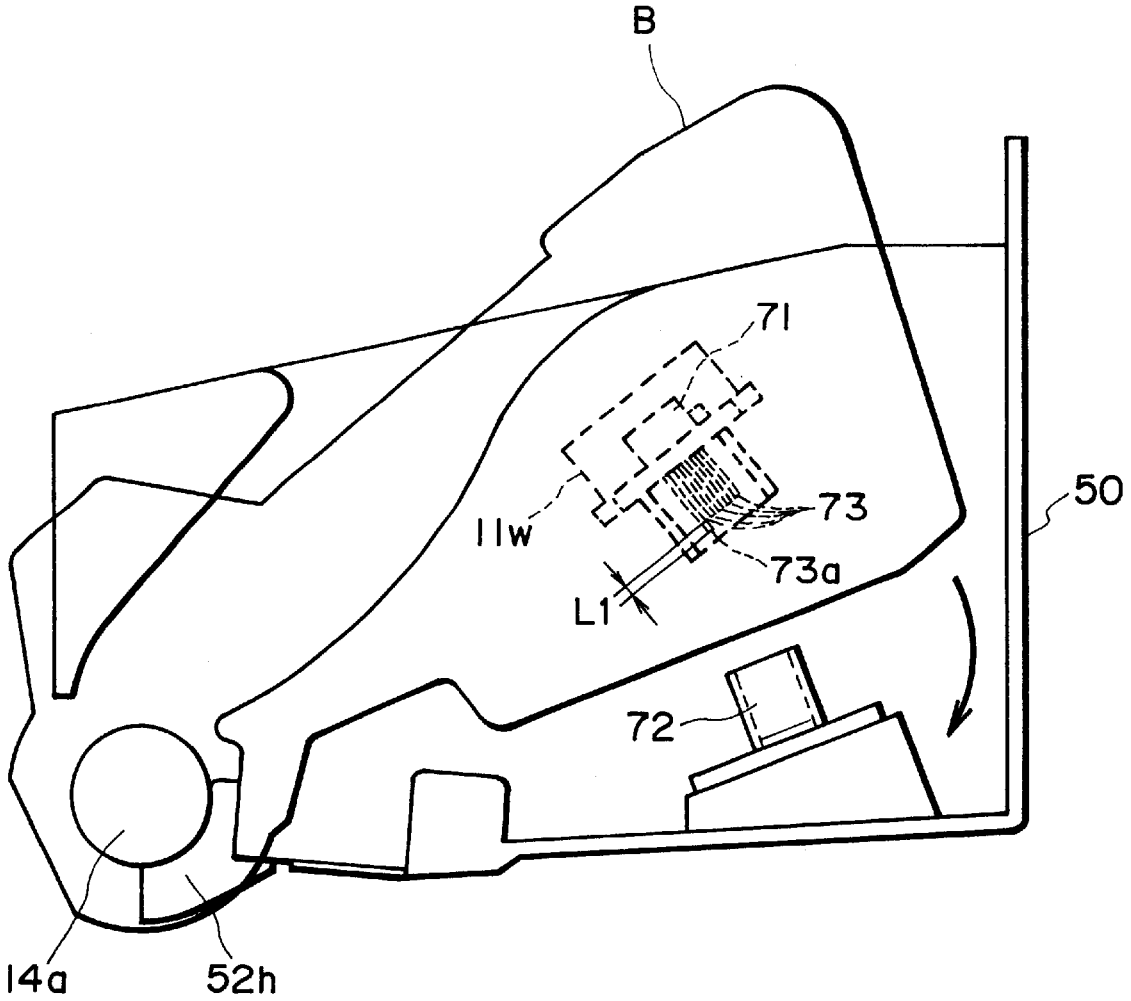
FIG. 30 is a side view illustrating a connecting operation between the connector of the process cartridge and the connector of the main assembly of the apparatus.
Figure 31:
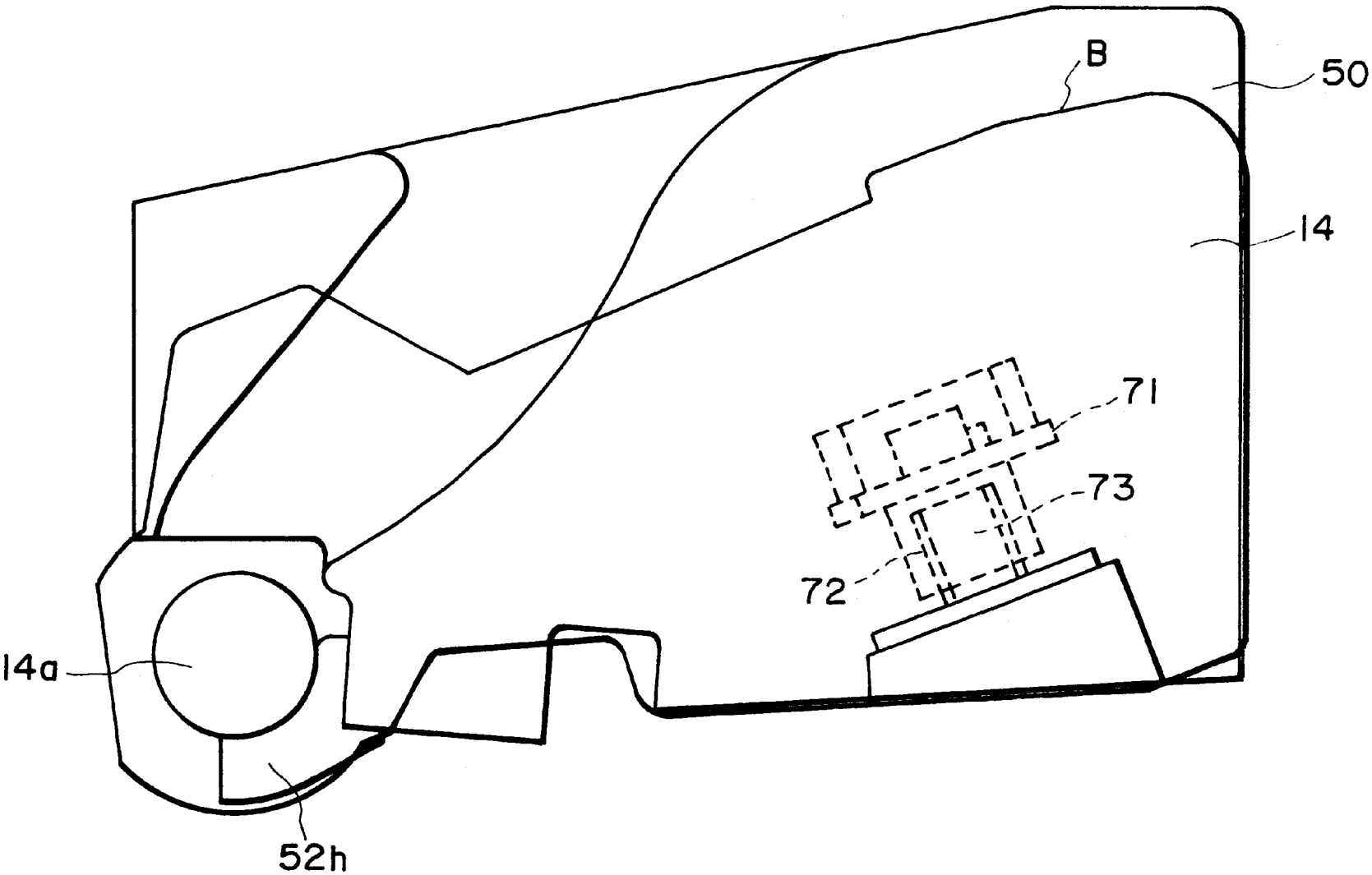
FIG. 31 is a side view illustrating a connected state of the connector of the process cartridge and the connector of the main assembly of the apparatus.

The process cartridge side connector 71 has an electronic device such as an IC memory or the like, and communicates with the I/O device in the main assembly of the apparatus, and therefore, the process cartridge side connector 71 and the main assembly side connector 72 shown in FIGS. 29–31 are connected by being mounted to the movable member 50 before the process cartridge B is inserted into the main assembly 20 of the apparatus.

On the non-driving side surface of the process cartridge B, a connector 71 is exposed with the connecting contact 73 thereof faced down.

Therefore, as shown in FIG. 30, the side plate 11*k* of the cleaner container 11 is a provided with a mounting seat portion 11*w* which is projected outwardly.

A description will be provided as to the connector 71 of the process cartridge B.

The connector 71 is more specifically a connector having an electronic device such as a RAM, non-volatile memory, ROM or another memory chip, in which necessary information may be stored beforehand, or which communicates with the main assembly 20 of the apparatus when the process cartridge is mounted to the main assembly 20, by which the use situation of the process cartridge B can be discriminated.

The connector 71, as shown in FIG. 30, is electrically connected with stabilization with the main assembly side connector 72 by the force produced when the process cartridge B is supported by the receiving portion 52*h* (51*h* during the driving period) and swings about the receiving portion 52*h* (51*h*) and by the moment produced by the weight of the process cartridge B (FIG. 31).

A description will be provided as to the position of the mounting of the connector 71.

Figure 32:
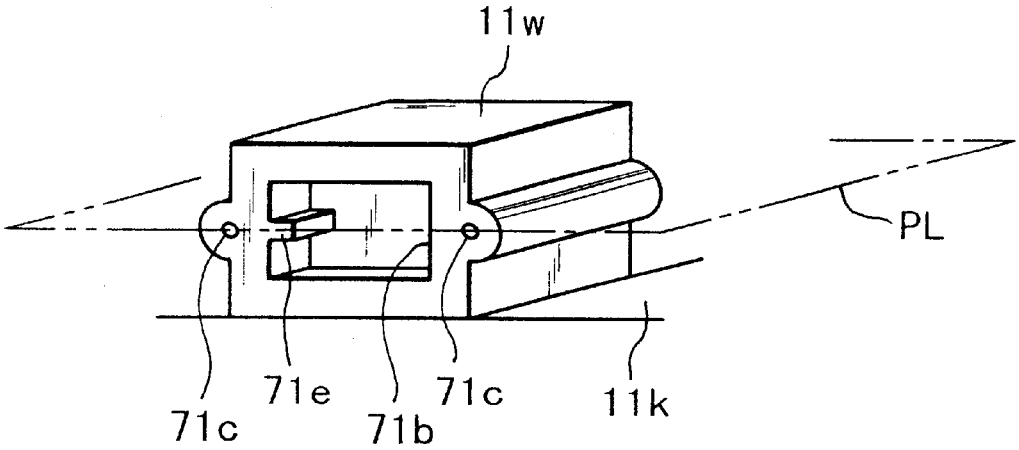
FIG. 32 is a perspective view showing a connector mounting portion Of the process cartridge.

As shown in FIG. 32, the connector 71 is mounted to the mounting seat portion 11*w* which is integral with the side plate 11*k* of the cleaner container 11.

In order to connect with the main assembly side connector 72, the connecting contact 73 thereof is faced down.

Because it is mounted on the outside of the side plate 11*k* which is substantially flash with the drum supporting portion of the cleaner container 11, it can be provided without reducing the capacity of the removing toner of the cleaner container 11, and in addition, the connectors 71,72 can be connected by the mounting operation of the process cartridge B to the movable member 50.

Because after the connector 71 is mounted to the side plate 11*k* of the cleaner container, it is covered with the end cover 14, so that connector 71 is not easily touched by the user, and the electronic device such as an IC memory can be protected from static electricity or the like.

At this time, the main assembly side connector 72 enters the end cover 14 to be connected, as shown in FIG. 31.

A detailed description will be provided as to the connection between the connector 71 and the main assembly side connector 72.

As shown in FIG. 30, the ground connecting contact 73*a* of the connecting contacts 73 in the connector 71, is located at a position closest to the center of the photosensitive drum 1.

By doing so, when the process cartridge is mounted to the main assembly while rotating about the center of the photosensitive drum 1, the ground connecting contact is first connected.

Thus, the memory can be assuredly protected, and the breakdown of the memory can be avoided.

If the ground connecting contact 73*a* is projected out more than the other connecting contacts 73 by several mm L1, the protection is further assured.

A detailed description will be provided as to the mounting of the connector 71 to the cleaner container 11.

Figure 35:
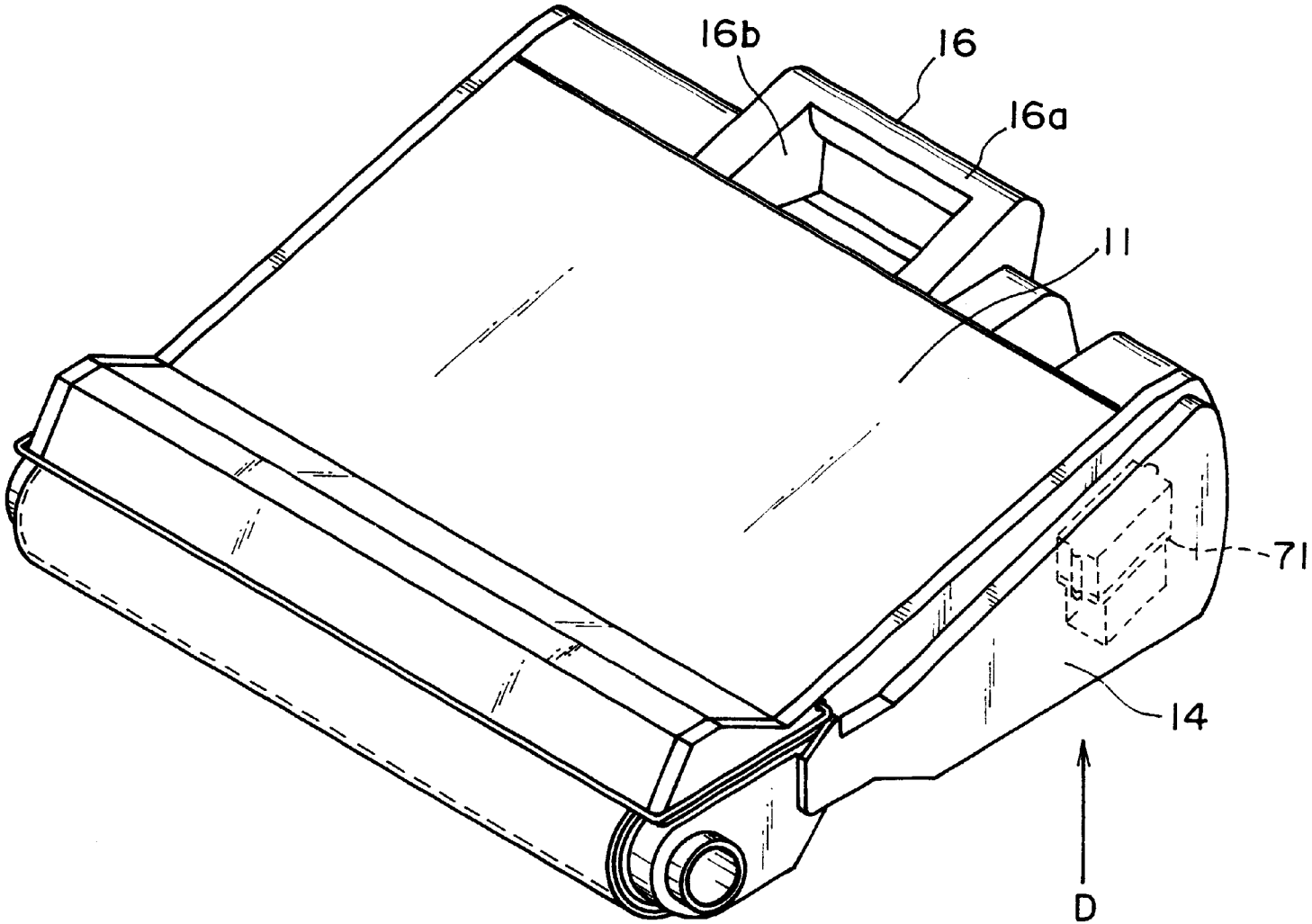
FIG. 35 is a perspective view illustrating a connector position of the process cartridge.

FIG. 32 is a perspective view of a mounting portion of the connector 71 taken along D in FIG. 35.

Figure 33:
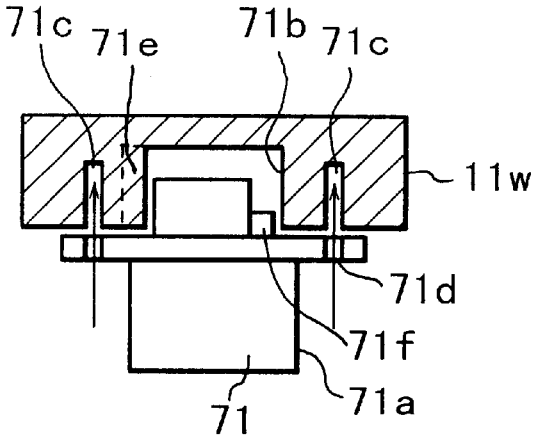
FIG. 33 is a longitudinal sectional view of a connector portion shown in FIG. 31.
Figure 34:
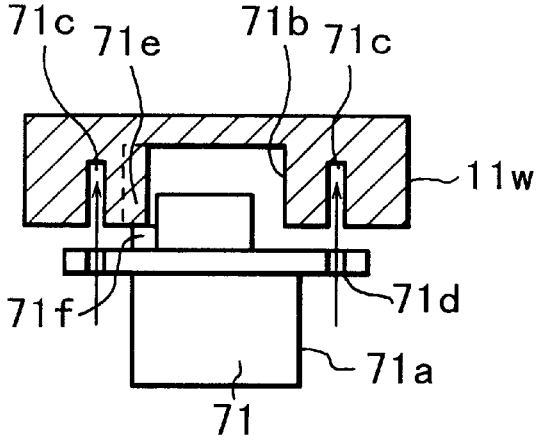
FIG. 34 is a longitudinal sectional view of a connector portion shown in FIG. 31.

FIGS. 33, 34 are longitudinal sections of the connector portion shown in FIG. 31.

Connector insertion holes 71*b*, tapping holes 71*c*, the main body 71*a* of the connector and small screw bores 71*d* to be aligned with the tapping holes 71*c* are symmetrical with respect to a vertical line an a plane including two tapping holes 71*c*, apart from rib 71*e*.

The inside of the connector insertion hole 71*b* is provided with a rib 71*e*.

The rib 71*e* is on a flat surface PL including the two tapping holes 71*c*.

As shown in FIGS. 33, 34, the connector 71 is provided with a projection 71*f*.

As shown in FIG. 33, in the regular state of mounting, the rib 71*e* and the projection 71*f* are at opposite sides from each other. If the position is reversed, as shown in FIG. 34, the projection 71*f* and the rib 71*e* interfere with each other, so that mounting is prevented.

Thus, erroneous mounting of the connector 71 is prevented.

As described in the foregoing, the process cartridge B is pivoted about the center of the photosensitive drum, when the process cartridge B is mounted to the image forming apparatus A, and therefore, the electrical connection of the connectors is stabilized.

By the provision of the process cartridge side connector 71 on the side plate 11*k* of the cleaner container 11, the decrease of the capacity for the removed toner can be avoided.

By providing the ground connecting contact 73*a* at the position closest to the center of the pivot, the ground connecting contact is first connected, and therefore, the memory IC or the like can be assuredly protected.

By covering the connector 71 mounted to the side plate 11*k* of the cleaner container 11 with the end cover 14, the access to the memory IC or the like by the user can be effectively prevented so that memory IC or the like can be protected.

By the interference between the connector insertion hole 71*b* of the seat portion 11*w* and the projection 71*f* of the connector 71 upon erroneous mounting, the orientation of the connector 71 can be assured in the assemblying.

(adjusting device for image density)

According to an aspect of the present invention, developed images of respective color test patterns are formed on the photosensitive drum 1 before the image forming operation, and the densities of the test patterns are detected, so that engine controller 131 effects the adjustment of the image density for each color.

The reading device 93 comprises a reading sensor 93*a* such as a light receiving element in the form of a CCD or the like and a lamp 93*b* for supplying image light of the test pattern 92 to the light receiving element by reflection.

Figure 37:
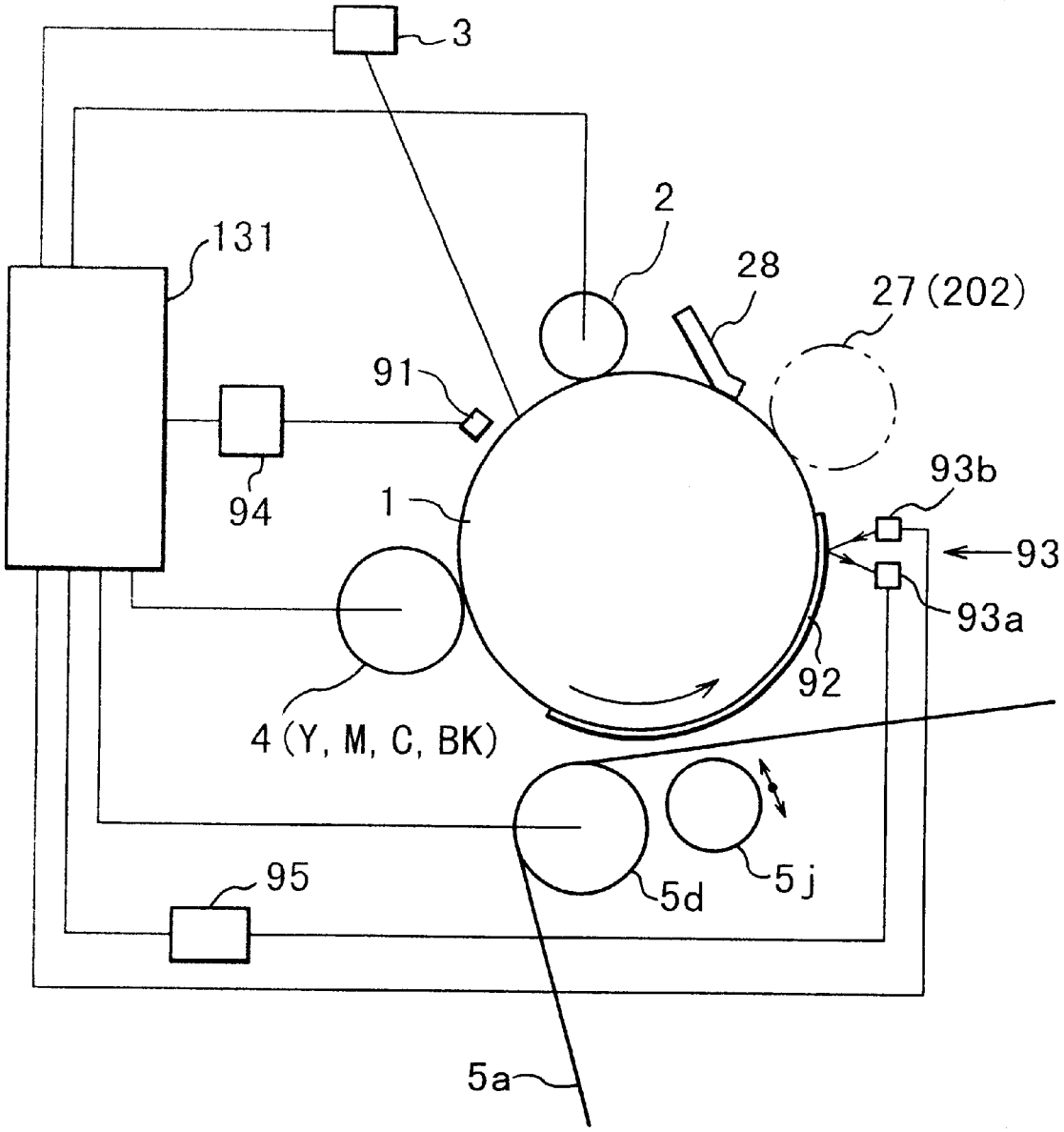
FIG. 37 is a block diagram of a test pattern reading apparatus.

As shown in FIG. 37, a surface potential detection device 91 for detecting the surface potential of the photosensitive drum 1 after the primary charging, is connected with the engine controller 131 through a surface potential meter 94.

One of the developing devices 4Y, 4M, 4C, 4Bk forms a toner image of the test pattern 92 on the photosensitive drum 1, and the test pattern 92 is read by a pattern reading apparatus 93.

The reading device 93 comprises a reading sensor 93*a* such as a light receiving element in the form of a CCD or the like and a lamp 93*b* for supplying image light of the test pattern 92 to the light receiving element by reflection.

The test pattern 92 read by the sensor 93*a* is converted to a density signal through a density conversion circuit 95, and is supplied to the engine controller 131.

The detected toner content is processed by the engine controller 131, which then controls the image forming means, and more particularly, the charged potential, LUT toner content, transferring current or the like.

Figure 38:
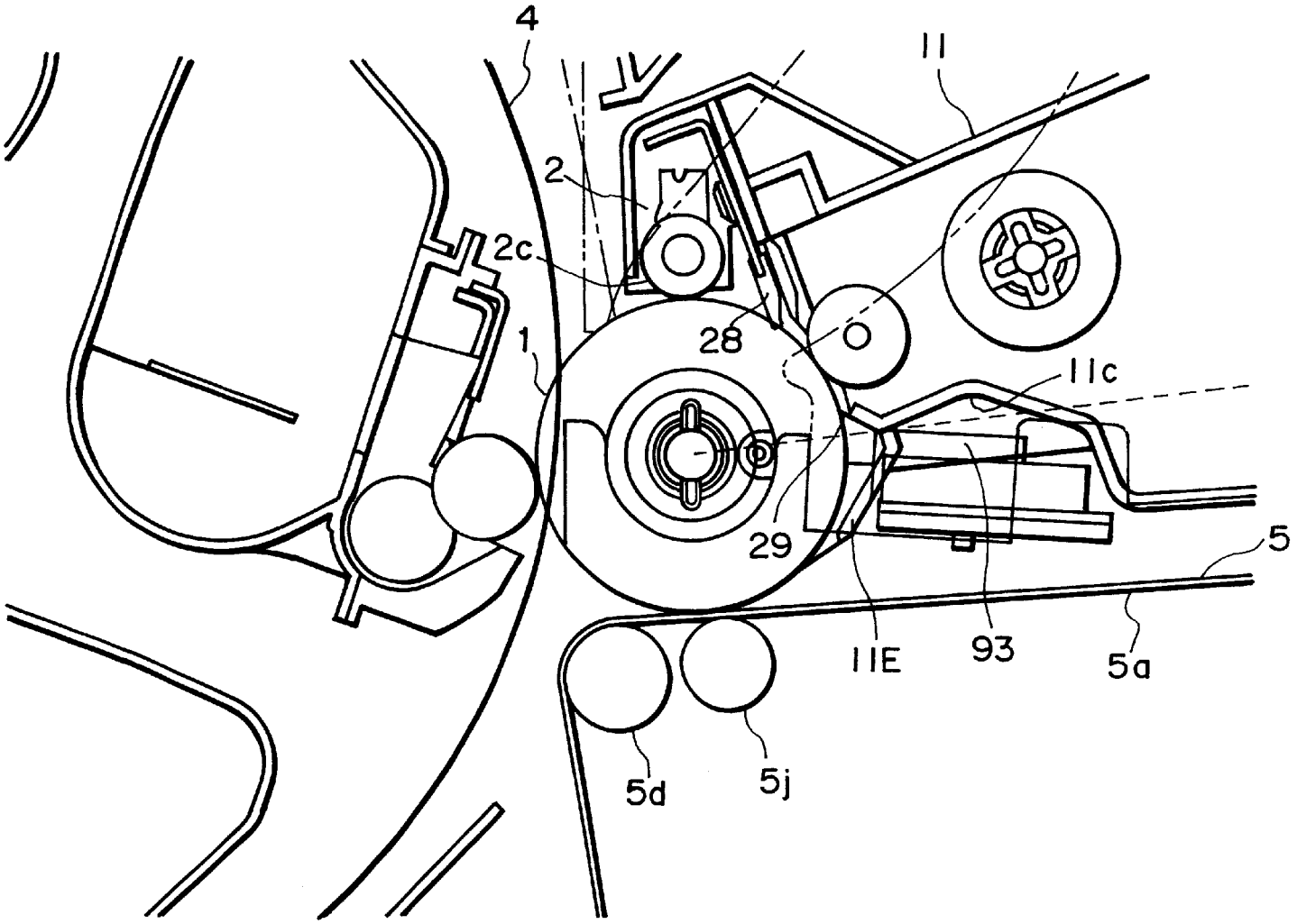
FIG. 38 is a side view of a test pattern reading apparatus.

As shown in FIG. 38, the lower portion of the cleaner container 11 adjacent the photosensitive drum 1 is provided with a recess 11*c* extended along the total length thereof, and the recess 11*c* receives the pattern reading apparatus 93.

As shown in FIG. 12 which is a perspective view of the process cartridge in a reversed state, the read apparatus 93 is disposed opposed to the rectangular openings 11*x* distributed over substantially the entire length and having the same size or to the position of the cut-away portion 11*x*1 in middle portion of the downward wall 11*y*.

The openings 11*x* or the cut-away portion are provided below the jaw in the form of a wall extending downwardly toward the photosensitive drum 1 from the portion of the cleaner container 11 to which the receptor sheet 29 is bonded.

The lower portion of the jaw is a part of the wall surface of the recess 11*c*.

FIG. 38 is a sectional view of the image forming apparatus A including the pattern reading apparatus 93.

The pattern reading apparatus 93 is fixed to the bottom plate portion 50*a* of the movable member 50 which is movable in the direction indicated by an arrow at each side of the frame of the image forming apparatus A.

As shown in FIG. 37, the direction of projection of the lamp 93*b* in the pattern reading apparatus 93 is toward the photosensitive drum 1, and the reading sensor 93*a* is disposed at a position for receiving the reflected light from the photosensitive drum 1.

The light from the lamp and the light reflected by the photosensitive drum 1, are passed through the one and the same opening 11*x* or the cut-away portion 11*x*1 as shown in FIG. 12.

The opening 11*x* is disposed immediately upstream of the receptor sheet 29 with respect to the moving direction of the peripheral surface of the photosensitive drum 1.

The test pattern 92 is formed in the similar manner as formation of the intended image. More particularly, the photosensitive drum 1 is charged uniformly by the charging device 2, and is exposed to color light by the exposure means 3 to form a latent image which is developed by a developing devices 4Y,4M,4C and 4Bk. When the developed image passes by the transfer unit 5, the confining roller 5*j* is placed away from the photosensitive drum 1, and the intermediary transfer belt 5*a* is stretched to provide a flat surface between the driving roller 5*b* and the follower roller 5*d*, thus providing a gap between the transfer belt 5*a* and the photosensitive drum 1. The test pattern 92 passes through the gap, and is read by the pattern reading apparatus 93. Then, it passes between the photosensitive drum 1 and the receptor sheet 29, and is removed from the photosensitive drum 1 by the cleaning blade 28.

Or, the follower roller 5*d* is supplied with a voltage having the same polarity as the toner of the test pattern 92 when the test pattern 92 passes through the transfer portion.

As described in the foregoing, the opening for the image density detection is disposed immediately above the receptor sheet with respect to the moving direction of the peripheral surface of the photosensitive drum, and therefore, the provision of the test pattern reading apparatus in the image forming apparatus A does not influence the disposition, in the moving direction of the peripheral surface of the photosensitive drum 1, of the devices between the charging roller and the transfer unit 5, more particularly, the charging device 2, the developing device 4, the transfer unit 5 and the exposure position.

The opening for the detection of the toner image density is disposed in a range of the length of the photosensitive drum, and therefore, the adjustment of the image density is possible in the range corresponding to the maximum width recording material.

A plurality (four, in this embodiment) of the test pattern reading apparatus 93 for reading the test pattern are provided to cover substantially the total length of the photosensitive drum l, and therefore, the image density adjustment can be carried out for the maximum width recording material. However, the detection of the density of the test pattern at one position in the longitudinal range, provides quite satisfactory density detection.

In view of this, the cut-away portion 11*x*1 (FIGS. 7, 12) is formed at one position in the longitudinal range of the photosensitive drum 1, and along the cut-away portion 11*x*1 a sheet member 201, which is a second flexible sheet, may be provided on the cleaner container 11 in addition to the first flexible sheet (receptor sheet).

The sheet member 201 is of a plastic resin material, and the front side which can be seen in FIGS. 7, 12 blocks transmission of the light from the lamp 93*b* and prevents reflection of the light by roughening the surface thereof.

The sheet member 201 receives the toner tending to leak through the cut-away portion 11*x*1, thus preventing leakage of the toner to the outside of the process cartridge B.

As shown in FIG. 7, the longitudinal center 12 of the cut-away portion 11*x*1 is deviated or shifted toward the shaft coupling member 23 of the driving force receiving portion beyond the longitudinal center 11 of the photosensitive drum 1.

The light from the lamp 93*b* illuminates the position 11 which is substantially the longitudinal center of the photosensitive drum 1.

Here, the deviation is used for the purpose of good opposing relation of the detecting members 93*a*, 93*b* provided in the main assembly 20 of the apparatus relative to the cut-away portion 11*x*1.

As described in the foregoing, the embodiments are summarized as follows.

Aspect 1. A process cartridge B is detachably mountable to a main assembly 20 of an image forming apparatus, wherein the process cartridge is mounted to or demounted from a movable member 50 which is retractable in a horizontal direction to mount the process cartridge to the main assembly or to demount the process cartridge from the main assembly. The cartridge comprises: an electrophotographic photosensitive member 1; a cleaning member 28 for removing toner from the electrophotographic photosensitive member; a toner feeding portion 19 for feeding by a toner feeding member 11A toner removed from the electrophotographic photosensitive member by the cleaning member; a cartridge frame 10 supporting at least the electrophotographic photosensitive member; a first projection 13*a* projecting outwardly substantially coaxially with the electrophotographic photosensitive member, provided on one end surface of the cartridge frame, as seen in a mounting direction when the process cartridge is mounted to the main assembly of the image forming apparatus; a third projection 11*a* projecting outwardly at a position upstream of the first projection with respect to the mounting direction; a second projection 14*a* projected outwardly substantially coaxially with the first projection, provided on the other end surface; a fourth projection 11*b* projected outwardly substantially coaxially with the third projection; wherein centers of the first and second projections are placed at predetermined positions in the main assembly of the image forming apparatus; wherein the third and fourth projections are placed at predetermined circumferential positions about the center; wherein the first, second, third and fourth projections function as guiding members when the process cartridge is mounted to or demounted from the movable member.

Aspect 2. A process cartridge includes the features of aspect 1, where at least one of the third projection 11*b* and the fourth projection 11*a* acts on the movable member 50 when the process cartridge B is mounted to or demounted from the movable member to provide a mount feeling.

Aspect 3. A process cartridge includes the features of aspect 2, where the movable member is provided with an elastic member 53, 54 effective to produce an urging force in a direction which crosses with a path along which the third projection 11*a* and/or the fourth projection 11*b* passes and which is substantially perpendicular to an axis of the third projection and/or the fourth projection 11*b*, when the process cartridge is mounted to or demounted from the movable member, and wherein when the process cartridge is inserted into the movable member, at least one of the third projection and the fourth projection is inserted against the elastic member 53, 53.

Aspect 4. A process cartridge includes the features of aspect 1 or 2, where at least one of the third projection 11*s* and the fourth projection 11*b* is pressed by the movable member.

Aspect 5. A process cartridge includes the features of any one of aspects 1–4, wherein when the process cartridge B is mounted to the movable member 50, the centers of the first and second projections 13*a*, 23, 14*a*, 14*b* are positioned relative to the movable member 50, and the third and fourth projections 11*a*, 11*b* are positioned in the circumferential direction about the centers, and when the movable member is inserted into the main assembly of the image forming apparatus, the centers of the first and second projections 13*a*, 23, 14*a*, 14*b* are positioned relative to the main assembly 20.

Aspect 6. A process cartridge includes the features of any one of aspects 1–5, wherein the first and second projections 13*a*, 23, 14*a*, 14*b* are in the form of cylindrical bosses.

Aspect 7. A process cartridge includes the features of any one of aspects 1–6, where outer portions 23, 14*b*, in the axial direction, of the first and second projections 13*a*, 23, 14*a*, 14*b* are guided by the movable member 50, and inner portions thereof are positioned to a positioning member 61 in the main assembly 20 of the image forming apparatus.

Aspect 8. A process cartridge includes the features of aspect 7, where an outer portion, in the axial direction, of the first projection 13*a*, 23 has a cylindrical outer periphery fixed to a supporting shaft 1*d* for the electrophotographic photosensitive drum 1, and the first projection functions as a shaft coupling member 23 guided by the movable member, and inner part, in the axial direction, is in the form of a cylindrical boss 13*a*.

Aspect 9. A process cartridge includes the features of aspect 7 or 8, where outer portions 23, 14*b*, in the axial direction, of the first and second projection 13*a*, 23, 14*a*, 14*b* have a diameter smaller than those in inner portions 13*a*, 14*a*.

Aspect 10. An electrophotographic image forming apparatus A for forming an image on a recording material, to which apparatus a process cartridge B is detachably mountable to a main assembly 20 of the image forming apparatus, includes:

a) a movable member retractable from the main assembly of the image forming apparatus, wherein a process cartridge is detachably mountable to the movable member, said process cartridge including: an electrophotographic photosensitive member 1; a cleaning member 28 for removing toner from the electrophotographic photosensitive member; a toner feeding portion 19 for feeding by a toner feeding member 11A toner removed from the electrophotographic photosensitive member by the cleaning member; a cartridge frame 10 supporting at least the electrophotographic photosensitive member; a first projection 13*a* projecting outwardly substantially coaxially with the electrophotographic photosensitive member, provided on one end surface of the cartridge frame, as seen in a mounting direction when the process cartridge is mounted to the main assembly of the image forming apparatus; a third projection 11*a* projecting outwardly at a position upstream of the first projection with respect to the mounting direction; a second projection 14*a* projected outwardly substantially coaxially with the first projection, provided on the other end surface; a fourth projection 11*b* projected outwardly substantially coaxially with the third projection; wherein centers of the first and second projections are placed at predetermined positions in the main assembly of the image forming apparatus; wherein the third and fourth projections are placed at predetermined circumferential positions about the center; wherein the first, second, third and fourth projections function as guiding members when the process cartridge is mounted to or demounted from the movable member;

b) an inserting portion for the movable member 50;

c) an engaging member 61, provided in the main assembly 20 and functioning as a positioning member to which the first and second projections 13*a*, 14*a* are abutted when the movable member 50 is inserted into the main assembly of the image forming apparatus; and c) feeding means 7 for feeding the recording material S.

Aspect 11. An apparatus includes the features of aspect 10, where the movable member 50 has a member 53 for providing a mount feeling by acting on the third projection 11*a* or fourth projection 11*b* for indexing the process cartridge when the process cartridge is mounted to the movable member.

Aspect 12. An apparatus includes the features of aspect 10, wherein the movable member 50 is provided with an elastic member 53, 65 effective to produce an urging force in a direction which crosses with a path along which the third projection and/or the fourth projection 11*a*, 11*b* of the process cartridge B passes and which is substantially perpendicular to an axis of the third projection and/or the fourth projection, when the process cartridge is mounted to or demounted from the movable member 50, and wherein when the process cartridge is inserted into the movable member, at least one of the third projection and the fourth projection 11*a*, 11*b* is inserted against said elastic member.

Aspect 13. An apparatus includes the features of aspect 10 or 11, where the movable member 50 includes a receiving portion 51*h*, 52*h* capable of supporting the first and second projections 13*a*, 23, 14*a*, 14*b* of the process cartridge when the process cartridge is mounted, and an abutment portion 51*f*, 52*f* for abutment with a first and second projections provided at a rear side of the receiving portion as seen in a direction of insertion of the movable member into the main assembly of the image forming apparatus.

Aspect 14. An apparatus includes the feature of aspect 10, where the main assembly side engageable member 61 has a semicircular section which is open to the movable member, and wherein when the movable member is inserted into the main assembly of the image forming apparatus, outer surfaces of the first and second cylindrical projections 13*a*, 14*a* of the process cartridge is engaged with the main assembly side engageable member.

Aspect 15. An apparatus includes the features of any one of aspects 10 to 14, where the movable member 50 is provided at a trailing end with respect to a direction of insertion thereof into the main assembly of the image forming apparatus, with an opening member 56 for the movable member which urges the movable member into a main assembly of the image forming apparatus through an elastic member 57 and which is engaged with the main assembly of the image forming apparatus in an urged state.

Aspect 16. An apparatus includes the features of aspect 15, wherein when the movable member 50 is inserted into the main assembly of the image forming apparatus A, the first and second projections 13*a*, 14*a* of the process cartridge B is engaged with the main assembly side engageable member 61, so that elastic member 57 provided between the movable member 50 and the opening member 56 is compressed by the opening member of the movable member, and the abutment portion of the movable member presses the first and second projections against the main assembly side engageable member 61.

Aspect 17. An apparatus includes the features of aspect 16, wherein when the movable member is inserted into the main assembly of the image forming apparatus, and the first and second projections of the process cartridge are engaged with the main assembly side engageable member, the receiving portion of the movable member is apart from the first and second projections.

Aspect 18. An apparatus includes the features of aspect 17, where when the process cartridge B is mounted to the movable member 50, the third and fourth projections 11*a*, 11*b* of the process cartridge is supported on a surface 51*g*, 52*g* which is substantially parallel with a direction of motion of the movable member 50 at an end portion of a guide surface 51*c*, 52*c* along the guide surface provided on the movable member, and is movable in a direction substantially parallel with the direction of the motion of the movable member.

Aspect 19. An apparatus includes the features of aspect 18, wherein the elastic members 53, 54 provided on the movable member 50 and actable on the third and fourth projections 11*a*, 11*b* of the process cartridge, and urges the process cartridge relative to the movable member 50 in a direction opposite from the direction of insertion into the main assembly of the image forming apparatus.

As described in the foregoing, the provision of the first and second centering outward projections coaxial with the electrophotographic photosensitive member at the opposite ends of the process cartridge, and the provision of the third and fourth indexing projections at positions away from the first and second projections, provide the following effects.

(1) The centering projections are positioned in the main assembly of the image forming apparatus, and they are positioned relative to the movable member substantially in the horizontal direction, and the indexing projections are positioned in the circumferential direction in the movable member relative to the centering projection.

(2) When the process cartridge is mounted to or demounted from the movable member, the centering projections and the indexing projections function as mounting guides.

(3) An elastic member is provided at a path along which the indexing projections pass in the movable member, and when the process cartridge is mounted to or demounted from the movable member, the indexing projections and the elastic member are elastically deformed.

When the process cartridge is mounted in the movable member, the elastic member presses against the indexing projection downwardly.

By the foregoing function, the following effects are provided.

The relative positioning among the image forming apparatus, the movable member and the process cartridge, can be assured by a simple structure.

The space occupied by the electrophotographic photosensitive member can be saved in the longitudinal direction.

There is no need of providing the insertion guide in the main assembly of the image forming apparatus, so that configuration is simplified, and the expenses for the mold can be reduced.

(3) The positioning action in the circumferential direction at the last stage of the process cartridge, is not required, and therefore, the usability is improved.

The elastic member in the paths of the third and fourth projection paths in the movable member produces a click feeling with the urging force for the indexing of the process cartridge, and in addition, it provides a part of urging force at the abutment portion of the centering projection relative to the movable member (multifunctions), despite the fact that elastic member is a single part (less expensive).

As described in the foregoing, according to the present invention, the process cartridge can be smoothly mounted to the main assembly of the apparatus.

Additionally, the process cartridge can be assuredly mounted at the correct position in the main assembly of the apparatus.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, wherein said process cartridge is mounted to or demounted from a movable member which is retractable in a horizontal direction to mount the process cartridge to the main assembly or to demount the process cartridge from the main assembly, comprising:

an electrophotographic photosensitive member;

a cleaning member for removing toner from said electrophotographic photosensitive member;

a toner feeding portion for feeding by a toner feeding member toner removed from said electrophotographic photosensitive member by said cleaning member;

a cartridge frame supporting at least said electrophotographic photosensitive member;

a first projection, projecting outwardly coaxially with said electrostatic photosensitive member, and provided on one end surface of said cartridge frame, as seen in a mounting direction when said process cartridge is mounted to the main assembly of the image forming apparatus;

a second projection, projected outwardly substantially coaxially with said first projection, and provided on the other end surface of said cartridge frame;

a third projection projecting outwardly at a position upstream of said first projection with respect to the mounting direction; and a fourth projection projected outwardly substantially coaxially with said third projection;

wherein said first and second projections are placed at predetermined positions in the main assembly of said image forming apparatus;

wherein said third and fourth projections are disposed so as to regulate rotation of said process cartridge about said first and second projections; and wherein said first, second, third and fourth projections function as guiding members when said process cartridge is mounted to or demounted from the movable member.

2. A process cartridge according to claim 1, wherein at least one of said third projection and said fourth projection acts on the movable member when said process cartridge is mounted to or demounted from said movable member to provide mount feeling.

3. A process cartridge according to claim 2, wherein said movable member is provided with an elastic member effective to produce an urging force in a direction which crosses with a path along which said third projection and/or said fourth projection passes and which is substantially perpendicular to an axis of said third projection and/or said fourth projection, when said process cartridge is mounted to or demounted from the movable member, and wherein when said process cartridge is inserted into said movable member, at least one of said third projection and said fourth projection is inserted against the urging force of said elastic member.

4. A process cartridge according to claim 1 or 2, wherein at least one of said third projection and said fourth projection is pressed by said movable member.

5. A process cartridge according to any one of claims 1–3, wherein when said process cartridge is mounted to said movable member, centers of said first and second projections are positioned relative to the movable member, and said third and fourth projections are positioned in the circumferential direction about the centers, and when the movable member is inserted into the main assembly of the image forming apparatus, the centers of said first and second projections are positioned relative to the main assembly.

6. A process cartridge according to any one of claims 1–3, wherein said first and second projections are in the form of cylindrical bosses.

7. A process cartridge according to any one of claims 1–3, wherein outer portions, in the axial direction, of said first and second projections are guided by the movable member, and inner portions thereof are positioned relative to a positioning member in the main assembly of the image forming apparatus.

8. A process cartridge according to claim 7, wherein an outer portion, in the axial direction, of said first projection has a cylindrical outer periphery fixed to a supporting shaft for the electrophotographic photosensitive drum, and said first projection functions as a shaft coupling member guided by the movable member, and an inner part, in the axial direction, of said first projection is in the form of a cylindrical boss.

9. A process cartridge according to claim 7, wherein outer portions, in the axial direction, of said first and second projection have a diameter smaller than those in inner portions.

10. An electrophotographic image forming apparatus for forming an image on a recording material, to which apparatus a process cartridge is detachably mountable to a main assembly of the image forming apparatus, comprising:

a) a movable member retractable from the main assembly of the image forming apparatus, wherein a process cartridge is detachably mountable to said movable member, said process cartridge including:
   an electrophotographic photosensitive member;
   a cleaning member for removing toner from said electrophotographic photosensitive member;
   a toner feeding portion for feeding by a toner feeding member toner removed from said electrophotographic photosensitive member by said cleaning member;
   a cartridge frame supporting at least said electrophotographic photosensitive member;
   a first projection, projecting outwardly substantially coaxially with said electrophotographic photosensitive member, and provided on one end surface of said cartridge frame, as seen in a mounting direction when said process cartridge is mounted to the main assembly of the image forming apparatus;
   a second projection, projected outwardly substantially coaxially with said first projection, and provided on the other end surface of said cartridge frame;
   a third projection projecting outwardly at a position upstream of said first projection with respect to the mounting direction; and
   a fourth projection projected outwardly substantially coaxially with said third projection;
   wherein said first and second projections are placed at predetermined positions in the main assembly of said image forming apparatus;
   wherein said third and fourth projections are disposed so as to regulate rotation of said process cartridge about said first and second projections; and
   wherein said first, second, third and fourth projections function as guiding members when said process cartridge is mounted to or demounted from the movable member;
   said apparatus further comprising:
b) an inserting portion for said movable member;
c) an engaging member, provided in the main assembly and functioning as a positioning member to which said first and second projections are abutted when said movable member is inserted into the main assembly of the image forming apparatus; and
d) feeding means for feeding the recording material.

11. An apparatus according to claim 10, wherein said movable member has a member for providing a mount feeling by acting on said third projection or fourth projection for indexing said process cartridge when said process cartridge is mounted to said movable member.

12. An apparatus according to claim 10, wherein said movable member is provided with an elastic member effective to produce an urging force in a direction which crosses with a path along which said third projection and/or said fourth projection of said process cartridge passes and which is substantially perpendicular to an axis of said third projection and/or said fourth projection, when said process cartridge is mounted to or demounted from the movable member, and wherein when said process cartridge is inserted into said movable member, at least one of said third projection and said fourth projection is inserted against the urging force of said elastic member.

13. An apparatus according to claim 10 or 11, wherein said movable member includes a receiving portion capable of supporting said first and second projections of said process cartridge when said process cartridge is mounted, and an abutment portion for abutment with first and second abutment projections provided at a rear side of the receiving portion as seen in a direction of insertion of said movable member into the main assembly of the image forming apparatus.

14. An apparatus according to claim 10, wherein said main assembly side engaging member has a semicircular section which is open to said movable member, and wherein when said movable member is inserted into the main assembly of the image forming apparatus, outer surfaces of said first and second cylindrical projections of said process cartridge engage with said main assembly side engaging member.

15. An apparatus according to any one of claims 10 to 12, wherein said movable member is provided at a trailing end with respect to a direction of insertion thereof into the main assembly of the image forming apparatus, with an opening member for said movable member which urges said movable member into a main assembly of the image forming apparatus through an elastic member and which is engaged with the main assembly of the image forming apparatus in an urged state.

16. An apparatus according to claim 15, wherein when said movable member is inserted into the main assembly of the image forming apparatus, said first and second projections of said process cartridge engage with the main assembly side engaging member, so that said elastic member provided between said movable member and said opening member is compressed by the opening member of said movable member and the abutment portion of the movable member presses said first and second abutment projections against the main assembly side engaging member.

17. An apparatus according to claim 16, wherein when said movable member is inserted into the main assembly of the image forming apparatus, and said first and second projections of said process cartridge are engaged with the main assembly side engaging member, the receiving portion of the movable member is apart from the first and second projections.

18. An apparatus according to claim 17, wherein when said process cartridge is mounted to said movable member, said third and fourth projections of said process cartridge are supported on a surface which is substantially parallel with a direction of motion of said movable member at an end portion of a guide surface along the guide surface provided on said movable member, and are movable in a direction substantially parallel with the direction of the motion of the movable member.

19. An apparatus according to claim 18, wherein said elastic member provided on said movable member, and actable on said third and fourth projections of said process cartridge, urges said process cartridge relative to said movable member in a direction opposite from the direction of insertion into the main assembly of the image forming apparatus.

* * * * *

UNITED STATES PATENT AND TRADEMARK OFFICE

CERTIFICATE OF CORRECTION

PATENT NO. : 6,351,620 B1
DATED : February 26, 2002
INVENTOR(S) : Shigeo Miyabe et al.

It is certified that error appears in the above-identified patent and that said Letters Patent is hereby corrected as shown below:

Title page,
Item [56], References Cited, U.S. PATENT DOCUMENTS, "Miyage et al." should read -- Miyabe et al. --.

Column 1,
Line 10, "to the" should read -- to --.

Column 4,
Line 19, "Of" should read -- of --.
Line 38, "partitions" should read -- partition --.
Line 53, "shutter" should read -- shutter. --.
Line 57, "shutter" should read -- shutter. --.

Column 5,
Line 21, "view" should read -- view of a --.

Column 14,
Line 43, "adjusted ." should read -- adjusted. --.

Column 15,
Line 61, "drum 1" should read -- drum 1. --.

Column 23,
Line 1, "in" should read -- is --.

Column 27,
Line 39, "Pivot" should read -- pivot --.

Column 29,
Line 18, "with out" should read -- without --.

Column 35,
Line 43, "19c and 19c)," should read -- 19c --.

Column 36,
Line 13, "an" should read -- and --.
Line 65, "41e)," should read -- 41e, --.

Column 37,
Line 53, "potion" should read -- portion --.

UNITED STATES PATENT AND TRADEMARK OFFICE

CERTIFICATE OF CORRECTION

PATENT NO. : 6,351,620 B1
DATED : February 26, 2002
INVENTOR(S) : Shigeo Miyabe et al.

It is certified that error appears in the above-identified patent and that said Letters Patent is hereby corrected as shown below:

Column 38,
Line 16, “sides” should read -- side --.

Column 39,
Line 23, “may” should read -- may be --.

Column 40,
Line 45, “is” should read -- is the --.

Column 44,
Line 39, “cleaning” should read -- Cleaning --.
Line 67, “inertial” should read -- inertia --.

Column 52,
Line 56, “be always” should read -- always be --

Column 53,
Line 25, “throughput” should read -- throughout --.

Column 55,
Line 34, “positions,” should read -- positions. --.
Line 50, “electrical contacts)” should read -- Electrical Contacts) --.

Column 56,
Line 3, “(structure of the drum grounding contact)” should read -- (Structure of the Drum Grounding Contact) --.
Line 24, “provided.” should read -- provided. ¶The electrical contact portion 14gl main assembly 20 of the drum supporting shaft for contact with the main assembly 20 of the apparatus, continues from a cylindrical positioning boss 14a having the same outer diameter as the inner diameter of the main assembly side engageable member 61, and is lower than the outer end surface 14b1 of a guide portion 14b having a diameter smaller than the boss 14a. --.

Column 57,
Line 33, “he free” should read -- the free --.
Line 34, “rounding” should read -- grounding --.

Column 58,
Line 7, “FIG. 3)” should read -- (FIG. 3) --.
Line 41, “is a” should read -- is --.

UNITED STATES PATENT AND TRADEMARK OFFICE

CERTIFICATE OF CORRECTION

PATENT NO. : 6,351,620 B1
DATED : February 26, 2002
INVENTOR(S) : Shigeo Miyabe et al.

It is certified that error appears in the above-identified patent and that said Letters Patent is hereby corrected as shown below:

Column 59,
Line 25, “assemble” should read -- assembled --.
Line 33, “Charging” should read -- charging --.
Line 63, “is the” should read -- is --.

Column 60,
Line 51, “is a” should read -- is --.

Column 61,
Line 15, “is” should read -- it --.

Column 62,
Line 18, “Furthemore” should read -- Furthermore, --.
Line 62, “flash” should read -- flush --.

Column 63,
Line 33, “an a” should read -- on a --.

Column 64,
Lines 10-13, should be deleted.

Column 67,
Line 60, “c)” should read -- d) --.

Signed and Sealed this

Twenty-fourth Day of December, 2002

JAMES E. ROGAN
*Director of the United States Patent and Trademark Office*